US006844146B2

(12) United States Patent
Hosokawa et al.

(10) Patent No.: US 6,844,146 B2
(45) Date of Patent: Jan. 18, 2005

(54) SILVER HALIDE COLOR PHOTOSENSITIVE MATERIAL

(75) Inventors: Junichiro Hosokawa, Minami-Ashigara (JP); Kohzaburoh Yamada, Minami-Ashigara (JP); Yasuhiro Shimada, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/298,633

(22) Filed: Nov. 19, 2002

(65) Prior Publication Data

US 2003/0198905 A1 Oct. 23, 2003

(30) Foreign Application Priority Data

Nov. 20, 2001 (JP) ..... 2001-355001

(51) Int. Cl.[7] ..... G03C 1/12; G03C 1/28; G03C 1/295; G03C 1/10; G03C 1/34

(52) U.S. Cl. ..... 430/566; 430/580; 430/581; 430/583; 430/584; 430/588; 430/590; 430/592; 430/599; 430/600; 430/603; 430/595; 430/955

(58) Field of Search ..... 430/512, 533, 430/578, 586, 581, 583, 584, 588, 590, 592, 595, 599, 600, 603, 955, 566, 585, 593

(56) References Cited

U.S. PATENT DOCUMENTS

| | | | | |
|---|---|---|---|---|
| 4,247,627 A | * | 1/1981 | Chen | 430/512 |
| 6,197,488 B1 | | 3/2001 | Allway et al. | |
| 6,242,170 B1 | * | 6/2001 | Pepe et al. | 430/600 |
| 6,245,497 B1 | * | 6/2001 | Eikenberry et al. | 430/600 |
| 6,258,519 B1 | * | 7/2001 | Matsunaga et al. | 430/533 |
| 6,319,660 B1 | | 11/2001 | Allway et al. | |
| 6,350,564 B1 | | 2/2002 | Bringley et al. | |
| 6,426,180 B1 | | 7/2002 | Bringley et al. | |

FOREIGN PATENT DOCUMENTS

| | | |
|---|---|---|
| EP | 1 143 291 A2 | 10/2001 |
| EP | 1 160 620 A2 | 12/2001 |
| JP | 51-59943 | 5/1976 |
| JP | 54-32552 | 3/1979 |
| JP | 62-27740 A | 2/1987 |
| JP | 9-211769 A | 8/1997 |
| JP | 11-119364 A | 4/1999 |
| JP | 2000-181002 A | 6/2000 |
| JP | 2000-194085 A | 7/2000 |
| JP | 2001-133931 A | 5/2001 |
| JP | 2001-235825 A | 8/2001 |
| JP | 2001-281784 A | 10/2001 |
| JP | 2002-23293 A | 1/2002 |
| JP | 2003-66555 A | 3/2003 |

OTHER PUBLICATIONS

Derwent Abstr. of JP62–27740, Feb. 5, 1987.*
U.S. Appl. No. 10/301,762, filed Nov. 19, 2002.
U.S. Appl. No. 10/207,106, filed Jul. 30, 2002.

* cited by examiner

*Primary Examiner*—Richard L. Schilling
(74) *Attorney, Agent, or Firm*—Sughrue Mion, PLLC

(57) ABSTRACT

A silver halide color photosensitive material has at least one blue-sensitive silver halide emulsion layer containing a yellow coupler, at least one green-sensitive silver halide emulsion layer containing a magenta coupler, at least one red-sensitive silver halide emulsion layer containing a cyan coupler, and at least one non-lightsensitive layer, on a support. The photosensitive material contains, in at least one of the layers, a compound having a reducing group and a compound having at least three hetero atoms capable of increasing a photographic speed of the photosensitive material in comparison with the case where the material does not contain the same.

7 Claims, No Drawings

SILVER HALIDE COLOR PHOTOSENSITIVE MATERIAL

CROSS-REFERENCE TO RELATED APPLICATIONS

This application is based upon and claims the benefit of priority from the prior Japanese Patent Application No. 2001-355001, filed Nov. 20, 2001, the entire contents of which are incorporated herein by reference.

BACKGROUND OF THE INVENTION

1. Field of the Invention

The present invention relates to a silver halide photosensitive material. More specifically, the present invention relates to a silver halide photosensitive material having a high speed and an excellent storability.

2. Description of the Related Art

Silver halide photosensitive materials contain a dispersing medium mainly containing lightsensitive silver halide grains on a support. Huge researches have been made to enhance the speed of silver halide photosensitive materials. To enhance the speed of silver halide photosensitive materials, it is very important to enhance the inherent speed of silver halide grains. Various methods have been used to enhance the inherent speed of silver halide of silver halide grains. For example, performed are speed enhancement by chemical sensitizers such as sulfur, gold and the VIII group metal compound, speed enhancement by chemical sensitizers such as sulfur, gold and the VIII family metal compounds in combination with additives that promote the sensitizing effect of the sensitizers, and speed enhancement by addition of additives having a sensitizing effect with silver halide emulsion seeds. These are described in: Research Disclosure, Vol. 120, April 1974, 12008; Research Disclosure, Vol. 34, June 1975, 13452; U.S. Pat. Nos. 2,642,361, 3,297,446, 3,772,031, 3,857,711, 3,901,714, 4,266,018, and 3,904,415; and BG 1,315,755. Further, a method of reduction-sensitizing silver halide grains has been used as means for enhancing the speed. Reduction sensitization of silver halide grains are described in U.S. Pat. Nos. 2,518,698, 3,201,254, 3,411,917, 3,779,777, and 3,930,867, for example. Methods of using reducing agents are described in Jpn. Pat. Appln. KOKOKU Publication No. (hereinafter referred to as JP-B-) 57-33572 and JP-B-58-1410, and Jpn. Pat. Appn. KOKAI Publication No. (hereinafter referred to as JP-A-)57-179835, for example. Furthermore, as recently described in U.S. Pat. Nos. 5,747,235 and 5,747,236, EP's 786692A1, 893731A1, 898732A1, and WO99/05570, a sensitizing technique using an organic electron-donating compound formed of electron-donating groups and split-off groups. This method is a new sensitizing technique, and is effective for increasing speed. However, although this compound increases speed, its effect is not sufficient. Further, the compound has a defect of increasing the fog (Dmin) and deteriorates a latent-image storability, and it was strongly desired to be improved. Further, it was found that fog increases when pressure and heat are simultaneously applied to the photosensitive material in the case of using this compound.

Furthermore, recently, JP-A-2000-194085 discloses a technique of enhancing speed without deteriorating graininess, by making a silver halide photosensitive material containing at least three hetero atoms which do not react with an oxidized developing agent. However, although this method described in the publication increases the speed, this technique alone fails to produce a sufficient effect, and a further effective method for increasing speed is desired.

BRIEF SUMMARY OF THE INVENTION

As a result of continuous study for obtaining a greater effect, the inventors has found a method of preferably increasing the speed by using a compound of general formula (M) or general formula (C) set forth below. Although its detailed mechanism is not identified, the inventors estimated that it is advantageous to have a characteristic of adsorbing to surfaces of emulsion grains without changing the silver ion concentration in the film, and thus using the compound of general formula (M) or (C) is more effective in this point than using the compounds mentioned as examples in JP-A-2000-194085. However, in these days there is a great demand for high speed on a photosensitive material. Even if these techniques are used, the effects thereof are not regarded as being sufficient, and a further effective method of increasing speed is desired.

The objects of the present invention are to solve problems of the above prior arts, and to provide a silver halide photosensitive material having a high speed and an excellent storability.

The objects of the present invention have been achieved by the following means.

(1) A silver halide color photosensitive material having at least one blue-sensitive silver halide emulsion layer containing a yellow coupler, at least one green-sensitive silver halide emulsion layer containing a magenta coupler, at least one red-sensitive silver halide emulsion layer containing a cyan coupler, and at least one non-lightsensitive layer, on a support, wherein at least one of the layers contains a compound selected from the group consisting of compounds of type A and compounds of types 1 to 4, and at least one of the layers contains the following Compound (B).

(Type A)

A compound represented by X—Y, wherein X represents a reducing group, Y represents a split-off group, and wherein a one-electron oxide product thereof generated by one-electron-oxidation of the reducing group represented by X is capable of leaving Y to generate an X radical accompanying a subsequent cleavage reaction of X—Y bonding, and is capable of releasing another electron.

(Type 1)

A compound capable of undergoing a one-electron oxidation to thereby form a one-electron oxidation product thereof, wherein the one-electron oxidation product is capable of releasing further two or more electrons accompanying a subsequent bond cleavage reaction;

(Type 2)

A compound capable of undergoing a one-electron oxidation to thereby form a one-electron oxidation product thereof, wherein the one-electron oxidation product is capable of releasing further one electron accompanying a subsequent carbon-carbon bond cleavage reaction, and the compound having, in its molecule, two or more groups adsorptive to silver halide;

(Type 3)

A compound capable of undergoing a one-electron oxidation to thereby form a one-electron oxidation product thereof, wherein the one-electron oxidation product is capable of releasing further one or more electrons after going through a subsequent bond forming process; and (Type 4)

A compound capable of undergoing a one-electron oxidation to thereby form a one-electron oxidation product thereof, wherein the one-electron oxidation product is capable of releasing further one or more electrons after going through a subsequent intramolecular ring cleavage reaction.

Compound (B)

A compound having at least three hetero atoms, the compound capable of increasing a photographic speed of the photosensitive material in comparison with the case where the material does not contain the compound.

(2) The silver halide color photosensitive material according to (1), wherein the compound selected from the group consisting of compounds of Type A and of types 1 to 4 is a compound selected from the group consisting of compounds represented by general formula (A) and compounds represented by general formulae (1-1) to (4-2).

(A)

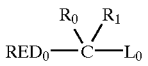

In the general formula (A), $RED_0$ represents a reducing group, $L_0$ represents a split-off group, and $R_0$ and $R_1$ independently represent a hydrogen atom or substituent. The groups $RED_0$ and $R_0$, and the groups $R_0$ and $R_1$ may be bonded with each other to thereby form a cyclic structure.

(1-1)

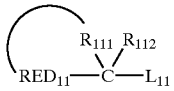

(1-2)

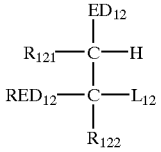

(2)

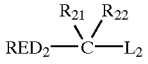

(3)

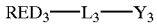

(4-1)

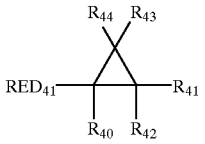

(4-2)

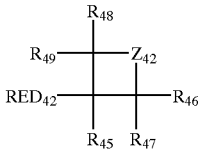

In the general formula (1-1), $RED_{11}$, represents a reducing group; $L_{11}$ represents a split-off group; and $R_{112}$ represents a hydrogen atom or substituent. $R_{111}$ represents a group of nonmetallic atoms capable of forming a cyclic structure corresponding to a tetrahydro form, hexahydro form or octahydro form of a 5-membered or 6-membered aromatic ring (including an aromatic heterocycle) together with the carbon atom (C) and $RED_{11}$.

In the general formula (1-2), $RED_{12}$ and $L_{12}$ have the same meanings as those of $RED_{11}$, and $L_{11}$ of the general formula (1-1), respectively. Each of $R_{121}$ and $R_{122}$ represents a hydrogen atom or substituent capable of substituting on the carbon atom, which may have the same meaning as $R_{112}$ of the general formula (1-1). $ED_{12}$ represents an electron-donating group. In the general formula (1-2), the groups $R_{121}$ and $RED_{12}$, the groups $R_{121}$ and $R_{122}$, or the groups $ED_{12}$ and $RED_{12}$ may be bonded with each other to thereby form a cyclic structure.

In the general formula (2), $RED_2$ has the same meaning as that of $RED_{12}$ of the general formula (1-2); $L_2$ represents a split-off group; each of $R_{21}$ and $R_{22}$ represents a hydrogen atom or substituent; and $RED_2$ and $R_{21}$ may be bonded with each other to thereby form a cyclic structure. The compound represented by the general formula (2) is a compound having, in its molecule, two or more groups adsorptive to silver halide.

In the general formula (3), $RED_3$ has the same meaning as $RED_{12}$ of the general formula (1-2). $Y_3$ represents a reactive group having a carbon-carbon double bond moiety or a carbon-carbon triple bond moiety, which moiety capable of forming a new bond by reacting with a one-electron oxidation product formed as a result of a one-electron oxidation of $RED_3$. $L_3$ represents a linking group that links between $RED_3$ and $Y_3$.

In the general formulae (4-1) and (4-2), each of $RED_{41}$ and $RED_{42}$ has the same meaning as $RED_{12}$ of the general formula (1-2). Each of $R_{40}$ to $R_{44}$ and $R_{45}$ to $R_{49}$ represents a hydrogen atom or substituent. In the general formula (4-2), $Z_{42}$ represents $—CR_{420}R_{421}—$, $—NR_{423}—$ or —O—. Herein, each of $R_{420}$ and $R_{421}$ represents a hydrogen atom or substituent; and $R_{423}$ represents a hydrogen atom, alkyl group, aryl group or heterocyclic group.

(3) The silver halide color photosensitive material according to (1) or (2), wherein the compound selected from the group consisting of compounds of type A and compounds of types 1 to 4 has, in a molecule thereof, an adsorptive group or a partial structure of a sensitizing dye.

(4) The silver halide color photosensitive material according to any one of (1) to (3), wherein the compound (B) is a 1,3,4,6-tetraazaindene or a derivative thereof.

(5) The silver halide color photosensitive material according to any one of (1) to (3), wherein the compound (B) is represented by general formula (M) or general formula (C).

(M)

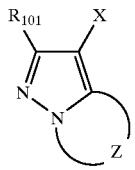

In the general formula (M), $R_{101}$ represents a hydrogen atom or substituent. Z represents a group of nonmetallic atoms required to form a 5-membered azole ring containing 2 to 4 nitrogen atoms, and the azole ring may have a substituent (including a condensed ring, i.e., an aromatic ring such as a benzene ring may be fused to the azole ring).

X represents a hydrogen atom or substituent.

(C)

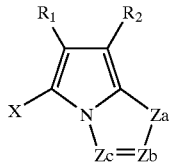

In the general formula (C), Za represents —NH— or —CH($R_3$)—, and each of Zb and Zc represents a —C($R_4$)= or —N=. Each of $R_1$, $R_2$ and $R_3$ represents an electron-withdrawing group having Hammett substituent constant σ p value of 0.2 to 1.0. $R_4$ represents a hydrogen atom or substituent. If two or more $R_4$'s exist in the formula, they may be the same or different. X represents a hydrogen atom or substituent.

(6) The silver halide color photosensitive material according to any one of (1) to (5), wherein the photosensitive material further contains, in at least one of the layers, a fine-grain dispersion containing an ultraviolet absorbent, the fine grains being prepared by means of emulsification by putting water into an organic solvent phase containing vinyl polymer and the ultraviolet absorbent, or putting the organic solvent phase into water.

(7) A silver halide color photosensitive material comprising at least one blue-sensitive silver halide emulsion layer containing an yellow coupler, at least one green-sensitive silver halide emulsion layer containing a magenta coupler, at least one red-sensitive silver halide emulsion layer containing a cyan coupler, and at least one non-lightsensitive layer, wherein at least one of the layers contains the compound selected from the group consisting of compounds of the type A and compounds of types 1 to 4 described in (1) above, and at least one of the layers contains a fine-grain dispersion containing an ultraviolet absorbent, the fine grains being prepared by means of emulsification by putting water into an organic solvent phase containing vinyl polymer and the ultraviolet absorbent, or putting the organic solvent phase into water.

(8) The silver halide color photosensitive material according to (7), wherein the compound selected from the group consisting of compounds of type A and compounds of types 1 to 4 is a compound selected from the group consisting of compounds represented by the general formula (A) and compounds represented by the general formulae (1-1) to (4-2) described in item (2) above.

(9) The silver halide color photosensitive material according to (7) or (8), wherein the compound selected from the group consisting of compounds of type A and compounds of types 1 to 4 has, in a molecule thereof, an adsorptive group or a partial structure of a sensitizing dye.

(10) A silver halide color photosensitive material comprising at least one blue-sensitive silver halide emulsion layer containing an yellow coupler, at least one green-sensitive silver halide emulsion layer containing a magenta coupler, at least one red-sensitive silver halide emulsion layer containing a cyan coupler, and at least one non-lightsensitive layer, wherein at least one of the layers contains the compound selected from the group consisting of compounds of type A and compounds of types 1 to 4, the support is formed of polyethylene naphthalate, and the photosensitive material further comprising a magnetic recording layer in a back layer thereof.

(11) The silver halide color photosensitive material according to (10), wherein the compound selected from the group consisting of compounds of type A and compounds of types 1 to 4 is a compound selected from the group consisting of compounds represented by the general formula (A) and compounds represented by the general formulae (1-1) to (4-2) described in item (2) above.

(12) The silver halide color photosensitive material according to (10) or (11), wherein the compound selected from the group consisting of compounds of type A and of types 1 to 4 has, in a molecule thereof, an adsorptive group or a partial structure of a sensitizing dye.

(13) The silver halide color photosensitive material according to any one of (1) to (9), wherein the support is formed of polyethylene naphthalate, and the photosensitive material further comprising a magnetic recording layer in a back layer thereof.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The present invention will now be described in more details.

The compound selected from the compounds of type A and of types 1 to 4 used in the present invention will now be described.

(Type A)

A compound represented by X—Y, wherein X represents a reducing group, Y represents a split-off group, and wherein a one-electron oxide product thereof generated by one-electron-oxidation of the reducing group represented by X is capable of leaving Y to generate an X radical accompanying a subsequent cleavage reaction of X—Y bonding, and is capable of releasing another electron.

(Type 1)

A compound capable of undergoing a one-electron oxidation to thereby form a one-electron oxidation product thereof, wherein the one-electron oxidation product is capable of releasing further two or more electrons accompanying a subsequent bond cleavage reaction;

(Type 2)

A compound capable of undergoing a one-electron oxidation to thereby form a one-electron oxidation product thereof, wherein the one-electron oxidation product is capable of releasing further one electron accompanying a subsequent carbon-carbon bond cleavage reaction, and the compound having, in its molecule, two or more groups adsorptive to silver halide;

(Type 3)

A compound capable of undergoing a one-electron oxidation to thereby form a one-electron oxidation product thereof, wherein the one-electron oxidation product is capable of releasing further one or more electrons after going through a subsequent bond forming process; and (Type 4)

A compound capable of undergoing a one-electron oxidation to thereby form a one-electron oxidation product thereof, wherein the one-electron oxidation product is capable of releasing further one or more electrons after going through a subsequent intramolecular ring cleavage reaction.

Compounds preferred among the above compounds of type A and of types 1 to 4 are represented by the general formula (A) and general formula (1-1) to (1-4). Specifically, among the above compounds of type A, preferable compounds are represented by the following general formula (A); among the above compounds of type 1, preferable compounds are represented by the following general formula (1-1) or general formula (1-2); among the above compounds of type 2, preferable compounds are represented by the following general formula (2); among the above compounds of type 3, preferable compounds are represented by the following general formula (3); and among the above compounds of type 4, preferable compounds are represented by the following general formula (4-1) or general formula (4-2).

(A)

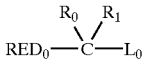

In the general formula (A), $RED_0$ represents a reducing group, $L_0$ represents a split-off group, and $R_0$ and $R_1$ independently represent a hydrogen atom or substituent. The groups $RED_0$ and $R_0$, and the groups $R_0$ and $R_1$ may be bonded with each other to thereby form a cyclic structure.

(1-1)

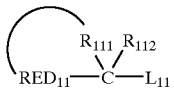

(1-2)

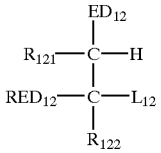

(2)

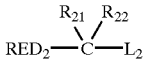

(3)

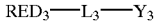

(4-1)

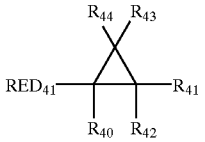

(4-2)

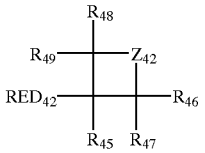

In the general formula (1-1), $RED_{11}$ represents a reducing group; $L_{11}$ represents a split-off group; and $R_{112}$ represents a hydrogen atom or substituent. $R_{111}$ represents a group of nonmetallic atoms capable of forming a cyclic structure corresponding to a tetrahydro form, hexahydro form or octahydro form of a 5-membered or 6-membered aromatic ring (including an aromatic heterocycle) together with the carbon atom (C) and $RED_{11}$.

In the general formula (1-2), $RED_{12}$ and $L_{12}$ have the same meanings as those of $RED_{11}$ and $L_{11}$ of the general formula (1-1), respectively. Each of $R_{121}$ and $R_{122}$ represents a hydrogen atom or substituent capable of substituting on the carbon atom, which may have the same meaning as $R_{112}$ of the general formula (1-1). $ED_{12}$ represents an electron-donating group. In the general formula (1-2), the groups $R_{121}$ and $RED_{12}$, the groups $R_{121}$ and $R_{122}$, or the groups $ED_{12}$ and $RED_{12}$ may be bonded with each other to thereby form a cyclic structure.

In the general formula (2), $RED_2$ has the same meaning as that of $RED_{12}$ of the general formula (1-2); $L_2$ represents a split-off group; each of $R_{21}$ and $R_{22}$ represents a hydrogen atom or substituent; and $RED_2$ and $R_{21}$ may be bonded with each other to thereby form a cyclic structure. The compound represented by the general formula (2) is a compound having, in its molecule, two or more groups adsorptive to silver halide.

In the general formula (3), $RED_3$ has the same meaning as $RED_{12}$ of the general formula (1-2). $Y_3$ represents a reactive group having a portion of a carbon-carbon double bond or a portion of a carbon-carbon triple bond, which portion capable of forming a new bond by reacting with a one-electron oxidation product formed as a result of a one-electron oxidation of $RED_3$. $L_3$ represents a linking group that links between $RED_3$ and $Y_3$.

In the general formulae (4-1) and (4-2), each of $RED_{41}$ and $RED_{42}$ has the same meaning as $RED_{12}$ of the general formula (1-2). Each of $R_{40}$ to $R_{44}$ and $R_{45}$ to $R_{49}$ represents a hydrogen atom or substituent. In the general formula (4-2), $Z_{42}$ represents $—CR_{420}R_{421}—$, $—NR_{423}—$ or —O—. Herein, each of $R_{420}$ and $R_{421}$ represents a hydrogen atom or substituent; and $R_{423}$ represents a hydrogen atom, alkyl group, aryl group or heterocyclic group.

Among the compounds of type A, type 1, type 3, and type 4, preferable are "compounds each having, in a molecule thereof, an adsorptive group acting on silver halide" or "compounds each having, in a molecule thereof, a partial structure of a sensitizing dye", and more preferable are "compounds each having, in a molecule thereof, an adsorptive group acting on silver halide."

Similarly, among the compounds of the general formula (A) and general formula (1-1) to general formula (4-2), preferable are "compounds each having, in a molecule thereof, an adsorptive group acting on silver halide" or "compounds each having, in a molecule thereof, a partial structure of a sensitizing dye." More preferable are "compounds each having, in a molecule thereof, an adsorptive group acting on silver halide."

First of all, the compounds of types 1 to 4 will be described.

With respect to the compound of type 1, the expression "bond cleavage reaction" refers to the cleavage of a carbon-carbon bond, or carbon-silicon bond. Further, the cleavage of carbon-hydrogen bond may accompany the above bond cleavage. The compound of type 1 is a compound capable of undergoing a one-electron oxidation to thereby form a one-electron oxidation product. The one-electron oxidation product only thereafter capable of undergoing a bond cleavage reaction to thereby further release two or more electrons (preferably three or more electrons). In another expression, the one-electron oxidation product of the compound of type 1 is capable of being oxidized with further two or more electrons (preferably three or more electrons).

Among the compounds of type 1, preferable compounds are represented by the general formula (1-1) or general formula (1-2). These compounds are compounds which, after a one-electron oxidation of the reducing group represented by $RED_{11}$ or $RED_{12}$ of the general formula (1-1) or general formula (1-2), can spontaneously split $L_{11}$ or $L_{12}$ through a bond cleavage reaction, namely, cleave the C (carbon atom)-$L_{11}$ bond or the C (carbon atom)-$L_{12}$ bond to thereby further release two or more, preferably three or more, electrons.

The compounds of the general formula (1-1) will first be described in detail below.

In the general formula (1-1), the reducing group represented by $RED_{11}$, capable of being oxidized with one-electron is a group capable of bonding with $R_{111}$ described later to thereby form a specific ring. The reducing group can be, for example, a divalent group corresponding to a monovalent group, as mentioned below, having one hydrogen atom removed therefrom at a position which is appropriate for cyclization. The monovalent group can be, for example, any of an alkylamino group, arylamino group (e.g., anilino, naphthylamino), heterocyclic amino group (e.g., benzothiazolylamino, pyrrolylamino), alkylthio group, arylthio group (e.g., phenylthio), heterocyclic thio group, alkoxy group, aryloxy group (e.g., phenoxy), heterocyclic oxy group, aryl group (e.g., phenyl, naphthyl, anthranyl) and aromatic or nonaromatic heterocyclic group (for example, 5- to 7-membered monocyclic or condensed heterocycle containing at least one hetero atom selected from a group consisting of a nitrogen atom, sulfur atom, oxygen atom and selenium atom, which heterocycle can be, for example, a tetrahydroquinoline ring, tetrahydroisoquinoline ring, tetrahydroquinoxaline ring, tetrahydroquinazoline ring, indoline ring, indole ring, indazole ring, carbazole ring, phenoxazine ring, phenothiazine ring, benzothiazoline ring, pyrrole ring, imidazole ring, thiazoline ring, piperidine ring, pyrrolidine ring, morpholine ring, benzimidazole ring, benzimidazoline ring, benzoxazoline ring or 3,4-methylenedioxyphenyl ring) (hereinafter, for simplicity, $RED_{11}$ is referred to as denoting a monovalent group). These groups may each have a substituent.

The substituent can be, for example, any of a halogen atom, alkyl groups (including, e.g., an aralkyl group, cycloalkyl group, active methine group), an alkenyl group, alkynyl group, aryl group, heterocyclic group, with its substitution position is not questioned), heterocyclic group containing a quaternated nitrogen atom (e.g., pyridinio, imidazolio, quinolinio or isoquinolinio), acyl group, alkoxycarbonyl group, aryloxycarbonyl group, carbamoyl group, carboxyl group or salt thereof, sulfonylcarbamoyl group, acylcarbamoyl group, sulfamoylcarbamoyl group, carbazoyl group, oxalyl group, oxamoyl group, cyano group, thiocarbamoyl group, hydroxyl group, alkoxy groups (including a group containing ethyleneoxy or propyleneoxy repeating units), aryloxy group, heterocyclic oxy group, acyloxy group, alkoxy- or aryloxy-carbonyloxy group, carbamoyloxy group, sulfonyloxy group, amino group, alkyl-, aryl- or heterocyclic-amino group, acylamino group, sulfonamido group, ureido group, thioureido group, imido group, alkoxy- or aryloxy-carbonylamino group, sulfamoylamino group, semicarbazido group, thiosemicarbazido group, hydrazino group, ammonio group, oxamoylamino group, alkyl- or aryl-sulfonylureido group, acylureido group, acylsulfamoylamino group, nitro group, mercapto group, alkyl-, aryl- or heterocyclic-thio group, alkyl- or aryl-sulfonyl group, alkyl- or aryl-sulfinyl group, sulfo group or salt thereof, sulfamoyl group, acylsulfamoyl group, sulfonylsulfamoyl group or salt thereof, and group containing a phosphoramide or phosphoric ester structure. These substituents may be further substituted with these substituents.

In the general formula (1-1), $L_{11}$ represents a split-off group which can be split off through a bond cleavage only after a one-electron oxidation of the reducing group represented by $RED_{11}$. Specifically, $L_{11}$ represents, for example, a carboxyl group or salt thereof, or silyl group.

When $L_{11}$ represents a salt of carboxyl group, as a counter ion for forming a salt, there can be mentioned, for example, an alkali metal ion (e.g., $Li^+$, $Na^+$, $K^+$ or $Cs^+$), an alkaline earth metal ion (e.g., $Mg^{2+}$, $Ca^{2+}$ or $Ba^{2+}$), a heavy metal ion (e.g., $Ag^+$ or $Fe^{2+/3+}$), an ammonium ion or a phosphonium ion. When $L_{11}$ represents a silyl group, the silyl group is, for example, a trialkylsilyl group, an aryldialkylsilyl group or a triarylsilyl group. The alkyl of these groups can be, for example, methyl, ethyl, benzyl or t-butyl. The aryl of these groups can be, for example, phenyl.

In the general formula (1-1), $R_{112}$ represents a hydrogen atom or substituent capable of substituting on the carbon atom. When $R_{112}$ represents a substituent capable of substituting on the carbon atom, the substituent can be, for example, any of those mentioned as substituent examples with respect to the $RED_{11}$ having a substituent. Provided however that $R_{112}$ and $L_{11}$ do not represent the same group.

In the general formula (1-1), $R_{111}$ represents a group of nonmetallic atoms capable of forming a specific 5-membered or 6-membered cyclic structure together with the carbon atom (C) and $RED_{11}$. Herein, the expression "specific 5-membered or 6-membered cyclic structure" formed by $R_{111}$ means a cyclic structure corresponding to a tetrahydro form, hexahydro form or octahydro form of 5-membered or 6-membered aromatic ring, including an aromatic heterocycle. Herein, the terminology "hydro form" means a cyclic structure resulting from partial hydrogenation of internal carbon to carbon double bonds or carbon to nitrogen double bonds of an aromatic ring, including an aromatic heterocycle. The tetrahydro form refers to a structure resulting from hydrogenation of two carbon to carbon double bonds or carbon to nitrogen double bonds. The hexahydro form refers to a structure resulting from hydrogenation of three carbon to carbon double bonds or carbon to nitrogen double bonds. The octahydro form refers to a structure resulting from hydrogenation of four carbon to carbon double bonds or carbon to nitrogen double bonds. As a result of hydrogenation, the aromatic ring becomes a partially hydrogenated nonaromatic cyclic structure.

Specifically, as examples of 5-membered monocycles, there can be mentioned a pyrrolidine ring, imidazolidine ring, thiazolidine ring, pyrazolidine ring and oxazolidine ring which correspond to tetrahydro forms of aromatic rings including a pyrrole ring, imidazole ring, thiazole ring, pyrazole ring and oxazole ring, respectively. As examples of 6-membered monocycles, there can be mentioned tetrahydro or hexahydro forms of aromatic rings such as a pyridine ring, pyridazine ring, pyrimidine ring and pyrazine ring. Particular examples thereof include a piperidine ring, tetrahydropyridine ring, tetrahydropyrimidine ring and piperazine ring. As examples of 6-membered condensed rings, there can be mentioned a tetralin ring, tetrahydroquinoline ring, tetrahydroisoquinoline ring, tetrahydroquinazoline ring and tetrahydroquinoxaline ring which correspond to tetrahydro forms of aromatic rings including a naphthalene ring, quinoline ring, isoquinoline ring, quinazoline ring and quinoxaline ring, respectively. As examples of tricyclic compounds, there can be mentioned a tetrahydrocarbazole ring, which is a tetrahydro form of a carbazole ring, and an octahydrophenanthridine ring, which is an octahydro form of a phenanthridine ring.

These cyclic structures may further be substituted. As examples of suitable substituents, there can be mentioned those described above with respect to substituents which may be had by the $RED_{11}$. Substituents of these cyclic structures may be further bonded with each other to thereby form a ring. The thus newly formed ring is a nonaromatic carbon ring or heterocycle.

Preferred range of compounds represented by the general formula (1-1) of the present invention will be described below.

In the general formula (1-1), $L_{11}$ preferably represents a carboxyl group or salt thereof, or hydrogen atom. More preferably, $L_{11}$ is a carboxyl group or salt thereof. As a counter ion of the salt, there can preferably be mentioned an alkali metal ion or an ammonium ion. An alkali metal ion (especially $Li^+$, $Na^+$ or $K^+$ ion) is most preferred.

In the general formula (1-1), it is preferred that $RED_{11}$ represents an alkylamino group, arylamino group, heterocyclic amino group, aryl group, or aromatic or nonaromatic heterocyclic group. As the heterocyclic group, preferred group is, for example, tetrahydroquinolinyl, tetrahydroquinoxalinyl, tetrahydroquinazolinyl, indolyl, indolenyl, carbazolyl, phenoxazinyl, phenothiazinyl, benzothiazolinyl, pyrrolyl, imidazolyl, thiazolidinyl, benzimidazolyl, benzimidazolinyl or 3,4-methylenedioxyphenyl-1-yl. More preferred group is an arylamino group (especially an anilino) or aryl group (especially an phenyl), preferably having 18 or less carbon atoms.

When $RED_{11}$ represents an aryl group, it is preferred that the aryl group has at least one electron-donating group (the number of electron-donating groups is preferably 4 or less, more preferably 1 to 3). Herein, the electron-donating group specifically refers to a hydroxyl group, alkoxy group, mercapto group, sulfonamido group, acylamino group, alkylamino group, arylamino group, heterocyclic amino group, active methine group, electron-excessive aromatic heterocyclic group (e.g., indolyl, pyrrolyl, imidazolyl, benzimidazolyl, thiazolyl, benzthiazolyl or indazolyl), or a nonaromatic nitrogen-containing heterocyclic group that is bonded to the carbon atom of the general formula (1-1) via its nitrogen atom (e.g., pyrrolidinyl, indolinyl, piperidinyl, piperazinyl or morpholino). Herein, the active methine group refers to a methine group substituted with two electron-withdrawing groups. Herein, the electron-withdrawing groups refer to an acyl group, alkoxycarbonyl group, aryloxycarbonyl group, carbamoyl group, alkylsulfonyl group, arylsulfonyl group, sulfamoyl group, trifluoromethyl group, cyano group, nitro group and imino group. These two electron-withdrawing groups may be bonded with each other to thereby form a circular structure.

When $RED_{11}$ represents an aryl group, the substituent of the aryl group is preferably an alkylamino group, hydroxyl group, alkoxy group, mercapto group, sulfonamido group, active methine group, or nonaromatic nitrogen-containing heterocyclic group that is bonded to the carbon atom of the general formula (1-1) via its nitrogen atom. More preferably, the substituent is an alkylamino group, hydroxyl group, active methine group, or nonaromatic nitrogen-containing heterocyclic group that is bonded to the carbon atom of the general formula (1-1) via its nitrogen atom. Most preferably, the substituent is an alkylamino group, or nonaromatic nitrogen-containing heterocyclic group that is bonded to the carbon atom of the general formula (1-1) via its nitrogen atom.

In the general formula (1-1), $R_{112}$ preferably represents any of a hydrogen atom, alkyl group, aryl group (e.g., phenyl), alkoxy group (e.g., methoxy, ethoxy or benzyloxy), hydroxyl group, alkylthio group (e.g., methylthio or butylthio), amino group, alkylamino group, arylamino group and heterocyclic amino group, each preferably having 18 or less carbon atoms. More preferably, $R_{112}$ represents any of a hydrogen atom, alkyl group, alkoxy group, phenyl group, alkylamino group, each preferably having 10 or less carbon atoms.

In the general formula (1-1), $R_{111}$ preferably represents a group of nonmetallic atoms capable of forming the following specific 5-membered or 6-membered cyclic structure together with the carbon atom (C) and $RED_{11}$. Specifically, the cyclic structure formed by $R_{111}$ may be, for example, either of a pyrrolidine ring and an imidazolidine ring which correspond to tetrahydro forms of monocyclic 5-membered aromatic rings including a pyrrole ring and imidazole ring, respectively. Also, the cyclic structure may be a tetrahydro or hexahydro form of monocyclic 6-membered aromatic ring such as a pyridine ring, pyridazine ring, pyrimidine ring or pyrazine ring. For example, the cyclic structure may be a piperidine ring, tetrahydropyridine ring, tetrahydropyrimidine ring or piperazine ring. Further, the cyclic structure may be any of a tetralin ring, tetrahydroquinoline ring, tetrahydroisoquinoline ring, tetrahydroquinazoline ring and tetrahydroquinoxaline ring which correspond to tetrahydro forms of condensed-ring of 6-membered aromatic rings including a naphthalene ring, a quinoline ring, isoquinoline ring, quinazoline ring and quinoxaline ring, respectively. Still further, the cyclic structure may be a tetrahydrocarbazole ring which is a tetrahydro form of a tricyclic aromatic carbazole ring, or octahydrophenanthridine ring which is an octahydro form of a phenanthridine ring.

The cyclic structure formed by $R_{111}$ is more preferably selected from a pyrrolidine ring, imidazolidine ring, piperidine ring, tetrahydropyridine ring, tetrahydropyrimidine ring, piperazine ring, tetrahydroquinoline ring, tetrahydroquinazoline ring, tetrahydroquinoxaline ring and tetrahydrocarbazole ring. Most preferably, the cyclic structure formed by $R_{111}$ is selected from a pyrrolidine ring, piperidine ring, piperazine ring, tetrahydroquinoline ring, tetrahydroquinazoline ring, tetrahydroquinoxaline ring and tetrahydrocarbazole ring. Optimally, the cyclic structure formed by $R_{111}$ is selected from a pyrrolidine ring, piperidine ring and tetrahydroquinoline ring.

Now, the general formula (1-2) will be described in detail.

With respect to the $RED_{12}$ and $L_{12}$ of the general formula (1-2), not only the meanings but also the preferred ranges thereof are the same as those of the $RED_{11}$ and $L_{11}$ of the general formula (1-1), respectively. Provided however that $RED_{12}$ represents a monovalent group unless the following cyclic structure is formed thereby. For example, the monovalent group can be any of those mentioned with respect to $RED_{11}$. With respect to $R_{121}$ and $R_{122}$, not only the meanings but also the preferred ranges thereof are the same as those of the $R_{112}$ of the general formula (1-1). $ED_{12}$ represents an electron-donating group. $R_{121}$ and $RED_{12}$; $R_{121}$ and $R_{122}$; or $ED_{12}$ and $RED_{12}$ may be bonded with each other to thereby form a cyclic structure.

In the general formula (1-2), the electron-donating group represented by $ED_{12}$ refers to a hydroxyl group, alkoxy group, mercapto group, alkylthio group, arylthio group, heterocyclic thio group, sulfonamido group, acylamino group, alkylamino group, arylamino group, heterocyclic amino group, active methine group, electron-excessive aromatic heterocyclic group (e.g., indolyl, pyrrolyl or indazolyl), a nonaromatic nitrogen-containing heterocyclic group that is bonded to the carbon atom of the general formula (1-2) via its nitrogen atom (e.g., pyrrolidinyl, piperidinyl, indolinyl, piperazinyl or morpholino), or an aryl group substituted with any of these electron-donating groups (e.g., p-hydroxyphenyl, p-dialkylaminophenyl, an o,p-dialkoxyphenyl or 4-hydroxynaphthyl). Herein, the active methine group is the same as described above as a substituent when $RED_{11}$ represents an aryl group.

$ED_{12}$ preferably represents a hydroxyl group, alkoxy group, mercapto group, sulfonamido group, alkylamino group, arylamino group, active methine group, electron-excessive aromatic heterocyclic group, nonaromatic nitrogen-containing heterocyclic group that is bonded to the carbon atom of the general formula (1-2) via its nitrogen atom, or phenyl group substituted with any of these electron-donating groups. More preferably, $ED_{12}$ represents a hydroxyl group, mercapto group, sulfonamido group, alkylamino group, arylamino group, active methine group, nonaromatic nitrogen-containing heterocyclic group that is bonded to the carbon atom of the general formula (1-2) via its nitrogen atom, or phenyl group substituted with any of these electron-donating groups (e.g., p-hydroxyphenyl, p-dialkylaminophenyl or o,p-dialkoxyphenyl).

In the general formula (1-2), $R_{121}$ and $RED_{12}$; $R_{122}$ and $R_{121}$; or $ED_{12}$ and $RED_{12}$ may be bonded with each other to thereby form a cyclic structure. The thus formed cyclic structure is a substituted or unsubstituted cyclic structure of a 5 to 7-membered monocyclic or condensed-ring nonaromatic carbon ring or heterocycle.

When $R_{121}$ and $RED_{12}$ form a cyclic structure, the thus formed cyclic structure can be, for example, a pyrrolidine ring, pyrroline ring, imidazolidine ring, imidazoline ring, thiazolidine ring, thiazoline ring, pyrazolidine ring, pyrazoline ring, oxazolidine ring, oxazoline ring, indane ring, piperidine ring, piperazine ring, morpholine ring, tetrahydropyridine ring, tetrahydropyrimidine ring, indoline ring, tetralin ring, tetrahydroquinoline ring, tetrahydroisoquinoline ring, tetrahydroquinoxaline ring, tetrahydro-1,4-oxazine ring, 2,3-dihydrobenzo-1,4-oxazine ring, tetrahydro-1,4-thiazine ring, 2,3-dihydrobenzo-1,4-thiazine ring, 2,3-dihydrobenzofuran ring or 2,3-dihydrobenzothiophene ring.

When $ED_{12}$ and $RED_{12}$ form a cyclic structure, $ED_{12}$ preferably represents an amino group, alkylamino group or arylamino group. The cyclic structure formed thereby can be, for example, a tetrahydropyrazine ring, piperazine ring, tetrahydroquinoxaline ring or tetrahydroisoquinoline ring.

When $R_{122}$ and $R_{121}$ form a cyclic structure, the thus formed cyclic structure can be, for example, a cyclohexane ring or cyclopentane ring.

Those which are more preferred among the compounds of the general formula (1-1) of the present invention are represented by the following general formulae (10) to (12). Those which are more preferred among the compounds of the general formula (1-2) are represented by the following general formulae (13) and (14).

(10)

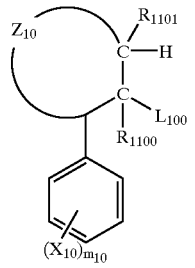

(11)

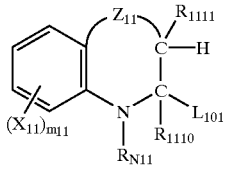

(12)

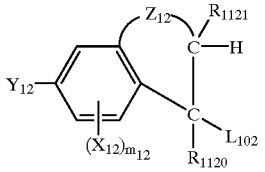

(13)

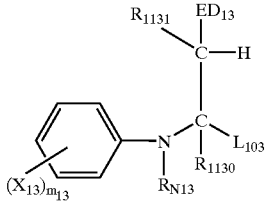

(14)

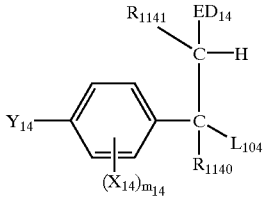

With respect to the $L_{100}$, $L_{101}$, $L_{102}$, $L_{103}$ and $L_{104}$ of the general formulae (10) to (14), not only the meanings but also the preferred ranges thereof are the same as those of the $L_{11}$ of the general formula (1-1). With respect to $R_{1100}$ and $R_{1101}$; $R_{1110}$ and $R_{1111}$; $R_{1120}$ and $R_{1121}$; $R_{1130}$ and $R_{1131}$; and $R_{1140}$ and $R_{1141}$; not only the meanings but also the preferred ranges thereof are the same as those of the $R_{122}$ and $R_{121}$, respectively of the general formula (1-2). With respect to the $ED_{13}$ and $ED_{14}$, not only the meanings but also the preferred ranges thereof are the same as those of the $ED_{12}$ of the general formula (1-2).

Each of $X_{10}$, $X_{11}$, $X_{12}$, $X_{13}$ and $X_{14}$ represents a substituent capable of substituting on the benzene ring. Each of $m_{10}$, $m_{11}$, $m_{12}$, $m_{13}$ and $m_{14}$ is an integer of 0 to 3. When it is 2 or more, a plurality of $X_{10}$, $X_{11}$, $X_{12}$, $X_{13}$ or $X_{14}$ groups may be the same or different. Each of $Y_{12}$ and $Y_{14}$ represents an amino group, alkylamino group, arylamino group, nonaromatic nitrogen-containing heterocyclic group that is bonded to the benzene ring of the general formula (12) or (14) via its nitrogen atom (e.g., pyrrolyl, piperidinyl, indolinyl, piperazino or morpholino), hydroxyl group or alkoxy group.

Each of $Z_{10}$, $Z_{11}$ and $Z_{12}$ represents a nonmetallic atomic group capable of forming a specific cyclic structure. The specific cyclic structure formed by $Z_{10}$ means a cyclic structure corresponding to a tetrahydro form or hexahydro form of 5- or 6-membered, monocyclic or condensed-ring, nitrogen-containing aromatic heterocycle. As such a cyclic structure, there can be mentioned, for example, a pyrrolidine ring, imidazolidine ring, thiazolidine ring, pyrazolidine ring, piperidine ring, tetrahydropyridine ring, tetrahydropyrimidine ring, piperazine ring, tetrahydroquinoline ring, tetrahydroisoquinoline ring, tetrahydroquinazoline ring or tetrahydroquinoxaline ring. The specific cyclic structure formed by $Z_{11}$ refers to a tetrahydroquinoline ring or tetrahydroquinoxaline ring. The specific cyclic structure formed by $Z_{12}$ refers to a tetralin ring, tetrahydroquinoline ring or tetrahydroisoquinoline ring.

Each of $R_{N11}$ and $R_{N13}$ represents a hydrogen atom or substituent capable of substituting on the nitrogen atom. The substituent can be, for example, any of an alkyl group, alkenyl group, alkynyl group, aryl group, heterocyclic group and acyl group, preferably an alkyl group or aryl group, each of which preferably have 18 or less carbon atoms, more preferably 10 or less carbon atoms.

The substituents capable of substituting on the benzene ring, represented by $X_{10}$, $X_{11}$, $X_{12}$, $X_{13}$ or $X_{14}$, can be, for example, those which may be had by the $RED_{11}$ of the general formula (1-1). Preferably, the substituents can be a halogen atom, alkyl group, aryl group, heterocyclic group, acyl group, alkoxycarbonyl group, aryloxycarbonyl group, carbamoyl group, cyano group, alkoxy group (including a group containing ethyleneoxy or propyleneoxy repeating units), alkyl-, aryl- or heterocyclic-amino group, an acylamino group, sulfonamido group, ureido group, thioureido group, imido group, alkoxy- or aryloxy-carbonylamino group, nitro group, alkyl-, aryl- or heterocyclic-thio group, alkyl- or aryl-sulfonyl group, a sulfamoyl group, etc.

Each of $m_{10}$, $m_{11}$, $m_{12}$, $m_{13}$ and $m_{14}$ is preferably an integer of 0 to 2, more preferably 0 or 1.

Each of $Y_{12}$ and $Y_{14}$ preferably represents an alkylamino group, arylamino group, nonaromatic nitrogen-containing heterocyclic group that is bonded to the benzene ring of the general formula (12) or (14) via its nitrogen atom, hydroxyl group or alkoxy group. More preferably, each of $Y_{12}$ and $Y_{14}$ represents an alkylamino group, 5- or 6-membered nonaromatic nitrogen-containing heterocyclic group that is bonded to the benzene ring of the general formula (12) or (14) via its nitrogen atom, or hydroxyl group. Most preferably, each of $Y_{12}$ and $Y_{14}$ represents an alkylamino group (especially, dialkylamino) or a 5- or 6-membered nonaromatic nitrogen-containing heterocyclic group that is bonded to the benzene ring of the general formula (12) or (14) via its nitrogen atom.

In the general formula (13), $R_{1131}$ and $X_{13}$; $R_{1131}$ and $R_{N13}$; $R_{1130}$ and $X_{13}$; or $R_{1130}$ and $R_{N13}$ may be bonded with each other to thereby form a cyclic structure. In the general formula (14), $R_{1141}$ and $X_{14}$; or $R_{1141}$ and $R_{1140}$; $ED_{14}$ and $X_{14}$; or $R_{1140}$ and $X_{14}$ may be bonded with each other to thereby form a cyclic structure. The thus formed cyclic structure is a substituted or unsubstituted cyclic structure consisting of a 5- to 7-membered monocyclic or condensed-ring nonaromatic carbon ring or heterocycle.

When, in the general formula (13), $R_{1131}$ and $X_{13}$ are bonded with each other to thereby form a cyclic structure, or $R_{1131}$ and $R_{N13}$ are bonded with each other to thereby form a cyclic structure, the resultant compound, like that wherein no cyclic structure is formed, is a preferred example of the compounds of the general formula (13).

As the cyclic structure formed by $R_{1131}$ and $X_{13}$ in the general formula (13), there can be mentioned, for example, any of an indoline ring, in which case, $R_{1131}$ represents a single bond, tetrahydroquinoline ring, tetrahydroquinoxaline ring, 2,3-dihydrobenzo-1,4-oxazine ring and 2,3-dihydrobenzo-1,4-thiazine ring. Of these, an indoline ring, tetrahydroquinoline ring and tetrahydroquinoxaline ring are especially preferred.

As the cyclic structure formed by $R_{1131}$ and $R_{N13}$ in the general formula (13), there can be mentioned, for example, any of a pyrrolidine ring, pyrroline ring, imidazolidine ring, imidazoline ring, thiazolidine ring, thiazoline ring, pyrazolidine ring, pyrazoline ring, oxazolidine ring, oxazoline ring, piperidine ring, piperazine ring, morpholine ring, tetrahydropyridine ring, tetrahydropyrimidine ring, indoline ring, tetrahydroquinoline ring, tetrahydroisoquinoline ring, tetrahydroquinoxaline ring, tetrahydro-1,4-oxazine ring, 2,3-dihydrobenzo-1,4-oxazine ring, tetrahydro-1,4-thiazine ring, 2,3-dihydrobenzo-1,4-thiazine ring, 2,3-dihydrobenzofuran ring and 2,3-dihydrobenzothiophene ring. Of these, a pyrrolidine ring, piperidine ring, tetrahydroquinoline ring and tetrahydroquinoxaline ring are especially preferred.

When, in the general formula (14), $R_{1141}$ and $X_{14}$ are bonded with each other to thereby form a cyclic structure, or $ED_{14}$ and $X_{14}$ are bonded with each other to thereby form a cyclic structure, the resultant compound, like that wherein no cyclic structure is formed, is a preferred example of the compounds of the general formula (14). As the cyclic structure formed by the bonding of $R_{1141}$ and $X_{14}$ in the general formula (14), there can be mentioned, for example, an indane ring, tetralin ring, tetrahydroquinoline ring, tetrahydroisoquinoline ring or indoline ring. As the cyclic structure formed by the bonding of $ED_{14}$ and $X_{14}$, there can be mentioned, for example, a tetrahydroisoquinoline ring or tetrahydrocinnoline ring.

The compound of type 2 will be described below.

The compound of type 2 is a compound capable of undergoing a one-electron oxidation to thereby form a one-electron oxidation product and capable of, only thereafter, undergoing a carbon-carbon bond cleavage reaction to thereby further release another electron. That is, the one-electron oxidation product of the compound of type 2 is capable of being oxidized with a further one-electron oxidation. Herein, the expression "bond cleavage reaction" refers to the cleavage of a carbon-carbon bond. The cleavage of carbon-hydrogen bond may accompany the above carbon-carbon bond cleavage.

Among the compounds of type 2, those preferred are represented by the general formula (2). Herein, the compound of type 2 is, after the one-electron oxidation of the reducing group represented by $RED_2$, $L_2$ is spontaneously split off through a bond cleavage reaction, namely, the C (carbon atom)-$L_2$ bond is cleaved, so that further another electron can be released.

Provided that the compound of type 2 is a compound having, in its molecule, two or more (preferably 2 to 6, more preferably 2 to 4) groups adsorptive to silver halide. More preferably, the compound of type 2 is a compound having a nitrogen-containing heterocyclic group substituted with two or more mercapto groups as the adsorptive group. The number of adsorptive groups is preferably in the range of 2 to 6, more preferably 2 to 4. The adsorptive groups will be described later.

With respect to $RED_2$ of the general formula (2), not only the meaning but also the preferred range thereof is the same as those of the $RED_{12}$ of the general formula (1-2). $L_2$ represents a carboxy group or a salt thereof, not only the counter ion forming the salt but also the preferred range thereof is the same as those described for the $L_{11}$ of the general formula (1-1). Each of $R_{21}$ and $R_{22}$ represents a hydrogen atom or substituent. With respect to these, not only the meanings but also the preferred ranges thereof are the same as those of the $R_{112}$ of the general formula (1-1). $RED_2$ and $R_{21}$ may be bonded with each other to thereby form a cyclic structure.

The thus formed cyclic structure is preferably a 5- to 7-membered monocyclic or condensed-ring nonaromatic carbon ring or heterocycle, which may have a substituent. Provided however that the cyclic structure is not one corresponding to a tetrahydro form, hexahydro form or octahydro form of an aromatic ring or aromatic heterocycle. The substituent can be any of those mentioned as substituent examples with respect to substituted $RED_{11}$ of the general formula (1-1). The cyclic structure is preferably an indoline ring, 2,3-dihydrobenzothiophene ring, 2,3-dihydrobenzofuran ring, 1,2-dihydropyridine ring, 1,4-dihydropyridine ring, benzo-α-pyran ring, benzothiazoline ring, benzoxazoline ring, benzimidazoline ring, 1,2-dihydroquinoline ring, 1,2-dihydroquinazoline ring, 1,2-dihydroquinoxaline ring, chroman ring, or isochroman ring. Preferable cyclic structure is an indoline ring, 2,3-dihydrobenzothiophene ring, 1,2-dihydropyridine ring, benzothiazoline ring, benzoxazoline ring, benzimidazoline ring, 1,2-dihydroquinoline ring, 1,2-dihydroquinazoline ring, or 1,2-dihydroquinoxaline ring. More preferable cyclic structure is an indoline ring, benzothiazoline ring, benzimidazoline ring, or 1,2-dihydroquinoline ring. Especially preferable cyclic structure is an indoline ring.

The compound of type 3 will be described below.

The compound of type 3 is a compound characterized in that it can undergo a one-electron oxidation to thereby form a one-electron oxidation product, the one-electron oxidation product undergoing a subsequent bond forming process to thereby further release one or more electrons. Herein the expression "bond forming process" refers to the formation of bond between atoms, in particular, carbon-carbon bond, carbon-nitrogen bond, carbon-sulfur bond or carbon-oxygen bond.

The compound of type 3 is preferably a compound characterized in that it can undergo a one-electron oxidation to thereby form a one-electron oxidation product, the one-electron oxidation product subsequently reacting with a carbon to carbon double bond moiety, or a carbon to carbon triple bond moiety, which coexists in the molecule to thereby form a bond, followed by further release of one or more electrons.

The one-electron oxidation product formed by the one-electron oxidation of the compound of type 3 refers to a cation radical species, which may undergo splitting off a proton to thereby form a neutral radical species. This one-electron oxidation product (cation radical species or neutral radical species) reacts with a carbon to carbon double bond moiety, or a carbon to carbon triple bond moiety which coexist in the molecule, thereby forming interatomic bonds such as carbon-carbon bond, carbon-nitrogen bond, carbon-sulfur bond and carbon-oxygen bond. Thus, a new intramolecular cyclic structure is formed. Simultaneously or thereafter, further one or more electrons are released. The characteristic of the electron-releasing compound of type 3 resides in this respect.

More specifically, the compound of type 3 is characterized in that the bond forming reaction after the one-electron oxidation leads to formation of a new radical species of cyclic structure, from which the second electron is further released directly or through splitting off a proton to thereby cause an oxidation thereof.

Furthermore, the compounds of type 3 include one exhibiting such a capability that the thus formed two-electron oxidation product subsequently undergoes a tautomeric reaction accompanying a transfer of proton either by way of a hydrolytic reaction or directly to thereby further release one or more, generally two or more, electrons, resulting in an oxidation thereof. Still further, the compounds of type 3 include one exhibiting such a capability that, without undergoing such a tautomeric reaction, further one or more, generally two or more, electrons are directly released from the two-electron oxidation product, resulting in oxidation thereof.

The compound of type 3 is preferably represented by the general formula (3).

In the general formula (3), $RED_3$ represents the same meanings as defined for $RED_{12}$ of the general formula (1-2).

In the general formula (3), $RED_3$ preferably represents an arylamino group, heterocyclic amino group, or a substituted aryl group or a substituted heterocyclic group, which substituent is selected from a group consisting of a hydroxy group, mercapto group, alkylthio group, methyl group and amino group.

When $RED_3$ represents an arylamino group, the examples thereof are an anilino group and naphthylamono group. The heterocycle of the heterocyclic amino group is an aromatic or nonaromatic, monocyclic or condensed heterocycle, which preferably has at least one aromatic ring as a partial structure thereof. Herein, the expression "has at least one aromatic ring as a partial structure thereof" may be either one of 1) the heterocycle itself is the aromatic ring, 2) the aromatic ring is condensed to a heterocycle, or 3) the aromatic ring is substituted on a heterocycle. Of these, the cases of 1) and 2) are preferable. Herein, the amino group is directly substituted on the aromatic ring that is included in the heterocycle as a partial structure thereof. The examples of the heterocycle are pyrrole ring, indole ring, indoline ring, imidazole ring, benzimidazole ring, benzimidazoline ring, thiazole ring, benzothiazole ring, benzothiazoline ring, oxazole ring, benzoxazoles ring benzoxazoline ring, quinoline ring, tetrahydroquinoline ring, quinoxaline ring, tetrahydroquinoxaline ring, quinazoline ring, tetrahydroquinazoline ring, pyridine ring, isoquinoline, thiophene ring, benzothiophene ring, 2,3-dihydrobenzothiophene ring, furan ring, benzofuran ring, 2,3-dihydrobenzofran, carbazole ring, phenothiazine ring, phenozazine ring, and phenazine ring.

When $RED_3$ represents an arylamino group or heterocyclic amino group, the amino group of the arylamino group and the amino group of the heterocyclic amino group may be substituted with a further arbitral substituent. In addition such a substituent may further form a cyclic structure with the aryl group or the heterocyclic group. Examples of such a cyclic structure is, an indoline ring, tetrahydroquinoline ring and carbazole ring.

When $RED_3$ represents an aryl group or heterocyclic group substituted, for example, with a hydroxy group, mercapto group, methyl group, alkylthio group or amino group, the aryl group, for example, is phenyl group or naphthyl group, while the examples of the heterocycle of the heterocyclic group are those described for "the heterocycle of the heterocyclic amino group." Herein the methyl group may have an arbitral substituent, and the arbitral substituent may also form a ring structure with the aryl group or heterocyclic group. Such a ring structure, for example, is a tetralin ring or indan ring. On the other hand, the amino group may have an alkyl group, aryl group or heterocyclic group as a substituent thereof, and the substituent may also form a ring structure with the aryl group or heterocyclic group. Such a ring structure, for example, is a tetrahydroquinoline ring, indoline ring or carbazole ring.

$RED_3$ preferably represents an arylamino group, an aryl group substituted with a hydroxy group, mercapto group or methyl group, or a heterocyclic group substituted with a hydroxy group, mercapto group or methyl group. $RED_3$ more preferably represents an arylamino group, an aryl group substituted with a mercapto group, methyl group or amino group, or a heterocyclic group substituted with a mercapto group, methyl group or amino group. $RED_3$ especially preferably represents an arylamino group, or aryl group substituted with a methyl group or amino group, or a heterocyclic group substituted with a methyl group or amino group.

As an arylamino group, an anilino group or naphthylamino group is preferable, and an anilino group is especially preferable. For a substituent of the anilino group, a chloride atom, alkyl group, alkoxy group, acylamino group, sulfamoyl group, carbamoyl group, ureido group, sulfonamide group, alkoxycarbonyl group, cyano group, alkylsulfonyl or arylsulfonyl group or heterocyclic group is preferable.

A hydroxyphenyl group, 5-hydroxyindoline ring group, or 6-hydroxy-1,2,3,4-tetrahdroquinoline ring group is preferable, as an example of an aryl group or heterocyclic group substituted with a hydroxy group. Of these a hydroxyphenyl group is especially preferable.

A mercaptophenyl group, 5-mercaptoindoline ring group, 6-mercapto-1,2,3,4-tetrahydrouquinoline ring group is preferable, as an example of an aryl group or heterocyclic group substituted with a mercapto group.

A methylphenyl group, ethylphenyl group, isopropylphenyl group, 3-methlindole ring group, 3-isopropylindole ring group, 5-methlindole ring group, 5-methylindoline ring group, 6-methyl-1,2,3,4-tetrahydroquinoline ring group, or 6-methyl-1,2,3,4-tetrahydroquinoxaline group is preferable as an example of an aryl group or heterocyclic group substituted with a methyl group.

A methylaminophenyl group, octylaminophenyl group, dodecylaminophenyl group, dimethlaminophenyl group, benzylaminophenyl group, phenylaminophenyl group, methylaminonaphthyl group, 5-methylaminotetraline, 1-butylamino-3,4-methylenedioxyphenyl group, 3-methylaminopyrrole ring group, 3-ethylaminoindole ring group, 5-benzylaminoindoline ring group, 2-aminoimidazole ring group, 2-methylaminothazole ring group, or 6-phenylaminobenzothiazole ring group is preferable as an example of an aryl group or heterocyclic group substituted with an amino group. Of these, more preferable $RED_3$ is a phenyl group substituted with an alkylamino group or phenylamino group, and especially preferable RED3 is a phenyl group substituted with an alkylamino group.

As an substituent that an aryl group or heterocyclic group substituted with a hydroxy group, mercapto group, methyl group or amino group may have, a chlorine atom, alkyl group, alkoxy group, acylamino group, sulfamoyl group, carbamoyl group, ureido group, sulfonamide group, alkoxycarbonyl group, cyano group, alkyl- or aryl-sulfonyl group, heterocyclic group, alkylamino group or an arylamino group is preferable.

In the general formula (3), the reactive group represented by $Y_3$ specifically means an organic group having at least one carbon to carbon double bond moiety or carbon to carbon triple bond moiety. The carbon to carbon double bond moiety or carbon to carbon triple bond moiety may have a substituent, which, for example, is the same as those described as the substituent that $RED_{11}$ of the general formula (1-1) may have. The substituent is preferably be any of, for example, an alkyl group, aryl group, alkoxycarbonyl group, carbamoyl group, acyl group, cyano group, and electron-donating group. Herein, the electron-donating group refers to any of an alkoxy group, hydroxyl group, amino group, alkylamino group, arylamino group, heterocyclic amino group, sulfonamido group, acylamino group, active methine group, mercapto group, an alkylthio group, arylthio group and aryl group having any of these groups as a substituent. Herein the active methine group refers to a methine group substituted with two electron-withdrawing groups, wherein the electron-withdrawing group means an acyl group, alkoxycarbonyl group, aryloxycarbonyl group, carbamoyl group, alkylsulfonyl group, arylsulfonyl group, sulfamoyl group, trifluoromethyl group, cyano group, intro group or imino group. Herein, the two electron-withdrawing groups may be bonded to each other to form a cyclic structure.

When $Y_3$ represents an organic group comprising a carbon to carbon double bond moiety which has a substituent, the substituent thereof is more preferably, for example, any one of an alkyl group, alkoxycarbonyl group, carbamoyl group, or electron-donating group. Herein, the electron-donating group preferably refers to any of an alkoxy group, amino group, alkylamino group, arylamino group, heterocyclic amino group, sulfonamide group, acylamino group, active methylene group, mercapto group, and alkylthio group, and a phenyl group having one of these electron-donating group as a substituent thereof. The substituents such as an alkyl group, alkoxy group, alkylthio group and alkylamino group may be bonded to each other to form a cyclic structure including the carbon-carbon double bond, which specifically, for example, is 2,3-dihydro-γ-pyran ring group, cyclohexene-3-yl group, or tetrahydropyridine ring group.

When $Y_3$ represents an organic group having a carbon to carbon double bond moiety which has a substituent, two of the substituents may be bonded to each other to form a cyclic structure. The cyclic structure formed herein is a nonaromatic, 5- to 7-membered carbon ring or heterocycle. When $Y_3$ represents an organic group having a carbon to carbon triple bond moiety which has a substituent, the substituent is preferably a hydrogen atom, alkoxycarbonyl group, carbamoyl group or electron-donating group. The electron-donating group herein preferably is, any one of an alkoxy group, amino group, alkylamino group, arylamino group, heterocyclic amino group, sulfonamide group, acylamino group, active methylene group, mercapto group and alkylthio group and a phenyl group having one of these electron-donating groups as a substituent thereof.

In the general formula (3), the reactive group represented by Y3 is more preferably an organic group having a carbon-carbon double bond moiety.

In the general formula (3), $L_3$ represents a linking group which links between $RED_3$ and $Y_3$. For example, $L_3$ represents a group consisting of each of, or each of combinations of, a single bond, alkylene group, arylene group, heterocyclic group, —O—, —S—, —$NR_N$—, —C(=O)—, —$SO_2$—, —SO— and —P(=O)—. Herein, $R_N$ represents a hydrogen atom, alkyl group, aryl group or heterocyclic group. The linking group represented by $L_3$ may have a substituent. The substituent can be any of those mentioned hereinbefore as substituents which may be had by $RED_{11}$ of the general formula (1-1).

When a cation radical species generated through an oxidation of $RED_3$ of the general formula (3), or a radical species generated together with dissociation of a proton therefrom, reacts with the reactive group represented by $Y_3$ of the general formula (3) thereby to form a bonding, an atomic group concerting this reaction preferably is capable of forming a 3- to 7-membered cyclic structure including $L_3$.

As a preferred example of $L_3$, there can be mentioned a divalent linking group selected from a single bond, alkylene group (especially methylene, ethylene or propylene), an arylene group (especially phenylene), —C(=O)— group, —O— group, —NH— group, —N(alkyl group)— group and combinations thereof.

Among the compounds of the general formula (3), preferred compounds are represented by the following general formulae (I) to (IV):

(I)

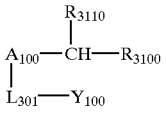

(II)

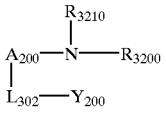

(III)

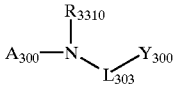

(IV)

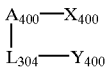

In the general formulae (I) to (IV), each of $A_{100}$, $A_{200}$ and $A_{400}$ represents an arylene group or divalent heterocyclic group, and $A_{300}$ represents an aryl group or a heterocyclic group. The preferred range thereof is the same as that of $RED_3$ of the general formula (3). Each of $L_{301}$, $L_{302}$, $L_{303}$ and $L_{304}$ represents a linking group. With respect to these, not only the meanings but also the preferred ranges thereof are the same as those of $L_3$ of the general formula (3). Each of $Y_{100}$, $Y_{200}$, $Y_{300}$ and $Y_{400}$ represents a reactive group. With respect to these, not only the meanings but also the preferred ranges thereof are the same as those of $Y_3$ of the general formula (3). Each of $R_{3100}$, $R_{3110}$, $R_{3200}$, $R_{3210}$ and $R_{3310}$ represents a hydrogen atom or substituent. Each of $R_{3100}$ and $R_{3110}$ preferably represents a hydrogen atom, alkyl group or aryl group. Each of $R_{3200}$ and $R_{3310}$ preferably represents a hydrogen atom. $R_{3210}$ preferably represents a substituent. This substituent is preferably an alkyl group or aryl group. $R_{3110}$ and $A_{100}$; $R_{3210}$ and $A_{200}$; $R_{3310}$ and $A_{300}$ may be bonded with each other to thereby form a cyclic structure. The thus formed cyclic structure is preferably, for example, a tetralin ring, indane ring, tetrahydroquinoline ring or indoline ring. $X_{400}$ represents a hydroxyl group, mercapto group or alkylthio group, preferably represents a hydroxyl group or mercapto group, and more preferably represents a mercapto group.

The relation between the general formula (I) to (IV) and the general formula (3) is as follows. A100 of the general formula (I) represents a heterocyclic group or aryl group substituted with a methyl group represented by —CH($R_{3110}$)($R_{3100}$). $A_{200}$ of the general formula (II) represents a heterocyclic group or aryl group substituted with an amino group represented by —N($R_{3210}$)($R_{3300}$). $A_{400}$ of the general formula (IV) represents a heterocyclic group or aryl group substituted with a hydroxy group, mercapto group, or alkylthio group. The group represented by $A_{300}$—N($R_{3310}$)— of the general formula (III) similarly represents a heterocyclic amino group or arylamino group.

Among the compounds of the general formulae (I) to (IV), the compounds of the general formulae (I), (II) and (IV) are preferred.

The compound of type 4 will be described below.

The compound of type 4 is a compound having a circular structure substituted with a reducing group, which compound can undergo a one-electron oxidation of the reducing group and thereafter a cleavage reaction of the circular structure to thereby further release one or more electrons.

In the compound of type 4, the cyclic structure is cleaved after a one-electron oxidation. Herein, the cyclic cleavage reaction refers to the following scheme of reaction:

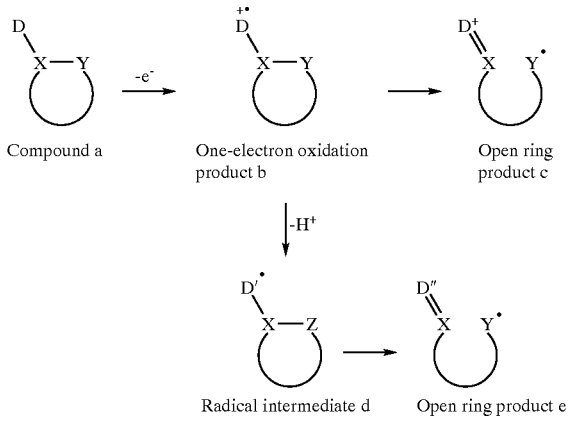

In the scheme, the compound a represents a compound of type 4. In the compound a, D represents a reducing group, and X and Y represent atoms forming a bond of the circular structure which is cleaved after a one-electron oxidation. First, the compound a undergoes a one-electron oxidation to thereby form a one-electron oxidation product b. Then, the D-X single bond is converted to a double bond, and simultaneously the X—Y bond is cleaved to thereby form an open-ring product c. An alternative route wherein a proton is split from the one-electron oxidation product b to thereby form a radical intermediate d, from which an open-ring product e is similarly formed, may be taken. One or more electrons are further released from the thus formed open-ring product c or e. The characteristic of this compound of the present invention resides in this respect.

The cyclic structure of the compound of type 4 refers to a nonaromatic, saturated or unsaturated, monocyclic or condensed-ring, 3- to 7-membered carbon ring or heterocycle. A saturated cyclic structure is preferred, and a 3- or 4-membered ring is more preferred. As preferred cyclic structures, there can be mentioned a cyclopropane ring, cyclobutane ring, oxirane ring, oxetane ring, aziridine ring, azetidine ring, episulfide ring and thietane ring. Of these, a cyclopropane ring, cyclobutane ring, oxirane ring, oxetane ring and azetidine ring are preferred. A cyclopropane ring, cyclobutane ring and azetidine ring are more preferred. The cyclic structure may have a substituent.

The compound of type 4 is preferably represented by the general formula (4-1) or (4-2).

With respect to $RED_{41}$ and $RED_{42}$ of the general formulae (4-1) and (4-2), not only the meanings but also the preferred ranges thereof are the same as those of $RED_{12}$ of the general formula (1-2). Each of $R_{40}$ to $R_{44}$ and $R_{45}$ to $R_{49}$ represents a hydrogen atom or substituent. The substituent can be any of those which may be had by $RED_{12}$. In the general formula (4-2), $Z_{42}$ represents —$CR_{420}R_{421}$—, —$NR_{423}$— or —O—. Each of $R_{420}$ and $R_{421}$ represents a hydrogen atom or substituent, and $R_{423}$ represents a hydrogen atom, alkyl group, aryl group or heterocyclic group.

In the general formula (4-1), $R_{40}$ preferably represents any of a hydrogen atom, alkyl group, alkenyl group, alkynyl group, aryl group, heterocyclic group, alkoxy group, amino group, alkylamino group, arylamino group, heterocyclic amino group, alkoxycarbonyl group, acyl group, carbamoyl group, cyano group and sulfamoyl group. Of these, a hydrogen atom, alkyl group, aryl group, heterocyclic group, alkoxy group, alkoxycarbonyl group, acyl group and carbamoyl group are more preferred. A hydrogen atom, alkyl group, aryl group, heterocyclic group, alkoxycarbonyl group and carbamoyl group are most preferred.

With respect to $R_{41}$ to $R_{44}$, it is preferred that at least one thereof be a donating group. It is also preferred that $R_{41}$ and $R_{42}$; or $R_{43}$ and $R_{44}$ be simultaneously electron-withdrawing groups. More preferably, at least one of $R_{41}$ to $R_{44}$ is a donating group. Most preferably, at least one of $R_{41}$ to $R_{44}$ is a donating group while, among $R_{41}$ to $R_{44}$, nondonating group or groups are a hydrogen atom or alkyl group.

Herein, the donating group refers to a hydroxyl group, alkoxy group, aryloxy group, mercapto group, acylamino group, sulfonylamino group, active methine group, or group selected from preferred examples of the $RED_{41}$ and $RED_{42}$ groups. As the donating group, there can preferably be used any of an alkylamino group, arylamino group, heterocyclic amino group, 5-membered aromatic heterocyclic group having one nitrogen atom in its ring, which may be monocyclic or in the form of condensed rings, a nonaromatic nitrogen-containing heterocyclic group that is bonded to the carbon atom of the general formula (4-1) via its nitrogen atom and phenyl group substituted with at least one electron-donating group, wherein the donating group refers to a hydroxyl group, alkoxy group, aryloxy group, amino group, alkylamino group, arylamino group, heterocyclic amino group or nonaromatic nitrogen-containing heterocyclic group that is bonded to the carbon atom of the general formula (4-1) via its nitrogen atom). Of these, an alkylamino group, arylamino group, 5-membered aromatic heterocyclic group having one nitrogen atom in its ring, wherein the aromatic heterocycle refers to an indole ring, pyrrole ring or carbazole ring, and a phenyl group substituted with at least one electron-donating group, in particular, a phenyl group substituted with 3 or more alkoxy groups or a phenyl group substituted with a hydroxyl group or alkylamino group or arylamino group, are more preferred. An arylamino group, 5-membered aromatic heterocyclic group having one nitrogen atom in its ring, wherein the 5-membered aromatic heterocyclic group represents a 3-indolyl group, and a phenyl group substituted with at least one electron-donating group, in particular, a trialkoxyphenyl group or a phenyl group substituted with an alkylamino group or arylamino group, are most preferred. The electron-donating groups are the same as those mentioned in the above description of active methine group.

In the general formula (4-2), the preferred range of $R_{45}$ is the same as described above with respect to $R_{40}$ of the general formula (4-1).

Each of $R_{46}$ to $R_{49}$ preferably represents any of a hydrogen atom, alkyl group, alkenyl group, alkynyl group, aryl group, heterocyclic group, hydroxyl group, alkoxy group, amino group, alkylamino group, arylamino group, heterocyclic amino group, mercapto group, arylthio group, alkylthio group, acylamino group and sulfonamino group. Of these, a hydrogen atom, alkyl group, aryl group, heterocyclic group, alkoxy group, alkylamino group, arylamino group and heterocyclic amino group are more preferred. Most preferably, each of $R_{46}$ to $R_{49}$ represents a hydrogen atom, alkyl group, aryl group, heterocyclic group, alkylamino group or arylamino group when $Z_{42}$ represents a group of the formula —$CR_{420}R_{421}$—; represents a hydrogen atom, alkyl group, aryl group or heterocyclic group when $Z_{42}$ represents a —$NR_{423}$—; and represents a hydrogen atom, alkyl group, aryl group or heterocyclic group when $Z_{42}$ represents —O—.

$Z_{42}$ preferably represents —$CR_{420}R_{421}$— or —$NR_{423}$—, and more preferably represents —$NR_{423}$—.

Each of $R_{420}$ and $R_{421}$ preferably represents any of a hydrogen atom, alkyl group, alkenyl group, alkynyl group, aryl group, heterocyclic group, hydroxyl group, alkoxy group, amino group, mercapto group, acylamino group and sulfonamino group. Of these, a hydrogen atom, alkyl group, aryl group, heterocyclic group, alkoxy group and amino group are more preferred. $R_{423}$ preferably represents a hydrogen atom, alkyl group, aryl group or aromatic heterocyclic group, and more preferably represents methyl, ethyl, isopropyl, t-butyl, t-amyl, benzyl, diphenylmethyl, allyl, phenyl, naphthyl, 2-pyridyl, 4-pyridyl or 2-thiazolyl.

When each of $R_{40}$ to $R_{49}$, $R_{420}$, $R_{421}$ and $R_{423}$ represents a substituent, the total number of carbon atoms of each thereof is preferably 40 or less, more preferably 30 or less, and most preferably 15 or less. These substituents may be bonded with each other or bonded with other moieties (e.g., $RED_{41}$, $RED_{42}$ or $Z_{42}$) of the molecule to thereby form rings.

It is preferred that the compounds of types 1, 3 and 4 according to the present invention be "compounds each having, in its molecule, an adsorptive group acting on silver halide" or "compounds each having, in its molecule, a partial structure of sensitizing dye. More preferably, the compounds of types 1, 3 and 4 according to the present invention are "compounds each having, in its molecule, an adsorptive group acting on silver halides". The compound of type 2 is a "compound having, in its molecule, two or more groups adsorptive to silver halide".

With respect to the compounds of types 1 to 4 according to the present invention, the adsorptive group acting on silver halide refers to a group directly adsorbed onto silver halide or a group capable of promoting the adsorption onto silver halide. For example, the adsorptive group is a mercapto group (or a salt thereof), thione group (—C(═S)—), heterocyclic group containing at least one atom selected from a nitrogen atom, sulfur atom, selenium atom and tellurium atom, sulfido group, cationic group or ethynyl group. Provided however that, with respect to the compound of type 2 according to the present invention, a sulfido group is not included in the adsorptive groups thereof.

The terminology "mercapto group (or a salt thereof)" as the adsorptive group means not only a mercapto group (or a salt thereof) per se but also, preferably, a heterocyclic, aryl or alkyl group substituted with at least one mercapto group (or salt thereof). Herein, the heterocyclic group refers to a 5- to 7-membered, monocyclic or condensed-ring, aromatic or nonaromatic heterocycle. As the heterocyclic group, there can be mentioned, for example, an imidazole ring group, thiazole ring group, oxazole ring group, benzimidazole ring group, benzothiazole ring group, benzoxazole ring group, triazole ring group, thiadiazole ring group, oxadiazole ring group, tetrazole ring group, purine ring group, pyridine ring group, quinoline ring group, isoquinoline ring group, pyrimidine ring group or triazine ring group. The heterocyclic group may be one containing a quaternary nitrogen atom, which may become a mesoion as a result of dissociation of a substituted mercapto group. This heterocyclic group can be, for example, any of an imidazolium ring group, pyrazolium ring group, thiazolium ring group, triazolium ring group, tetrazolium ring group, thiadiazolium ring group, pyridinium ring group, pyrimidinium ring group and triazinium ring group. Of these groups, a triazolium ring group (e.g., 1,2,4-triazolium-3-thiolate ring group) is preferred. The aryl group can be, for example, a phenyl group or naphthyl group. The alkyl group can be a linear, or branched, or cyclic alkyl group having 1 to 30 carbon atoms. When the mercapto group forms a salt, as the counter ion, there can be mentioned, for example, a cation of alkali metal, alkaline earth metal or heavy metal (e.g., $Li^+$, $Na^+$, $K^+$, $Mg^{2+}$, $Ag^+$ or $Zn^{2+}$), an ammonium ion, a heterocyclic group containing a quaternary nitrogen atom, or a phosphonium ion.

The mercapto group as the adsorptive group may further be tautomerized into a thione group. As such, there can be mentioned, for example, a thioamido group (herein a —C(═S)—NH— group) or a group containing a partial structure of the thioamido group, namely, a linear or cyclic thioamido group, thioureido group, thiourethane group or dithiocarbamic acid ester group. As examples of suitable cyclic groups, there can be mentioned, for example, a thiazolidine-2-thione group, oxazolidine-2-thione group, 2-thiohydantoin group, rhodanine group, isorhodanine group, thiobarbituric acid group and 2-thioxo-oxazolidin-4-one group.

The thione groups as the adsorptive group include not only the above thione groups resulting from tautomerization of mercapto groups but also a linear or cyclic thioamido group, thioureido group, thiourethane group and dithiocarbamic acid ester group which cannot be tautomerized into mercapto groups, i.e., not having any hydrogen atom at the α-position of thione group.

The heterocyclic group containing at least one atom selected from a nitrogen atom, sulfur atom, selenium atom and tellurium atom as the adsorptive group is a nitrogen-containing heterocyclic group having an —NH— group capable of forming an iminosilver (>NAg) as a partial structure of the heterocycle, or a heterocyclic group having an "—S—" group or "—Se—" group or "—Te—" group or "═N—" group capable of coordinating to silver ion by coordinate bond as a partial structure of the heterocycle. The former heterocyclic group can be, for example, a benzotriazole group, triazole group, indazole group, pyrazole group, tetrazole group, benzimidazole group, imidazole group or purine group. The latter heterocyclic group can be, for example, a thiophene group, thiazole group, oxazole group, benzothiazole group, benzoxazole group, thiadiazole group, oxadiazole group, triazine group, selenoazole group, benzoselenoazole group, tellurazole group or benzotellurazole group. The former heterocyclic group is preferred.

As the sulfido group as the adsorptive group, there can be mentioned all the groups having a partial structure of "—S—". Preferably, the sulfido group is a group having a partial structure of alkyl (or alkylene) —S— alkyl (or alkylene), aryl (or arylene) —S— alkyl (or alkylene), or aryl (or arylene) —S— aryl(or arylene). This sulfido group may be in the form of a cyclic structure or —S—S— group. As examples of sulfido groups forming a cyclic structure, there can be mentioned groups containing a thiolane ring, 1,3-dithiolane ring, 1,2-dithiolane ring, thiane ring, dithiane ring, tetrahydro-1,4-thiazine ring (thiomorpholine ring) or the like. Among the sulfide groups, groups having a partial structure of alkyl (or alkylene) —S— alkyl (or alkylene) are especially preferred.

The cationic group as the adsorptive group refers to a group containing a quaternary nitrogen atom. For example, it is a group containing an ammonio group or a nitrogen-containing heterocyclic group containing a quaternary nitrogen atom. However, the cationic group does not become part of an atomic group forming a dye structure (for example, cyanine chromophore). Herein, the ammonio group is, for example, a trialkylammonio group, dialkylarylammonio group or alkyldiarylammonio group. For example, as such, there can be mentioned benzyldimethylammonio group, trihexylammonio group or phenyldiethylammonio group. The nitrogen-containing heterocyclic group containing a quaternary nitrogen atom can be, for example, any of pyridinio group, quinolinio group, isoquinolinio group and imidazolio group. Of these, pyridinio group and imidazolio group are preferred. A pyridinio group is most preferred. The nitrogen-containing heterocyclic group containing a quaternary nitrogen atom may have an arbitrary substituent. However, when the nitrogen-containing heterocyclic group is a pyridinio group or imidazolio group, the substituent is preferably selected from, for example, an alkyl group, aryl group, acylamino group, chlorine atom, alkoxycarbonyl group and carbamoyl group. When the nitrogen-containing heterocyclic group is a pyridinio group, the substituent is most preferably a phenyl group.

The ethynyl group as the adsorptive group refers to a —C≡CH group, whose hydrogen atom may be replaced by a substituent.

The above adsorptive groups may have an arbitrary substituent.

Furthermore, examples of suitable adsorptive groups include those listed on pages 4 to 7 of Jpn. Pat. Appln. KOKAI Publication No. (hereinafter referred to as JP-A-) 11-95355, (U.S. Pat. No. 6,054,260, the entire contents of which are incorporated herein by reference.).

In the present invention, it is preferred that the adsorptive group be a nitrogen-containing heterocyclic group substituted with mercapto (e.g., a 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzothiazole group or 1,5-dimethyl-1,2,4-triazolium-3-thiolate group), or a nitrogen-containing heterocyclic group having an —NH— group capable of forming an iminosilver (>NAg) as a partial structure of the heterocycle (e.g., a benzotriazole group, benzimidazole group or indazole group). Although the adsorptive group may be substituted at any position of the general formulae (1-1) to (4-2), the substitution at $RED_{11}$, $RED_{12}$, $RED_2$ or $RED_3$ is preferred in the general formulae (1-1) to (3), and the substitution at $RED_{41}$, $R_{41}$, $RED_{42}$, or $R_{46}$ to $R_{48}$ is preferred in the general formulae (4-1) and (4-2). The adsorptive group is more preferably substituted at $RED_{11}$ to $RED_{42}$ for all the general formulae (1-1) to (4-2).

The partial structure of spectral sensitizing dye refers to a group containing a chromophore of spectral sensitizing dye, and refers to a residue resulting from removal of an arbitrary hydrogen atom or substituent from a spectral sensitizing dye compound. Although the partial structure of spectral sensitizing dye may be substituted at any position of the general formulae (1-1) to (4-2), the substitution at $RED_{11}$, $RED_{12}$, $RED_2$ and $RED_3$ is preferred in the general formulae (1-1) to (3), and the substitution at $RED_{41}$, $R_{41}$, $RED_{42}$ and $R_{46}$ to $R_{48}$ is preferred in the general formulae (4-1) and (4-2). The adsorptive group is more preferable substituted at $RED_{11}$ to $RED_{42}$ for all the general formulae (1) to (4-2). Preferred spectral sensitizing dyes are those typically employed in color sensitization techniques, which include, for example, cyanine dyes, composite cyanine dyes, merocyanine dyes, composite merocyanine dyes, homopolar cyanine dyes, styryl dyes and hemicyanine dyes. Representative spectral sensitizing dyes are disclosed in Research Disclosure, item 36544, September 1994, the entire contents of which are incorporated herein by reference. These spectral sensitizing dyes can be synthesized by persons skilled in the art to which the invention pertains in accordance with the procedure described in the above Research Disclosure or F. M. Hamer "The Cyanine Dyes and Related Compounds", Interscience Publishers, New York, 1964, the entire contents of which are incorporated herein by reference. Further, all the dyes described on pages 7 to 14 of JP-A-11-95355 (U.S. Pat. No. 6,054,260, the entire contents of which are incorporated herein by reference) per se are applicable.

With respect to the compounds of types 1 to 4 according to the present invention, the total number of carbon atoms is preferably in the range of 10 to 60, more preferably 10 to 50, most preferably 11 to 40, and optimally 12 to 30.

With respect to the compounds of types 1 to 4 according to the present invention, a one-electron oxidation thereof is induced upon exposure of the silver halide photosensitive material wherein use is made of the compounds, followed by reaction. Thereafter, another electron, or two or more electrons depending on the type of compound are released to thereby cause further oxidation. The oxidation potential with respect to the first electron is preferably about 1.4 V or below, more preferably 1.0 V or below. This oxidation potential is preferably higher than 0 V, more preferably higher than 0.3 V. Thus, the oxidation potential is preferably in the range of about 0 to about 1.4 V, more preferably about 0.3 to about 1.0 V.

Herein, the oxidation potential can be measured in accordance with the cyclic voltametry technique. For example, a sample compound is dissolved in a solution consisting of a 80%:20% (vol. %) mixture of acetonitrile and water (containing 0.1 M lithium perchlorate), and nitrogen gas is passed through the solution for 10 min. Thereafter, the oxidation potential is measured at 25° C. and at a potential scanning rate of 0.1 V/sec with the use of a glassy carbon disk as a working electrode, a platinum wire as a counter electrode and a calomel electrode (SCE) as a reference electrode. The oxidation potential vs. SCE is determined at the peak potential of cyclic voltametry wave.

With respect to, among the compounds of types 1 to 4 according to the present invention, those which undergo a one-electron oxidation and, after a subsequent reaction, further release another electron, the oxidation potential at the latter stage is preferably in the range of −0.5 to −2 V, more preferably −0.7 to −2 V, and most preferably −0.9 to −1.6 V.

On the other hand, with respect to, among the compounds of types 1 to 4 according to the present invention, those which undergo a one-electron oxidation and, after a subsequent reaction, further release two or more electrons to thereby effect oxidation, the oxidation potential at the latter stage is not particularly limited. The reason is that the oxidation potential with respect to the second electron cannot be clearly distinguished from the oxidation potential with respect to the third electron et seqq., so that it is often difficult to practically accomplish accurate measuring and distinguishing thereof.

Specific examples of the compounds of types 1 to 4 according to the present invention will be listed below, which however in no way limit the scope of the present invention.

1

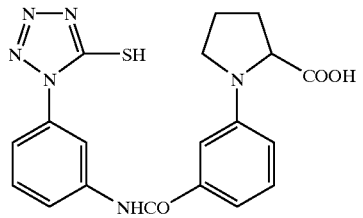

2

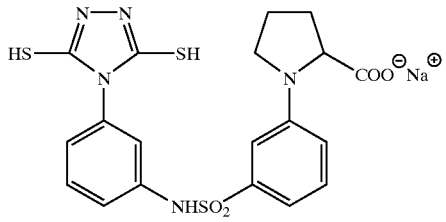

3

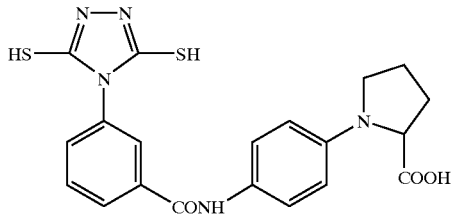

4

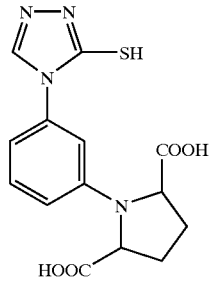

5

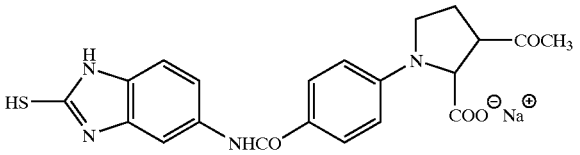

6

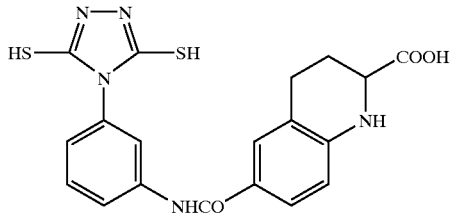

-continued
7
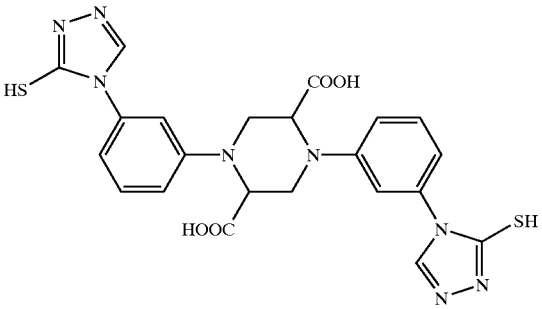
8
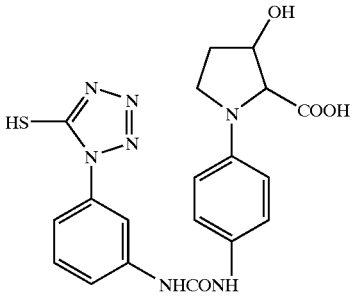
9
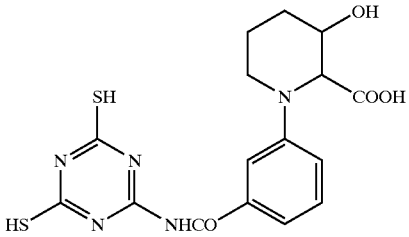
10
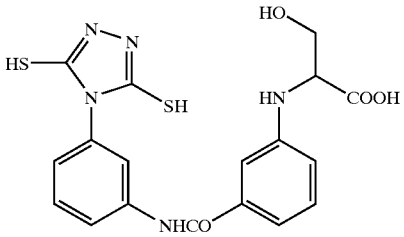
11
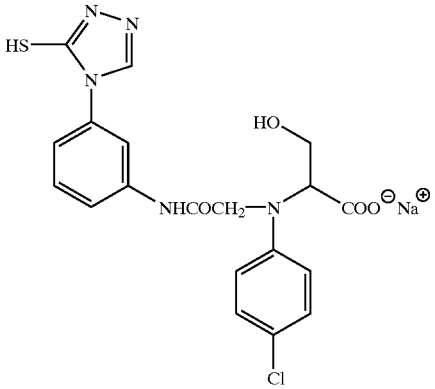
-continued
12
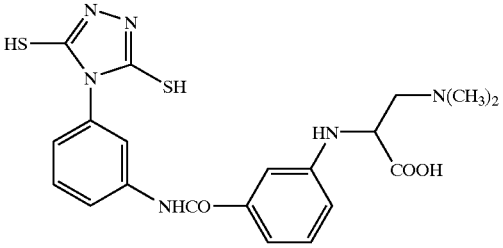
13
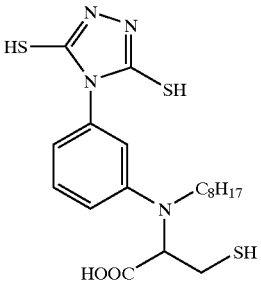
14
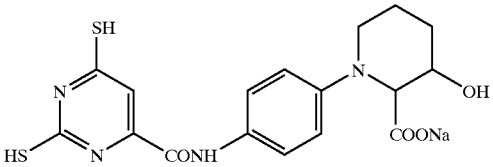
15
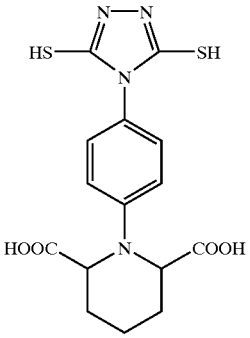
16
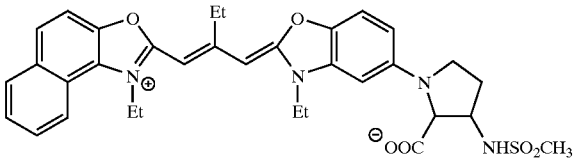
17
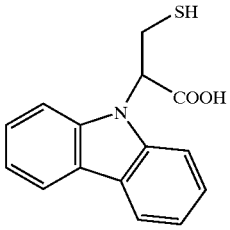

-continued
18
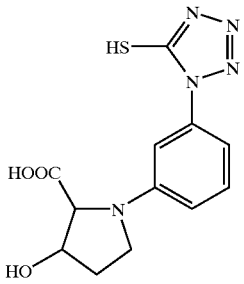
19
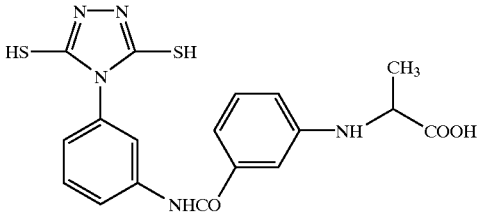
20
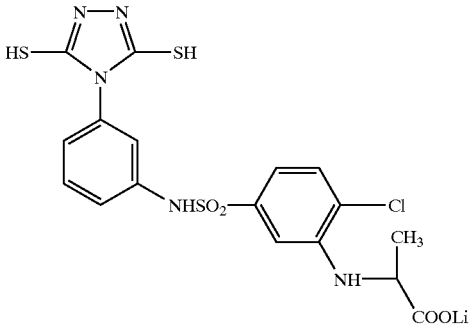
21
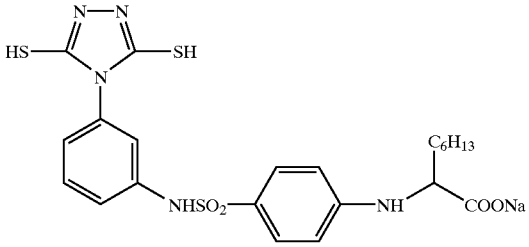
22
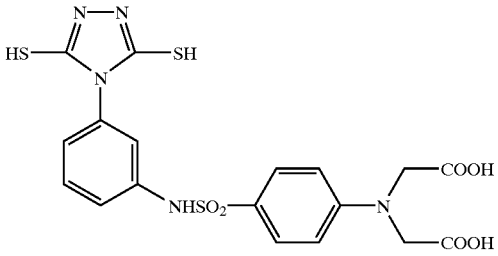
-continued
23
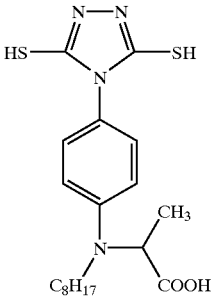
24
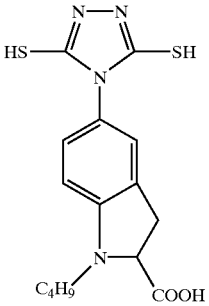
25
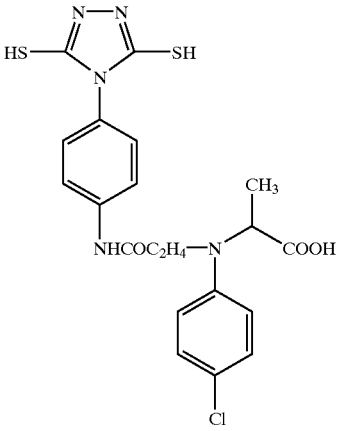
26
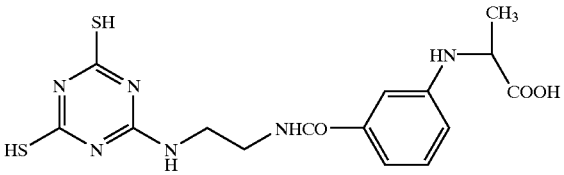
27
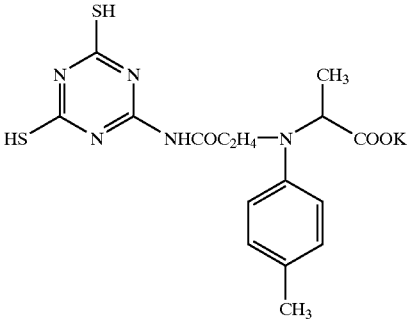

-continued
28
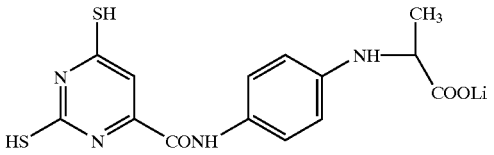
29
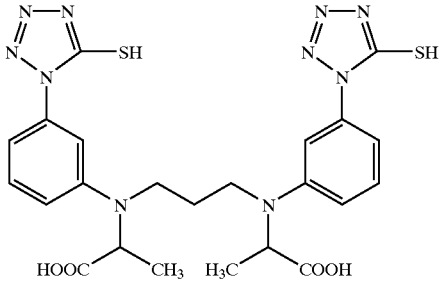
30
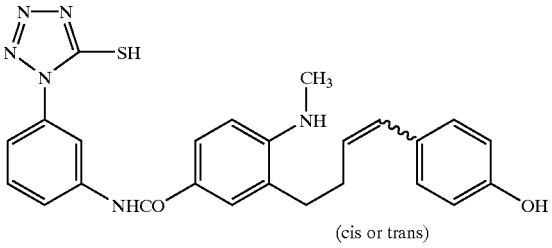
(cis or trans)
31
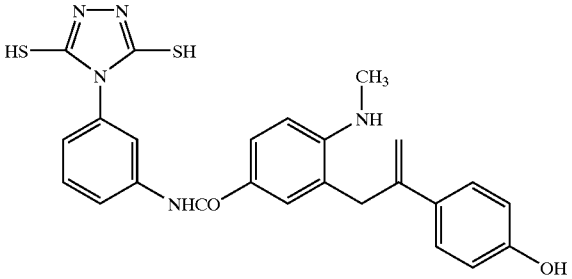
32
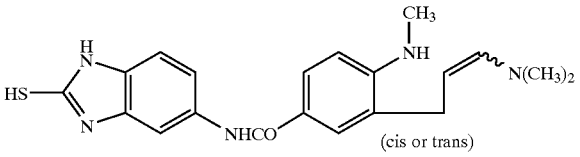
(cis or trans)
33
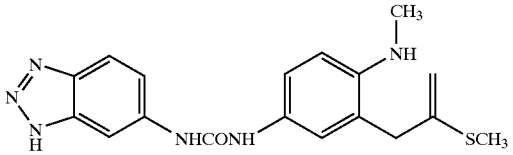
-continued
34
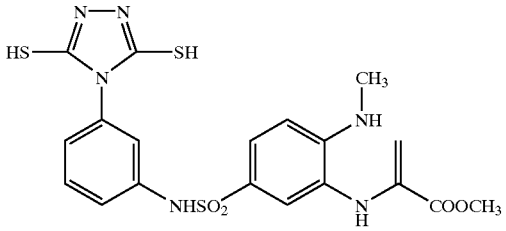
35
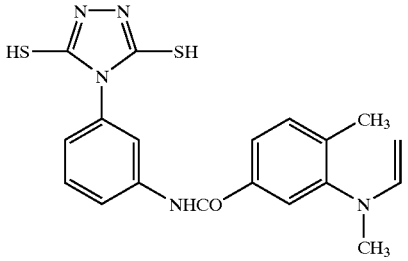
36
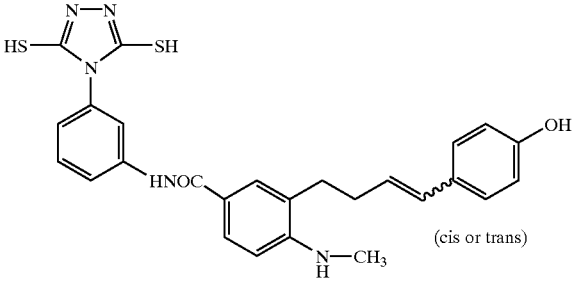
(cis or trans)
37
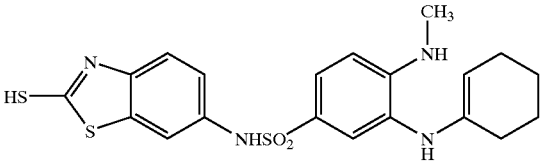
38
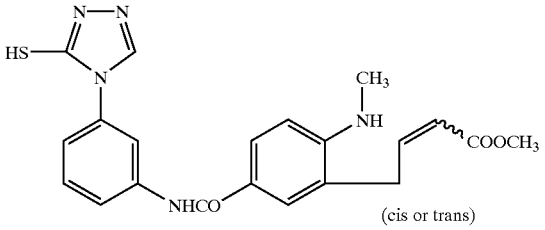
(cis or trans)
39
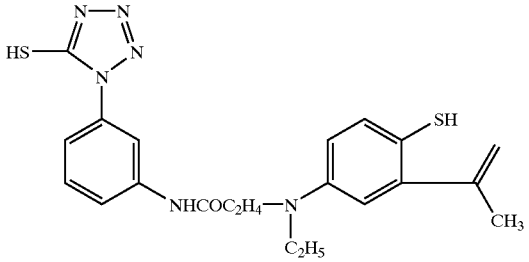

-continued
40
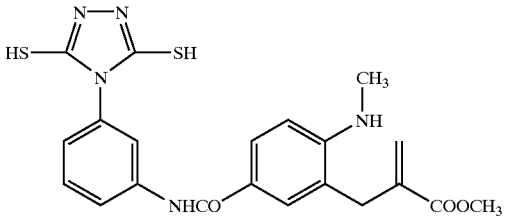
41
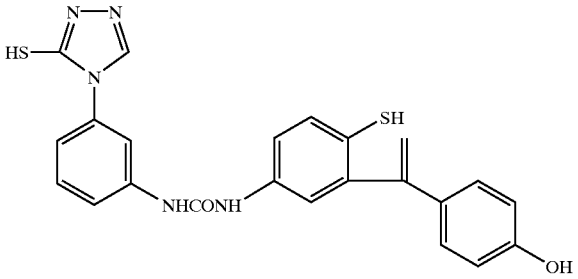
42
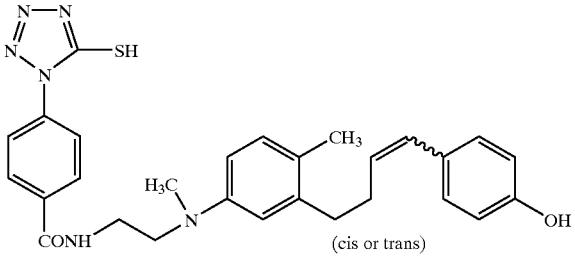
43
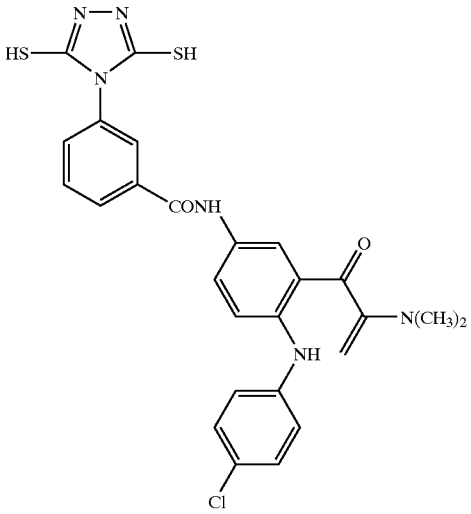
44
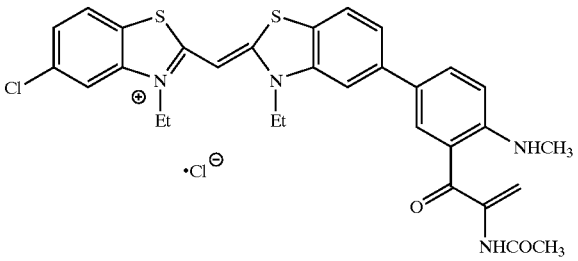
-continued
45
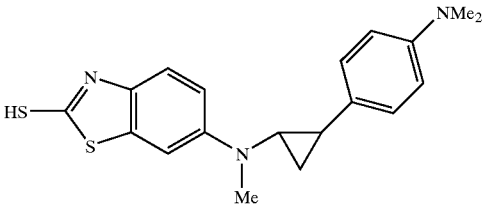
46
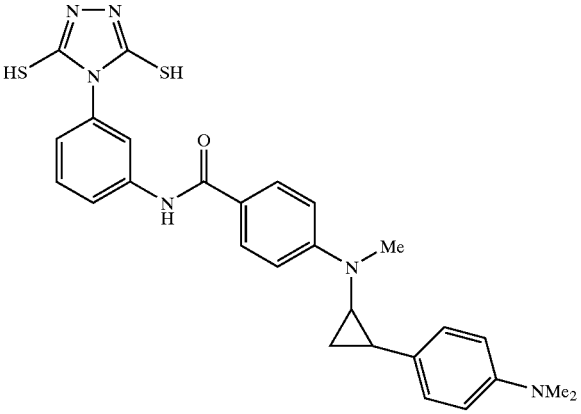
47
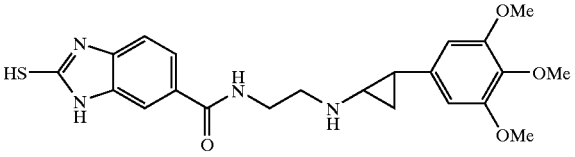
48
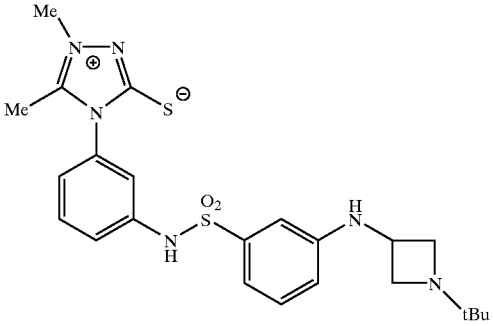
49
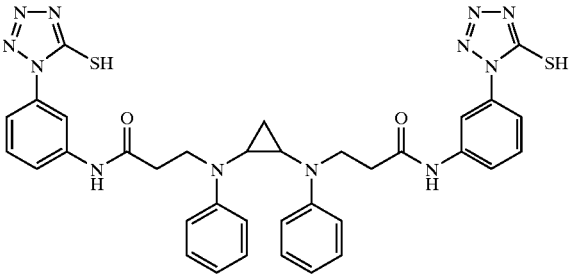

-continued

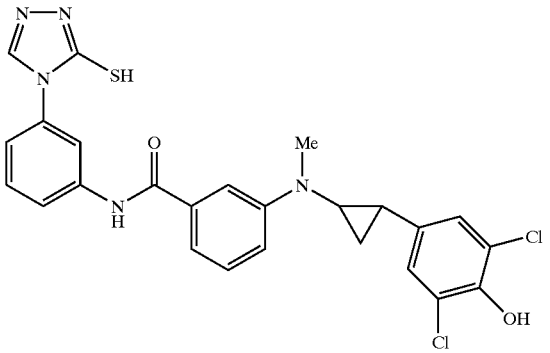

51

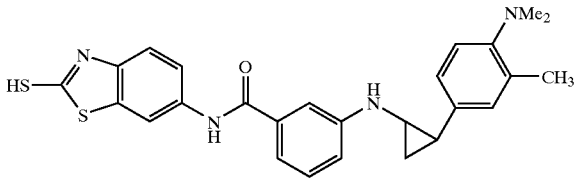

52

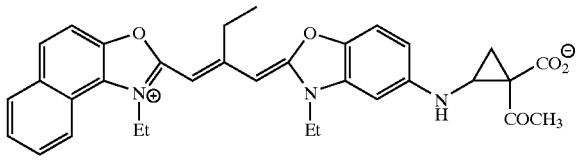

The compounds of types 1 to 4 are the same as those described in detail in Jpn. Pat. Appln. Nos. 2002-192373, 2002-192374, 2002-188537 and 2002-188536, the entire contents of all of which are incorporated herein by reference. The specific compounds described in these patent applications are also examples of the compounds of types 1 to 4 of the present invention.

Next, the compound of type A will now be described.

The compound of type A is represented by X—Y, wherein X represents a reducing group, Y represents a split-off group, and a one-electron oxide product generated by one-electron-oxidation of the reducing group represented by X dissociates Y with a subsequent cleavage reaction of X—Y bonding and generates an X radical, and can release another electron. Reaction when such a compound of type A has been oxidized can be represented by the following formula.

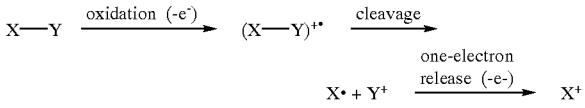

Oxidation potential of a compound of type A is preferably 0 to 1.4 V, more preferably 0.3 to 1.0 V. Further, oxidation potential of radical X. generated in the above reaction formula is preferably −0.7 V to −2.0 V, more preferably −0.9 V to −1.6 V.

A compound of type A is represented, preferably, by the general formula (A).

In the general formula (A), $RED_0$ represents a reducing group, $L_0$ represents a split-off group, and each of $R_0$ and $R_1$ represents a hydrogen atom or substituent. The groups $RED_0$ and $R_0$, and the groups $R_0$ and $R_1$ may bond to each other to form a ring structure.

$RED_0$ represents a group having the same meaning as that of $RED_{12}$ of the general formula (1-2), and its preferable range is also the same as that of $RED_{12}$. $R_0$ and $R_1$ are groups having the same meaning as those of $R_{21}$ and $R_{22}$ of the general formula (2), respectively, and their preferable ranges are the same as those of $R_{21}$ and $R_{22}$, respectively. However, $R_0$ and $R_1$ do not represent a group having the same meaning as that of $L_0$, except a hydrogen atom. $RED_0$ and $R_0$ may bond to each other to form a ring structure. The same examples as those of the ring structure formed by bonding of $RED_2$ and $R_{21}$ of the general formula (2) can be mentioned as examples of such a ring structure, and its preferable range is also the same as that of the ring structure of $RED_2$ and $R_{21}$. Examples of a ring structure formed by bonding of $R_0$ and $R_1$ are a cyclopentane ring and tetrahydrofuran ring.

In the general formula (A), a split-off group represented by $L_0$ is a carboxy group or salt thereof, silyl group, stannyl group, germyl group, tryaryl boron atom anion, —$C(R_0)(R_1)$-$RED_0$ group, or a hydrogen atom. Among them, with respect to carboxy group or salt thereof and silyl group, $L_0$ has the same meaning as that of $L_{11}$ of the general formula (1-1), and their preferable ranges are the same as those of $L_{11}$.

The stannyl group is preferably a trialkylstannyl group, the germyl group is preferably a trialkylgermyl group, and the triaryl boron atom anion is a triphenyl boron atom anion. The phenyl group may have a substituent. When $L_0$ denotes "—$C(R_0)(R_1)$-$RED_0$ group", the compound represented by the general formula (A) is a bis-type compound formed by bonding each of —$C(R_0)(R_1)$-$RED_0$ groups.

In the general formula (A), preferable examples of a split-off group represented by $L_0$ are carboxy group or salt thereof, silyl group, and —$C(R_0)(R_1)$-$RED_0$ group, more preferably carboxy group or salt thereof, and a hydrogen atom.

When $L_0$ represents a hydrogen atom, the compound represented by the general formula (A) preferably has a base moiety in a molecule. By action of the base, after the compound represented by the general formula (A) has been oxidized, a hydrogen atom represented by $L_0$ is deprotonated to provide a radical represented by "$RED_0(R_0)(R_1)C$", and one electron is released therefrom.

The term "base" specifically means a conjugat base of an acid indicating pKa of about 1 to about 10. Examples thereof are nitrogen-containing heterocycles (e.g. pyridines, imidazoles, benzoimidazoles, and thiazoles), anilines, trialkylamines, amino group, carbon acids (e.g. active methylene anion), thioacetic acid anion, carboxylate (—$COO^-$), sulfate (—$SO_3^-$), and amine oxide (>$N^+(O^-)$—). It is preferably a conjugat base of acid indicating pKa of about 1 to about 8, more preferably carboxylate, sulfate, or amine oxide, and especially preferably carboxylate. When these bases have an anion, they may have a counter cation. Examples thereof are the same as the counter ions which form a salt when $L_0$ represents a carboxy group or salt thereof.

The position to which these base parts bond may be any of $RED_0$, $R_0$, $R_1$ of the general formula (A), preferably $R_1$. Preferable examples of $R_1$ group when the base is carboxylate, for example, are —$(CH_2)_3$—$COO^-$, —$(CH_2)_2$—$COO^-$, and —$CH_2$—$COO^-$.

The compound represented by the general formula (A) is preferably "a compound having, in its molecule, an adsorptive group acting on silver halide" or "a compound having, in its molecule, a partial structure of a spectral sensitizing dye", more preferably "compound having, in its molecule, an adsorptive group acting on silver halide".

Examples of an adsorptive group acting on silver halide, of compound represented by the general formula (A) are the same as the adsorptive groups which the compounds of types 1 to 4 of the present invention may have. In addition, selenooxo group(—C═Se—), telluroxo group (—C═Te—), seleno group (—Se—), telluro group (—Te—), or an active methine group can be mentioned as examples. The terms "selenooxo group(—C═Se—)" and "telluroxo group (—C═Te—)" indicate a Se or Te derivative of a compound having a thione group (—C═S—). They may be groups containing a selenoamide group (—C═Se—NH—) or telluramide group (—C═Te—NH—), as explained with respect to a thione group. The terms "seleno group (—Se—)" and "telluro group (—Te—)" also indicate a Se or Te derivative of a compound having a sulfide group (—S—), and examples thereof are Se- or Te-substituted product of a compound having a sulfide group. The term "active methine group" indicates a methine group substituted by two electron-withdrawing groups. The term "electron-withdrawing group" indicates an acyl group, alkoxycarbonyl group, aryloxycarbonyl group, carbamoyl group, alkylsulphonyl group, arylsulphonyl group, sulfamoyl group, trifluoromethyl group, cyano group, nitro group, and imino group. Two electron-withdrawing groups may form a ring structure by bonding to each other.

Examples of an adsorption-promoting group which the compound represented by the general formula (A) has are preferably a mercapto group (or a salt thereof), thione group (—C═S—), a heterocyclic group containing at least one atom selected from nitrogen atom, sulfur atom, selenium atom and tellurium atom, and sulfide group, more preferably a mercapto-substituted nitrogen-containing heterocyclic group, dimercapto-substituted heterocyclic group, or nitrogen-containing heterocyclic group having, as a partial structure of its heterocycle, an —NH— group which can form imino silver (>NAg). These are the same as those explained with respect to preferable range of an adsorptive group which the compounds of types 1 to 4 may have. Although the adsorptive group may be substituted at any position of the general formula (A), it is preferably substituted at $RED_0$ or $R_0$, more preferably at $RED_0$.

The term "partial structure of a spectral sensitizing dye which the compound represented by the general formula (A) may has" is the same as the partial structure of a sensitizing dye which the compounds of types 1 to 4 of the present invention may have.

Specific examples of the compound represented by the general formula (A) will now be described, although the compound is not limited to them.

53

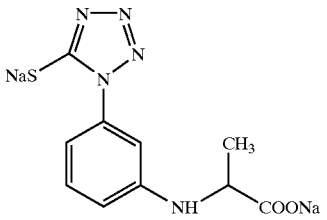

-continued

54

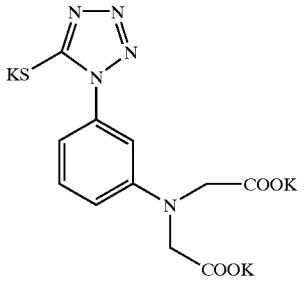

55

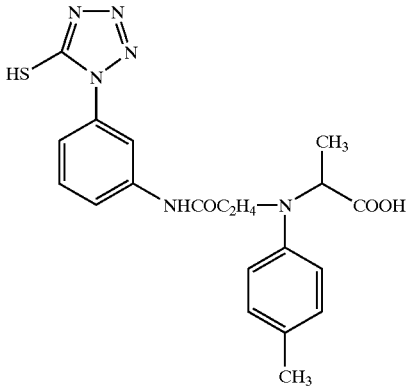

56

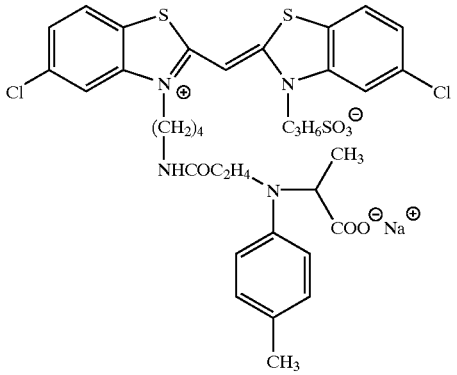

57

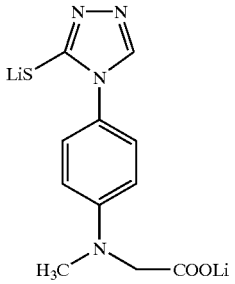

58

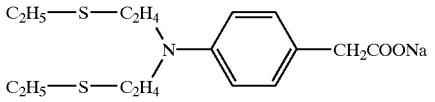

-continued
59
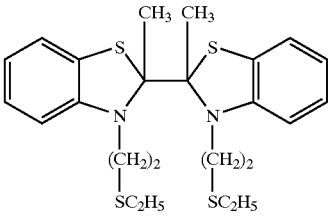
60
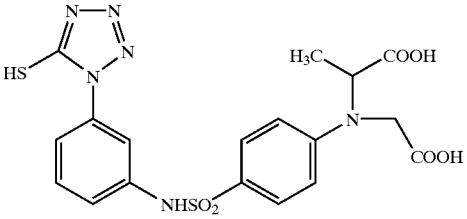
61
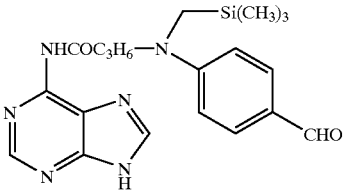
62
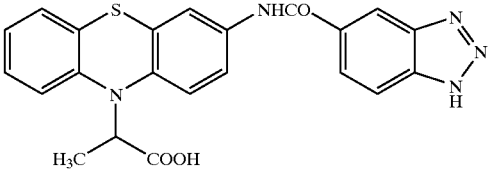
63
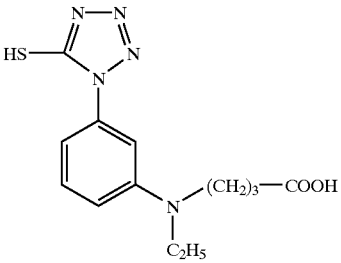
64
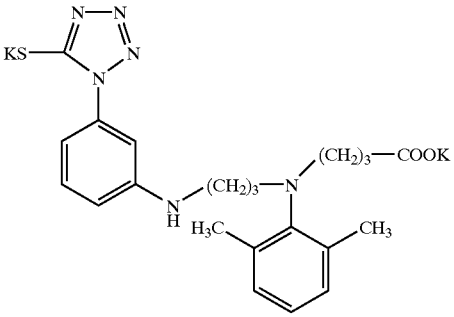
-continued
65
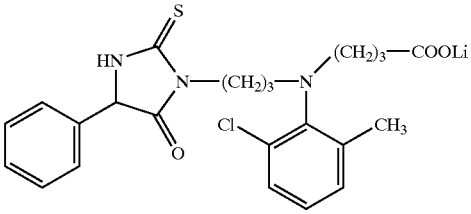
66
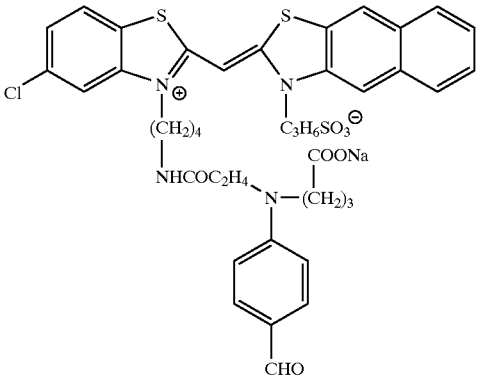
67
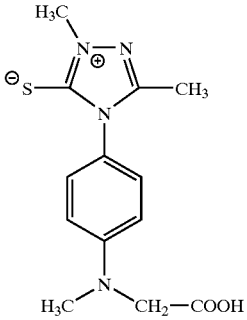
68
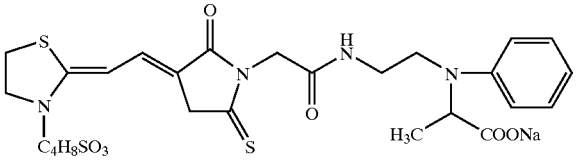
69
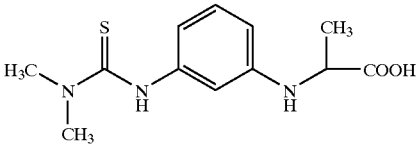
70
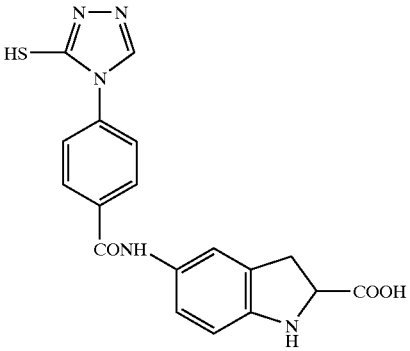

-continued

71

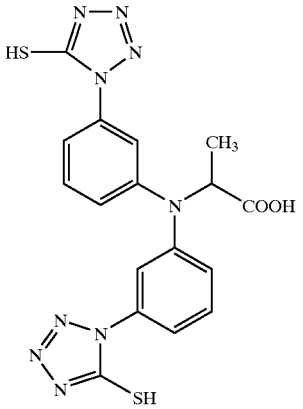

72

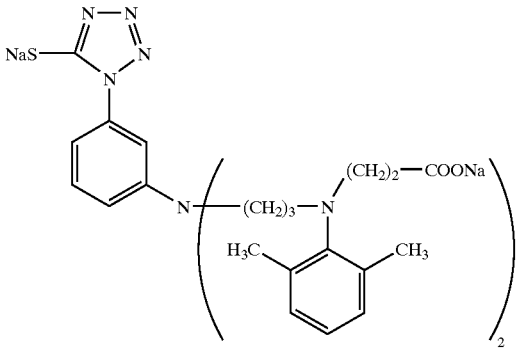

73

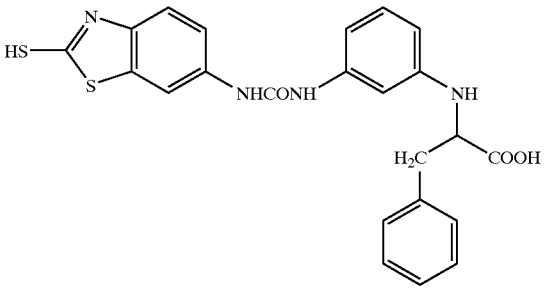

74

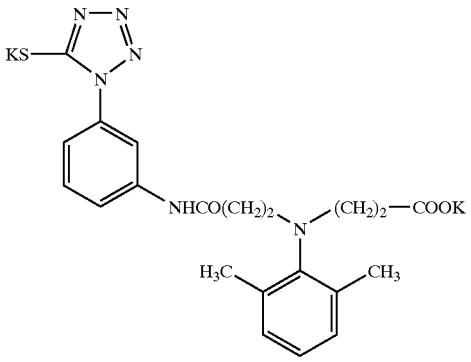

-continued

75

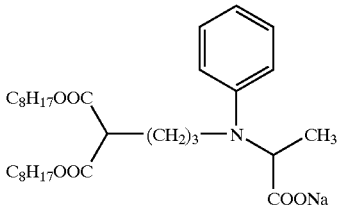

76

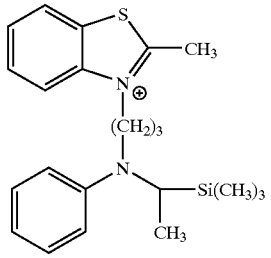

Specific examples of the compound represented by the general formula (A) are the compounds denominated as "one photon two electron sensitizer" or "deprotonating electron-donating sensitizer" such as those described in JP-A-9-211769 (compounds PMT-1 to S-37 described in Tables E and F on pages 28–32), JP-A's-9-211774, 11-95355 (compounds INV 1–36), Jpn. Pat. Appln. KOHYO Publication NO. 2001-500996 (compounds 1–74, 80–87 and 92–122), U.S. Pat. Nos. 5,747,235 and 5,747,236, EP's 786692A1 (compounds INV 1–35), EP 893732A1, U.S. Pat. Nos. 6,054,260 and 5,994,051.

The compound of type A or types 1 to 4 may be used at any time during emulsion preparation or in photosensitive material manufacturing step, for example, during grain formation, at desalting step, at the time of chemical sensitization, or before coating. The compound may be added separately in a plurality of times during the steps. Preferable addition timing is from the completion of grain formation to before a desalting step, at the time of chemical sensitization (immediately before the initiation of chemical sensitization to immediately after the completion thereof), or before coating. More preferable addition timing is at chemical sensitization or before coating.

The compound of type A or types 1 to 4 may preferable be added by dissolving it to a water or water-soluble solvent such as methanol, ethanol or a mixture of solvents. When the compound is added to water, if the solubility of the compound increases in a case where pH is raised or lowered, the compound may be added to the solvent by raising or lowering the pH thereof.

It is preferable that the compound of type A to types 1 to 4 is used in an emulsion layer, but the compound may be added in a protective layer or interlayer together with the emulsion layer, thereby making the compound diffuse during coating. The addition time of the compound of the invention is irrespective of before or after the addition time of a sensitizing dye. Each of the compounds is preferably contained in a silver halide emulsion layer in an amount of $1\times10^{-9}$ to $5\times10^{-2}$ mol, more preferably $1\times10^{-8}$ to $2\times10^{-3}$ mol pre mol of silver halide.

Next, the compound of the present invention (compound (B)) having at least three hetero atoms will be described. Although the term "hetero atom" includes any atoms other than carbon or hydrogen, preferably it is nitrogen, sulfur, phosphorus and oxygen.

If the compound (B) of the present invention is a heterocyclic compound, at least three hetero atoms exist in the heterocycle-constituting moiety, or at least one hetero atom exists in the heterocycle-constituting moiety and at least two hetero atoms exist in a position outside the ring, i.e., the at least two hetero atoms exist in positions separated from the heterocycle by at least one non-conjugated single bonding, or the at least two hetero atoms exist in a part of a further substituent of the heterocycle.

In the present invention, the expression "increase in the photographic speed of the photosensitive material" indicates that $S_{0.2}$ increases by 0.02 or more, preferably 0.03 or more, more preferably 0.04 or more. The term "$S_{0.2}$" indicates a logarithmic value of a reciprocal of an exposure amount which provide a density of fog plus 0.2 in a photosensitive material developed in the development method described in Example 1 of the present specification. The above expression means that this value in the case of containing a compound having at least three hetero atoms is at least 0.02 higher than that in the case of not containing the same.

The compound (B) of the present invention may be used for either of the silver halide lightsensitive layer and non-lightsensitive layer in the photosensitive material, preferably for the silver halide lightsensitive layer.

When the compound (B) is used in the silver halide lightsensitive layer, if the light sensitive layer is formed of separate layers having different speeds, it may be used for any layer. It is preferably used in a high speed layer.

If the compound (B) is used in a non-lightsensitive layer, it is preferably used for an interlayer located between a red-sensitive layer and a green-sensitive layer, or between a green-sensitive layer and a blue-sensitive layer.

The method of adding the compound (B) into the light-sensitive layer is not specifically limited. There are methods such as emulsification dispersion with a high-boiling organic solvent, solid dispersion, a method of dissolving it in an organic solvent of methanol or the like and adding it to a coating solution, and a method of adding it at the time of preparing the silver halide emulsion. It is preferably introduced into the sensitive material by emulsification dispersion.

Although a method of introducing the compound (B) as it is into the sensitive material without any processing is preferable, it is also preferable to introduce, in the sensitive material, a compound which reacts with a oxidized developing agent thereby to release a residue of the compound having at least three hetero atoms. Such a compound is also included in the range of the compound (B).

Although the addition amount of the compound (B) is not specifically limited, it is preferably 0.1 to 1000 mg/m$^2$, more preferably 1 to 500 mg/m$^2$, especially preferably 5 to 100 mg/m$^2$.

If it is used for the lightsensitive silver halide emulsion layer, the addition amount thereof is $1\times10^{-4}$ to $1\times10^{-1}$ mol per mol of silver in the same layer, more preferably $1\times10^{-3}$ to $5\times10^{-2}$ mol of silver in the same layer.

Examples of the compound (B) of the present invention will be set forth below. However, the compound (B) is not limited to these.

HET-1

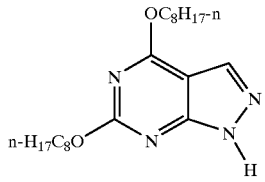

HET-2

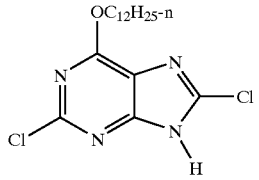

HET-3

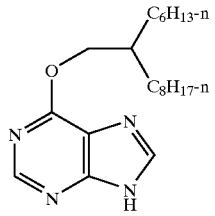

HET-4

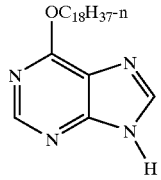

HET-5

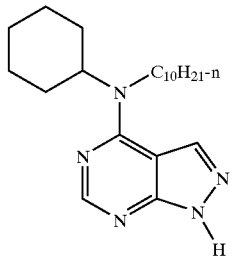

HET-6

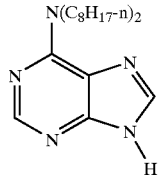

HET-7

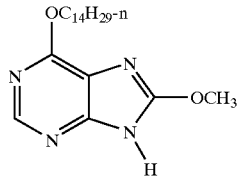

HET-8

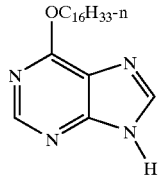

-continued
HET-9
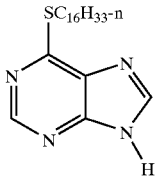
HET-10
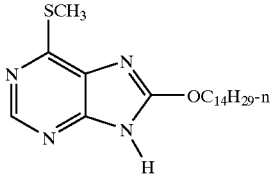
HET-11
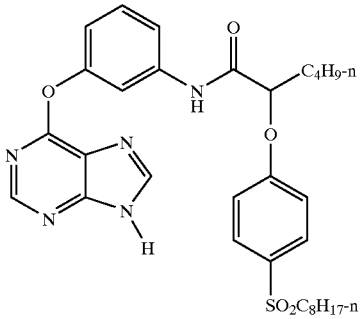
HET-12
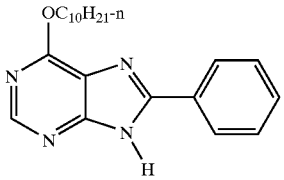
HET-13
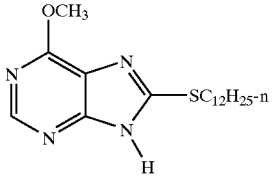
HET-14
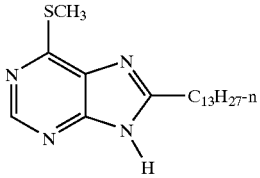
HET-15
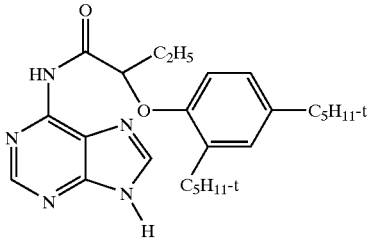
-continued
HET-16
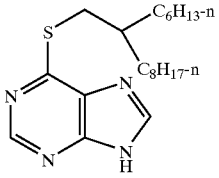
HET-17
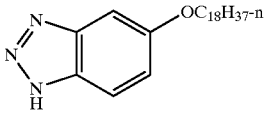
HET-18
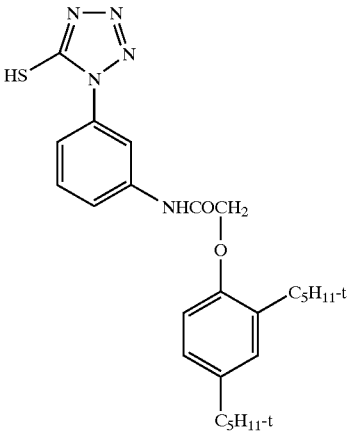
HET-19
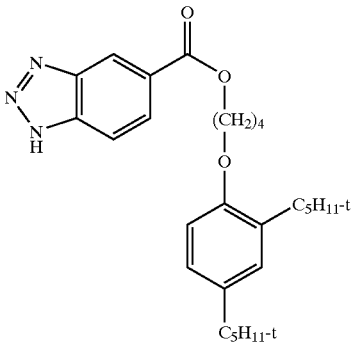
HET-20
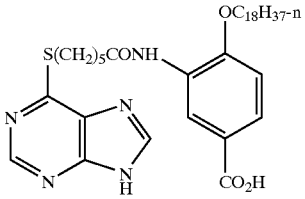
HET-21
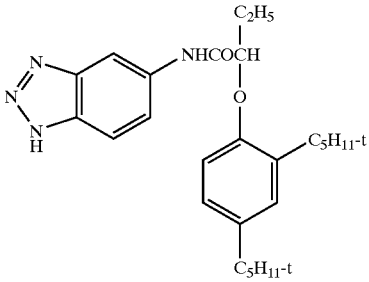

-continued
HET-22
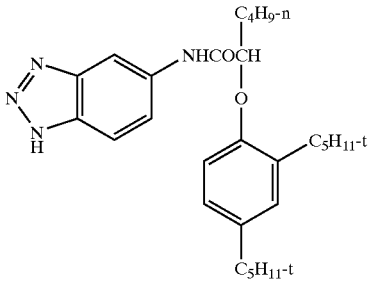
HET-23
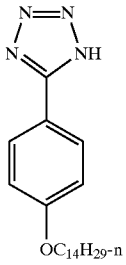
HET-24
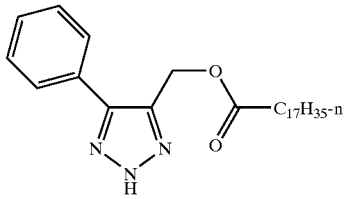
HER-25
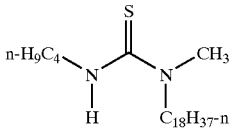
HET-26
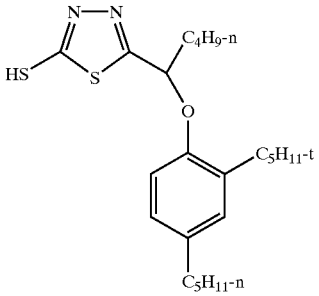
HET-27
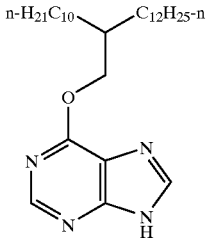
HET-28
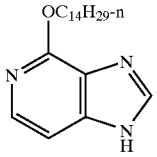
-continued
HET-29
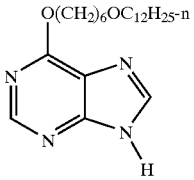
HET-30
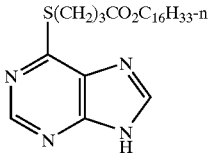
HET-31
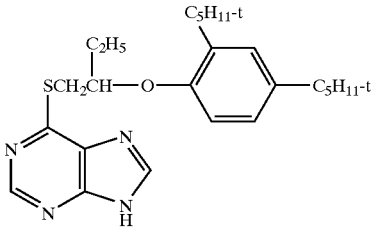
HET-32
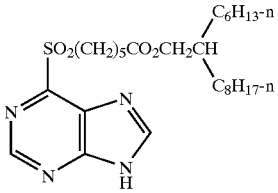
HET-33
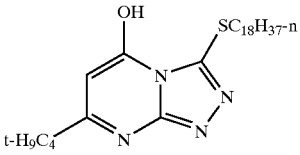
HET-34
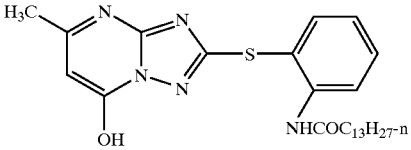
HET-35
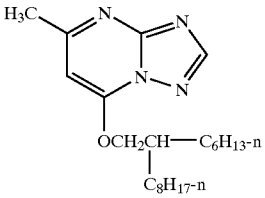
HET-36
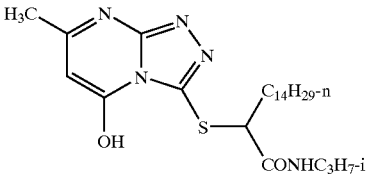

-continued
HET-37
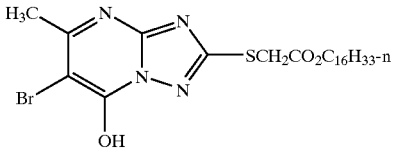
HET-38
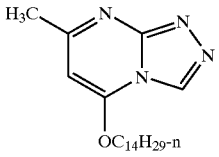
HET-39
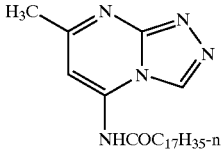
HET-40
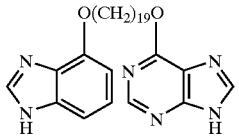
HET-41
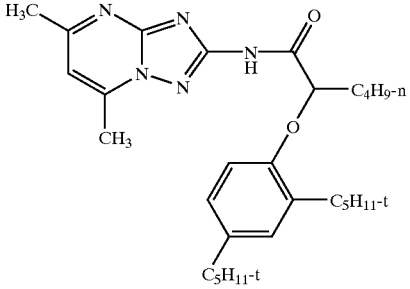
HET-42
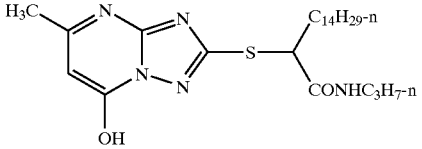
HET-43
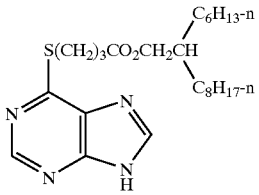
-continued
HET-44
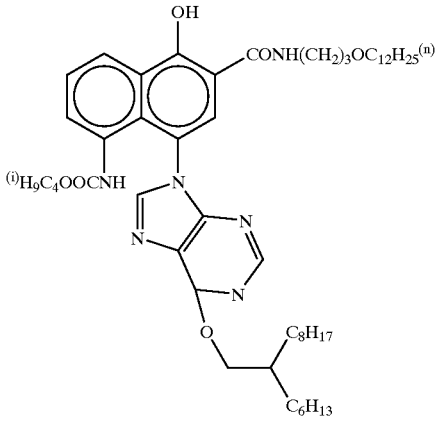
HET-45
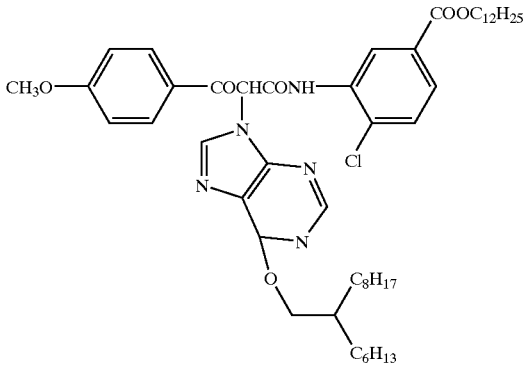
HET-46
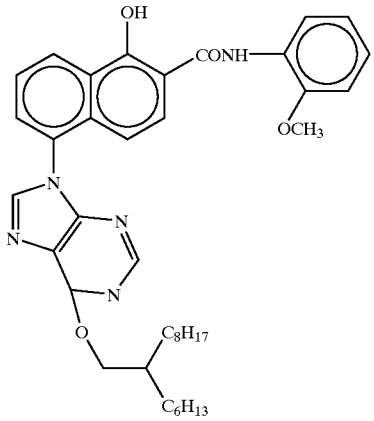
HET-47
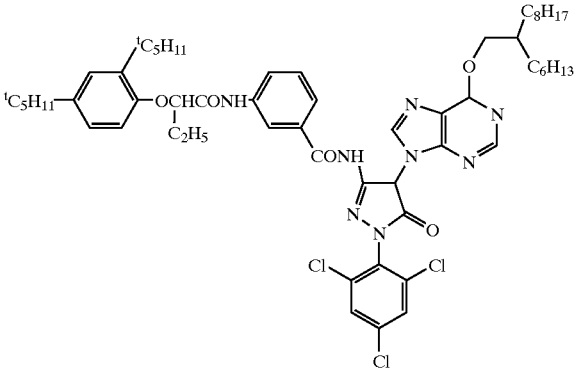

The compounds represented by the general formula (M) or (C) will now be described.

(M)

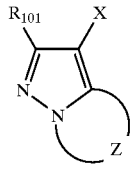

(C)

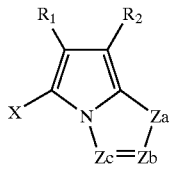

In the general formula (M), $R_{101}$ represents a hydrogen atom or a substituent. Z represents a group of nonmetallic atoms required to form a 5-membered azole ring containing 2 to 4 nitrogen atoms, and the azole ring may have a substituent (including a fused ring, i.e., an aromatic ring such as a benzene ring may be fused to the azole ring). X represents a hydrogen atom, or substituent.

In the general formula (C), Za represents —NH— or —CH($R_3$)—, and each of Zb and Zc represents a —C($R_4$)=, or —N=. Each of $R_1$, $R_2$ and $R_3$ represents an electron-withdrawing group having a Hammett substituent constant σp value of 0.2 to 1.0. $R_4$ represents a hydrogen atom or a substituent. If two $R_4$'s exist in the formula, they may be the same or different. X represents a hydrogen atom or a substituent.

The compounds will now be detailed below. The preferred skeletons among those represented by the formula (M) are 1H-pyrazolo[1,5-b][1,2,4]triazole, and 1H-pyrazolo[5,1-c][1,2,4]triazole, which are represented by the formulae (M-1) and (M-2), respectively.

(M-1)

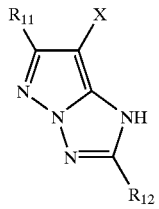

(M-2)

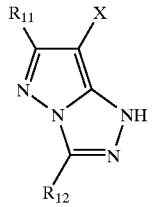

In the formulae, each of $R_{11}$ and $R_{12}$ independently represents a substituent, and X represents a hydrogen atom or substituent.

The substituents $R_{11}$, $R_{12}$ and X in the formula (M-1) or (M-2) will now be described in detail.

Examples of $R_{11}$ are a halogen atom (e.g. a chlorine atom, bromine atom and fluorine atom), alkyl group (1 to 60 carbon atoms, e.g., methyl, ethyl, propyl, iso-butyl, t-butyl, t-octyl, 1-ethylhexyl, nonyl, undecyl, pentadecyl, n-hexadecyl, and 3-decaneamidepropyl), alkenyl group (2 to 60 carbon atoms, e.g., vinyl, allyl, oleyl), cycloalkyl group (5 to 60 carbon atoms, e.g., cyclopentyl, cyclohexyl, 4-t-butylcyclohexyl, 1-indanyl, and cyclododecyl), aryl group (6 to 60 carbon atoms, e.g., phenyl, p-tolyl, and naphthyl), acylamino group (2 to 60 carbon atoms, e.g., acetylamino, n-butanamide, octanoylamino, 2-hexyldecanamide, 2-(2',4'-di-t-amylphenoxy)butanamide, benzoylamino, and nicotineamide), sulfonamide, group (1 to 60 carbon atoms, e.g., methanesulfonamide, octanesulfonamide, and benzenesulfonamide), ureido group (2 to 60 carbon atoms, e.g., decylaminocarbonylamino, and di-n-octylaminocarbonylamino), urethane group (2 to 60 carbon atoms, e.g., dodecyloxycarbonylamino, phenoxycarbonylamino, and 2-ethylhexyloxycarbonylamino), alkoxy group (1 to 60 carbon atoms, e.g., methoxy, ethoxy, butoxy, n-octyloxy, hexadecyloxy, and methoxyethoxy), aryloxy group (6 to 60 carbon atoms, e.g., phenoxy, 2,4-di-t-amylphenoxy, 4-t-octylphenoxy, and naphthoxy), alkylthio group (1 to 60 carbon atoms, e.g., methylthio, ethylthio, butylthio, and hexadecylthio), arylthio group (6 to 60 carbon atoms, e.g., phenylthio, and 4-dodecyloxyphenylthio), acyl group (1 to 60 carbon atoms, e.g., acetyl, benzoyl, butanoyl, and dodecanoyl), sulfonyl group (1 to 60 carbon atoms, e.g., methanesulfonyl, butanesulfonyl, and toluenesulfonyl), cyano group, carbamoyl group (1 to 60 carbon atoms, e.g., N,N-dicyclohexylcarbamoyl), sulfamoyl group (0 to 60 carbon atoms, e.g., N,N-dimethylsulfamoyl), hydroxy group, sulfo group, carboxyl group, nitro group, alkylamino group (1 to 60 carbon atoms, e.g., methylamino, diethylamino, octylamino, and octadecylamino), arylamino group (6 to 60 carbon atoms, e.g., phenylamino, naphthylamino, and N-methyl-N-phenylamino), heterocyclic group (0 to 60 carbon atoms, e.g., preferably 3- to 8-membered, and more preferably, 5- to 6-membered heterocyclic group including a hetero atom, which forms a ring, selected from the group consisting of a nitrogen atom, oxygen atom, and sulfur atom, and more preferably, including a carbon atom as the ring-forming atoms in addition to the hetero atoms, e.g., a group indicated as an example of term X described later), and acyloxy group (1 to 60 carbon atoms, e.g., formyloxy, acetyloxy, myristoyloxy, and benzoyloxy).

Among the above groups, alkyl group, cycloalkyl group, aryl group, acylamino group, ureido group, urethane group, alkoxy group, aryloxy group, alkylthio group, arylthio group, acyl group, sulfonyl group, cyano group, carbamoyl group, and sulfamoyl group include groups each having a substituent. Examples of the substituent are an alkyl group, cycloalkyl group, aryl group, acylamino group, ureido group, urethane group, alkoxy group, aryloxy group, alkylthio group, arylthio group, acyl group, sulfonyl group, cyano group, carbamoyl group, and sulfamoyl group.

Among these substituents, $R_{11}$ is preferably an alkyl group, aryl group, alkoxy group, and aryloxy group, more preferably an alkyl group, alkoxy group, and aryloxy group, and especially preferably a branched alkyl group.

Examples of $R_{12}$ are the same as the substituents mentioned as examples of $R_{11}$. Preferable substituents of $R_{12}$ are an alkyl group, aryl group, heterocyclic group, alkoxy group, and aryloxy group.

More preferably $R_{12}$ is a substituted alkyl group, and substituted aryl group, and most preferably a substituted aryl group. Compounds represented by general formulae (M-3) and (M-4) are preferable.

(M-3)

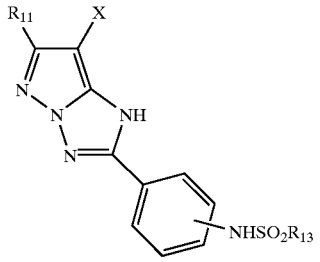

(M-4)

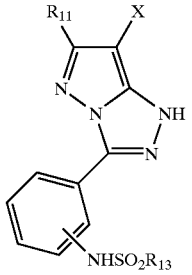

In the formulae, $R_{11}$ and X have the same meanings as those in the general formulae (M-1) and (M-2), and $R_{13}$ represents a substituent. Substituents which $R_{13}$ represents are the same as the substituents mentioned as $R_{11}$ above. Preferable substituents of $R_{13}$ are a substituted aryl group, and a substituted or unsubstituted alkyl group. As the substituent in this case, the substituents enumerated above as examples of $R_{11}$ are preferable.

X denotes a hydrogen atom or a substituent. Examples of the substituent are those mentioned as $R_{11}$ above. Substituents of X are preferably an alkyl group, alkoxycarbonyl group, carbamoyl group, or a group which leaves by reaction with an oxidized developing agent. Examples of the split-off group are a halogen atom (e.g., fluorine, chlorine, and bromine), alkoxy group (e.g., ethoxy, methoxycarbonylmethoxy, carboxypropyloxy, methanesulfonylethoxy, and perfluoropropoxy), aryloxy group (e.g., 4-carboxyphenoxy, 4-(4-hydroxyphenylsulfonyl)phenoxy, 4-methanesulfonyl-3-carboxyphenoxy, and 2-methanesulfonyl-4-acetylsulfamoylphenoxy), acyloxy group (e.g., acetoxy, and benzoiloxy), sulfonyloxy group (e.g., methanesulfonyloxy, and benzenesulfonyloxy), acylamino group (e.g., heptafluorobutylylamino), sulfonamide group (e.g., methanesulfonamide), alkoxycarbonyloxy group (e.g., ethoxycarbonyloxy), carbamoyloxy group (e.g., diethylcarbamoyloxy, piperidinocarbonyloxy, and morpholinocarbonyloxy), alkylthio group (e.g., 2-carboxyethylthio), arylthio group (e.g., 2-octyloxy-5-t-octylphenylthio, and 2-(2,4-di-t-amylphenoxy) butylylaminophenylthio), heterocyclic thio group (e.g., 1-phenyltetrazolylthio, and 2-benzimidazolylthio), heterocyclic oxy group (e.g., 2-pyridyloxy, and 5-nitro-2-pyridyloxy), 5 or 6-membered nitrogen-containing heterocyclic group (e.g., 1-triazolyl, 1-imidazolyl, 1-pyrazolyl, 5-chloro-1-tetrazolyl, 1-benzotriazolyl, 2-phenylcarbamoyl-1-imidazolyl, 5,5-dimethylhydantoin-3-yl, 1-benzylhydantoin-3-yl, 5,5-dimethyloxazolydine-2,4-dione-3-yl, and purine), and azo group (e.g., 4-methoxyphenylazo, and 4-pivaloylaminophenylazo).

Substituents of X are preferably an alkyl group, alkoxycarbonyl group, carbamoyl group, halogen atom, alkoxy group, aryloxy group, alkyl- or aryl-thio group, and a 5- or 6-membered nitrogen-containing heterocyclic group which bonds to a coupling active position with a nitrogen atom, especially preferably an alkyl group, carbamoyl group, halogen atom, substituted aryloxy group, substituted arylthio group, alkylthio group or 1-pyrazolyl group.

Each of the compounds represented by the general formulae (M-1) and (M-2), preferably used for the present invention, may form a polymer which is greater than or equal to a dimer through $R_{11}$ and $R_{12}$, or may bond to a macromolecular chain. Preferable compound in the present invention is the compound of the general formula (M-1), more preferably compound of the general formula (M-3).

Next, the general formula (C) will now be explained. The compound of the general formula (C) of the present invention is specifically represented by the following general formulae (C3) to (C10).

(C3)

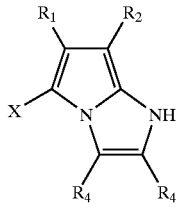

(C4)

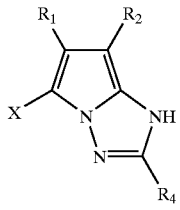

(C5)

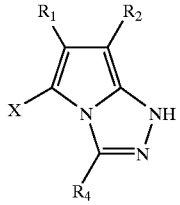

(C6)

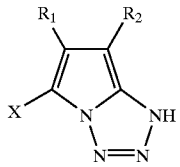

(C7)

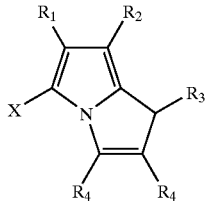

-continued (C8)

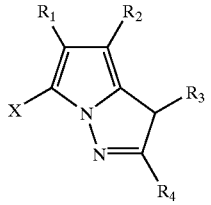

(C9)

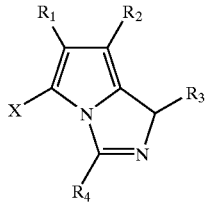

(C10)

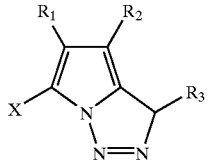

In the formulae, $R_1$ to $R_4$ and X have the same meanings as those in the general formula (C).

In the present invention, preferable compounds are the compounds represented by the general formulae (C3), (C4), (C5) and (C8), and especially preferable compound is that represented by the formula (C4).

In formula (C), the substituent represented by $R_1$, $R_2$ and $R_3$ is an electron-withdrawing group having a Hammett constant σp value of 0.20 to 1.0, preferably an electron-withdrawing group having a σp value of 0.20 to 0.8. Hammett's rule is an empirical rule proposed by L. P. Hammett in 1935 in order to quantitatively argue the effects of substituents on reaction or equilibrium of benzene derivatives. The rule is widely regarded as appropriate these days. The substituent constants obtained by the Hammett rule include a σp value and a σm value, and these values are described in a large amount of general literature. For example, the values are described in detail in J. A. Dean ed., "Lange's Handbook of Chemistry," the 12th edition, 1979 (McGraw-Hill), "The Extra Number of The Domain of Chemistry (KAGAKUNO RYOIKI ZOUKAN)," Vol. 122, pages 96 to 103, 1979 (Nanko Do) and Chemical Reviews, Vol. 91, pp. 165–195 (1991).

In the present invention, $R_1$, $R_2$, and $R_3$ are defined by the Hammett constant σp value. However, this does not mean that $R_1$, $R_2$, and $R_3$ are limited to substituents having the known values stated in the above literature. That is, the present invention includes, of course, substituents having values that fall within the above range when measured on the basis of Hammett's rule even if they are unknown in literature.

Examples of $R_1$, $R_2$, and $R_3$, as the electron-withdrawing group having a σp value of 0.2 to 1.0, are an acyl group, alkoxycarbonyl group, aryloxycarbonyl group, carbamoyl group, cyano group, nitro group, dialkylphosphono group, diarylphosphono group, diarylphosphinyl group, alkylsulfinyl group, arylsulfinyl group, alkylsulfonyl group, arylsulfonyl group, etc. Of these substituents, those capable of further having substituents can further have substituents to be enumerated later for $R_4$.

$R_1$, $R_2$, and $R_3$ preferably represent an acyl group, alkoxycarbonyl group, aryloxycarbonyl group, carbamoyl group, cyano group, and sulfonyl group, and more preferably, an cyano group, acyl group, alkoxycarbonyl group, aryloxycarbonyl group, and carbamoyl group.

A preferable example of the combination of $R_1$ and $R_2$, is one wherein $R_1$ represents a cyano group and $R_2$ represents an alkoxycarbonyl group.

$R_4$ represents a hydrogen atom or substituent. Examples of the substituent are those enumerated above for $R_{11}$.

Preferable examples of the substituents represented by $R_4$ are an alkyl group, aryl group, heterocyclic group, alkoxy group, aryloxy group, and acylamino group. An alkyl group and substituted aryl group are more preferable, and a substituted aryl group is most preferable. Examples of the substituent in this case are those enumerated above as $R_4$.

X has the same meaning as that defined in formula (M).

The following are examples of a coupler preferably used in the present invention. However, the present invention is not limited to these examples.

(1)

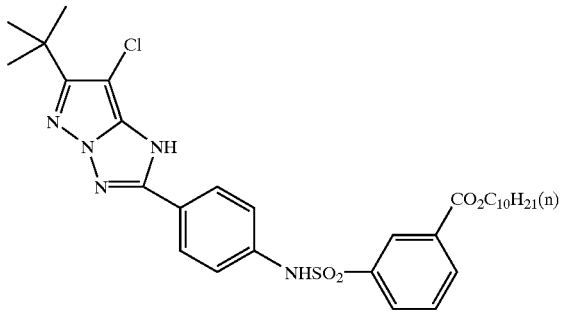

(2)

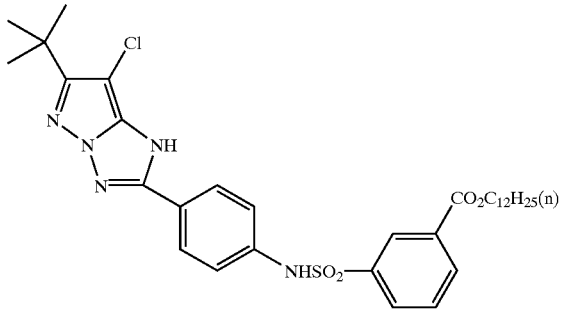

(3)

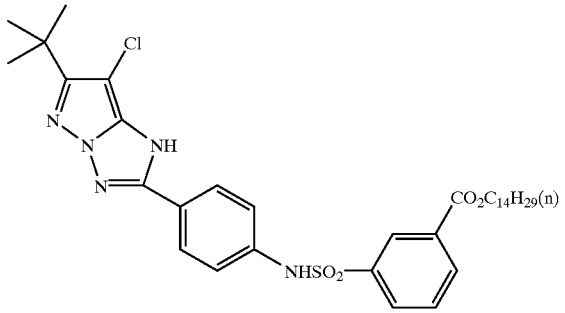

-continued
(4)
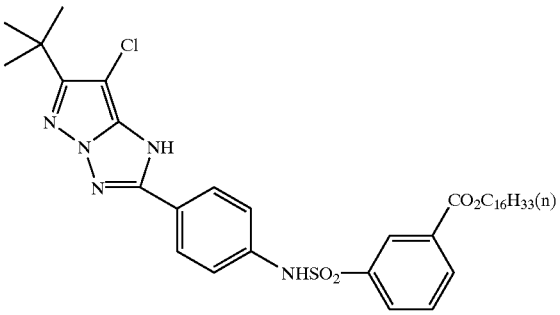
(5)
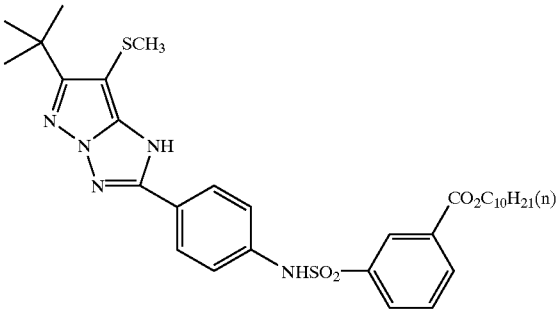
(6)
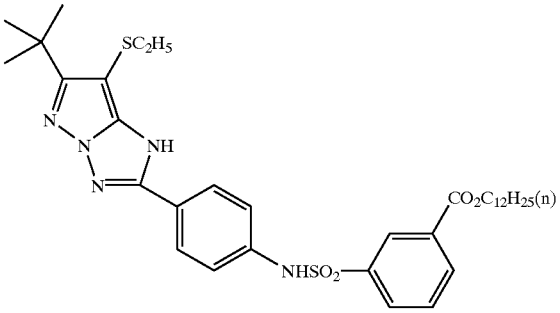
(7)
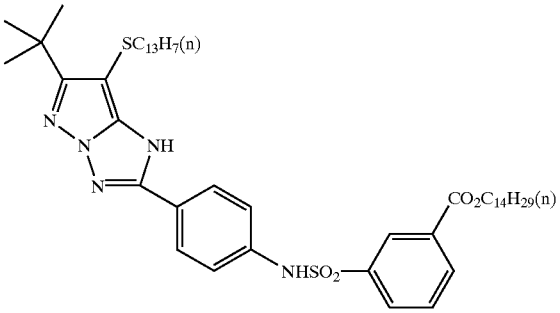
-continued
(8)
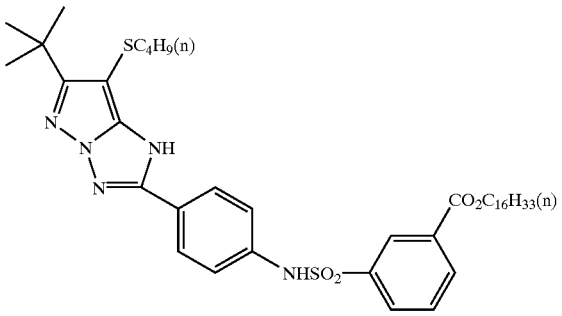
(9)
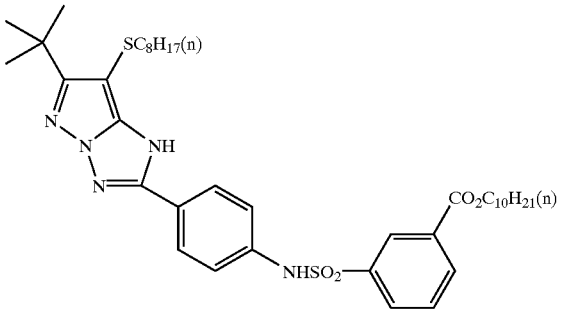
(10)
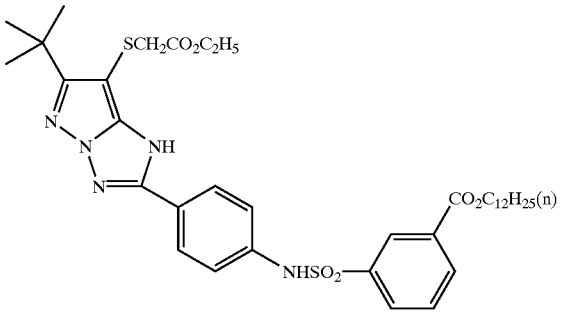
(11)
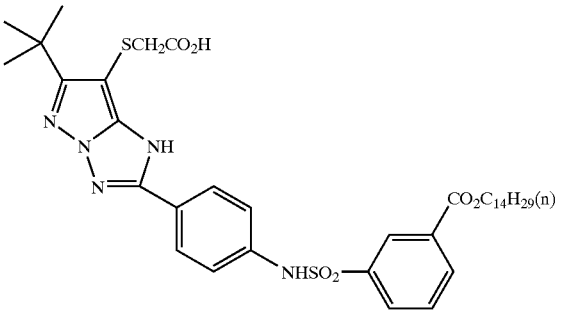

-continued
(12)
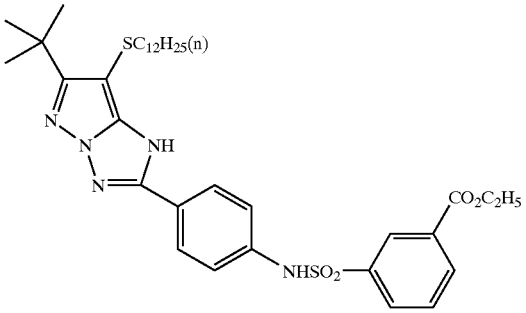
(13)
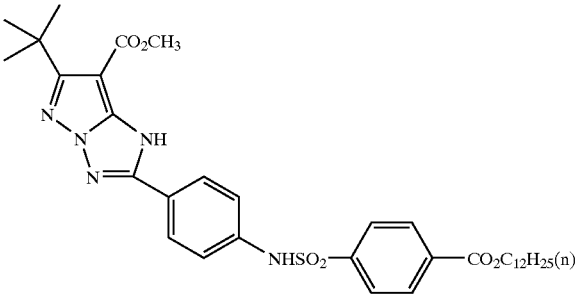
(14)
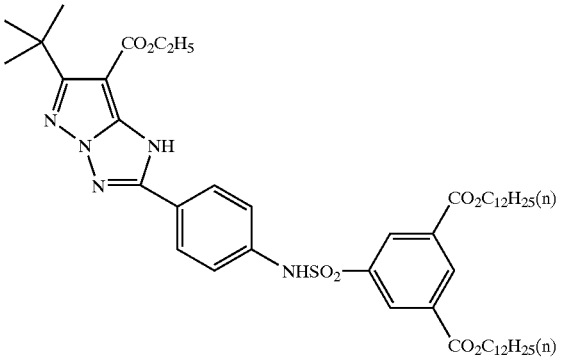
(15)
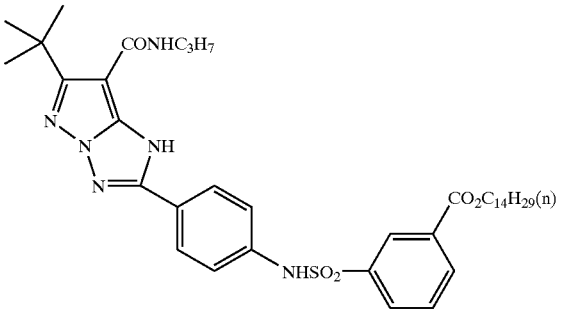
-continued
(16)
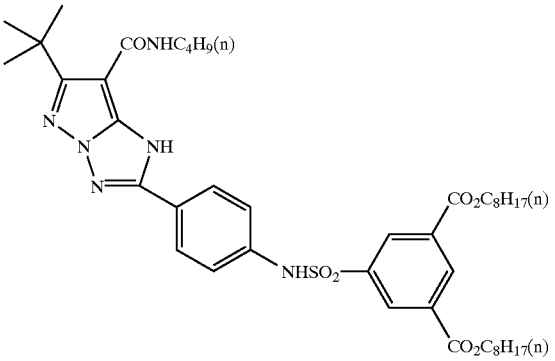
(17)
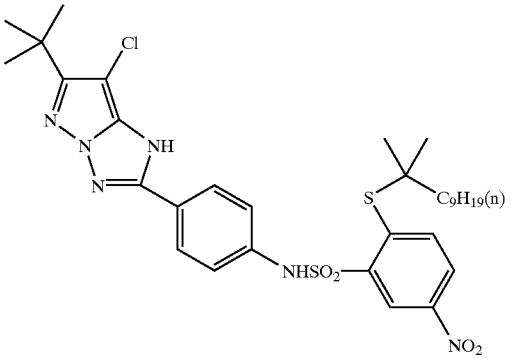
(18)
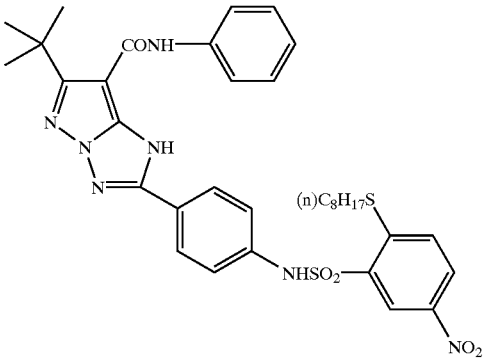
(19)
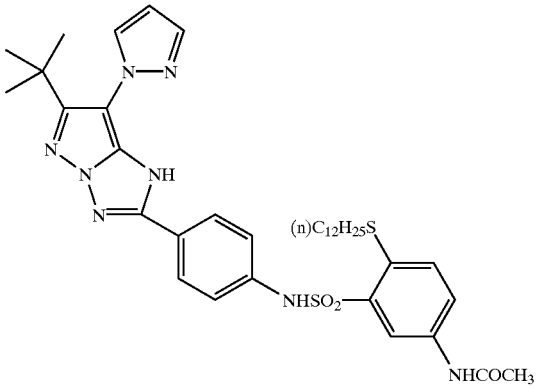

-continued
(20)
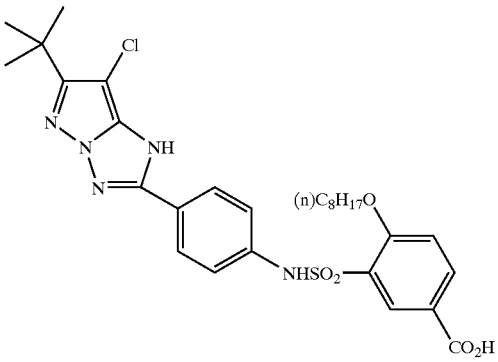
(21)
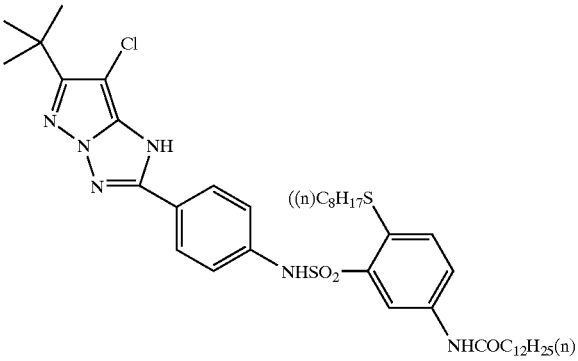
(22)
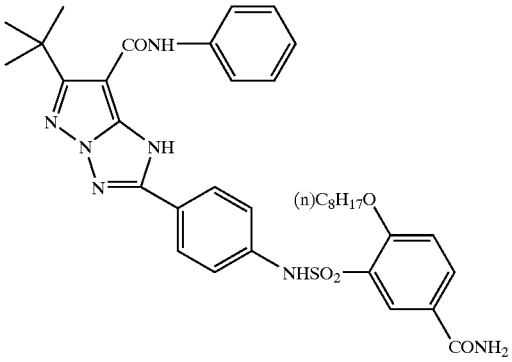
(23)
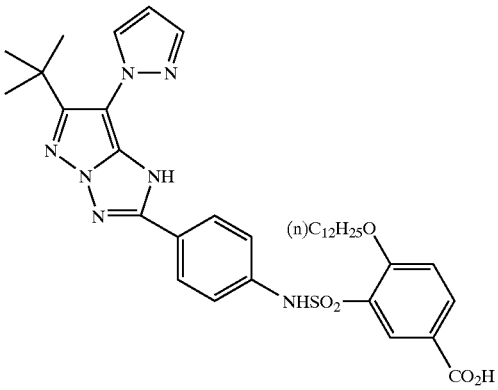
-continued
(24)
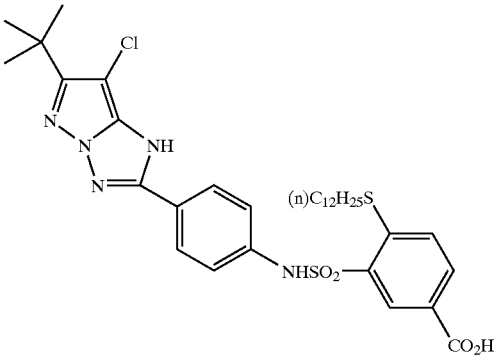
(25)
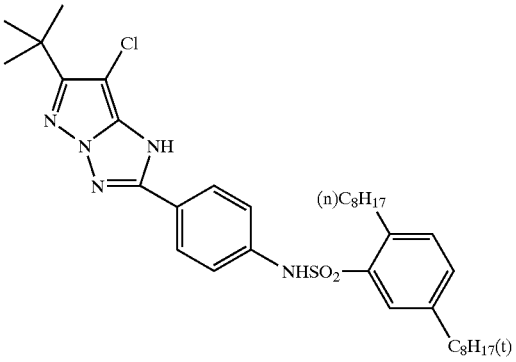
(26)
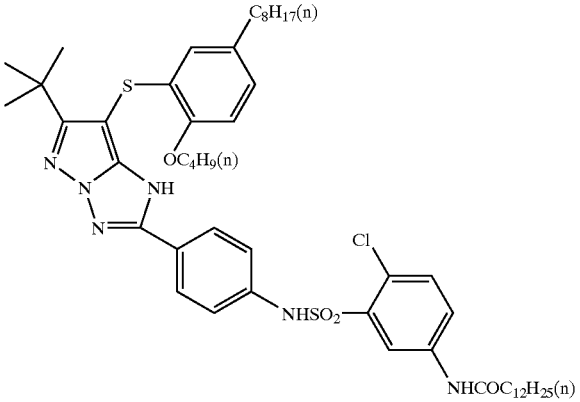
(27)
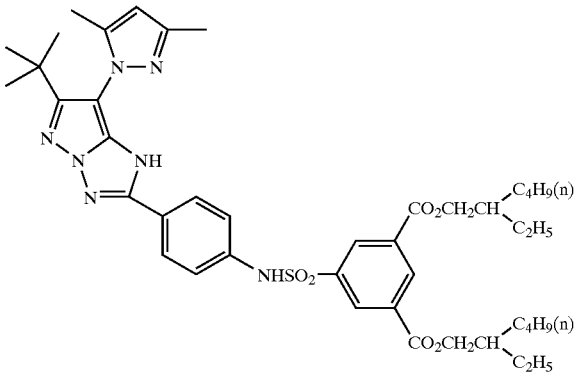

-continued
(28)
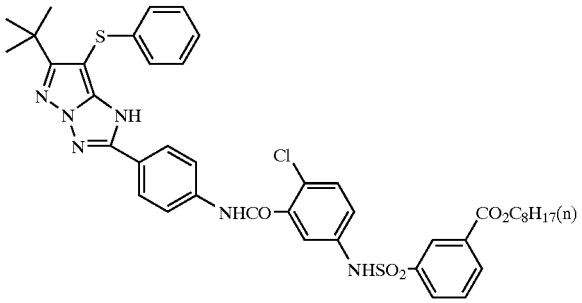
(29)
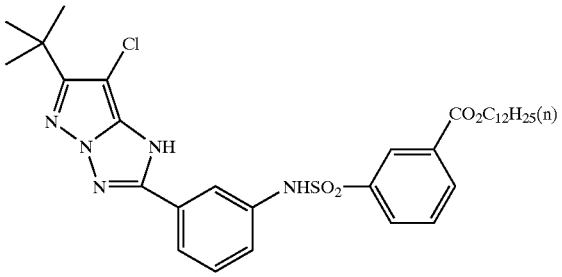
(30)
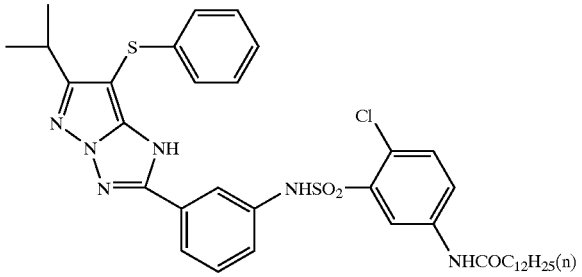
(31)
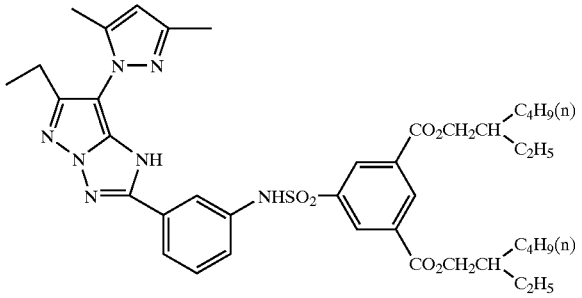
(32)
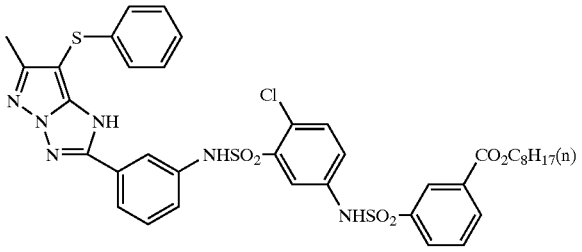
-continued
(33)
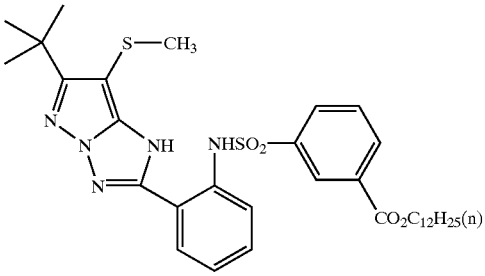
(34)
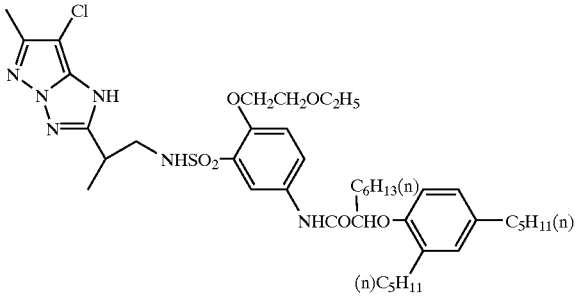
(35)
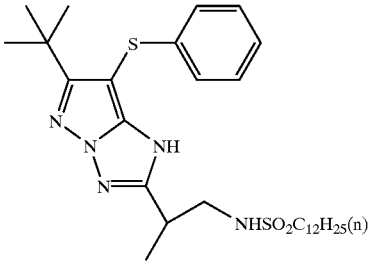
(36)
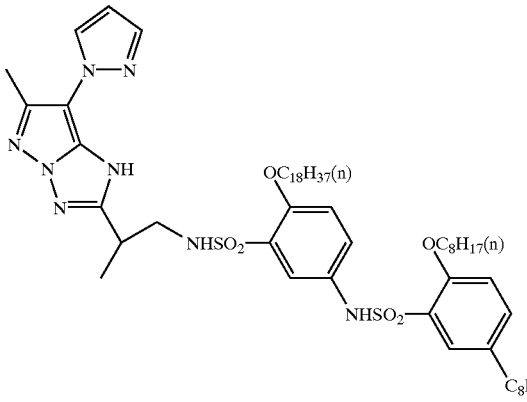
(37)
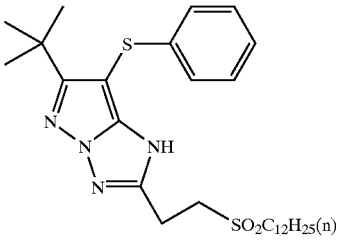

-continued
(38)
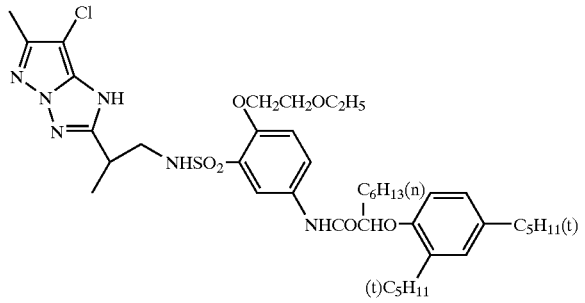
(39)
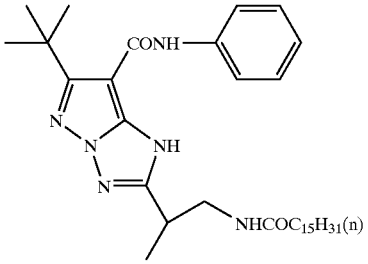
(40)
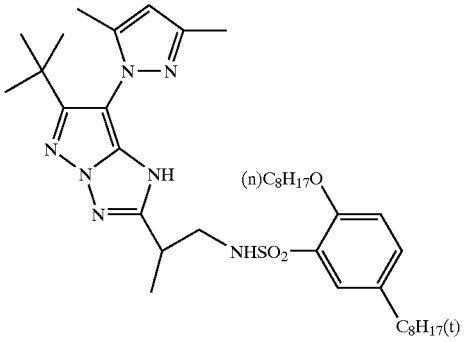
(41)
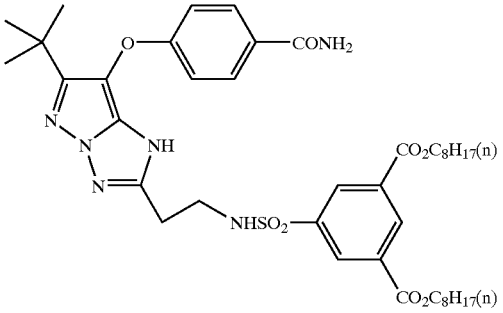
(42)
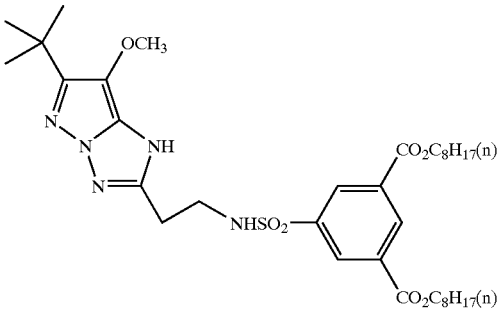
-continued
(43)
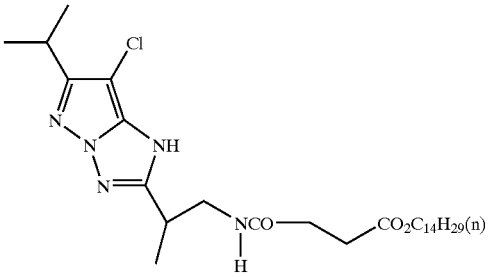
(44)
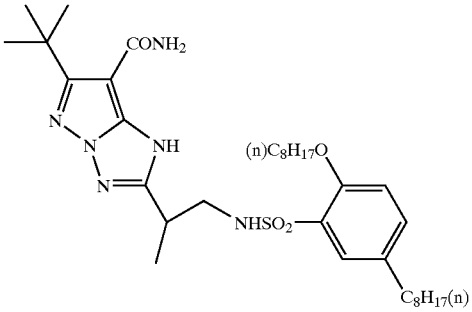
(45)
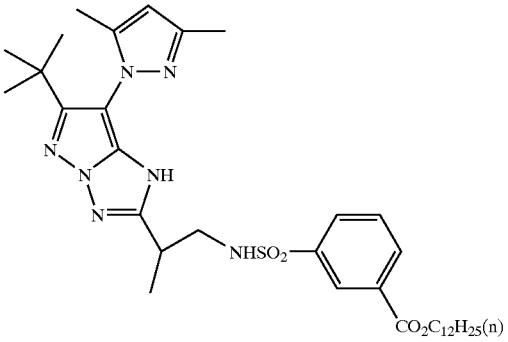
(46)
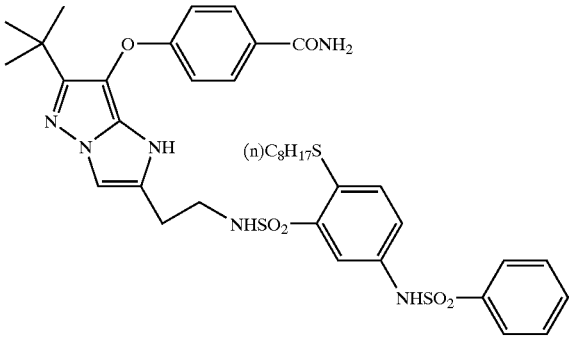
(47)
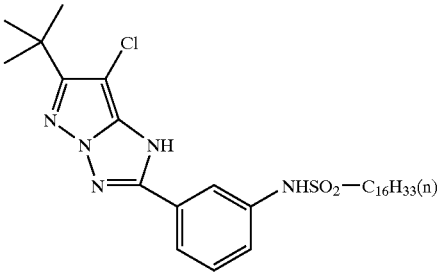

-continued
(48)
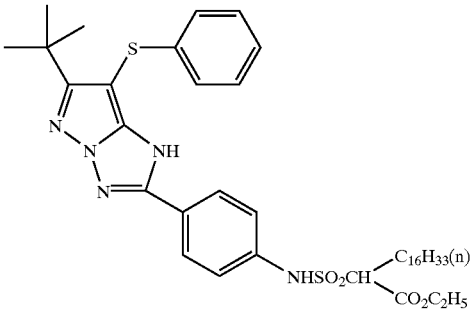
(49)
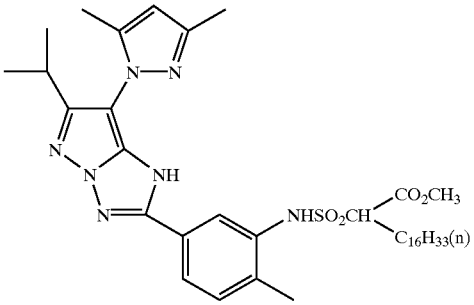
(50)
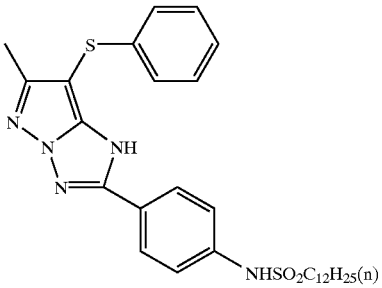
(51)
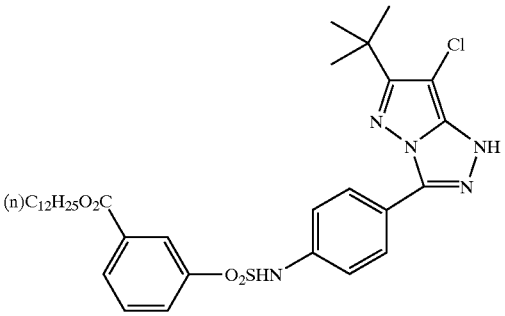
(52)
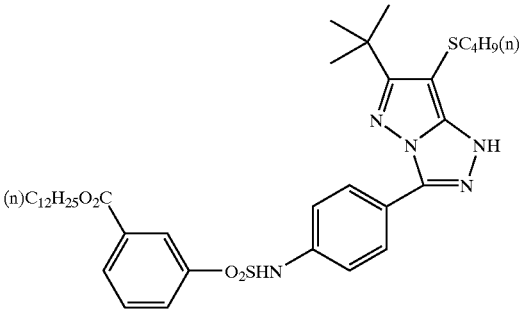
-continued
(53)
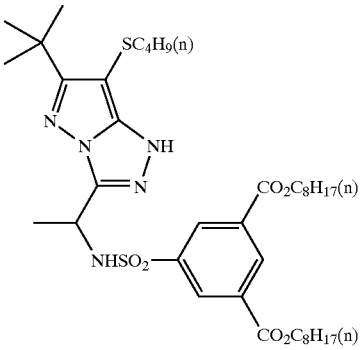
(54)
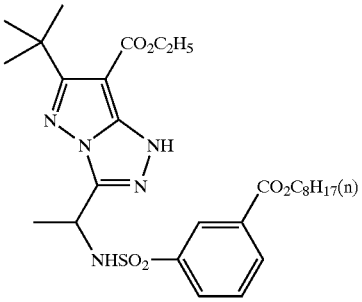
(55)
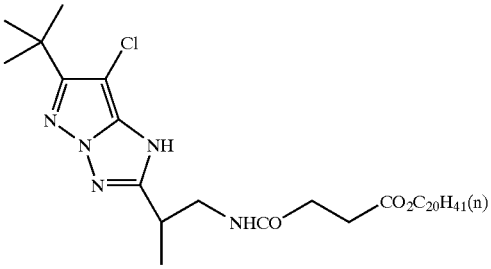
(56)
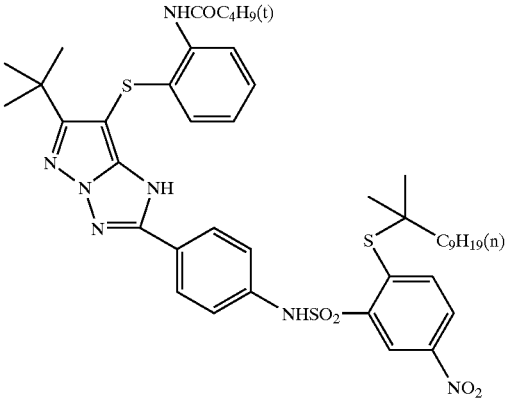

-continued
(57)
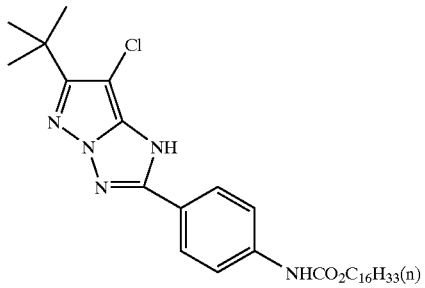
(58)
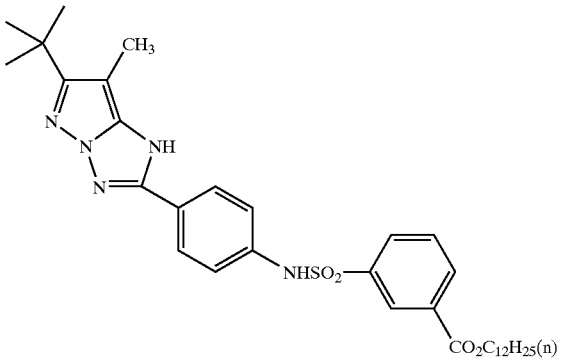
(59)
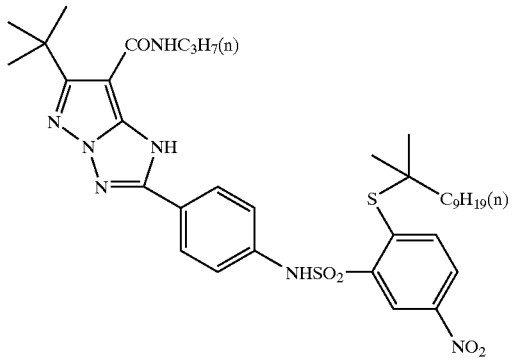
(60)
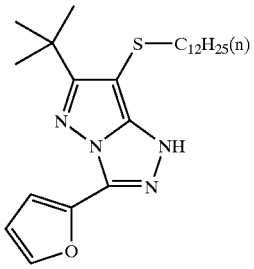
-continued
(61)
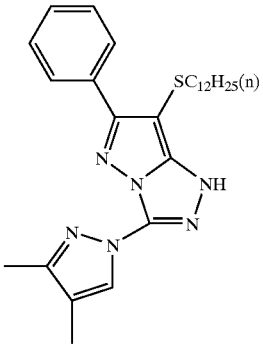
(62)
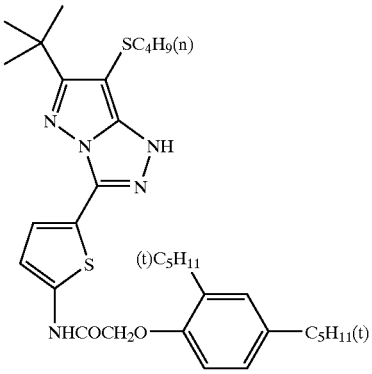
(63)
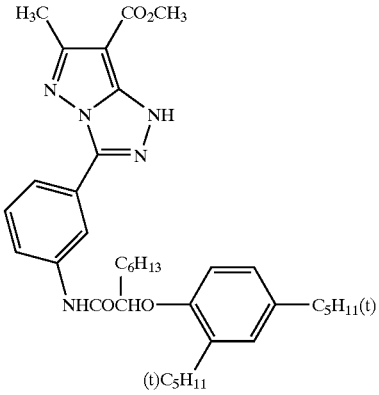
(64)
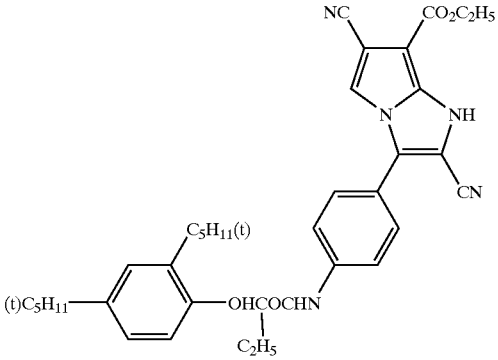

-continued
(65)
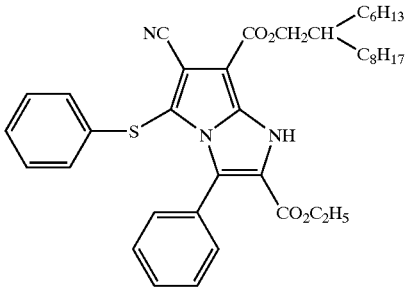
(66)
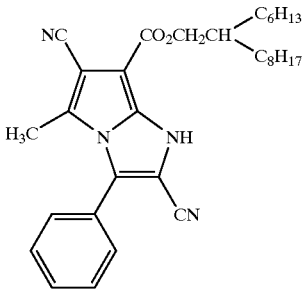
(67)
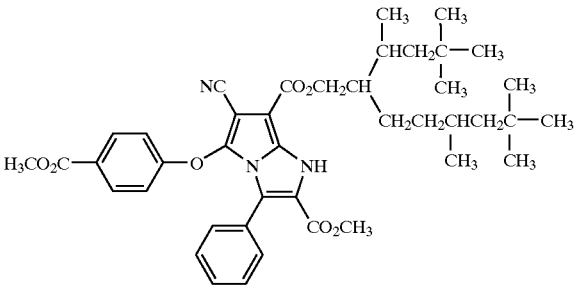
(68)
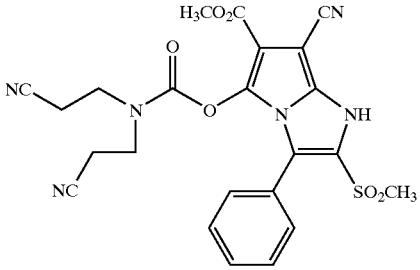
(69)
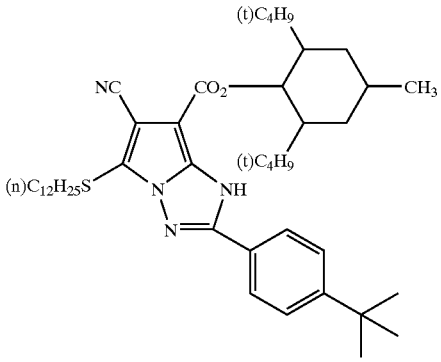
-continued
(70)
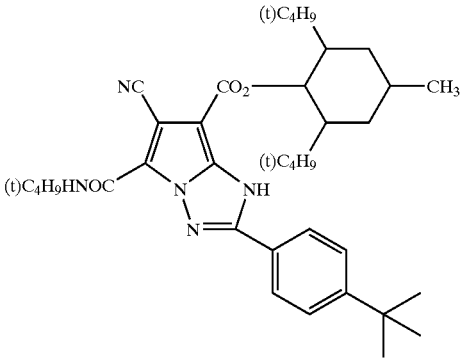
(71)
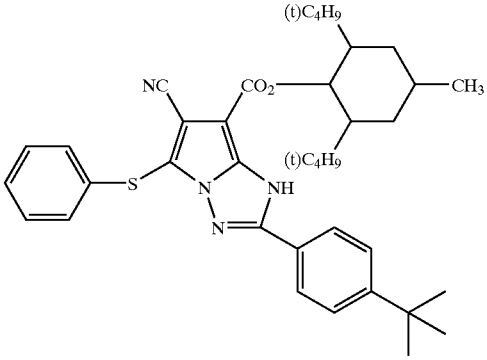
(72)
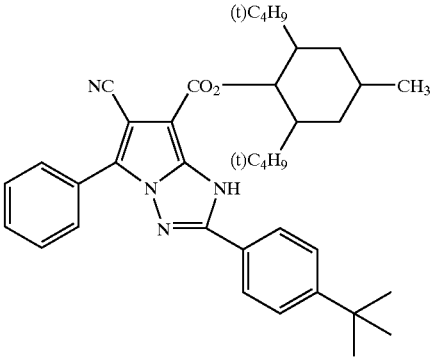
(73)
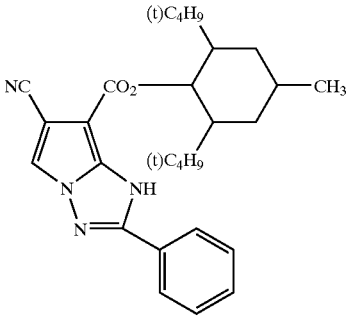

-continued
(74)
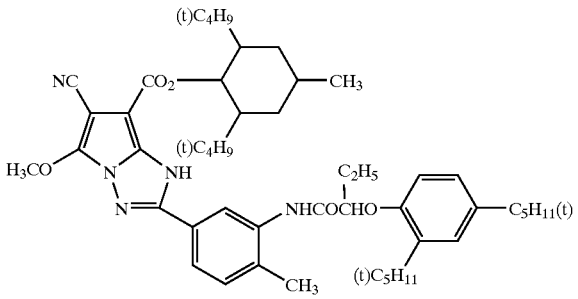
(75)
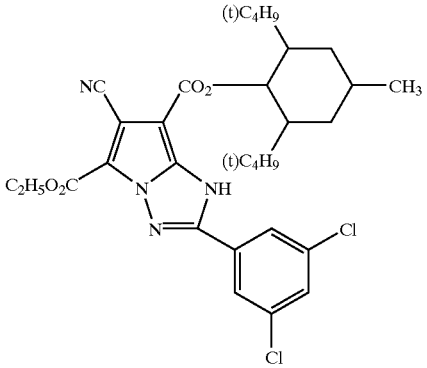
(76)
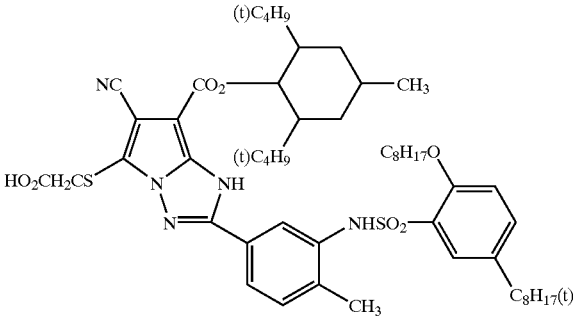
(77)
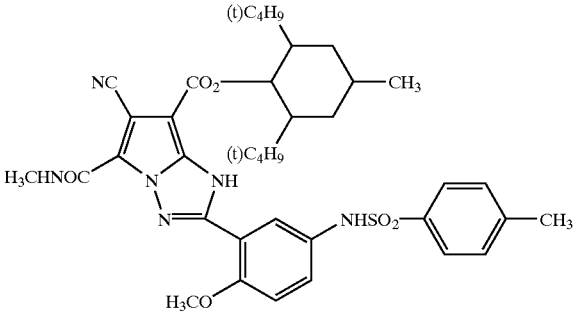
-continued
(78)
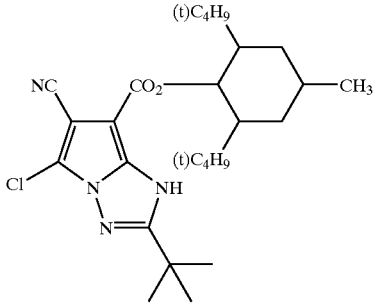
(79)
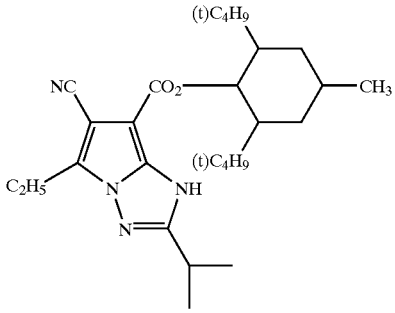
(80)
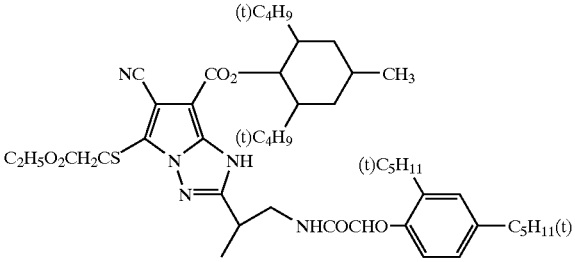
(81)
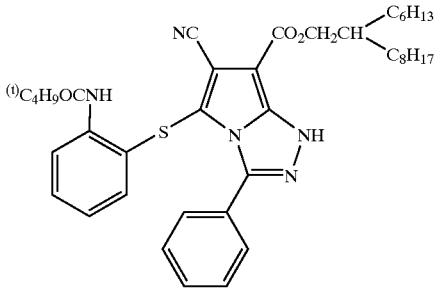
(82)
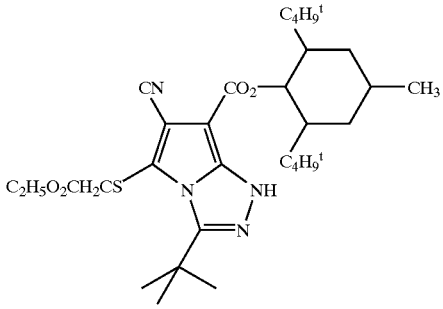

-continued (83)

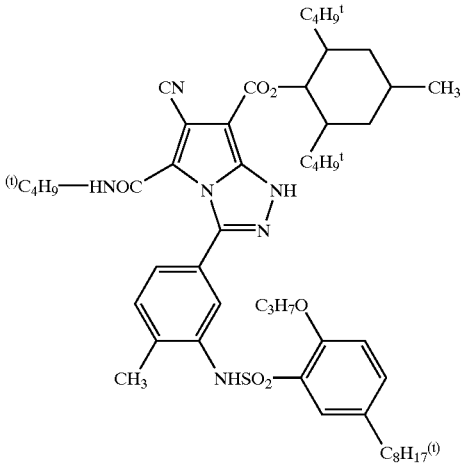

(84)

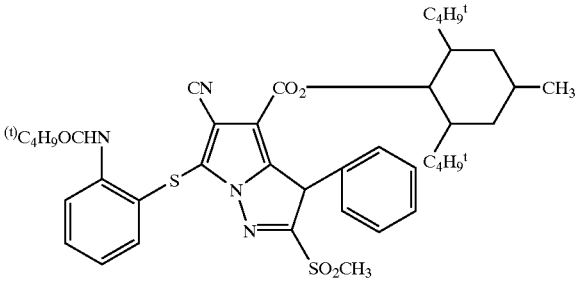

(85)

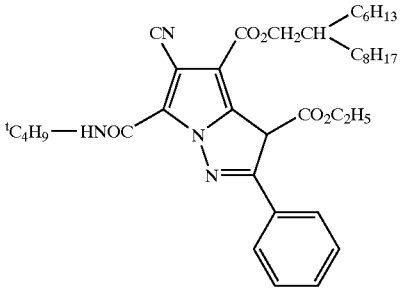

The compound represented by the general formula (M) and the general formula (C) of the present invention can easily be prepared using the synthesis methods described in JP-A's-61-65245, 61-65246, 61-147254 and 8-122984, etc. The addition amount of the compound represented by the general formula (M) and the general formula (C) of the present invention to the photosensitive material of the present invention is the same as that of the compound (B).

Conventionally known compounds can be used as the vinyl polymer used in the present invention. Although both of a water-dispersion (self-emulsification) type and a water-soluble type can be used as the vinyl polymer, a water-dispersion type is preferably used in respect of the easiness of fine-grain preparation and the dispersion stability.

The vinyl polymer preferably contains a sulfonic acid group as a dissociative group. The vinyl polymer may also use in a nonionic dispersing group such as a polyethyleneoxy chain in combination.

Examples of the monomer forming the vinyl polymer are acrylates, specifically, methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-butoxyethyl acrylate, 2-(2-methoxyethoxy)ethyl acrylate, 2-(2-butoxyethoxy)ethyl acrylate, glycidyl acrylate, 1-bromo-2-methoxyethyl acrylate, 1,1-dichloro-2-ethoxyethyl acrylate, 2,2,2-tetrafluoroethyl acrylate, and 1H,1H,2H,2H-perfluorodecyl acrylate. Further, examples of the monomer are methacrylates, specifically, methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, 2-(3-phenylpropyloxy)ethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-ethoxyethyl methacrylate, 2-iso-propoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, 2-acetoxyethyl methacrylate, 2-acetoacetoxyethyl methacrylate, allyl methacrylate, glycidyl methacrylate, 2,2,2-trifluoroethyl methacrylate, and 1H,1H,2H,2H-perfluorodecyl methacrylate, etc.

Further examples of the monomer are vinyl esters, specifically, vinyl acetate, vinyl propionate, vinyl butylate, vinyl isobutylate, vinyl caproate, vinyl chloroacetate, vinyl methoxyacetate, vinyl phenylacetate, vinyl benzoate, and vinyl salicylate, etc.

Further examples of the monomer are acrylamides, such as acrylamide, methylacrylamide, ethylacrylamide, propylacrylamide, butylacrylamide, tert-butylacrylamide, tert-octylacrylamide, cyclohexylacrylamide, benzylacrylamide, hydrlxymethylacrylamide, methoxymethylacrylamide, buthoxymethylacrylamide, methoxyethylacrylamide, phenylacrylamide, dimethylacrylamide, diethylacrylamide, β-cyanoethylacrylamide, N-(2-acetoacetoxyethyl) acrylamide, and diacetone acrylamide, etc.

Further examples of the monomer are methacrylamides, such as methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, phenylmethacrylamide, dimethylmethacrylamide, β-cyanoethylmethacrylamide, and N-(2-acetoacetoxyethyl)methacrylamide.

Further examples of the monomer are olefins, such as dicyclopentadiene, ethylene, propylene, 1-butene, 1-pentene, vinyl chloride, vinylidene chloride, isoprene, chloroprene, butadiene, and 2,3-dimethylbutadiene, and styrenes, such as styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene, and vinylbenzoate methylester.

Further examples of the monomer are vinyl ethers, such as methylvinyl ether, butylvinyl ether, hexylvinyl ether, and methoxyethylvinyl ether.

Further examples of the monomer are butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, N-vinyloxazolidone, N-vinylpyrolidone, vinylidene chloride, methylenemalonnitrile, vinylidene, diphenyl-2-acryloyloxyethyl phosphate, diphenyl-2-methacryloyloxyethyl phosphate, dibutyl-2-acryloyloxyethyl phosphate, and dioctyl-2-methacryloyloxyethyl phosphate, etc.

Examples of sulfonic acid monomers are styrenesulfonic acid, vinylsulfonic acid, acryloyloxyalkanesulfonic acid (e.g., acryloyloxymethanesulfonic acid, acryloyloxyethanesulfonic acid, and acryloyloxypropanesulfonic acid), methacryloyloxyalkanesulfonic acid (e.g., methacryloyloxymethanesulfonic acid, methacryloyloxyethanesulfonic acid, and methacryloyloxypropanesulfonic acid), acrylamidealkanesulfonic acid (e.g., 2-acrylamide-2-methyletanesulfonic acid, 2-acrylamide-2-methylpropanesulfonic acid, and 2-acrylamide-2-methylbutanesulfonic acid), and methacrylamidealkanesulfonic acid (e.g., 2-methacrylamide-2-methylethanesulfonic acid, 2-methacrylamide-2-methylpropanesulfonic acid, and 2-methacrylamide-2-methylbutanesulfonic acid). Among them, preferable sulfonic acid monomers are styrenesulfonic acid, vinylsulfonic acid, acrylamidealkylsulfonic acid, and methacrylamidealkylsulfonic acid, and more preferable monomers are styrenesulfonic acid, 2-acrylamide-2-methylpropanesulfonic acid, and 2-acrylamide-2-methylbutanesulfonic acid.

Examples of monomers containing a nonionic dispersing group are ester of polyethyleneglycolmonoalkyl ether and carboxylic acid monomer, ester of polyethyleneglycolmonoalkyl ether and sulfonic acid monomer, ester of polyethyleneglycolmonoalkyl ether and phosphoric acid monomer, vinyl-group-containing urethane formed of polyethyleneglycolmonoalkyl ether and isocyanate-group-containing monomer, and macromonomer containing a polyvinylalcohol structure, etc. The repeating number of the ethyleneoxy part of polyethyleneglycolmonoalkyl ether is preferably 8 to 50, more preferably 10 to 30. The alkyl group of polyethyleneglycolmonoalkylether preferably has 1 to 20 carbon atoms, more preferably 1 to 12.

For the monomer to be used in the polymer used in the present invention, two or more kinds of monomers (for example, the above monomers) may be used as co-monomers, according to various objects (e.g., Tg control, improvement of solubility, and dispersion stability).

In the case of using monomer having dissociative groups, too small content of dissociative groups decreases self-emulsification ability of vinyl polymer, and too much content thereof increases the water-solubility and is improper for dispersion of the ultravionet absorbent. The content of dissociative groups is preferably 0.1 to 3.0 mmol/g, more preferably 0.2 to 2.0 mmol/g. The dissociative group may be a salt of alkaline metal (e.g., Na and K) or an ammonium ion.

A part of specific examples of the polymers used in the present invention will be described below, although the present invention is not limited to them. The following ratios indicate weight ratios.

| Specific Example) | Kind of Polymer |
|---|---|
| P-1) | ethyl methacrylate/styrenesulfonic acid copolymer (90:10) |
| P-2) | isopropyl methacrylate/styrenesulfonic acid copolymer (85:15) |
| P-3) | n-butyl acrylate/styrene/styrenesulfonic acid copolymer (80:5:15) |
| P-4) | isobutyl methacrylate/styrenesulfonic acid copolymer (85:15) |
| P-5) | isobutyl acrylate/triethyleneglycol monomethacrylate/styrenesulfonic acid copolymer (80:10:10) |
| P-6) | ethyl acrylate/1H,1H,2H,2H-perfluorodecyl methacrylate/styrenesulfonic acid copolymer (83:10:7) |
| P-7) | n-butyl acrylate/2-butoxyethylmethacrylate/ styrenesulfonic acid copolymer (70:21.5:8.5) |
| P-8) | ethyl methacrylate/2-acrylamide-2-methylethanesulfonic acid copolymer (90:10) |
| P-9) | ethyl acrylate/2-butoxyethyl methacrylate/ 2-acrylamide-2-methylethanesulfonic acid copolymer (70:20:10) |
| P-10) | isobutyl methacrylate/2-acrylamide-2-methylethanesulfonic acid copolymer (92:8) |
| P-11) | isobutylacrylate/ethylmethacrylate/ 2-acrylamide-2-methylethanesulfonic acid copolymer (70:20:10) |
| P-12) | ethylacrylate/isopropyl methacrylate/ 2-acrylamide-2-methylethanesulfonic acid copolymer (60:30:10) |
| P-13) | n-butyl methacrylate/2-acrylamide-2-methylpropanesulfonic acid copolymer (90:10) |
| P-14) | ethyl methacrylate/2-acrylamide-2-methylpropanesulfonic acid copolymer (93.7:6.3) |
| P-15) | ethyl methacrylate/sodium 2-acrylamide-2-methylpropanesulfonate copolymer (94.2:5.8) |
| P-16) | ethyl acrylate/isopropyl methacrylate/ 2-acrylamide-2-methylpropanesulfonnic acid copolymer (63:30:7) |
| P-17) | ethyl methacrylate/isopropyl methacrylate/ sodium 2-acrylamide-2-methylpropanesulfonate copolymer (60:32.3:7.7) |
| P-18) | tert-butyl acrylate/tetrahydrofulfuryl acrylate/ 2-methylpropanesulfonic acid copolymer (50:40:10) |
| P-19) | isopropyl acrylate/1H,1H,2H,2H-perfluorodecyl methacrylate/2-acrylamide-2-methylpropanesulfonic acid copolymer (60:30:10) |
| P-20) | isopropyl acrylate/ polyethyleneglycolmonomethyl ether (the repeating number of ethyleneoxy chain is 23) methacrylate ester/ 2-acrylamide-2-methylpropanesulfonic acid copolymer (60:30:10) |
| P-21) | isobutyl acrylate/N-vinylpyrolidone/ 2-acrylamide-2-methylpropanesulfonic acid copolymer (60:30:10) |
| P-22) | ethyl methacrylate/sodium 2-acrylamide-2-methylpropanesulfonate copolymer (90.4:9.6) |
| P-23) | isopropylmethacrylate/sodium 2-acrylamide 2-methylpropanesulfonate copolymer (98:12) |
| P-24) | isobutyl methacrylate/sodium 2-acrylamide-2-methylpropanesulfonate copolymer (90.4:9.6) |
| P-25) | ethyl methacrylate/tert-butyl methacrylate/ sodium 2-acrylamide-2-methylpropanesulfonate copolymer (50:35:15) |
| P-26) | vinylpyrolidone/isobutyl methacrylate/ sodium 2-acrylamide-2-methylpropanesulfonate copolymer (50:35:15) |
| P-27) | n-butyl methacrylate/2-methacrylamide 2-methylpropanesulfonic acid copolymer (90:10) |
| P-28) | n-butyl acrylate/isopropyl methacrylate/ 2-methacrylamide-2-methylpropanesulfonic acid copolymer (60:30:10) |
| P-29) | isobutyl acrylate/hydroxymethylacrylamide/ 2-methacrylamide-2-methylpropanesulfonic acid copolymer (80:10:10) |
| P-30) | ethyl acrylate/isopropyl methacrylate/ vinylsulfonic acid copolymer (60:30:10) |
| P-31) | hexyl methacrylate/methyl methacrylate/ vinylsulfonic acid copolymer (40:45:15) |

-continued

| Specific Example) | Kind of Polymer |
|---|---|
| P-32) | ethyl acrylate/isopropyl methacrylate/ vinylsulfonic acid copolymer (60:30:10) |
| P-33) | ethyl methacrylate/2-acrylamide-2-methylbutanesulfonic acid copolymer (90:10) |
| P-34) | isopropyl methacrylate/2-acrylamide-2-methylbutanesulfonic acid copolymer (90:10) |
| P-35) | ethyl acrylate/isopropyl methacrylate/ 2-acrylamide-2-methylbutanesulfonic acid copolymer (60:30:10) |
| P-36) | ethyl acrylate/isopropyl methacrylate/ 2-acrylamide-2-methylbutanesulfonic acid copolymer (60:30:10) |
| P-37) | ethylmethacrylate/sodium 2-acrylamide-2-methylbutanesulfonate copolymer (90.4:9.6) |
| P-38) | sec-propyl methacrylate/sodium 2-acrylamide-2-methylbutansulfonate copolymer (88:12) |
| P-39) | isobutyl methacrylate/sodium 2-acrylamide-2-methylbutanesulfonate copolymer (90.4:9.6) |
| P-40) | ethyl methacrylate/isopropyl methacrylate/ sodium 2-acrylamide-2-methylbutanesulfonate copolymer (50:35:15) |
| P-41) | ethyl methacrylate/2-methacrylamide-2-methylbutanesulfonic acid copolymer (90:10) |

The molecular weight (Mw) of vinyl polymer is 1000 to 100000, preferably 3000 to 50000. If the molecular weight is less than 1000, it tends to be difficult to obtain a stable dispersion and, if the molecular weight exceeds 100000, the solubility to an organic solvent deteriorates or viscosity of the organic solvent solution increases, which is an obstacle to dispersion.

The method of preparing the ultraviolet-absorbent-containing fine-grain dispersion will now be described.

The ultraviolet-absorbent-containing fine-grain dispersion of the present invention is prepared by dispersing ultraviolet-absorbent-containing fine grains comprising an ultraviolet absorbent and the vinyl polymer, into a water-base medium (an aqueous solution containing at least water). A specific example of the method is a co-emulsification dispersion method, etc.

The co-emulsification dispersion method will now be described.

A first example of this method comprises a first step of preparing a vinyl polymer ultraviolet-absorbent solution by dissolving the ultraviolet absorbent and the self-emulsifying vinyl polymer in an organic solvent, and a second step of preparing an ultraviolet-absorbent-containing fine-grain dispersion by mixing the vinyl polymer ultraviolet-absorbent solution with a solution containing at least water.

A second example of this method comprises a first step of preparing an ultraviolet-absorbent solution by dissolving the ultraviolet absorbent in an organic solvent, a second step of preparing a vinyl polymer solution by dissolving the self-emulsifying vinyl polymer, and a third step of preparing an ultraviolet-absorbent-containing fine-grain dispersion by mixing the ultraviolet-absorbent solution, the vinyl polymer solution, and a solution containing at least water.

A third example of this method comprises a first step of preparing an ultraviolet-absorbent solution by dissolving the ultraviolet absorbent in an organic solvent, and preparing an ultraviolet-absorbent fine-grain dispersion by mixing the ultraviolet-absorbent solution with a solution containing at least water, a second step of preparing a vinyl polymer solution by dissolving the self-emulsifying vinyl polymer, and preparing a vinyl polymer fine-grain dispersing solution by mixing the vinyl polymer solution with a solution containing at least water, and a third step of preparing an ultraviolet-absorbent-containing fine-grain dispersion by mixing the ultraviolet-absorbent fine-grain dispersing solution with the vinyl polymer fine-grain dispersing solution.

A fourth example of this method comprises a first step of preparing a vinyl polymer solution by dissolving the self-emulsifying vinyl polymer in an organic solvent, a second step of preparing an ultraviolet-absorbent solution by dissolving the ultraviolet absorbent, and preparing an ultraviolet-absorbent fine-grain dispersing solution by mixing the ultraviolet-absorbent solution with a solution containing at least water, and a third step of preparing an ultraviolet-absorbent-containing fine-grain dispersion by mixing the vinyl polymer solution with the ultraviolet-absorbent fine-grain dispersing solution.

In the ultraviolet-absorbent-containing fine-grain dispersion, the amount of use of the self-emulsifying vinyl polymer is preferably 10 to 1000 parts by weight, more preferably 20 to 400 parts by weight to 100 parts by weight of the ultraviolet absorbent.

If the amount of use of the self-emulsifying vinyl polymer is less than 10 parts by weight, it tends to be difficult to achieve fine and stable dispersion. If the amount exceeds 1000 parts by weight, the rate of the ultraviolet absorbent in the ultraviolet-absorbent-containing fine-grain dispersion decreases, and it tends to reduce the margin in the formulation design.

The average grain size of the ultraviolet-absorbent-containing fine-grain dispersion is preferably 1 to 500 nm, more preferably 10 to 100 nm. The average grain size can be adjusted by centrifugal separation and filtration, etc.

The addition amount of the ultraviolet absorbent is preferably 0.02 to 2.0 g/m$^2$, more preferably 0.2 to 1.0 g/m$^2$.

-Organic Solvent-

An organic solvent used for preparation of the ultraviolet-absorbent-containing fine-grain dispersion is not specifically limited, but can be selected, according to necessity, on the basis of the solubilities of the ultraviolet absorbent and the vinyl polymer. Examples of the organic solvent are ketone-based solvents such as acetone, methyl ethyl ketone and diethyl ketone, alcohol-based solvents such as methanol, ethanol, 2-propanol, 1-propanol, 1-butanol, and tert-butanol, chlorine-based solvents such as chloroform and methylene chloride, aromatic-based solvents such as benzene and toluene, ester-based solvents such as ethyl acetate, butyl acetate and isopropyl acetate, ether-based solvents such as diethyl ether, tetrahydrofuran and dioxane, and glycol-based ether solvents such as ethylene glycol monomethyl ether and ethylene glycol dimethyl ether.

These organic solvents may be used alon, or two or more solvents may be used in combination.

The amount of use of the organic solvent is not specifically limited, as long as it falls within the range of not inhibiting the effects of the present invention. The amount is preferably 10 to 2000 parts by weight, more preferably 100 to 1000 parts by weight to 100 pars by weight of the self-emulsifying vinyl polymer.

If the amount of use of the organic solvent is less than 10 parts by weight, it tends to be difficult to achieve a fine and stable dispersion of the ultraviolet-absorbent-containing fine grain. The amount exceeding 2000 parts by weight requires steps of de-solvation and concentration to remove the organic solvent, and tends to reduce the margin in the formulation design.

If the solubility of the organic solvent to water is 10% or less, or the vapor pressure of the organic solvent is greater than that of water, the organic solvent is preferably removed in respect of the stability of the ultraviolet-absorbent-containing fine-grain dispersion.

The organic solvent can be removed at 10° C. to 100° C. at a normal pressure to a reduced pressure, preferably at 40 to 100° C. at a normal pressure or 10 to 50° C. at a reduced pressure.

-Additives-

The ultraviolet-absorbent-containing fine-grain dispersion of the present invention may contain additives selected according to necessity, within the range of not inhibiting the effects of the present invention.

Examples of the additives are a neutralizer, dispersant, and dispersion stabilizer, etc.

The neutralizer can be suitably used in respect of pH control, control of self-emulsifying property, and provision of dispersion stability of the ultraviolet-absorbent-containing fine-grain dispersion, if the self-emulsifying vinyl polymer has an unneutralized dissociative group.

Examples of the neutralizer are an organic base and inorganic alkali, etc.

Examples of the organic base are triethanolamine, diethanolamine, N-methyldiethanolamine, and dimethylethanolamine, etc.

Examples of the inorganic alkali are alkali metal hydroxide (e.g., sodium hydroxide, lithium hydroxide, and potassium hydroxide), carbonate (e.g., sodium carbonate, and sodium hydrogen carbonate), and ammonia, etc.

From the viewpoint of improving the dispersion stability of the ultraviolet-absorbent-containing fine-grain dispersion, the neutralizer is added so that the pH preferably becomes 4.5 to 10.0, more preferably 6.0 to 10.0.

The dispersant and the dispersion stabilizer may be added to any of the self-emulsifying vinyl polymer dispersion, the self-emulsifying vinyl polymer solution, the ultraviolet-absorbent solution, and the solution containing at least water. They are preferably added to the self-emulsifying vinyl polymer, the ultraviolet-absorbent solution, or the solution containing water, in the step before preparing the self-emulsifying vinyl polymer and/or ultraviolet-absorbent fine-grain dispersing solution.

Examples of the dispersant and the dispersion stabilizer are various surfactants of cationic, anionic and nonionic series, water-soluble or water-dispersive low-molecular weight compounds, and oligomer, etc. The addition amount of the dispersant and the dispersion stabilizer is 0 to 100 wt %, more preferably 0 to 20 wt % to the total of the ultraviolet absorbent and the self-emulsifying vinyl polymer.

A silver halide emulsion that may be used in the silver halide color photosensitive material of the present invention is preferably silver bromide, silver chloride, silver iodobromide, silver iodochlorobromide, silver chlorobromide, silver chloroiodobromide and etc.

The first emulsion that may be used in the photosensitive material of the present invention, namely, the emulsion which contains tabular silver halide grains of silver iodobromide or silver chloroiodobromide whose chloride content is 10 mol % or less, each having (111) faces as parallel main planes will first be described.

This emulsion has (111) main plane surfaces opposite to each other and side faces connecting the main planes. The tabular grain emulsion is constituted of silver iodobromide or silver chloroiodobromide. Silver chloride may be contained in the emulsion. The silver chloride content is preferably 8 mol % or less, and more preferably 3 mol % or less, or 0 mol %. With respect to the silver iodide content it is 40 mol % or less, preferably 20 mol % or less.

Despite the silver iodide content, the variation coefficient of intergranular distribution of silver iodide content is preferably 20% or less, more preferably 10% or less.

It is preferred that the silver iodide distribution have an intragranular structure. The silver iodide distribution can have a double structure, a treble structure, a quadruple structure or a structure of higher order. The silver iodide content may continuously change in the grain.

50% or more of the total projected area is occupied by grains having an aspect ratio of 2 or more. The projected area and aspect ratio of tabular grains can be measured from an electron micrograph obtained by the carbon replica method in which the tabular grains together with reference latex spheres are shadowed. The tabular grains, as viewed from a direction perpendicular to the main plane, generally have the shape of a hexagon, a triangle or a circle. Herein, the aspect ratio refers to the quotient of the diameter of a circle with an area equal to the projected area divided by the grain thickness. With respect to the configuration of tabular grains, it is preferred that the ratio of hexagonal shape to all grain shapes be high. In the tabular grains of hexagonal shape, it is preferred that the ratio of neighboring-side lengths be 1:2 or less.

The projected area diameter of each of the tabular grains is preferably 0.1 μm to 20.0 μm, more preferably 0.2 μm to 10.0 μm. The term "projected area diameter" means a diameter of a circle having an area equal to the projected area of a silver halide grain. Further, the thickness of each of the tabular grains is preferably 0.01 μm to 0.5 μm, more preferably 0.02 μm to 0.4 μm. The thickness of a tabular grain means a distance between the two main planes of the grain. The equivalent sphere diameter of each of the grains is preferably 0.1 μm to 5.0 μm, more preferably 0.2 μm to 3 μm. The term "equivalent sphere diameter" means a diameter of a sphere having an area equal to the volume of each grain. Further, the aspect ratio thereof is preferably 1 to 100, more preferably 2 to 50. The aspect ratio is a value obtained by dividing the projected area diameter of a grain by the thickness of the grain.

The silver halide grains of the present invention are preferably monodisperse. The coefficient of variation of the equivalent sphere diameters of all the silver halide grains is 30% or less, preferably 25% or less. Further, in the case of tabular grains, the coefficient of variation of the projected area diameters is also important. The coefficient of variation of the projected area diameters of all the silver halide grains of the present invention is preferably 30% or less, more preferably 25% or less, further preferably 20% or less. Furthermore, the coefficient of variation of the thickness of the tabular grains is preferably 30% or less, more preferably 25% or less, further preferably 20% or less. The coefficient of variation of the projected area diameter is a value obtained by dividing a standard deviation of distribution of the projected area diameters of the silver halide grains by an average projected area diameter. Further, the coefficient of variation of the thickness is a value obtained by dividing a standard deviation of distribution of the thickness of the silver halide tabular grains by an average thickness.

The space between twin planes of each tabular grain of the present invention may be set to 0.012 μm or less as described in U.S. Pat. No. 5,219,720, and the value of "(111) main plane distance/twin plane space" may be set to 15 or more as described in JP-A-5-249585. They can be selected according to the object.

Since the higher aspect ratio can obtain the more remarkable effect, at least 50% of the total projected area of the tabular grain emulsion is preferably occupied with grains having an aspect ratio of 5 or more, more preferably an aspect ratio of 8 or more. Since a too large aspect ratio also increases the coefficient of variation of the grain size distribution, usually the aspect ratio is preferably 50 or less.

The dislocation lines of tabular grains can be observed by a direct method using a transmission electron microscope, described in J. F. Hamilton, Phot. Sci. Eng., 11,57,(1967) and T. Shiozawa, J. Soc. Phot. Sci. Japan, 35, 213 (1972), for example. Specifically, silver halide grains taken out from the emulsion with care so as not to apply strong pressure to the grains to generate new dislocation lines are put on a mesh for electron microscope observation. Then, the sample is observed by transmission electron radiography in the state where the sample is cooled to prevent damage (e.g., printout) by electron beam, are observed by the transmission method. The greater the thickness of the above grains, the more difficult the transmission of electron beams. Therefore, the use of an electron microscope of high voltage type (at least 200 kV on the grains of 0.25 $\mu$m in thickness) is preferred for ensuring clearer observation. The thus obtained photograph of grains enables determining the position and number of dislocation lines in each grain viewed in the direction perpendicular to the main planes.

The number of dislocation lines of the tabular grains according to the present invention is preferably at least 10 per grain on the average and more preferably at least 20 per grain on the average. When dislocation lines are densely present or when dislocation lines are observed in the state of crossing each other, it happens that the number of dislocation lines per grain cannot accurately be counted. However, in this instance as well, rough counting on the order of, for example, 10, 20 or 30 dislocation lines can be effected, so that a clear distinction can be made from the presence of only a few dislocation lines. The average number of dislocation lines per grain is determined by counting the number of dislocation lines of each of at least 100 grains and calculating a number average thereof.

Dislocation lines can be introduced in, for example, the vicinity of the periphery of tabular grains. In this instance, the dislocation is nearly perpendicular to the periphery, and each dislocation line extends from a position corresponding to x % of the distance from the center of tabular grains to the side (periphery) to the periphery. The value of x preferably ranges from 10 to less than 100, more preferably from 30 to less than 99, and most preferably from 50 to less than 98. In this instance, the figure created by binding the positions from which the dislocation lines start is nearly similar to the configuration of the grain. The created figure may be one which is not a complete similar figure but deviated. The dislocation lines of this type are not observed around the center of the grain. The dislocation lines are crystallographically oriented approximately in the (211) direction. However, the dislocation lines often meander and may also cross each other.

Dislocation lines may be positioned either nearly uniformly over the entire zone of the periphery of the tabular grains or local points of the periphery. That is, referring to, for example, hexagonal tabular silver halide grains, dislocation lines may be localized either only in the vicinity of six apexes or only in the vicinity of one of the apexes. Contrarily, dislocation lines can be localized only in the sides excluding the vicinity of six apexes.

Furthermore, dislocation lines may be formed over regions including the centers of two mutually parallel main planes of tabular grains. In the case where dislocation lines are formed over the entire regions of the main planes, the dislocation lines may crystallographically be oriented approximately in the (211) direction when viewed in the direction perpendicular to the main planes, and the formation of the dislocation lines may be effected either in the (110) direction or randomly. Further, the length of each dislocation line may be random, and the dislocation lines may be observed as short lines on the main planes or as long lines extending to the side (periphery). The dislocation lines may be straight or often meander. In many instances, the dislocation lines cross each other.

The position of dislocation lines may be localized on the periphery, main planes or local points as mentioned above, or the formation of dislocation lines may be effected on a combination thereof. That is, dislocation lines may be concurrently present on both the periphery and the main planes.

The silver iodide content on the grain surface of a tabular grain emulsion of the present invention is preferably 10 mol % or less, and particularly preferably, 5 mol % or less. The silver iodide content on the grain surface of the present invention is measured by using XPS (X-ray Photoelectron Spectroscopy). The principle of XPS used in an analysis of the silver iodide content near the surface of a silver halide grain is described in Junnich Aihara et al., "Spectra of Electrons" (Kyoritsu Library 16: issued Showa 53 by Kyoritsu Shuppan). A standard measurement method of XPS is to use Mg—K$\alpha$ as excitation X-rays and measure the intensities of photoelectrons (usually I-3d5/2 and Ag-3d5/2) of iodine (I) and silver (Ag) released from silver halide grains in an appropriate sample form. The content of iodine can be calculated from a calibration curve of the photoelectron intensity ratio (intensity (I)/intensity (Ag)) of iodine (I) to silver (Ag) formed by using several different standard samples having known iodine contents. XPS measurement for a silver halide emulsion must be performed after gelatin adsorbed by the surface of a silver halide grain is decomposed and removed by, e.g., proteinase. A tabular grain emulsion in which the silver iodide content on the grain surface is 10 mol % or less is an emulsion whose silver iodide content is 10 mol % or less when the emulsion grains are analyzed by XPS. If obviously two or more types of emulsions are mixed, appropriate preprocessing such as centrifugal separation or filtration must be performed before one type of emulsion is analyzed.

The structure of a tabular grain emulsion of the present invention is preferably a triple structure of silver bromide/silver iodobromide/silver bromide or a higher-order structure. The boundary of silver iodide content between structures can be either a clear boundary or a continuously gradually changing boundary. Commonly, when measured by using a powder X-ray diffraction method, the silver iodide content does not show any two distinct peaks; it shows an X-ray diffraction profile whose tail extends in the direction of high silver iodide content.

The interior silver iodide content is preferably higher than the surface silver iodide content. The interior silver iodide content is higher than the surface silver iodide content by 3 mol % or more, preferably by 5 mol % or more.

Next, a description will be made to the second emulsion that can be used in the photosensitive emulsion of the present invention, that is, grains having (111) faces as their parallel main planes wherein there is at least one epitaxial junction per grain at an apex portion and/or a side face portion and/or a main plane portion of a hexagonal silver halide grain, and wherein a ratio of the length of an edge having the maximum length to the length of an edge having the minimum length, is 2 or less. The grain with an epitaxial junction refers to a grain having main body of the silver halide grain to which a crystal portion (that is, an epitaxial portion) is joined, wherein the joined crystal portion usually projects from the main body of the silver halide grain. It is preferable that the ratio of the joined crystal portion (epitaxial portion) to the amount of the total silver contained in the grain is 2% or more and 30% or less, and more preferably or more 5% and 15% or less. The epitaxial portion may be located anywhere in the main body of the grain, but it is preferably located at a grain main plane portion and/or a grain side face portion and/or a grain apex portion. The number of the epitaxial portion is preferably at least one. The composition of the epitaxial portion is preferably AgCl, AgBrCl, AgBrClI, AgBrI, AgI, AgSCN and the like. When there is an epitaxial portion, a dislocation line may be present inside the grain, but it does not have to be present.

Next, a description will be made to methods for preparing the first emulsion and the second emulsion silver halide grains.

The preparation process of the present invention comprises (a) a base grain forming process and a grain forming process (process (b)) following step (a). Basically, it is preferable that process (a) is followed by process (b), but only process (a) may be carried out. Process (b) may be any of (b1) a step of introducing dislocation, (b2) a step of introducing dislocation at a corner portion restrictedly, and (b3) an epitaxial junction step. Process (b) may contain either one step or a combination of two or more steps.

First, (a) base grain forming process will be described. A base portion is preferably at least 50%, more preferably 60% or more of the amount of the total silver used for the grain formation. The average content of iodine relative to the amount of silver in the base portion is preferably 0 mol % or more and 30 mol % or less, and more preferably 0 mol % or more and 15 mol % or less. The base portion may have a core-shell structure, as needed. In this case, the core portion of the base portion is preferably 50% or more and 70% or less of the amount of the total silver contained in the base portion. The average iodine composition of the core portion is preferably 0 mol % or more and 30 mol % or less, and more preferably 0 mol % or more and 15 mol % or less. The iodine composition of the shell portion is preferably 0 mol % or more and 3 mol % or less.

A method comprising forming silver halide nuclei and then allowing the silver halide grains to grow, thereby obtaining grains with a desired size is general as a method for preparing a silver halide emulsion. The present invention is certainly similar to that. Further, with respect to the formation of tabular grains, steps of, at least, nucleation, ripening and growing are contained. These steps will be described in U.S. Pat. No. 4,945,037 in detail. Hereafter, the steps, nucleation, ripening and growing, will be described.

1. Nucleation Step

The nucleation of tabular grains is in general carried out by a double jet method comprising adding a silver salt aqueous solution and an alkali halide aqueous solution to a reaction vessel containing a protective colloid aqueous solution, or a single jet method comprising adding a silver salt aqueous solution to a protective colloid solution containing alkali halide. If necessary, a method comprising adding an alkali halide aqueous solution to a protective colloid solution containing silver salt may be used. Further, if necessary, a method comprising adding a protective colloid solution, a silver salt solution and an alkali halide aqueous solution to the mixer disclosed in JP-A-2-44335, and immediately transfer the mixture to a reaction vessel may be used for the nucleation of tabular grains. Further, as disclosed in U.S. Pat. No. 5,104,786, nucleation can be performed by passing an aqueous solution containing alkali halide and a protective colloid solution through a pipe and adding a silver salt aqueous solution thereto.

Gelatin is used as protective colloid but natural high polymers besides gelatin and synthetic high polymers can also be used. Alkali-processed gelatin, oxidized gelatin, i.e., gelatin in which a methionine group in the gelatin molecule is oxidized with hydrogen peroxide, etc. (a methionine content of 40 $\mu$mol/g or less), amino group-modified gelatin of the present invention (e.g., phthalated gelatin, trimellitated gelatin, succinated gelatin, maleated gelatin, and esterified gelatin), and low molecular weight gelatin (molecular weight of from 3,000 to 40,000) are used. JP-B-5-12696 can be referred to about oxidized gelatin. Descriptions of JP-A's-8-82883 and 11-143002 can be referred to about amino group-modified gelatin. Further, if necessary, lime-processed ossein gelatin containing 20% or more, preferably 30% or more of components having a molecular weight of 280,000 in a molecular weight distribution determined by the Puggy's method disclosed in JP-A-11-237704 may be employed. Furthermore, for example, starches disclosed in EP No. 758758 and U.S. Pat. No. 5,733,718 may also be used. Further, natural high polymers will be described in JP-B-7-111550 and Research Disclosure, Vol. 176, No. 17643, item IX (December, 1978).

Excessive halides in the nucleation are preferably $Cl^-$, $Br^-$ and $I^-$, and they can be present individually or in combination. The concentration of the total halides is $3\times10^{-5}$ mol/L or more and 0.1 mol/L or less, and preferably $3\times10^{-4}$ mol/L or more and 0.01 mol/L or less.

The halogen composition in a halide solution added during nucleation is preferably $Br^-$, $Cl^-$, and $I^-$, and they can be present individually or in combination. Nucleation such that the chlorine content is 10 mol % or more of the amount of the silver used for the nucleation as disclosed in JP-A-10-293372 may be employed. At this time, the concentration of $Cl^-$ is preferably 10 mol % or more and 100 mol % or less, and more preferably 20 mol % or more and 80 mol % or less, based on the concentration of the total halides.

The protective colloid may be dissolved in a halide solution added during nucleation. Alternatively, the gelatin solution may also be added separately but simultaneously with a halide solution during nucleation.

The temperature in the nucleation is preferably from 5 to 60° C., but when fine tabular grains having an average grain diameter of 0.5 $\mu$m or less are produced, the temperature is more preferably from 5 to 48° C.

The pH of the dispersion medium when amino group-modified gelatin is used is preferably 4 or more and 8 or less but when other gelatins are used it is preferably 2 or more and 8 or less.

2. Ripening Step

In the nucleation described in 1 above, fine grains other than tabular grains are formed (in particular, octahedral and single twin grains). Accordingly, the grains other than tabular grains are necessary to be vanished before entering a growing step described infra to obtain nuclei having the forms of becoming tabular grains and good monodispersibility. For this purpose, it is well known that Ostwald ripening is conducted subsequent to the nucleation.

The pBr is adjusted just after nucleation, then the temperature is raised and ripening is carried out until the hexagonal tabular grain ratio reaches the maximum. At this time, protective colloid may be added additionally. The concentration of protective colloid to the dispersion medium solution at this time is preferably 10% by weight or less. The above-described alkali-processed gelatin, amino group-modified gelatin of the present invention, oxidized gelatin, low molecular weight gelatin, natural high polymers and synthetic high polymers can be used as additional protective colloids. Further, if necessary, lime-processed ossein gelatin containing 20% or more, preferably 30% or more of components having a molecular weight of 280,000 in a molecular weight distribution determined by the Puggy's method disclosed in JP-A-11-237704 may be employed. Furthermore, for example, starches disclosed in EP No. 758758 and U.S. Pat. No. 5,733,718 may also be used.

The temperature during ripening is from 40 to 80° C., preferably from 50 to 80° C., and the pBr is from 1.2 to 3.0. The pH is preferably 4 or more and 8 or less when amino group-modified gelatin is present, and preferably 2 or more and 8 or less when other gelatins are used.

A silver halide solvent may be used for rapidly vanishing grains other than tabular grains. The concentration of the silver halide solvent at this time is preferably from 0.3 mol/L or less, more preferably 0.2 mol/L or less.

Thus, almost pure tabular grains are obtained by the ripening.

After the ripening is completed, if the silver halide solvent is unnecessary in the next growing stage, the silver halide solvent is removed as follows.

(i) In the case of alkaline silver halide solvents such as $NH_3$, an acid having great solubility product with Ag+ such as $HNO_3$ is added to be nullified.

(ii) In the case of thioether based silver halide solvent, an oxidizing agent such as $H_2O_2$ is added to be nullified as disclosed in JP-A-60-136736.

In the production method of an emulsion of the present invention, the completion of the ripening step is defined as a time of disappearance of tabular grains (regular or single twin grains) having hexagonal or triangular main planes but not having two or more twin planes. The disappearance of tabular grains having hexagonal or triangular main planes but not having two or more twin planes can be confirmed through the observation of the TEM image of a replica of grains.

In the ripening step, an over-ripening step disclosed in JP-A-11-174606 may be provided, if necessary. The over-ripening step refers to a step where ripening (ripening step) is performed until the proportion of hexagonal tabular grains becomes maximum, and then the tabular grains subjected to Ostwald ripening, thereby eliminating tabular grains with a slow anisotropic growing rate. When letting the number of grains obtained in the ripening step be 100, it is preferable to reduce the number of tabular grains to 90 or less, and more preferable to reduce it to 60 or more and 80 or less.

In the production method of the emulsion of the present invention, conditions of pBr, temperature and the like during the over-ripening step may be set as in the ripening step. Further, in the over-ripening step, a silver halide solvent may be added as in the ripening step, and the kind, concentration and the like thereof may be set to those the same as in the ripening step.

3. Growing Step

The pBr during the crystal growing stage subsequent to the ripening step is preferably maintained at 1.4 to 3.5. When the concentration of protective colloid in a dispersion medium solution before entering the growing step is low (1% by weight or less), protective colloid is additionally added in some cases. Further, protective colloid may be additionally added during the growing step. The timing of the addition may be any time during the growing step. The concentration of protective colloid in a dispersion medium solution at that time is preferably from 1 to 10% by weight. The above-described alkali-processed gelatin, amino group-modified gelatin of the present invention, oxidized gelatin, natural high polymers and synthetic high polymers can be used as additional protective colloids. Further, if necessary, lime-processed ossein gelatin containing 20% or more, preferably 30% or more of components having a molecular weight of 280,000 in a molecular weight distribution determined by the Puggy's method disclosed in JP-A-11-237704 may be employed. Furthermore, for example, starches disclosed in EP No. 758758 and U.S. Pat. No. 5,733,718 may also be used. The pH during growing is preferably from 4 to 8 when amino group-modified gelatin is present, and preferably from 2 to 8 when other gelatins are used. The feeding rate of $Ag^+$ and a halogen ion in the crystal growing stage is preferably adjusted to such a degree that the crystal growing speed becomes from 20 to 100%, more preferably from 30 to 100%, of the critical growing speed of the crystal. In this case, the feeding rates of a silver ion and a halogen ion are increased with the crystal growth of the grains and, as disclosed in JP-B's-48-36890 and 52-16364, the feeding rates of an aqueous solution of silver salt and an aqueous solution of halide may be increased, alternatively, the concentrations of an aqueous solution of silver salt and an aqueous solution of halide may be increased.

When performing by the double-jet method in which an aqueous silver salt solution and an aqueous halide salt solution are added simultaneously, it is preferable to stir in the reaction vessel well or to dilute the concentration of the solution to be added for preventing the introduction of growth dislocation due to ununiformity of iodine.

A method is more preferable in which an AgI fine grain emulsion prepared outside the reaction vessel is added to the same timing when an aqueous silver salt solution and an aqueous halide salt solution are added. In this case, the temperature of growth is preferably 50° C. or more and 90° C. or less, and more preferably 60° C. or more and 85° C. or less. The AgI fine grain emulsion may be that prepared in advance. Alternatively, an AgI fine grain emulsion may be added while being prepared continuously. In this case, with respect to the preparation method, JP-A-10-43570 is available as a reference.

The average grain size of the AgI emulsion to be added is 0.01 μm or more and 0.1 μm or less, and preferably 0.02 μm or more and 0.08 μm or less. The iodine composition of the base grains can be varied by adjusting the amount of the AgI emulsion to be added.

It is also possible to add silver iodobromide fine grains instead of adding an aqueous silver salt solution and an aqueous halide salt solution. In this case, base grains having a desired iodine composition are obtained by rendering the iodine amount of the fine grains equal to the iodine amount of the desired base grains. Although the silver iodobromide fine grains may be those prepared in advance, it is more preferable that the fine grains may be added while being prepared continuously. The size of the silver iodobromide fine grains to be added is 0.005 μm or more and 0.05 μm or less, and preferably 0.01 μm or more and 0.03 μm or less.

The temperature during the growth is 60° C. or more and 90° C. or less, and preferably from 70° C. to 85° C.

It is also possible to combine the aforementioned ion adding method, the AgI fine grain adding method, and the AgBrI fine grain adding method.

In the present invention, tabular grains preferably have dislocation lines. However, for the purpose of reducing pressure desensitization, it is preferable that there are no dislocation lines in a base portion. Dislocation lines in tabular grains can be observed by a direct method using a transmission electron microscope at a low temperature described in, e.g., J. F. Hamilton, Phot. Sci. Eng., 11, 57, (1967) or T. Shiozawa, J. Soc. Phot. Sci. Japan, 35, 213, (1972). That is, silver halide grains, extracted carefully from an emulsion so as not to apply a pressure at which dislocations are produced in the grains, are placed on a mesh for electron microscopic observation. Observation is performed by a transmission method while the sample is cooled to prevent damage (e.g., print out) due to electron rays. In this case, the greater the thickness of a grain, the more difficult it becomes to transmit electron rays through it. Therefore, grains can be observed more clearly by using an electron microscope of high voltage type (200 kV or more for a grain having a thickness of 0.25 $\mu$m). From photographs of grains obtained by the above method, it is possible to obtain the positions and the number of dislocation lines in each grain viewed in a direction perpendicular to the main planes of the grain.

Next, step (b) will be described.

First, step (b1) will be described. Step (b1) comprises a first shell step and a second shell step. A first shell is formed on the base described above. The ratio of the first shell is 1% or more and 30% or less of the total silver amount, and the average silver iodide content of the first shell is 20 mol % or more and 100 mol % or less. More preferably, the ratio of the first shell is 1% or more and 20% or less of the total silver amount, and the average silver iodide content of the first shell is preferably 25 mol % or more and 100 mol % or less. The growth of the first shell on a base is basically performed by the addition of an aqueous silver nitrate solution and an aqueous halogen solution containing both iodide and bromide by the double-jet method, or by the addition of an aqueous silver nitrate solution and an aqueous halogen solution containing iodide by the double-jet method. Alternatively, an aqueous halogen solution containing iodide is added by the single-jet method.

Any of these methods may be applied, and any combination thereof may also be applied. As is clear from the average silver iodide content of the first shell, silver iodide can also precipitate in addition to a silver iodobromide mixed crystal during the formation of the first shell. In either case, the silver iodide vanishes and entirely changes into a silver iodobromide mixed crystal during the formation of the second shell.

A preferable method for the formation of the first shell is a method comprising adding a silver iodobromide or silver iodide fine grain emulsion, ripening and dissolving. Another preferable method is a method comprising adding a silver iodide fine grain emulsion, followed by the addition of an aqueous silver nitrate solution or addition of aqueous silver nitrate solution and an aqueous halogen solution. In this case, the dissolution of the silver iodide fine grain emulsion is accelerated by the addition of the aqueous silver nitrate solution. The silver amount of the added silver iodide fine grain emulsion is used to obtain the first shell, and the silver iodide content thereof is assumed to be 100 mol %. The amount of silver of the added aqueous silver nitrate solution is used to calculate the second shell. It is preferable that the silver iodide fine grain emulsion is added abruptly.

"To add a silver iodide fine grain emulsion abruptly adding" is to add the silver iodide fine grain emulsion preferably within 10 minutes, and more preferably, within 7 minutes. This condition may vary in accordance with, e.g., the temperature, pBr, and pH of the system to which the emulsion is added, the type and concentration of a protective colloid agent such as gelatin, and the presence/absence, type, and concentration of a silver halide solvent. However, a shorter addition time is more preferable as described above. During the addition, it is preferable that an aqueous solution of silver salt such as silver nitrate is not substantially added. The temperature of the system during the addition is preferably 40° C. or more and 90° C. or less, and most preferably, 50° C. or more and 80° C. or less.

A silver iodide fine grain emulsion essentially need only be silver iodide and can contain silver bromide and/or silver chloride as long as a mixed crystal can be formed. The emulsion is preferably 100% silver iodide. The crystal structure of silver iodide can be a $\beta$ body, a $\gamma$ body, or, as described in U.S. Pat. No. 4,672,026, the disclosure of which is herein incorporated by reference, an $\alpha$ body or an $\alpha$ body similar structure. In the present invention, the crystal structure is not particularly restricted but is preferably a mixture of $\beta$ and $\gamma$ bodies, and more preferably, a $\beta$ body. The silver iodide fine grain emulsion can be either an emulsion formed immediately before addition described in U.S. Pat. No. 5,004,679 the disclosure of which is herein incorporated by reference, or an emulsion subjected to a regular washing step. In the present invention, an emulsion subjected to a regular washing step is used. The silver iodide fine grain emulsion can be readily formed by a method described in, e.g., aforementioned U.S. Pat. No. 4,672,026. A double-jet addition method using an aqueous silver salt solution and an aqueous iodide salt solution in which grain formation is performed with a fixed pI value is preferred. The pI is the logarithm of the reciprocal of the $I^-$ ion concentration of the system. The temperature, pI, and pH of the system, the type and concentration of a protective colloid agent such as gelatin, and the presence/absence, type, and concentration of a silver halide solvent are not particularly limited. However, a grain size of preferably 0.1 $\mu$m or less, and more preferably, 0.07 $\mu$m or less is convenient for the present invention. Although the grain shapes cannot be perfectly specified because the grains are fine grains, the variation coefficient of a grain size distribution is preferably 25% or less. The effect of the present invention is particularly remarkable when the variation coefficient is 20% or less. The sizes and the size distribution of the silver iodide fine grain emulsion are obtained by laying silver iodide fine grains on a mesh for electron microscopic observation and directly observing the grains by a transmission method instead of a carbon replica method. This is because measurement errors are increased by observation done by the carbon replica method since the grain sizes are small. The grain size is defined as the diameter of a circle having an area equal to the projected surface area of the observed grain. The grain size distribution also is obtained by using this equivalent-circle diameter of the projected surface area. In the present invention, the most effective silver iodide fine grains have a grain size of 0.06 to 0.02 $\mu$m and a grain size distribution variation coefficient of 18% or less.

After the grain formation described above, a silver iodide fine grain emulsion is preferably subjected to regular washing described in, e.g., U.S. Pat. No. 2,614,929, the disclosure of which is herein incorporated by reference, and adjustments of the pH, the pI, the concentration of a protective colloid agent such as gelatin, and the concentration of the contained silver iodide are performed. The pH is preferably 5 to 7. The pI value is preferably the one at which the solubility of silver iodide is a minimum or the one higher than that value. As the protective colloid agent, a common gelatin having an average molecular weight of approximately 100,000 is preferably used. A low-molecular-weight gelatin having an average molecular weight of 20,000 or less also is preferably used. It is sometimes convenient to use a mixture of gelatins having different molecular weights. The gelatin amount is preferably 10 to 100 g, and more preferably, 20 to 80 g per kg of an emulsion. The silver amount is preferably 10 to 100 g, and more preferably, 20 to 80 g, in terms of silver atoms, per kg of an emulsion. As the gelatin amount and/or the silver amount, it is preferable to choose values suited to abrupt addition of the silver iodide fine grain emulsion.

The silver iodide fine grain emulsion is usually dissolved before being added. During the addition it is necessary to sufficiently raise the efficiency of stirring of the system. The rotating speed of stirring is preferably set to be higher than usual. The addition of an antifoaming agent is effective to prevent the formation of foam during the stirring. More specifically, an antifoaming agent described in, e.g., examples of U.S. Pat. No. 5,275,929 is used.

As a more preferable method for forming the first shell, it is possible to form a silver halide phase containing silver iodide while causing iodide ions to generate abruptly by using an iodide ion releasing agent described in U.S. Pat. No. 5,496,694, instead of the conventional iodide ion supply method (the method of adding free iodide ions).

The iodide ion-releasing agent releases iodide ions through its reaction with an iodide ion release control agent (a base and/or a nucleophilic reagent). Preferable examples of this nucleophilic reagent used include the following chemical species, e.g., hydroxide ion, sulfite ion, hydroxylamine, thiosulfate ion, metabisulfite ion, hydroxamic acids, oximes, dihydroxybenzenes, mercaptanes, sulfinate, carboxylate, ammonia, amines, alcohols, ureas, thioureas, phenols, hydrazines, hydrazides, semicarbazides, phosphines and sulfides.

The release rate and timing of iodide ions can be controlled through the control of the concentration and addition method of a base or a nucleophilic reagent or the control of the temperature of the reaction solution. A preferable base is alkali hydroxide.

To generate iodide ions abruptly, the concentrations of the iodide ion-releasing agent and iodide ion release control agent are preferably $1\times10^{-7}$ to 20 M, more preferably, $1\times10^{-5}$ to 10 M, further preferably, $1\times10^{-4}$ to 5 M, and particularly preferably, $1\times10^{-3}$ to 2 M.

If the concentration exceeds 20 M, the addition amounts of the iodide ion-releasing agent and iodide ion release control agent having large molecular weights adversely become too great compared to the capacity of the grain formation vessel.

If the concentration is less than $1\times10^{-7}$ M, the iodide ion-releasing reaction rate adversely becomes too low, and this makes it difficult to abruptly generate the iodide ion-releasing agent.

The temperature is preferably 30 to 80, more preferably, 35 to 75° C., and particularly preferably, 35 to 60° C.

At high temperatures exceeding 80° C., the iodide ion-releasing reaction rate generally becomes extremely high. At low temperatures below 30° C., the iodide ion-releasing reaction temperature generally becomes extremely low. Both cases are undesirable because the use conditions are restricted.

When a base is used to release iodide ions, a change in the solution pH can also be used. If this is the case, the pH range for controlling the rate and timing of releasing iodide ions is preferably 2 to 12, more preferably 3 to 11, and particularly preferably 5 to 10. Most preferably, the pH after adjustment is 7.5 to 10.0. Under a neutral condition of pH 7, hydroxide ions having a concentration determined by the ion product of water function as control agents.

A nucleophilic reagent and a base can be used jointly. When this is the case, the pH can be controlled within the above range to thereby control the rate and timing of releasing iodide ions.

When iodine atoms are to be released in the form of iodide ions from the iodide ion-releasing agent, these iodine atoms may be entirely released or may partially remain without decomposition.

The second shell is formed on the above-described base and a tabular grain having the first shell. The ratio of the second shell is 10 mol % or more and 40 mol % or less of the total silver amount, and the average silver iodide content of the second shell is 0 mol % or more and 5 mol % or less. More preferably, the ratio of the second shell is 15 mol % or more and 30 mol % or less of the total silver amount, and the average silver iodide content of the fourth shell is 0 mol % or more and 3 mol % or less. The growth of the second shell on a base and a tabular grain having the first shell can be performed either in a direction to increase the aspect ratio of the tabular grain or in a direction to decrease it. The growth of the second shell is basically performed by addition of an aqueous silver nitrate solution and an aqueous halogen solution containing bromide using the double-jet method. Alternatively, it is also possible to add an aqueous silver halogen solution containing bromide and then add an aqueous silver nitrate solution by the single-jet method. The temperature and pH of the system, the type and concentration of a protective colloid agent such as gelatin, and the presence/absence, type, and concentration of a silver halide solvent may vary over a broad range. With respect to pBr, the pBr at the end of the formation of the second shell layer is preferably higher than that in the initial stages of the formation of that layer. Preferably, the pBr in the initial stages of the formation of the layer is 2.9 or less, and the pBr at the end of the formation of the layer is 1.7 or more. More preferably, the pBr in the initial stages of the formation of the layer is 2.5 or less, and the pBr at the end of the formation of the layer is 1.9 or more. Most preferably, the pBr in the initial stages of the formation of the layer is 1 or more and 2.3 or less and the pBr at the end of the formation of the layer is 2.1 or more and 4.5 or less.

It is preferable that there are dislocation lines in the portion of step (b1). The dislocation lines are preferably present in the vicinities of the side faces of tabular grains. The vicinities of the side faces refer to the six side faces of a tabular grain and the area inside the faces, that is, the portion grown in step (b1). The average number of the dislocation lines present in the side faces is preferably 10 or more, and more preferably 20 or more per grain. If dislocation lines are densely present or they are observed to cross each other, it is sometimes impossible to correctly count dislocation lines per grain. Even in such situations, however, dislocation lines can be roughly counted to such an extent as in units of 10 lines, like 10, 20, or 30 dislocation lines, thereby making it possible to distinguish these grains from those in which obviously only a few dislocation lines are present. The average number of dislocation lines per grain is obtained as a number average by counting dislocation lines for 100 or more grains.

The dislocation line amount distribution is preferably uniform between tabular grains of the present invention. In an emulsion of the present invention, silver halide grains containing 10 or more dislocation lines per grain account for preferably 100 to 50%, more preferably, 100 to 70%, and most preferably, 100 to 90%.

A percentage lower than 50% is undesirable in respect of homogeneity between grains.

To obtain the ratio of grains containing dislocation lines and the number of dislocation lines in the present invention, it is preferable to directly observe dislocation lines for 100 grains or more, more preferably 200 grains or more, and particularly preferably 300 grains or more.

Next, step (b2) will be described.

Step (b2) includes the following embodiments: as a first embodiment, a method comprising dissolving only the vicinities of apexes with iodide ions; as a second embodiment, a method comprising adding a silver salt solution and an iodide salt solution simultaneously; as a third embodiment, a method comprising substantially dissolving only the vicinities of apexes with a silver halide solvent; and as a forth embodiment, a method via halogen conversion.

The first embodiment, the method of dissolving with iodide ions will be described below.

When iodide ions are added to base grains, the vicinity of each apex portion of the base grains is dissolved and the grains are somewhat rounded. When, successively, a silver nitrate solution and a bromide solution, or a silver nitrate solution and a mixed solution comprising a bromide solution and an iodide solution are added simultaneously, the grains further grow and dislocation is introduced in the vicinities of the apexes. With respect to this method, JP-A's-4-149541 and 9-189974 are available as references.

For attaining an effective dissolution according to the present embodiment, it is preferable that when the value obtained by multiplying, by 100, the quotient resulting from dividing the number of the whole iodide ions by the mol number of the total silver in the base grains is let be $I_2$ (mol %), the total amount of the iodide ions to be added in this embodiment satisfies the condition in which $(I_2-I_1)$ is 0 or more and 8 or less, and more preferably 0 or more and 4 or less, with respect to the silver iodide content of the base grains $I_1$ (mol %).

The lower the concentration of the iodide ions to be added in this embodiment, the more preferable. Specifically, the concentration is preferably 0.2 mol/L or less, and more preferably 0.1 mol/L or less.

pAg during the addition of iodide ions is preferably 8.0 or more, and more preferably 8.5 or more.

Following the dissolution of the apex portions of the base grains by the addition of iodide ion to the base grains, the grains are further grown so that dislocation is introduced in the vicinities of the apexes by the addition of a silver nitrate solution or the simultaneous addition of a silver nitrate solution and a bromide solution or a silver nitrate solution and a mixed solution comprising a bromide solution and an iodide solution.

The second embodiment, the method comprising adding a silver salt solution and an iodide salt solution simultaneously will be described below. By rapidly adding a silver salt solution and an iodide salt solution to base grains, it is possible to epitaxially generate silver iodide or a silver halide having a high silver iodide content at apex portions of the grains. At this time, the addition rates of the silver salt solution and the iodide salt solution are preferably 0.2 min. or more and 0.5 min. or less, more preferably 0.5 min. or more and 2 min. or less. This method is disclosed in JP-A's-4-149541 and therefore the publication is available as a reference.

Following the dissolution of the apex portions of the base grains by the addition of iodide ion to the base grains, the grains are further grown so that dislocation is introduced in the vicinities of the apexes by the addition of a silver nitrate solution or the simultaneous addition of a silver nitrate solution and a bromide solution or a silver nitrate solution and a mixed solution comprising a bromide solution and an iodide solution.

The third embodiment, the method using a silver halide solvent will be described below.

When a silver halide solvent is added to a dispersion medium containing base grains and then a silver salt solution and an iodide salt solution are added simultaneously, silver iodide or a silver halide having a high silver iodide content preferentially grows at apex portions of the base grains dissolved with the silver halide solvent. In this operation, it is not necessary to add the silver salt solution or the iodide salt solution rapidly. This method is disclosed in JP-A's-4-149541 and therefore the publication is available as a reference.

Following the dissolution of the apex portions of the base grains by the addition of iodide ion to the base grains, the grains are further grown so that dislocation is introduced in the vicinities of the apexes by the addition of a silver nitrate solution or the simultaneous addition of a silver nitrate solution and a bromide solution or a silver nitrate solution and a mixed solution comprising a bromide solution and an iodide solution.

Next, the forth embodiment, the method via halogen conversion will be described.

This is a method in which an epitaxially growing site director (hereinafter, referred to as a site director), such as a sensitizing dye disclosed in JP-A-58-108526 and a water-soluble iodide, is added to base grains so that epitaxial of silver chloride is formed at the apex portions of the base grains and then iodide ions are added so that the silver chloride is halogen converted into silver iodide or silver halide having a high silver iodide content. As the site director, sensitizing dyes, a water-soluble thiocyanate ion and water-soluble iodide ion can be used, and the iodide ion is preferable. The iodide ion is used in an amount of 0.0005 to 1 mol %, and preferably 0.001 to 0.5 mol % of the base grains. When the optimum amount of iodide ion is added and then a silver salt solution and a chloride salt solution are added simultaneously, epitaxial of silver chloride can be formed at apex portions of the base grains.

The following is a description on halogen conversion of silver chloride caused by iodide ions. A silver halide having a great solubility is converted into a silver halide having a less solubility by addition of halide ions capable of forming the silver halide having a less solubility. This process is called halogen conversion and is disclosed in U.S. Pat. No. 4,142,900. By selectively subjecting the silver chloride epitaxially grown at apex portions of the base to halogen conversion with iodide ions, a silver iodide phase is formed at apex portions of the base grains. The detail will be disclosed in JP-A-4-149541.

Following the halogen conversion of the silver chloride epitaxially grown at apex portions of the base grains into a silver iodide phase caused by the addition of iodide ions, the grains are further grown so that dislocation is introduced in the vicinities of the apexes by the addition of a silver nitrate solution or the simultaneous addition of a silver nitrate solution and a bromide solution or a silver nitrate solution and a mixed solution comprising a bromide solution and an iodide solution.

It is preferable that there are dislocation lines in the portion of step (b2). The dislocation lines are preferably present in the vicinities of the apex portions of tabular grains. The vicinity of an apex portion of a grain refers to the three-dimensional portion defined in the following manner. Perpendiculars are dropped each from a point located on a straight line connecting the center of the grain and x % away from the center of the straight line to each of the sides of the grain defining the apex. The above perpendiculars and the above sides surround a three-dimensional portion. The value of x is preferably 50 or more and less than 100, and more preferably 75 or more and less than 100. The average number of the dislocation lines present in the edge portions is preferably 10 or more, and more preferably 20 or more per grain. If dislocation lines are densely present or they are observed to cross each other, it is sometimes impossible to correctly count dislocation lines per grain. Even in such situations, however, dislocation lines can be roughly counted to such an extent as in units of 10 lines, like 10, 20, or 30 dislocation lines, thereby making it possible to distinguish these grains from those in which obviously only a few dislocation lines are present. The average number of dislocation lines per grain is obtained as a number average by counting dislocation lines for 100 or more grains.

The dislocation line amount distribution is preferably uniform between tabular grains of the present invention. In an emulsion of the present invention, silver halide grains containing 10 or more dislocation lines per grain account for preferably 100 to 50%, more preferably, 100 to 70%, and most preferably, 100 to 90%.

A percentage lower than 50% is undesirable in respect of homogeneity between grains.

To obtain the ratio of grains containing dislocation lines and the number of dislocation lines in the present invention, it is preferable to directly observe dislocation lines for 100 grains or more, more preferably 200 grains or more, and particularly preferably 300 grains or more.

Next, step (b3) will be described.

About the epitaxial formation of silver halide to base grains, U.S. Pat. No. 4,435,501 discloses that silver salt epitaxial can be formed at selected sites, e.g., apex portions or side face portions of base grains, by a site director such as iodide ions, aminoazaindene or spectral sensitizing dyes adsorbed to the surface of the base grains. In JP-A-8-69069, the enhancement of sensitivity is attained by forming silver salt epitaxial at selected sites in extremely thin tabular grains and subjecting the epitaxial phase to optimum chemical sensitization.

Also in the present invention, it is very preferable to enhance the sensitivity of the base grains of the present invention using these methods. As the site director, aminoazaindene or spectral sensitizing dyes may be used and iodide ions or thiocyanate ions may also be used. These may be properly used depending on the purposes, or may be used in combination.

By varying the addition amounts of the sensitizing dyes, sensitizing ions and thiocyanate ions, the site for forming silver salt epitaxial can be limited to the main plane portions, the side face portions or the apex portions of base grains. Combinations of them are also possible. It is preferable that the amounts of aminoazaindene, iodide ions, thiocyanate ions and spectral sensitizing dyes are suitably selected depending on the silver amount and the surface area of the silver halide base grains to be used, and the limited sites of epitaxial. The addition amount of the iodide ions is 0.0005 to 1.0 mol %, preferably 0.001 to 0.5 mol % to the silver amount of the base grains. Further the amount of the thiocyanate ions is 0.01 to 0.2 mol %, preferably 0.02 to 0.1 mol % of the silver mount of the base grains. After the addition of the site director, the silver salt solution and halide solution are added to form epitaxial. The temperature at which silver salt epitaxial is formed is preferably 40 to 70° C., and more preferably 45 to 60° C. At this time, pAg is preferably 7.5 or less, and more preferably 6.5 or less. By using the site directors epitaxial of silver salt can be formed on apex portions of the base grain or side face portions. The thus obtained emulsion may be enhanced its sensitivity by being subjected to chemical sensitization selectively in its epitaxial phase as in JP-A-8-69069, and also may be further grown by means of simultaneous addition of a silver salt solution and a halide salt solution following the silver salt epitaxial formation. As the aqueous halide salt solution to be added in this treatment, a bromide salt solution, or a mixed solution comprising a bromide salt solution and an iodide salt solution is preferable. In the treatment, the temperature is preferably 40 to 80° C., and more preferably 45 to 70° C. At this time, pAg is preferably 5.5 or more and 9.5 or less, and more preferably 6.0 or more and 9.0 or less.

The epitaxial formed in step (b3) is characterized by projecting outside the base grains formed in step (a). The composition of epitaxial is preferably AgCl, AgBrCl, AgBrClI, AgBrI, AgI, AgSCN, or the like. It is more preferable to introduce a "dopant (metal complex)" such as those disclosed in JP-A-8-69069, to an epitaxial layer. The position of epitaxial growth may be at least a part of the apex portions, the side face portions and the main plane portions of the base grains and also may be spread over two or more portions. It is preferable that the shapes wherein the apex portion is only at apex portions, or only at side face portions or both apex and side face portions.

No dislocation lines are required to be present in the portion of step (b3), but it is more preferable that there is a dislocation line. It is preferable for dislocation lines to be present in the connecting portion between a base grain and an epitaxial growth portion or in an epitaxial portion. The average number of the dislocation lines present in the connecting portions or epitaxial portions is preferably 10 or more, and more preferably 20 or more per grain. If dislocation lines are densely present or they are observed to cross each other, it is sometimes impossible to correctly count dislocation lines per grain. Even in such situations, however, dislocation lines can be roughly counted to such an extent as in units of 10 lines, like 10, 20, or 30 dislocation lines, thereby making it possible to distinguish these grains from those in which obviously only a few dislocation lines are present. The average number of dislocation lines per grain is obtained as a number average by counting dislocation lines for 100 or more grains.

It is preferable that the system is doped with a hexacyanometal complex during the formation of an epitaxial portion. Of hexacyanometal complexes, those containing iron, ruthenium, osmium, cobalt, rhodium, iridium or chromium are preferable. The addition amount of such a metal complex is preferably with in the range of from $10^{-9}$ to $10^{-2}$ mol per mol of silver halide, and more preferably within the range of from $10^{-8}$ to $10^{-4}$ mol per mol of silver halide. The metal complex may be added after being dissolved in water or an organic solvent. The organic solvent preferably has a miscibility with water. Examples of the organic solvent includes alcohol, ether, glycol, ketone, ester and amide.

The dislocation line amount distribution is preferably uniform between tabular grains that may be used in the photosensitive material of the present invention. In an emulsion of the present invention, silver halide grains containing 10 or more dislocation lines per grain account for preferably 100 to 50% (in number), more preferably, 100 to 70%, and most preferably, 100 to 90%.

A percentage lower than 50% is undesirable in respect of homogeneity between grains.

To obtain the ratio of grains containing dislocation lines and the number of dislocation lines in the present invention, it is preferable to directly observe dislocation lines for 100 grains or more, more preferably 200 grains or more, and particularly preferably 300 grains or more.

As a protective colloid and as a binder of other hydrophilic colloid layers that are used when the emulsion that may be used in the present invention is prepared, gelatin is used advantageously, but another hydrophilic colloid can also be used.

Use can be made of, for example, a gelatin derivative, a graft polymer of gelatin with another polymer, a protein, such as albumin and casein; a cellulose derivative, such as hydroxyethylcellulose, carboxymethylcellulose, and cellulose sulfate ester; sodium alginate, a saccharide derivative, such as a starch derivative; and many synthetic hydrophilic polymers, including homopolymers and copolymers, such as a polyvinyl alcohol, a polyvinyl alcohol partial acetal, a poly-N-vinylpyrrolidone, a polyacrylic acid, a polymethacrylic acid, a polyacrylamide, a polyvinylimidazole and a polyvinylpyrazole.

Preferably, the silver halide emulsion that may be used in the photosensitive material of the present invention is washed with water for desalting and is dispersed in a freshly prepared protective colloid. Gelatin is used as protective colloid but natural high polymers besides gelatin and synthetic high polymers can also be used. Alkali-processed gelatin, oxidized gelatin, i.e., gelatin in which a methionine group in the gelatin molecule is oxidized with hydrogen peroxide, etc. (a methionine content of 40 $\mu$mol/g or less) and amino group-modified gelatin of the present invention (e.g., phthalated gelatin, trimellitated gelatin, succinated gelatin, maleated gelatin, and esterified gelatin). Further, if necessary, lime-processed ossein gelatin containing 20% or more, preferably 30% or more of components having a molecular weight of 280,000 in a molecular weight distribution determined by the Puggy's method disclosed in JP-A-11-237704 may be employed. Furthermore, for example, starches disclosed in EP No. 758758 and U.S. Pat. No. 5,733,718 may also be used. Further, natural high polymers will be described in JP-B-7-111550 and Research Disclosure, Vol. 176, No. 17643, item IX (December, 1978). The temperature at which the washing with water is carried out can be selected in accordance with the purpose, and preferably the temperature is selected in the range of 5° C. to 50° C. The pH at which the washing with water is carried out can be selected in accordance with the purpose, and preferably the pH is selected in the range of 2 to 10, and more preferably in the range of 3 to 8. The pAg at which the washing with water is carried out can be selected in accordance with the purpose, and preferably the pAg is selected in the range of 5 to 10. As a method of washing with water, it is possible to select from the noodle washing method, the dialysis method using a diaphragm, the centrifugation method, the coagulation settling method, the ion exchange method and the ultrafiltration. In the case of the coagulation settling method, selection can be made from, for example, the method wherein sulfuric acid salt is used, the method wherein an organic solvent is used, the method wherein a water-soluble polymer is used, and the method wherein a gelatin derivative is used.

During the grain formation of the present invention, it is possible to cause a polyalkyleneoxide block copolymer disclosed in, for example, JP-A's-5-173268, 5-173269, 5-173270, 5-173271, 6-202258 and 7-175147, or a polyalkyleneoxide copolymer disclosed in Japanese Patent No. 3089578 to exist. Such a compound exists may exist at any timing during the preparation of the grains. However, its use in early stages of grain formation exhibits a great effect.

A description will be made to the third emulsion that can be used in the photosensitive material of the present invention, that is, tabular silver halide grains having (100) faces as their parallel main planes and constituted by silver iodobromide or silver chloroiodobromide whose chloride content is 10 mol % or less.

With respect to the (100) tabular grains of the present invention, 50 to 100%, preferably 70 to 100%, and more preferably 90 to 100%, of the total projected area is occupied by tabular grains having (100) faces as main planes and having an aspect ratio of 2 or more. The grain thickness is preferably in the range of 0.01 to 0.10 $\mu$m, more preferably 0.02 to 0.08 $\mu$m, and most preferably 0.03 to 0.07 $\mu$m. The aspect ratio is preferably in the range of 2 to 100, more preferably 3 to 50, and most preferably 5 to 30. The variation coefficient of grain thickness (percentage of "standard deviation of distribution/average grain thickness", hereinafter referred to as "COV") is preferably 30% or less, more preferably 25% or less, and most preferably 20% or less. The smaller this COV, the higher the monodispersity of grain thickness.

In the measuring the equivalent circle diameter and thickness of tabular grains, a transmission electron micrograph (TEM) thereof is taken according to the replica method, and the equivalent circle diameter and thickness of each individual grain are measured. In this method, the thickness of tabular grains is calculated from the length of shadow of the replica. In the present invention, the COV is determined as a result of measuring at least 600 grains.

The silver halide composition of the (100) tabular grains of the present invention is silver iodobromide or silver chloroiodobromide having a silver chloride content of less than 10 mol %. Furthermore, other silver salts, such as silver rhodamide, silver sulfide, silver selenide, silver telluride, silver carbonate, silver phosphate and an organic acid salt of silver, may be contained in the form of other separate grains or as parts of silver halide grains.

The X-ray diffraction method is known as means for investigating the halogen composition of AgX crystals. The X-ray diffraction method is described in detail in, for example, Kiso Bunseki Kagaku Koza 24 (Fundamental Analytical Chemistry Course 24) "X-sen Kaisetu (X-ray Diffraction)". In the standard method, Kβ radiation of Cu is used as a radiation source, and the diffraction angle of AgX (420) face is determined by the powder method.

When the diffraction angle 2θ is determined, the lattice constant (a) can be determined by Bragg's equation as follows:

$$2d \sin \theta = \lambda$$

$$d = a/(h^2+k^2+l^2)^{1/2},$$

wherein 2θ represents the diffraction angle of (hkl) face; λ represents the wavelength of X rays; and d represents the spacing of (hkl) faces. Because, with respect to silver halide solid solutions, the relationship between the lattice constant (a) and the halogen composition is known (described in, for example, T. H. James "The Theory of the Photographic Process, 4th ed.", Macmillian, New York), determination of the lattice constant leads to determination of the halogen composition.

The halogen composition structure of (100) tabular grains according to the present invention is not limited. Examples thereof include grains having a core/shell double structure wherein the halogen compositions of the core and the shell are different from each other and grains having a multiple structure composed of a core and two or more shells. The core is preferably constituted of silver bromide, to which, however, the core of the present invention is not limited. With respect to the composition of the shell, it is preferred that the silver iodide content be higher therein than in the core.

It is preferred that the (100) tabular grains of the present invention have an average silver iodide content of 2.3 mol % or more and an average silver iodide content, at the surface of grains, of 8 mol % or more. The surface silver iodide content, can be measured by the above mentioned XPS.

The (100) tabular grains that may be used in the photosensitive material of the present invention can be classified by shape into the following six types of grains. (1) Grains whose main plane shape is a right-angled parallelogram. (2) Grains whose main plane shape is a right-angled parallelogram having one or more, preferably 1 to 4 corners selected from four corners of which are non-equivalently deleted, namely, grains whose K1=(area of maximum deletion)/(area of minimum deletion) is 2 to ∞. (3) Grains whose main plane shape is a right-angled parallelogram having four corners of which are equivalently deleted (grains whose K1 is smaller than 2). (4) Grains whose 5 to 100%, preferably 20 to 100% of the side of faces in the deletions one (111) faces. (5) Grains having main planes each with four sides, of which at least two sides opposite to each other are outward protrudent curves. (6) Grains whose main plane shape is a right-angled parallelogram having one or more, preferably 1 to 4 corners selected from four corners of which are deleted in the shape of a right-angled parallelogram. These features of the grains can be identified by observation through an electron microscope.

With respect to the (100) tabular grains of the present invention, the ratio of (100) faces to surface crystal habits is 80% or more, preferably 90% or more. A statistical estimation of the ratio can be performed by the use of an electron micrograph of grains. When the (100) tabular face ratio of AgX grains of an emulsion is nearly 100%, the above estimate can be ascertained by the following method. The method is described in Journal of the Chemical Society of Japan, 1984 No. 6, page 942, which comprises causing a given amount of (100) tabular grains to adsorb varied amounts of benzothiacyanine dye at 40° C. for 17 hr, determining the sum total (S) of surface areas of all grains and the sum total (S1) of areas of (100) faces per unit emulsion from light absorption at 625 nm, and calculating the (100) face ratio by applying these sum total values to the formula: (S1/S)×100 (%).

The average equivalent sphere diameter of the (100) tabular grains of the present invention is preferably less than 0.35 μm. An estimate of grain size can be obtained by measuring the projected area and thickness according to the replica method.

A description will be made to the fourth emulsion that can be used in the photosensitive material of the present invention, that is, tabular silver halide grains having (111) faces or (100) faces as parallel main planes, having an aspect ratio of 2 or more and containing silver chloride in an amount of at least 80 mol %.

Special measures must be implemented for producing (111) grains of high silver chloride content. Use may be made of the method of producing tabular grains of high silver chloride content with the use of ammonia as described in U.S. Pat. No. 4,399,215 to Wey. Also, use may be made of the method of producing tabular grains of high silver chloride content with the use of a thiocyanate as described in U.S. Pat. No. 5,061,617 to Maskasky. Further, use may be made of the following methods of incorporating additives (crystal habit-controlling agents) at the time of grain formation in order to form grains of high silver chloride content having (111) faces as external surfaces:

| Pat. No. | crystal habit-controlling agent | Inventor |
|---|---|---|
| U.S. Pat. No. 4,400,463 | azaindene + thioether peptizer | Maskasky |
| U.S. Pat. No. 4,783,398 | 2,4-dithiazolidinone | Mifune et al. |
| U.S. Pat. No. 4,713,323 | aminopyrazolopyrimidine | Maskasky |
| U.S. Pat. No. 4,983,508 | bispyridinium salt | Ishiguro et al. |
| U.S. Pat. No. 5,185,239 | triaminopyrimidine | Maskasky |
| U.S. Pat. No. 5,178,997 | 7-azaindole compound | Maskasky |
| U.S. Pat. No. 5,178,998 | xanthine | Maskasky |
| JP-A-64-70741 | dye | Nishikawa et al. |
| JP-A-3-212639 | aminothioether | Ishiguro |
| JP-A-4-283742 | thiourea derivative | Ishiguro |
| JP-A-4-335632 | triazolium salt | Ishiguro |
| JP-A-2-32 | bispyridinium salt | Ishiguro et al. |
| JP-A-8-227117 | monopyridinium salt | Ozeki et al. |

With respect to the formation of (111) tabular grains, although various methods of using crystal habit-controlling agents are known as listed in the above table, the compounds (compound examples 1 to 42) described in JP-A-2-32 are preferred, and the crystal habit-controlling agents 1 to 29 described in JP-A-8-227117 are especially preferred. However, the present invention is in no way limited to these.

The (111) tabular grains are obtained by forming two parallel twinned crystal faces. The formation of such twin faces is influenced by the temperature, dispersion medium (gelatin), halide concentration, etc., so that appropriate conditions must be set on these. In the presence of a crystal habit-controlling agent at the time of nucleation, the gelatin concentration is preferably in the range of 0.1 to 10%. The chloride concentration is 0.01 mol/liter or more, preferably 0.03 mol/liter (liter hereinafter referred to as "L") or more.

JP-A-8-184931 discloses that, for monodispersing grains, it is preferred not to use any crystal habit-controlling agent at the time of nucleation. When no crystal habit-controlling agent is used at the time of nucleation, the gelatin concentration is in the range of 0.03 to 10%, preferably 0.05 to 1.0%. The chloride concentration is in the range of 0.001 to 1 mol/L, preferably 0.003 to 0.1 mol/L. The nucleation temperature, although can arbitrarily be selected as long as it is in the range of 2 to 90° C., is preferably in the range of 5 to 8° C., more preferably 5 to 40° C.

Nuclei of tabular grains are formed at the initial stage of nucleation. However, a multiplicity of non-tabular grain nuclei are contained in the reaction vessel immediately after the nucleation. Therefore, such a technology that, after the nucleation, ripening is carried out to thereby cause only tabular grains to remain while other grains are eliminated is required. When the customary Ostwald ripening is performed, nuclei of tabular grains are also dissolved and eliminated, so that the number of nuclei of tabular grains is reduced with the result that the size of obtained tabular grains is increased. In order to prevent this, a crystal habit-controlling agent is added. In particular, the simultaneous use of gelatin phthalate enables increasing the effect of the crystal habit-controlling agent and thus enables preventing the dissolution of tabular grains. The pAg during the ripening is especially important, and is preferably in the range of 60 to 130 mV with silver/silver chloride electrodes.

The thus formed nuclei are subjected to physical ripening and are grown in the presence of a crystal habit-controlling agent by adding a silver salt and a halide thereto. In the system, the chloride concentration is 5 mol/L or less, preferably in the range of 0.05 to 1 mol/L. The temperature for grain growth, although can be selected from among 10 to 90° C., is preferably in the range of 30 to 80° C.

The total addition amount of crystal habit-controlling agent is preferably $6\times10^{-5}$ mol or more, more preferably in the range of $3\times10^{-4}$ to $6\times10^{-2}$ mol, per mol of silver halides of completed emulsion. The timing of addition of the crystal habit-controlling agent can be at any stage from the silver halide grain nucleation to physical ripening and during the grain growth. After the addition, the formation of (111) faces is started. Although the crystal habit-controlling agent may be placed in the reaction vessel in advance, in the formation of tabular grains of small size, it is preferred that the crystal habit-controlling agent be placed in the reaction vessel simultaneously with the grain growth so that the concentration thereof is increased.

When the amount of dispersion medium used at nucleation is short in growth, it is needed to compensate for the same by an addition. It is preferred that 10 to 100 g/L of gelatin be present for growth. The compensatory gelatin is preferably gelatin phthalate or gelatin trimellitate.

The pH at grain formation, although arbitrary, is preferably in the neutral to acid region.

Now, the (100) tabular grains will be described. The (100) tabular grains are tabular grains having (100) faces as main planes. The shape of these main planes is, for example, a right-angled parallelogram, or a tri- to pentagon corresponding to a right-angled parallelogram having one corner selected from the four corners of which has been deleted (deletion having the shape of a right-angled triangle composed of the corner apex and sides making the corner), or a tetra- to octagon corresponding to a right-angled parallelogram having two to four corners selected from the four corners of which have been deleted.

When a right-angled parallelogram having been compensated for the deletions is referred to as a compensated tetragon, the neighboring side ratio (length of long side/length of short side) of the right-angled parallelogram or compensated tetragon is in the range of 1 to 6, preferably 1 to 4, and more preferably 1 to 2.

The formation of tabular silver halide emulsion grains having (100) main planes is performed by adding an aqueous solution of silver salt and an aqueous solution of halide to a dispersion medium such as an aqueous solution of gelatin under agitation and mixing them together. For example, JP-A's-6-301129, 6-347929, 9-34045 and 9-96881 disclose such a method that, at the formation, making silver iodide or iodide ions, or silver bromide or bromide ions, exist to thereby produce strain in nuclei due to a difference in size of crystal lattice from silver chloride so that a crystal defect imparting anisotropic growability, such as spiral dislocation, is introduced. When the spiral dislocation is introduced, the formation of two-dimensional nuclei at the surface is not rate-determining under low supersaturation conditions with the result that the crystallization at the surface is advanced. Thus, the introduction of spiral dislocation leads to the formation of tabular grains. Herein, the low supersaturation conditions preferably refer to 35% or less, more preferably 2 to 20%, of the critical addition. Although the crystal defect has not been ascertained as being a spiral dislocation, it is contemplated that the possibility of spiral dislocation is high from the viewpoint of the direction of dislocation introduction and the impartation of anisotropic growability to grains. It is disclosed in JP-A's-8-122954 and 9-189977 that, for reducing the thickness of tabular grains, retention of the introduced dislocation is preferred.

Moreover, the method of forming the (100) tabular grains by adding a (100) face formation accelerator is disclosed in JP-A-6-347928, in which use is made of imidazoles and 3,5-diaminotriazoles, and JP-A-8-339044, in which use is made of polyvinyl alcohols. However, the present invention is in no way limited thereto.

Although the grains of high silver chloride content refer to those having a silver chloride content of 80 mol % or more, it is preferred that 95 mol % or more thereof consist of silver chloride. The grains of the present invention preferably have a so-termed core/shell structure consisting of a core portion and a shell portion surrounding the core portion. Preferably, 90 mol % or more of the core portion consists of silver chloride. The core portion may further consist of two or more portions whose halogen compositions are different from each other. The volume of the shell portion is preferably 50% or less, more preferably 20% or less, of the total grain volume. The silver halide composition of the shell portion is preferably silver iodochloride or silver iodobromochloride. The shell portion preferably contains 0.5 to 13 mol %, more preferably 1 to 13 mol %, of iodide. The silver iodide content of a whole grain is preferably 5 mol % or less, more preferably 1 mol % or less.

Also, it is preferred that the silver bromide content be higher in the shell portion than in the core portion. The silver bromide content of a whole grain is preferably 20 mol % or less, more preferably 5 mol % or less.

The average grain size (equivalent sphere diameter in terms of volume) of silver halide grains, although not particularly limited, is preferably in the range of 0.1 to 0.8 μm, more preferably 0.1 to 0.6 μm.

The tabular grains of silver halides preferably have an equivalent circle diameter of 0.2 to 1.0 μm. Herein, the diameter of silver halide grains refers to the diameter of a circle having the same area as the projected area of each individual grain in an electron micrograph. The thickness of silver halide grains is preferably 0.2 μm or less, more preferably 0.1 μm or less, and most preferably 0.06 μm or less. In the present invention, 50% or more, in terms of a ratio to total projected area of all the grains, are occupied by silver halide grains having an aspect ratio (ratio of grain diameter/thickness) of 2 or more, preferably ranging from 5 to 20.

Generally, the tabular grains are of a tabular shape having two parallel surfaces. Therefore, the "thickness" of the present invention is expressed by the spacing of two parallel surfaces constituting the tabular grains.

The grain size distribution of silver halide grains of the present invention, although may be polydisperse or monodisperse, is preferably monodisperse. In particular, the variation coefficient of equivalent circle diameter of tabular grains occupying 50% or more of the total projected area is preferably 20% or less, ideally 0%.

When the crystal habit-controlling agent is present on the grain surface after the grain formation, it exerts influence on the adsorption of sensitizing dye and the development. Therefore, it is preferred to remove the crystal habit-controlling agent after the grain formation. However, when the crystal habit-controlling agent is removed, it is difficult for the (111) tabular grains of high silver chloride content to maintain the (111) faces under ordinary conditions. Therefore, it is preferable to retain the grain configuration by substitution with a photographically useful compound such as a sensitizing dye. This method is described in, for example, JP-A's-9-80656 and 9-106026, and U.S. Pat. Nos. 5,221,602, 5,286,452, 5,298,387, 5,298,388 and 5,176,992.

The crystal habit-controlling agent is desorbed from grains by the above method. The desorbed crystal habit-controlling agent is preferably removed out of the emulsion by washing. The washing can be performed at such temperatures that the gelatin generally used as a protective colloid is not solidified. For the washing, use can be made of various known techniques such as the flocculation method and the ultrafiltration method. The washing temperature is preferably 40° C. or higher.

The desorption of the crystal habit-controlling agent from grains is accelerated at low pH values. Therefore, the pH of the washing step is preferably lowered as far as excess aggregation of grains does not occur.

The general aspects of the emulsions or the present invention will be described below.

Reduction sensitization preferable performed in the present invention can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. It is also possible to combine two or more of these methods.

The method of adding reduction sensitizers is preferred in that the level of reduction sensitization can be finely adjusted.

As examples of the reduction sensitizer stannous chloride, ascorbic acid and its derivatives, hydroquinone and its derivatives, catechol and is derivatives, hydroxylamine and its derivatives, amines and polyamines, hydrazine and its derivatives, para-phenylenediamin and its derivatives, formamidinesulfinic acid(thiourea dioxide), a silane compound, and a borane compound, can be mentioned. In reduction sensitization of the present invention, it is possible to selectively use these reduction sensitizers or to use two or more types of compounds together. Regarding the methods for performing the reduction sensitization, those disclosed in U.S. Pat. Nos. 2,518,698, 3,201,254, 3,411,917, 3,779,777, 3,930,867, may be used. Regarding the methods for using the reduction sensitizer, those disclosed in JP-B's-57-33572 and 58-1410, JP-A-57-179835, may be used. Preferable compounds as the reduction sensitizer are catechol and its derivatives, hydroxylamine and its derivatives, and formamidinesulfinic acid(thiourea dioxide). Although the addition amount of reduction sensitizers must be so selected as to meet the emulsion manufacturing conditions, a proper amount is $10^{-7}$ to $10^{-1}$ mol per mol of a silver halide.

The reduction sensitizer is added during grain formation by dissolving thereof to water, or organic solvents such as alcohols, glycols, ketones, esters, and amides.

Examples of the silver halide solvents which can be employed in the present invention include (a) organic thioethers described in U.S. Pat. Nos. 3,271,157, 3,531,289, and 3,574,628, JP-A's-54-1019 and 54-158917, (b) thiourea derivatives described in, for example, JP-A's-53-82408, 55-77737 and 55-2982, (c) silver halide solvents having a thiocarbonyl group interposed between an oxygen or sulfur atom and a nitrogen atom, described in JP-A-53-144319, (d) imidazoles described in JP-A-54-100717, (e) ammonia and (f) thiocyanates.

Thiocyanates, ammonia and tetramethylthiourea can be mentioned as especially preferred silver halide solvents. The amount of added solvent, although varied depending on the type thereof, is, if thiocyanate is use, preferably in the range of $1\times10^{-4}$ to $1\times10^{-2}$ mol per mol of silver halide.

In the preparation of the emulsion of the present invention, it is preferable to make salt of metal ion exist, for example, during grain formation, desalting, or chemical sensitization, or before coating in accordance with the intended use. The metal ion salt is preferably added during grain formation when doped into grains, and after grain formation and before completion of chemical sensitization when used to decorate the grain surface or used as a chemical sensitizer. The salt can be doped in any of an overall grain, only the core, the shell, or the epitaxial portion of a grain, and only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroxide, hexa-coordinated complex salt, or tetra-coordinated complex salt. Examples are $CdBr_2$, $CdCl_2$, $Cd(NO_3)_2$, $Pb(NO_3)_2$, $Pb(CH_3COO)_2$, $K_4[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in the form of a combination of two or more types of them.

The metal compounds are preferably dissolved in an appropriate solvent, such as water, methanol or acetone, and added in the form of a solution. To stabilize the solution, an aqueous hydrogen halogenide solution (e.g., HCl or HBr) or an alkali halide (e.g., KCl, NaCl, KBr, or NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, or KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

It is sometimes useful to perform a method of adding a chalcogen compound during preparation of an emulsion, such as described in U.S. Pat. No. 3,772,031. In addition to S, Se and Te, cyanate, thiocyanate, selenocyanate, carbonate, phosphate, or acetate may be present.

The silver halide grains which can be used for the photosensitive material of the present invention can be subjected to at least one of chalcogen sensitization such as sulfur sensitization, selenium sensitization and tellurium sensitization, noble metal sensitization such as gold sensitization and palladium sensitization, and reduction sensitization, in a desired step in the process for preparation of the silver halide emulsion. Two or more kinds of sensitization are preferably used in combination. Various types of emulsion can be prepared according to in which step chemical sensitization is performed. The types include a type in which a chemical sensitizing core is embedded in each grain, a type in which a chemical sensitizing core is embedded in a position close to a surface of each grain, and a type in which a chemical sensitizing core is formed on a surface of each grain. The location of a chemical sensitizing core of the emulsion which can be used for the photosensitive material of the present invention can be selected according to the object. Generally, preferable is the case where at least one kind of chemical sensitizing core is formed in the vicinity of a surface of each grain.

One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferred.

A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

An oxidizer capable of oxidizing silver is preferably used during the process of producing the emulsion for use in the present invention. The silver oxidizer is a compound having an effect of acting on metallic silver to thereby convert the same to silver ion. A particularly effective compound is one that converts very fine silver grains, formed as a by-product in the step of forming silver halide grains and the step of chemical sensitization, into silver ions. Each silver ion produced may form a silver salt sparingly soluble in water, such as a silver halide, silver sulfide or silver selenide, or may form a silver salt easily soluble in water, such as silver nitrate. The silver oxidizer may be either an inorganic or an organic substance. Examples of suitable inorganic oxidizers include ozone, hydrogen peroxide and its adducts (e.g., $NaBO_2.H_2O_2.3H_2O$, $2NaCO_3.3H_2O_2$, $Na_4P_2O_7.2H_2O_2$ and $2Na_2SO_4.H_2O_2.2H_2O$), peroxy acid salts (e.g., $K_2S_2O_8$, $K_2C_2O_6$ and $K_2P_2O_8$), peroxy complex compounds (e.g., $K_2[Ti(O_2)C_2O_4].3H_2O$, $4K_2SO_4.Ti(O_2)OH.SO_4.2H_2O$ and $Na_3[VO(O_2)(C_2H_4)_2].6H_2O$), permanganates (e.g., $KMnO_4$), chromates (e.g., $K_2Cr_2O_7$) and other oxyacid salts, halogen elements such as iodine and bromine, perhalogenates (e.g., potassium periodate), salts of high-valence metals (e.g., potassium hexacyanoferrate (II)) and thiosulfonates.

Examples of suitable organic oxidizers include quinones such as p-quinone, organic peroxides such as peracetic acid and perbenzoic acid and active halogen releasing compounds (e.g., N-bromosuccinimide, chloramine T and chloramine B).

Oxidizers preferred in the present invention are inorganic oxidizers selected from among ozone, hydrogen peroxide and adducts threreof, halogen elements and thiosulfonates and organic oxidizers selected from among quinones. The embodiment wherein the above-mentioned reduction sensitizer and the oxidizer to silver are used in combination is preferable. A method of performing reduction sensitization after the oxidizer is used, or the reversed method thereof, or a method of making both sensitizer and oxidizer co-exist can be used by selection. These method can be performed in a grain formation step or chemical sensitization step by selection.

Photographic emulsions used in the present invention can contain various compounds in order to prevent fog during the preparing process, storage, or photographic processing of a sensitized material, or to stabilize photographic properties. That is, it is possible to add many compounds known as antifoggants or stabilizers, e.g., thiazoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxazolinethione; and azaindenes such as triazaindenes, tetrazaindenes (particularly 4-hydroxy-substituted(1,3,3a,7) tetrazaindenes), and pentazaindenes. For example, compounds described in U.S. Pat. Nos. 3,954,474 and 3,982,947 and JP-B-52-28660 can be used. One preferred compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and stabilizers can be added during preparation of an emulsion to achieve their original fog preventing effect and stabilizing effect. In addition, the antifoggants and stabilizers can be used for various purposes of, e.g., controlling the crystal habit of grains, decreasing the grain size, decreasing the solubility of grains, controlling chemical sensitization, and controlling the arrangement of dyes.

The photographic emulsion that is used in the present invention is preferably spectrally sensitized by methine dyes and so in order to exert the advantages of the present invention. Examples of employed dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dye, and composite merocyanine dyes. Any of nuclei commonly used in cyanine dyes as basic heterocyclic nuclei can be employed in these dyes. That is, there can be employed, for example, a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzoimidazole nucleus and a quinoline nucleus. These nuclei may have substituents on carbon atoms thereof.

5- or 6-membered heterocyclic cores of pyrazoline-5-one core, thiohydaontoin core, 2-thiooxazolidine-2,4-dione core, thiazolidine-2,4-dione core, rhodanine core, and thiobarbiturate core can be applied to a merocyanine dye or complex merocyanine dye, as a core having a ketomethylene structure.

These sensitizing dyes may be used individually, or a combination thereof may be used. A combination of sensitizing dyes is often adopted for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, GB Nos. 1, 344, 281, and 1,507,803, JP-B's-43-4936, and 53-12375, JP-A's-52-110618 and 52-109925.

Along with sensitizing dyes, the emulsion may include a dye having no spectral sensitizing effect, or a material which does not substantially absorb visible light and displays supersensitization.

The time at which the sensitizing dye can be added at any stage of emulsion preparation which is known to be useful. Most usually, the addition of the sensitizing dye is performed in a time period after the completion of the chemical sensitization but before coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, the spectral sensitization can be conducted prior to the chemical sensitization and, also, the spectral sensitizing dye can be added prior to the completion of silver halide grain precipitation to thereby initiate the spectral sensitization as described in JP-A-58-113928. Further, the above sensitizing dye can be divided prior to addition, that is, part of the sensitizing dye can be added prior to the chemical sensitization with the rest of the sensitizing dye added after the chemical sensitization as taught in U.S. Pat. No. 4,225,666. Still further, the spectral sensitizing dye can be added at any stage during the formation of silver halide grains according to the method disclosed in U.S. Pat. No. 4,183,756 and other methods.

The addition amount of the sensitizing dye is preferably $4\times10^{-6}$ to $8\times10^{-3}$ mol per mol of silver halide.

The silver halide color photosensitive material of the present invention is only required to have at least one light-sensitive layer on a support. Typical example thereof is a silver halide photosensitive material having at least one light-sensitive unit layer comprising a plural of silver halide emulsion layers each having the substantially the same color sensitivity but different in speed. The light-sensitive unit layer is a unit layer having color sensitivity to any one of blue light, green light and red light. In a multi-layered silver halide color photosensitive material, the arrangement of the unit layer is generally, in the order, from a support, of a red-sensitive layer. However, the arrangement order may be reversed depending on the purpose of the photographic material. A non lightsensitive layer can be formed between the silver halide lightsensitive layers and as the uppermost layer and the lowermost layer. These intermediate layers may contain, e.g., couplers to be described later, DIR compounds and color-mixing inhibitors. As for a plurality of silver halide emulsion layers constituting respective unit lightsensitive layer, a two-layered structure of high- and low-speed emulsion layers can be preferably used in this order so as to the speed becomes lower toward the support as described in DE (German Patent) 1,121,470 or GB 923,045, the disclosures of which are incorporated herein by reference. Also, as described in JP-A's-57-112751, 62-200350, 62-206541 and 62-206543, the disclosures of which are incorporated herein by reference, layers can be arranged such that a low-speed emulsion layer is formed farther from a support and a high-speed layer is formed closer to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932, the disclosure of which is incorporated herein by reference, layers can be arranged from the farthest side from a support in the order of blue-sensitive layer/GH/RH/GL/RL. Furthermore, as described in JP-A's-56-25738 and 62-63936, the disclosures of which are incorporated herein by reference, layers can be arranged from the farthest side from a support in the order of blue-sensitive layer/GL/RL/GH/RH.

As described in JP-B-49-15495, the disclosure of which is incorporated herein by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464, the disclosure of which is incorporated herein by reference.

In addition, the order of high-speed emulsion layer/low-speed emulsion layer/medium-speed emulsion layer or low-speed emulsion layer/medium-speed emulsion layer/high-speed emulsion layer can be adopted. Furthermore, the arrangement can be changed as described above even when four or more layers are formed.

In order to improve the color reproducibility, a donor layer (CL) of an interlayer effect having a spectral sensitivity distribution different from the main lightsensitive layers BL, GL and RL as described in U.S. Pat. Nos. 4,663,271, 4,705,744 and 4,707,436 and JP-A's-62-160448 and 63-89850 is preferably arranged adjacent to or close to the main lightsensitive layers.

The silver halide preferably used in the present invention is silver iodobromide, silver iodochloride, or silver iodochlorobromide containing about 30 mol % or less of silver iodide. A particularly preferable silver halide is silver iodebromide or silver iodochlorobromide containing about 2 to about 10 mol % of silver iodide.

Silver halide grains contained in the photographic emulsion can have regular crystals such as cubic, octahedral, or tetradecahedral crystals, irregular crystals such as spherical or tabular crystals, crystals having crystal defects such as twin planes, or composite shapes thereof.

The silver halide grain can be a fine grain having a grain size of about 0.2 μm or less, or be a large grain having a projected area diameter of up to about 10 μm, and an emulsion can be either a polydisperse or monodisperse emulsion.

A silver halide photographic emulsion which can be used in the present invention can be prepared by methods described in, e.g., "I. Emulsion preparation and types," Research Disclosure (RD) No. 17643 (December, 1978), pp. 22 and 23, and RD No. 18716 (November, 1979), page 648, and RD No. 307105 (November, 1989), pp. 863 to 865; P. Glafkides, "Chemie et Phisique Photographique", Paul Montel, 1967; C. F. Duffin, "Photographic Emulsion Chemistry", Focal Press, 1966; and V. L. Zelikman et al., "Making and Coating Photographic Emulsion", Focal Press, 1964.

Monodisperse emulsions described in, e.g., U.S. Pat. Nos. 3,574,628 and 3,655,394, and GB1,413,748 are also preferable.

Tabular grains having an aspect ratio of 3 or more can also be used in the present invention. Tabular grains can be easily prepared by methods described in Gutoff, "Photographic Science and Engineering", Vol. 14, pp. 248 to 257 (1970); and U.S. Pat. Nos. 4,434,226, 4,414,310, 4,433,048, and 4,439,520, and GB 2,112,157.

A crystal structure can be uniform, can have different halogen compositions in the interior and the surface layer thereof, or can be a layered structure. Alternatively, a silver halide having a different composition can be bonded by an epitaxial junction or a compound except for a silver halide such as silver rhodamide or lead oxide can be bonded. A mixture of grains having various types of crystal shapes can also be used.

The above emulsion can be any of a surface latent image type emulsion which mainly forms a latent image on the surface of a grain, an internal latent image type emulsion which forms a latent image in the interior of a grain, and another type of emulsion which has latent images on the surface and in the interior of a grain. However, the emulsion must be a negative type emulsion. The internal latent image type emulsion can be a core/shell internal latent image type emulsion described in JP-A-63-264740. A method of preparing this core/shell internal latent image type emulsion is described in JP-A-59-133542. Although the thickness of a shell of this emulsion depends on, e.g., development conditions, it is preferably 3 to 40 nm, and most preferably, 5 to 20 nm.

A silver halide emulsion is normally subjected to physical ripening, chemical ripening, and spectral sensitization steps before it is used. Additives for use in these steps are described in RD Nos. 17643, 18716, and 307105, and they are summarized in a table to be presented later.

In a photosensitive material of the present invention, it is possible to mix, in a single layer, two or more types of emulsions different in at least one of characteristics of a photosensitive silver halide emulsion, i.e., a grain size, grain size distribution, halogen composition, grain shape, and speed.

It is also possible to preferably use surface-fogged silver halide grains described in U.S. Pat. No. 4,082,553, internally fogged silver halide grains described in U.S. Pat. Nos. 4,626,498 and JP-A-59-214852, and colloidal silver, in sensitive silver halide emulsion layers and/or essentially non-sensitive hydrophilic colloid layers. The internally fogged or surface-fogged silver halide grain means a silver halide grain which can be developed uniformly (non-imagewise) regardless of whether the location is a non-exposed portion or an exposed portion of the photosensitive material. A method of preparing the internally fogged or surface-fogged silver halide grain is described in U.S. Pat. Nos. 4,626,498 and JP-A-59-214852. A silver halide which forms the core of an internally fogged core/shell type silver halide grain can have a different halogen composition. As the internally fogged or surface-fogged silver halide, any of silver chloride, silver chlorobromide, silver bromoiodide, and silver bromochloroiodide can be used. The average grain size of these fogged silver halide grains is preferably 0.01 to 0.75 μm, and most preferably, 0.05 to 0.6 μm. The grain shape can be a regular grain shape. Although the emulsion can be a polydisperse emulsion, it is preferably a monodisperse emulsion (in which at least 95% in weight or number of grains of silver halide grains have grain sizes falling within the range of ±40% of the average grain size).

In the present invention, it is preferable to use a nonsensitive fine grain silver halide. The nonsensitive fine grain silver halide consists of silver halide grains which are not exposed during imagewise exposure for obtaining a dye image and are not essentially developed during development. These silver halide grains are preferably not fogged in advance. In the fine grain silver halide, the content of silver bromide is 0 to 100 mol %, and silver chloride and/or silver iodide can be added if necessary. The fine grain silver halide preferably contains 0.5 to 10 mol % of silver iodide. The average grain size (the average value of equivalent-circle diameters of projected areas) of the fine grain silver halide is preferably 0.01 to 0.5 μm, and more preferably, 0.02 to 0.2 μm.

The fine grain silver halide can be prepared following the same procedures as for a common sensitive silver halide. The surface of each silver halide grain need not be optically sensitized nor spectrally sensitized. However, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this fine grain silver halide grain-containing layer.

The silver coating amount of a photosensitive material of the present invention is preferably 6.0 $g/m^2$ or less, most preferably 4.5 $g/m^2$.

Photographic additives usable in the present invention are also described in RD's, the disclosures of which are incorporated herein by reference, and the relevant portions are summarized in the following table.

| | Types of Additives | RD17643 | RD18716 | RD307105 |
|---|---|---|---|---|
| 1. | Chemical sensitizers | page 23 | page 648 right column | page 866 |
| 2. | Sensitivity increasing agents | | page 648 right column | |
| 3. | Spectral sensitizers, super sensitizers | pages 23–24 | page 648, right column to page 649, right column | pages 866–868 |
| 4. | Brighteners | page 24 | page 647, right column | page 868 |
| 5. | Light absorbents, filter dyes, ultraviolet absorbents | pages 25–26 | page 649, right column to page 650, left column | page 873 |
| 6. | Binders | page 26 | page 651, left column | pages 873–874 |
| 7. | Plasticizers, lubricants | page 27 | page 650, right column | page 876 |
| 8. | Coating aids, surfactants | pages 26–27 | page 650, right column | pages 875–876 |
| 9. | Antistatic agents | page 27 | page 650, right column | pages 876–877 |
| 10. | Matting agents | | | pages 878–879. |

Various dye forming couplers can be used in the photosensitive material of the present invention, and the following couplers are particularly preferable.

Yellow couplers: couplers represented by formulae (I) and (II) in EP No. 502,424A; couplers represented by formulae (1) and (2) in EP No. 513,496A (particularly Y-28 on page 18); a coupler represented by formula (I) in claim 1 of EP No. 568,037A; a coupler represented by general formula (I) in column 1, lines 45 to 55, in U.S. Pat. No. 5,066,576; a coupler represented by general formula (I) in paragraph 0008 of JP-A-4-274425; couplers described in claim 1 on page 40 in EP No. 498,381A1 (particularly D-35 on page 18); couplers represented by formula (Y) on page 4 in EP No. 447,969A1 (particularly Y-1 (page 17) and Y-54 (page 41)); and couplers represented by formulae (II) to (IV) in column 7, lines 36 to 58, in U.S. Pat. No. 4,476,219 (particularly II-17, II-19 (column 17), and II-24 (column 19)), the disclosures of the above documents disclosing the yellow couplers are incorporated herein by reference.

Magenta couplers: JP-A-3-39737 (L-57 (page 11, lower right column), L-68 (page 12, lower right column), and L-77 (page 13, lower right column); [A-4]-63 (page 134), and [A-4]-73 and -75 (page 139) in EP No. 456,257; M-4 and -6 (page 26), and M-7 (page 27) in EP No. 486,965; M-45 (page 19) in EP No. 571,959A; (M-1) (page 6) in JP-A-5-204106; and M-22 in paragraph 0237 of JP-A-4-362631, the disclosures of the above documents disclosing the magenta couplers are incorporated herein by reference.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by general formulae (Ia) and (Ib) in claim 1 of JP-A-6-67385, the disclosures of the above documents disclosing the cyan couplers are incorporated herein by reference.

Polymer couplers: P-1 and P-5 (page 11) in JP-A-2-44345, the disclosure of which is incorporated herein by reference.

Couplers for forming a colored dye with a proper diffusibility are preferably those described in U.S. Pat. No. 4,366,237, GB 2,125,570, EP 96,873B, and DE 3,234,533, the disclosures of which are incorporated herein by reference.

As couplers for correcting the unnecessary absorption of a colored dye, preferred use is made of, yellow colored cyan couplers represented by formulae (CI), (CII), (CIII), and (CIV) described on page 5 in EP No. 456,257A1 (particularly YC-86 on page 84); yellow colored magenta couplers ExM-7 (page 202), Ex-1 (page 249), and EX-7 (page 251) described in EP No. 456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers represented by formula (A) in claim 1 of WO No. 92/11575 (particularly compound examples on pages 36 to 45), the disclosures of all the documents disclosing the couplers for correcting the unnecessary absorption of a colored dye are incorporated herein by reference.

Examples of couplers that release a photographically useful group are as follows, the contents of the patent documents and etc. described below are incorporated herein by reference: Development inhibitor release compounds: compounds represented by formulae (I), (II), (III), and (IV) on page 11 of EP No. 378,236A1 (particularly T-101 (page 30), T-104 (page 31), T-113 (page 36), T-131 (page 45), T-144 (page 51), and T-158 (page 58)); a compound represented by formula (I) on page 7 of EP No. 436,938A2 (particularly D-49 (page 51)); a compound represented by formula (1) in EP No. 568,037A (particularly (23) (page 11)); and compounds represented by formulae (I), (II), and (III) on pages 5 and 6 of EP No. 440,195A2 (particularly I-(1) on page 29). Bleaching accelerator release compounds: compounds represented by formulae (I) and (I') on page 5 of EP No. 310,125A2 (particularly (60) and (61) on page 61); and compounds represented by formula (I) in claim 1 of JP-A-6-59411 (particularly (7) (page 7)). Ligand release compounds: compounds represented by LIG-X described in claim 1 of U.S. Pat. No. 4,555,478 (particularly compounds in column 12, lines 21 to 41). Leuco dye release compounds: compounds 1 to 6 in columns 3 to 8 of U.S. Pat. No. 4,749,641. Fluorescent dye release compounds: compounds represented by COUP-DYE in claim 1 of U.S. Pat. No. 4,774,181 (particularly compounds 1 to 11 in columns 7 to 10). Development accelerator or fogging agent release compounds: compounds represented by formulae (1), (2), and (3) in column 3 of U.S. Pat. No. 4,656,123 (particularly (I-22) in column 25); and ExZK-2 on page 75, lines 36 to 38, in EP No. 450,637A2. Compounds which release a group which does not function as a dye unless it splits off: compounds represented by formula (I) in claim 1 of U.S. Pat. No. 4,857,447 (particularly Y-1 to Y-19 in columns 25 to 36).

Preferable examples of additives other than couplers are as follows.

Dispersion mediums of an oil-soluble organic compound: P-3, P-5, P-16, P-19, P-25, P-30, P-42, P-49, P-54, P-55, P-66, P-81, P-85, P-86, and P-93 (pages 140 to 144) in JP-A-62-215272. Impregnating latexes of an oil-soluble organic compound: latexes described in U.S. Pat. No. 4,199,363. Scavengers of developing agent in an oxidized form: compounds represented by formula (I) in column 2, lines 54 to 62, in U.S. Pat. No. 4,978,606 (particularly I-(1), I-(2), I-(6), and I-(12) (columns 4 and 5)), and formulae in column 2, lines 5 to 10, in U.S. Pat. No. 4,923,787 (particularly compound 1 (column 3)). Stain inhibitors: formulae (I) to (III) on page 4, lines 30 to 33, particularly I-47, I-72, III-1, and III-27 (pages 24 to 48) in EP No. 298321A. Discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP No. 298,321A; II-1 to III-23, particularly III-10, in columns 25 to 38 of U.S. Pat. No. 5,122,444; I-1 to III-4, particularly II-2, on pages 8 to 12 in EP No. 471,347A; and A-1 to A-48, particularly A-39 and A-42, in columns 32 to 40 of U.S. Pat. No. 5,139,931. Materials which reduce the use amount of a color enhancer or a color-mixing inhibitor: I-1 to II-15, particularly I-46, on pages 5 to 24 in EP No. 411,324A. Formalin scavengers: SCV-1 to SCV-28, particularly SCV-8, on pages 24 to 29 in EP No. 477,932A. Film hardeners: H-1, H-4, H-6, H-8, and H-14 on page 17 in JP-A-1-214845; compounds (H-1 to H-54) represented by formulae (VII) to (XII) in columns 13 to 23 of U.S. Pat. No. 4,618,573;, compounds (H-1 to H-76), particularly H-14, represented by formula (6) on page 8, lower right column, in JP-A-2-214852; and compounds described in claim 1 of U.S. Pat. No. 3,325,287. Development inhibitor precursors: P-24, P-37, and P-39 (pages 6 and 7) in JP-A-62-168139; and compounds described in claim 1, particularly 28 and 29 in column 7, of U.S. Pat. No. 5,019,492. Antiseptic agents and mildewproofing agents; I-1 to III-43, particularly II-1, II-9, II-10, II-18, and III-25, in columns 3 to 15 of U.S. Pat. No. 4,923,790. Stabilizers and antifoggants: I-1 to (14), particularly I-1, I-60, (2), and (13), in columns 6 to 16 of U.S. Pat. No. 4,923,793; and compounds 1 to 65, particularly compound 36, in columns 25 to 32 of U.S. Pat. No. 4,952,483. Chemical sensitizers: triphenylphosphine, selenide, and compound 50 in JP-A-5-40324. Dyes: a-1 to b-20, particularly a-1, a-12, a-18, a-27, a-35, a-36, and b-5, on pages 15 to 18 and V-1 to V-23, particularly V-1, on pages 27 to 29 in JP-A-3-156450; F-I-1 to F-II-43, particularly F-I-11 and F-II-8, on pages 33 to 55 in EP No. 445,627A; III-1 to III-36, particularly III-1 and III-3, on pages 17 to 28 in EP No. 457,153A; microcrystalline dispersions of Dye-1 to Dye-124 on pages 8 to 26 in WO No. 88/04794; compounds 1 to 22, particularly compound 1, on pages 6 to 11 in EP No. 319,999A; compounds D-1 to D-87 (pages 3 to 28) represented by formulae (1) to (3) in EP No. 519,306A; compounds 1 to 22 (columns 3 to 10) represented by formula (I) in U.S. Pat. No. 4,268,622; and compounds (1) to (31) (columns 2 to 9) represented by formula (I) in U.S. Pat. No. 4,923,788. UV absorbents: compounds (18b) to (18r) and 101 to 427 (pages 6 to 9) represented by formula (1) in JP-A-46-3335; compounds (3) to (66) (pages 10 to 44) represented by formula (I) and compounds HBT-1 to HBT-10 (page 14) represented by formula (III) in EP No. 520,938A; and compounds (1) to (31) (columns 2 to 9) represented by formula (1) in EP No. 521,823A.

The present invention can be applied to various color photosensitive materials such as color negative films for general purposes or cinemas, color reversal films for slides and TV, color paper, color positive films and color reversal paper. Moreover, the present invention is suitable to lens-equipped film units described in JP-B-2-32615 and Jpn. Utility Model Appln. KOKOKU Publication No. 3-39784.

Supports which can be suitably used in the present invention are described in, e.g., RD. No. 17643, page 28; RD. No. 18716, from the right column of page 647 to the left column of page 648; and RD. No. 307105, page 879.

In the photosensitive material of the present invention, the total of thicknesses of all the hydrophilic colloidal layers on the side having emulsion layers is preferably 28 $\mu$m or less, more preferably 23 $\mu$m or less, especially preferably 18 $\mu$m or less. The film swelling speed $T_{1/2}$ is preferably 30 sec or less, and more preferably, 20 sec or less. The film swelling speed $T_{1/2}$ is defined as the time that, when the saturation film thickness means 90% of the maximum swollen film thickness realized by the processing in a color developing solution at 30° C. for 3 min 15 sec, spent for the film thickness to reach ½ of the saturation film thickness. The film thickness means one measured under moisture conditioning at 25° C. and at a relative humidity of 55% (two days). The film swelling speed $T_{1/2}$ can be measured by using a swellometer described in A. Green et al., Photogr. Sci. Eng., Vol. 19, No. 2, pp. 124 to 129. The film swelling speed $T_{1/2}$ can be regulated by adding a film hardening agent to gelatin as a binder or by changing aging conditions after coating. The swelling ratio preferably ranges from 150 to 400%. The swelling ratio can be calculated from the maximum swollen film thickness measured under the above conditions in accordance with the formula:

[maximum swollen film thickness−film thickness]/film thickness.

In the photosensitive material of the present invention, hydrophilic colloid layers (called "back layers") having a total dried film thickness of 2 to 20 $\mu$m are preferably formed on the side opposite to the side having emulsion layers. The back layers preferably contain the above light absorbent, filter dye, ultraviolet absorbent, antistatic agent, film hardener, binder, plasticizer, lubricant, coating aid and surfactant. The swelling ratio of the back layers is preferably 150% to 500%.

The photosensitive material of the present invention can be developed by conventional methods described in RD. No. 17643, pages 28 and 29; RD. No. 18716, page 651, left to right columns; and RD No. 307105, pages 880 and 881.

The color negative film processing solution for use in the present invention will be described below.

The compounds listed in page 9, right upper column, line 1 to page 11, left lower column, line 4 of JP-A-4-121739 can be used in the color developing solution for use in the present invention. Preferred color developing agents for use in especially rapid processing are 2-methyl-4-[N-ethyl-N-(2-hydroxyethyl)amino]aniline, 2-methyl-4-[N-ethyl-N-(3-hydroxypropyl)amino]aniline and 2-methyl-4-[N-ethyl-N-(4-hydroxybutyl)amino]aniline.

These color developing agents are preferably used in an amount of 0.01 to 0.08 mol, more preferably 0.015 to 0.06 mol, and much more preferably 0.02 to 0.05 mol per liter (L) of the color developing solution. The replenisher of the color developing solution preferably contains the color developing agent in an amount corresponding to 1.1 to 3 times the above concentration, more preferably 1.3 to 2.5 times the above concentration.

Hydroxylamine can widely be used as preservatives of the color developing solution. When enhanced preserving properties are required, it is preferred to use hydroxylamine derivatives having substituents for example, alkyl, hydroxyalkyl, sulfoalkyl and carboxyalkyl groups, examples of which include N,N-di(sulfoehtyl)hydroxylamine, monomethylhydroxylamine, dimethylhydroxylamine, monoethylhydroxylamine, diethylhydroxylamine and N,N-di(carboxyethyl)hydroxylamine. Of these, N,N-di(sulfoehtyl)hydroxylamine is most preferred. Although these may be used in combination with the hydroxylamine, it is preferred that one or at least two members thereof be used in place of the hydroxylamine.

These preservatives are preferably used in an amount of 0.02 to 0.2 mol, more preferably 0.03 to 0.15 mol, and most preferably 0.04 to 0.1 mol per liter of the color developing solution. The replenisher of the color developing solution preferably contains the preservative in an amount corresponding to 1.1 to 3 times the concentration of the mother liquor (processing tank solution) as in the color developing agent.

Sulfurous salts are used as tarring preventives for the color developing agent in an oxidized form in the color developing solution. Each sulfurous salt is preferably used in the color developing solution in an amount of 0.01 to 0.05 mol, more preferably 0.02 to 0.04 mol per liter, and is preferably used in the replenisher in an amount corresponding to 1.1 to 3 times the above concentration.

The pH value of the color developing solution preferably ranges from 9.8 to 11.0, especially preferably from 10.0 to 10.5. That of the replenisher is preferably set at 0.1 to 1.0 higher than the above value. Common buffers such as carbonate, phosphonate, sulfosalicylate and borate are used for stabilizing the above pH value.

Although the amount of the replenisher of the color developing solution preferably ranges from 80 to 1300 mL per $m^2$ of the photosensitive material, it is desired that the amount be smaller from the viewpoint of reducing environmental pollution load. Specifically, the amount of the replenisher more preferably ranges from 80 to 600 mL, most preferably from 80 to 400 mL.

Although the bromide ion concentration of the color developing solution generally ranges from 0.01 to 0.06 mol per liter, it is preferred that the above concentration be set at 0.015 to 0.03 mol per liter for inhibiting fog while maintaining speed to thereby improve discrimination and for bettering graininess. When the bromide ion concentration is set so as to fall within the above range, the replenisher preferably contains bromide ion in a concentration as calculated by the following formula. However, when C is negative, it is preferred that no bromide ion be contained in the replenisher.

$$C=A-W/V$$

wherein

C: bromide ion concentration of the color developing replenisher (mol/L),

A: target bromide ion concentration of the color developing solution (mol/L),

W: amount of bromide ions which elutes from the photosensitive material to the color developing solution when a 1 $m^2$ of photosensitive material is color-developed (mol), V: amount of color developing replenisher supplied per $m^2$ of the photosensitive material (L).

Development accelerators such as pyrazolidones represented by 1-phenyl-3-pyrazolidone and 1-phenyl-2-methyl-2-hydroxymethyl-3-pyrazolidone and thioether compounds represented by 3,6-dithia-1,8-octanediol are preferably used as means for enhancing speed when the amount of the replenisher has been reduced or when a high bromide ion concentration has been set.

Compounds and processing conditions described on page 4, left lower column, line 16 to page 7, left lower column, line 6 of JP-A-4-125558 can be applied to the processing solution having bleaching capability for use in the present invention.

Bleaching agents having redox potentials of at least 150 mV are preferably used. Specifically, suitable examples thereof are those described in JP-A-5-72694 and JP-A-5-173312, and especially suitable examples thereof are 1,3-diaminopropanetetraacetic acid and ferric complex salts of Example 1 compounds listed on page 7 of JP-A-5-173312.

For improving the biodegradability of the bleaching agent, it is preferred that ferric complex salts of compounds listed in JP-A's-4-251845, and 4-268552, EP Nos. 588,289, and 591,934 and JP-A-6-208213 be used as the bleaching agent. The concentration of the above bleaching agent preferably ranges from 0.05 to 0.3 mol per liter of the solution having bleaching capability, and it is especially preferred that a design be made at 0.1 to 0.15 mol per liter for reducing the discharge to the environment. When the solution having bleaching capability is a bleaching solution, a bromide is preferably incorporated therein in an amount of 0.2 to 1 mol, more preferably 0.3 to 0.8 mol per liter.

Each component is incorporated in the replenisher of the solution having bleaching capability fundamentally in a concentration calculated by the following formula. This enables holding the concentration of the mother liquor constant.

$$C_R=C_T\times(V1+V2)/V1+C_P$$

CR: concentration of each component in the replenisher,

CT: concentration of the component in the mother liquor (processing tank solution), V1: amount of replenisher having bleaching capability supplied per $m^2$ of photosensitive material (mL), and V2: amount carried from previous bath by 1 $m^2$ of photosensitive material (mL).

In addition, a pH buffer is preferably incorporated in the bleaching solution, and it is especially preferred to incorporate a dicarboxylic acid of low odor such as succinic acid, maleic acid, malonic acid, glutaric acid or adipic acid. It is also preferred to use common bleaching accelerators listed in JP-A-53-95630, RD No. 17129 and U.S. Pat. No. 3,893,858.

The bleaching solution is preferably replenished with 50 to 1000 mL, more preferably 80 to 500 mL, and much more preferably 100 to 300 mL, of a bleaching replenisher per $m^2$ of the photosensitive material. Further, the bleaching solution is preferably aerated.

Compounds and processing conditions described on page 7, left lower column, line 10 to page 8, right lower column, line 19 of JP-A-4-125558 can be applied to a processing solution having fixing capability.

For enhancing the fixing velocity and preservability, it is especially preferred to incorporate compounds represented by the general formulae (I) and (II) of JP-A-6-301169 either individually or in combination in the processing solution having fixing capability. Further, the use of p-toluenesulfinic salts and sulfinic acids listed in JP-A-1-224762 is preferred from the viewpoint of enhancing the preservability.

Although the incorporation of an ammonium as a cation in the solution having bleaching capability or solution having fixing capability is preferred from the viewpoint of enhancing the desilverization ability, it is preferred that the amount of ammonium be reduced or brought to nil from the viewpoint of minimizing environmental pollution.

Conducting jet agitation described in JP-A-1-309059 is especially preferred in the bleach, bleach-fix and fixation steps.

The amount of replenisher supplied in the bleach-fix or fixation step is in the range of 100 to 1000 mL, preferably 150 to 700 mL, and especially preferably 200 to 600 mL, per $m^2$ of the photosensitive material.

Silver is preferably recovered by installing any of various silver recovering devices in an in-line or off-line mode in the bleach-fix or fixation step. In-line installation enables processing with the silver concentration of the solution lowered, so that the amount of replenisher can be reduced. It is also suitable to conduct an off-line silver recovery and recycle residual solution for use as a replenisher.

The bleach-fix and fixation steps can each be constructed by a plurality of processing tanks. Preferably, the tanks are provided with cascade piping and a multistage counterflow system is adopted. A 2-tank cascade structure is generally effective from the viewpoint of a balance with the size of the developing machine. The ratio of processing time in the former-stage tank to that in the latter-stage tank is preferably in the range of 0.5:1 to 1:0.5, more preferably 0.8:1 to 1:0.8.

From the viewpoint of enhancing the preservability, it is preferred that a chelating agent which is free without forming any metal complex be present in the bleach-fix and fixing solutions. Biodegradable chelating agents described in connection with the bleaching solution are preferably used as such a chelating agent.

Descriptions made on page 12, right lower column, line 6 to page 13, right lower column, line 16 of JP-A-4-125558 mentioned above can preferably be applied to water washing and stabilization steps. In particular, with respect to stabilizing solutions, the use of azolylmethylamines described in EP Nos. 504,609 and 519,190 and N-methylolazoles described in JP-A-4-362943 in place of formaldehyde and the dimerization of magenta coupler into a surfactant solution not containing an image stabilizer such as formaldehyde are preferred from the viewpoint of protecting working environment.

To reduce adhesion of dust to a magnetic recording layer formed on a photosensitive material, a stabilizer described in JP-A-6-289559 can be preferably used.

The replenishment rate of washing water and a stabilizer is preferably 80 to 1,000 mL, more preferably, 100 to 500 mL, and most preferably, 150 to 300 mL per $m^2$ of a photosensitive material in order to maintain the washing and stabilization functions and at the same time reduce the waste liquors for environmental protection. In processing performed with this replenishment rate, it is preferable to prevent the propagation of bacteria and mildew by using known mildewproofing agents such as thiabendazole, 1,2-benzoisothiazoline-3-one, and 5-chloro-2-methylisothiazoline-3-one, antibiotics such as gentamicin, and water deionized by an ion exchange resin or the like. It is more effective to use deionized water together with a mildewproofing agent or an antibiotic.

The replenishment rate of a solution in a washing water tank or stabilizer tank is preferably reduced by performing reverse permeable membrane processing described in JP-A's-3-46652, 3-53246, 3-55542, 3-121448, and 3-126030. A reverse permeable membrane used in this processing is preferably a low-pressure reverse permeable membrane.

In the processing of the present invention, it is particularly preferable to perform processing solution evaporation correction disclosed in Journal of Technical Disclosure No. 94-4992. In particular, a method of performing correction on the basis of (formula-1) on page 2 by using temperature and humidity information of an environment in which a processor is installed is preferable. Water for use in this evaporation correction is preferably taken from the washing water replenishment tank. If this is the case, deionized water is preferably used as the washing replenishing water.

Processing agents described in aforementioned Journal of Technical Disclosure No. 94-4992, page 3, right column, line 15 to page 4, left column, line 32 are preferably used in the present invention. As a processor for these processing agents, a film processor described on page 3, right column, lines 22 to 28 is preferable.

Practical examples of processing agents, automatic processors, and evaporation correction methods suited to practicing the present invention are described in the same Journal of Technical Disclosure No. 94-4992, page 5, right column, line 11 to page 7, right column, last line.

Processing agents used in the present invention can be supplied in any form: a liquid agent having the concentration of a solution to be used, concentrated liquid agent, granules, powder, tablets, paste, and emulsion. Examples of such processing agents are a liquid agent contained in a low-oxygen permeable vessel disclosed in JP-A-63-17453, vacuum-packed powders and granules disclosed in JP-A's-4-19655 and 4-230748, granules containing a water-soluble polymer disclosed in JP-A-4-221951, tablets disclosed in JP-A's-51-61837 and 6-102628, and a paste disclosed in PCT KOHYO Publication No. 57-500485. Although any of these processing agents can be preferably used, the use of a liquid adjusted to have the concentration of a solution to be used is preferable for the sake of convenience in use.

As a vessel for containing these processing agents, polyethylene, polypropylene, polyvinylchloride, polyethyleneterephthalate, and nylon are used singly or as a composite material. These materials are selected in accordance with the level of necessary oxygen permeability. For a readily oxidizable solution such as a color developer, a low-oxygen permeable material is preferable. More specifically, polyethyleneterephthalate or a composite material of polyethylene and nylon is preferable. A vessel made of any of these materials preferably has a thickness of 500 to 1,500 $\mu$m and an oxygen permeability of 20 mL/$m^2$·24 hrs·atm or less.

Color reversal film processing solutions used in the present invention will be described below. Processing for a color reversal film is described in detail in Aztech Ltd., Known Technology No. 6 (1991, Apr. 1), page 1, line 5 to page 10, line 5 and page 15, line 8 to page 24, line 2, and any of the contents can be preferably applied. In this color reversal film processing, an image stabilizing agent is contained in a control bath or a final bath. Preferable examples of this image stabilizing agent are formalin, sodium formaldehyde-bisulfite, and N-methylolazole. Sodium formaldehyde-bisulfite or N-methylolazole is preferable in terms of work environment, and N-methyloltriazole is particularly preferable as N-methylolazole. The contents pertaining to a color developer, bleaching solution, fixing solution, and washing water described in the color negative film processing can be preferably applied to the color reversal film processing.

Preferable examples of color reversal film processing agents containing the above contents are an E-6 processing agent manufactured by Eastman Kodak Co. and a CR-56 processing agent manufactured by Fuji Photo Film Co., Ltd.

The magnetic recording layer for use in the present invention will be described below.

The magnetic recording layer is obtained by coating on a support with a water-base or organic solvent coating liquid having magnetic material grains dispersed in a binder.

Suitable magnetic material grains can be composed of any of ferromagnetic iron oxides such as $\gamma$ $Fe_2O_3$, Co coated $\gamma$ $Fe_2O_3$, Co coated magnetite, Co containing magnetite, ferromagnetic chromium dioxide, ferromagnetic metals, ferromagnetic alloys, Ba ferrite of hexagonal system, Sr ferrite, Pb ferrite and Ca ferrite. Of these, Co coated ferromagnetic iron oxides such as Co coated $\gamma$ $Fe_2O_3$ are preferred. The configuration thereof may be any of acicular, rice grain, spherical, cubic and plate shapes. The specific surface area is preferably at least 20 $m^2$/g, more preferably at least 30 $m^2$/g in terms of $S_{BET}$. The saturation magnetization ($\sigma s$) of the ferromagnetic material preferably ranges from $3.0\times10^4$ to $3.0\times10^5$ A/m, more preferably from $4.0\times10^4$ to $2.5\times10^5$ A/m. The ferromagnetic material grains may have their surface treated with silica and/or alumina or an organic material. Further, the magnetic material grains may have their surface treated with a silane coupling agent or a titanium coupling agent as described in JP-A-6-161032. Still further, use can be made of magnetic material grains having their surface coated with an organic or inorganic material as described in JP-A's-4-259911 and 5-81652.

The binder for use in the magnetic material grains can be composed of any of natural polymers (e.g., cellulose derivatives and sugar derivatives), acid-, alkali- or bio-degradable polymers, reactive resins, radiation curable resins, thermosetting resins and thermoplastic resins listed in JP-A-4-219569 and mixtures thereof. The Tg of each of the above resins ranges from −40 to 300° C. and the weight average molecular weight thereof ranges from 2 thousand to 1 million. For example, vinyl copolymers, cellulose derivatives such as cellulose diacetate, cellulose triacetate, cellulose acetate propionate, cellulose acetate butyrate and cellulose tripropionate, acrylic resins and polyvinylacetal resins can be mentioned as suitable binder resins. Gelatin is also a suitable binder resin. Of these, cellulose di(tri)acetate is especially preferred. The binder can be cured by adding an epoxy, aziridine or isocyanate crosslinking agent. Suitable isocyanate crosslinking agents include, for example, isocyanates such as tolylene diisocyanate, 4,4'-diphenylmethane diisocyanate, hexamethylene diisocyanate and xylylene diisocyanate, reaction products of these isocyanates and polyalcohols (e.g., reaction product of 3 mol of tolylene diisocyanate and 1 mol of trimethylolpropane), and polyisocyanates produced by condensation of these isocyanates, as described in, for example, JP-A-6-59357.

The method of dispersing the magnetic material in the above binder preferably comprises using a kneader, a pin type mill and an annular type mill either individually or in combination as described in JP-A-6-35092. Dispersants listed in JP-A-5-088283 and other common dispersants can be used. The thickness of the magnetic recording layer ranges from 0.1 to 10 $\mu$m, preferably 0.2 to 5 $\mu$m, and more preferably from 0.3 to 3 $\mu$m. The weight ratio of magnetic material grains to binder is preferably in the range of 0.5:100 to 60:100, more preferably 1:100 to 30:100. The coating amount of magnetic material grains ranges from 0.005 to 3 g/m$^2$, preferably from 0.01 to 2 g/m$^2$, and more preferably from 0.02 to 0.5 g/m$^2$. The transmission yellow density of the magnetic recording layer is preferably in the range of 0.01 to 0.50, more preferably 0.03 to 0.20, and most preferably 0.04 to 0.15. The magnetic recording layer can be applied to the back of a photographic support in its entirety or in striped pattern by coating or printing. The magnetic recording layer can be applied by the use of, for example, an air doctor, a blade, an air knife, a squeeze, an immersion, reverse rolls, transfer rolls, a gravure, a kiss, a cast, a spray, a dip, a bar or an extrusion. Coating liquids set forth in JP-A-5-341436 are preferably used.

The magnetic recording layer may also be provided with, for example, lubricity enhancing, curl regulating, antistatic, sticking preventive and head polishing functions, or other functional layers may be disposed to impart these functions. An abrasive of grains whose at least one member is nonspherical inorganic grains having a Mohs hardness of at least 5 is preferred. The nonspherical inorganic grains are preferably composed of fine grains of any of oxides such as aluminum oxide, chromium oxide, silicon dioxide and titanium dioxide; carbides such as silicon carbide and titanium carbide; and diamond. These abrasives may have their surface treated with a silane coupling agent or a titanium coupling agent. The above grains may be added to the magnetic recording layer, or the magnetic recording layer may be overcoated with the grains (e.g., as a protective layer or a lubricant layer). The binder which is used in this instance can be the same as mentioned above and, preferably, the same as the that of the magnetic recording layer. The photosensitive material having the magnetic recording layer is described in U.S. Pat. Nos. 5,336,589, 5,250,404, 5,229,259, and 5,215,874 and EP No. 466,130.

The polyester support for use in the present invention will be described below. Particulars thereof together with the below mentioned photosensitive material, processing, cartridge and working examples are specified in Journal of Technical Disclosure No. 94-6023 (issued by Japan Institute of Invention and Innovation on Mar. 15, 1994). The polyester for use in the present invention is prepared from a diol and an aromatic dicarboxylic acid as essential components. Examples of suitable aromatic dicarboxylic acids include 2,6-, 1,5-, 1,4- and 2,7-naphthalenedicarboxylic acids, terephthalic acid, isophthalic acid and phthalic acid, and examples of suitable diols include diethylene glycol, triethylene glycol, cyclohexanedimethanol, bisphenol A and other bisphenols. The resultant polymers include homopolymers such as polyethylene terephthalate, polyethylene naphthalate and polycyclohexanedimethanol terephthalate. Polyesters containing 2,6-naphthalenedicarboxylic acid in an amount of 50 to 100 mol % are especially preferred. Polyethylene 2,6-naphthalate is most preferred. The average molecular weight thereof ranges from approximately 5,000 to 200,000. The Tg of the polyester of the present invention is at least 50° C., preferably at least 90° C.

The polyester support is subjected to heat treatment at a temperature of from 40° C. to less than Tg, preferably from Tg minus 20° C. to less than Tg, in order to suppress curling. This heat treatment may be conducted at a temperature held constant within the above temperature range or may be conducted while cooling. The period of heat treatment ranges from 0.1 to 1500 hr, preferably 0.5 to 200 hr. The support may be heat treated either in the form of a roll or while being carried in the form of a web. The surface form of the support may be improved by rendering the surface irregular (e.g., coating with conductive inorganic fine grains of $SnO_2$, $Sb_2O_5$, etc.). Moreover, a scheme is desired such that edges of the support are knurled so as to render only the edges slightly high, thereby preventing photographing of core sections. The above heat treatment may be carried out in any of stages after support film formation, after surface treatment, after back layer application (e.g., application of an antistatic agent or a lubricant) and after undercoating application. The heat treatment is preferably performed after antistatic agent application.

An ultraviolet absorber may be milled into the polyester. Light piping can be prevented by milling, into the polyester, dyes and pigments commercially available as polyester additives, such as Diaresin produced by Mitsubishi Chemical Industries, Ltd. and Kayaset produced by NIPPON KAYAKU CO., LTD.

Next, in the present invention, a surface treatment is preferably conducted for bonding a support and a photosensitive material constituting layer to each other. The surface treatment is, for example, a surface activating treatment such as chemical treatment, mechanical treatment, corona discharge treatment, flame treatment, ultraviolet treatment, high frequency treatment, glow discharge treatment, active plasma treatment, laser treatment, mixed acid treatment or ozone oxidation treatment. Of these surface treatments, ultraviolet irradiation treatment, flame treatment, corona treatment and glow treatment are preferred.

Next, the subbing layer may be composed of a single layer or two or more layers. As the binder for the substratum, there can be mentioned not only copolymers prepared from monomers, as starting materials, selected from among vinyl chloride, vinylidene chloride, butadiene, methacrylic acid, acrylic acid, itaconic acid and maleic anhydride but also polyethyleneimine, an epoxy resin, a grafted gelatin, nitrocellulose and gelatin. Resorcin or p-chlorophenol is used as a support swelling compound. A gelatin hardener such as a chromium salt (e.g., chrome alum), an aldehyde (e.g., formaldehyde or glutaraldehyde), an isocyanate, an active halogen compound (e.g., 2,4-dichloro-6-hydroxy-S-triazine), an epichlorohydrin resin or an active vinyl sulfone compound can be used in the subbing layer. Also, $SiO_2$, $TiO_2$, inorganic fine grains or polymethyl methacrylate copolymer fine grains (0.01 to 10 $\mu$m) may be incorporated therein as a matting agent.

Further, an antistatic agent is preferably used in the present invention. Examples of suitable antistatic agents include carboxylic acids and carboxylic salts, sulfonic acid salt containing polymers, cationic polymers and ionic surfactant compounds.

Most preferred as the antistatic agent are fine grains of at least one crystalline metal oxide selected from among ZnO, $TiO_2$, $SnO_2$, $Al_2O_3$, $In_2O_3$, $SiO_2$, MgO, BaO, $MoO_3$ and $V_2O_5$ having a volume resistivity of $10^7$ Ω·cm or less, preferably $10^5$ Ω·cm or less, and having a grain size of 0.001 to 1.0 $\mu$m or a composite oxide thereof (Sb, P, B, In, S, Si, C, etc.) and fine grains of sol form metal oxides or composite oxides thereof. The content thereof in the photosensitive material is preferably in the range of 5 to 500 mg/m$^2$, more preferably 10 to 350 mg/m$^2$. The ratio of amount of conductive crystalline oxide or composite oxide thereof to binder is preferably in the range of 1/300 to 100/1, more preferably 1/100 to 100/5.

It is preferred that the photosensitive material of the present invention have lubricity. The lubricant containing layer is preferably provided on both the lightsensitive layer side and the back side. Preferred lubricity ranges from 0.25 to 0.01 in terms of dynamic friction coefficient. The measured lubricity is a value obtained by conducting a carriage on a stainless steel ball of 5 mm in diameter at 60 cm/min (25° C., 60% RH). In this evaluation, value of approximately the same level is obtained even when the opposite material is replaced by the lightsensitive layer side.

The lubricant which can be used in the present invention is, for example, a polyorganosiloxane, a higher fatty acid amide, a higher fatty acid metal salt or an ester of higher fatty acid and higher alcohol. Examples of suitable polyorganosiloxanes include polydimethylsiloxane, polydiethylsiloxane, polystyrylmethylsiloxane and polymethylphenylsiloxane. The lubricant is preferably added to the back layer or the outermost layer of the emulsion layer. Especially, polydimethylsiloxane and an ester having a long chain alkyl group are preferred.

A matting agent is preferably used in the photosensitive material of the present invention. Although the matting agent may be used on the emulsion side or the back side indiscriminately, it is especially preferred that the matting agent be added to the outermost layer of the emulsion side. The matting agent may be soluble in the processing solution or insoluble in the processing solution, and it is preferred to use the soluble and insoluble matting agents in combination. For example, polymethyl methacrylate, poly (methyl methacrylate/methacrylic acid) (9/1 or 5/5 in molar ratio) and polystyrene grains are preferred. The grain size thereof preferably ranges from 0.8 to 10 $\mu$m. Narrow grain size distribution thereof is preferred, and it is desired that at least 90% of the whole number of grains be included in the range of 0.9 to 1.1 times the average grain size. Moreover, for enhancing the mat properties, it is preferred that fine grains of 0.8 $\mu$m or less be simultaneously added, which include, for example, fine grains of polymethyl methacrylate (0.2 $\mu$m), poly(methyl methacrylate/methacrylic acid) (9/1 in molar ratio, 0.3 $\mu$m), polystyrene (0.25 $\mu$m) and colloidal silica (0.03 $\mu$m).

The film patrone employed in the present invention will be described below. The main material composing the patrone for use in the present invention may be a metal or a synthetic plastic.

Examples of preferable plastic materials include polystyrene, polyethylene, polypropylene and polyphenyl ether. The patrone for use in the present invention may contain various types of antistatic agents and can preferably contain, for example, carbon black, metal oxide grains, nonionic, anionic, cationic or betaine type surfactants and polymers. Such an antistatic patrone is described in JP-A's-1-312537 and 1-312538. The resistance thereof at 25° C. in 25% RH is preferably $10^{12}$ Ω or less. The plastic patrone is generally molded from a plastic having carbon black or a pigment milled thereinto for imparting light shielding properties. The patrone size may be the same as the current size 135, or for miniaturization of cameras, it is advantageous to decrease the diameter of the 25 mm cartridge of the current size 135 to 22 mm or less. The volume of the case of the patrone is preferably 30 cm$^3$ or less, more preferably 25 cm$^3$ or less. The weight of the plastic used in each patrone or patrone case preferably ranges from 5 to 15 g.

The patrone for use in the present invention may be one capable of feeding a film out by rotating a spool. Further, the patrone may be so structured that a film front edge is accommodated in the main frame of the patrone and that the film front edge is fed from a port part of the patrone to the outside by rotating a spool shaft in a film feeding out direction. These are disclosed in U.S. Pat. Nos. 4,834,306 and 5,226,613. The photographic film for use in the present invention may be a generally so termed raw stock having not yet been developed or a developed photographic film. The raw stock and the developed photographic film may be accommodated in the same new patrone or in different patrones.

A color photosensitive material of the present invention is also suitably used as a negative film for an advanced photo system (to be referred to as an APS hereinafter). Examples are NEXIA A, NEXIA F, and NEXIA H (ISO 200, 100, and 400, respectively) manufactured by Fuji Photo Film Co., Ltd. (to be referred to as Fuji Film hereinafter). These films are so processed as to have an APS format and set in an exclusive cartridge. These APS cartridge films are loaded into APS cameras such as the Fuji Film EPION Series represented by the EPION 300Z. A color photosensitive film of the present invention is also suited as a film with lens such as Fuji Film FUJICOLOR UTSURUNDESU SUPER SLIM.

A photographed film is printed through the following steps in a miniature laboratory system.

(1) Reception (an exposed cartridge film is received from a customer)
(2) Detaching step (the film is transferred from the cartridge to an intermediate cartridge for development)
(3) Film development
(4) Reattaching step (the developed negative film is returned to the original cartridge)

(5) Printing (prints of three types C, H, and P and an index print are continuously automatically printed on color paper [preferably Fuji Film SUPER FA8])

(6) Collation and shipment (the cartridge and the index print are collated by an ID number and shipped together with the prints)

As these systems, the Fuji Film MINILABO CHAMPION SUPER FA-298, FA-278, FA-258, FA-238 are preferable. Examples of a film processor are the FP922AL, FP562B, FP562BL, FP362B, and FP3622BL, and a recommended processing chemical is the FUJICOLOR JUST-IT CN-16L. Examples of a printer processor are the PP3008AR, PP3008A, PP1828AR, PP1828A, PP1258AR, PP1258A, PP728AR, and PP728A, and a recommended processing chemical is the FUJICOLOR JUST-IT CP-47L. A detacher used in the detaching step and a reattacher used in the reattaching step are preferably the Fuji Film DT200 or DT100 and AT200 or AT100, respectively.

The APS can also be enjoyed by PHOTO JOY SYSTEM whose main component is the Fuji Film Aladdin 1000 digital image scanner. For example, a developed APS cartridge film is directly loaded into the Aladdin 1000, or image information of a negative film, positive film, or print is input to the Aladdin 1000 by using the FE-550 35-mm film scanner or the PE-550 flat head scanner. Obtained digital image data can be easily processed and edited. This data can be printed out by the NC-550AL digital color printer using a photo-fixing heat-sensitive color printing system or the PICTOROGRAPHY 3000 using a laser exposure thermal development transfer system, or by existing laboratory equipment through a film recorder. The Aladdin 1000 can also output digital information directly to a floppy disk or Zip disk or to an CD-R via a CD writer.

In a home, a user can enjoy photographs on a TV set simply by loading a developed APS cartridge film into the Fuji Film Photo Player AP-1. Image information can also be continuously input to a personal computer by loading a developed APS cartridge film into the Fuji Film Photo Scanner AS-1. The Fuji Film Photo Vision FV-10 or FV-5 can be used to input a film, print, or three-dimensional object. Furthermore, image information recorded in a floppy disk, Zip disk, CD-R, or hard disk can be variously processed on a computer by using the Fuji Film Photo Factory application software. The Fuji Film NC-2 or NC-2D digital color printer using a photo-fixing heat-sensitive color printing system is suited to outputting high-quality prints from a personal computer.

To keep developed APS cartridge films, the FUJICOLOR POCKET ALBUM AP-5 POP L, AP-1 POP L, or AP-1 POP KG, or the CARTRIDGE FILE 16 is preferable.

EXAMPLE

Examples of the present invention will be described below, but the present invention is not limited to these examples.

Example 1

Silver halide emulsions Em-A1 was prepared by the methods set forth below:

(Em-A1)

42.2 L of an aqueous solution containing 36.7 g of a low-molecular-weight gelatin of 15,000 molecular weight converted to phthalate at a ratio of 97% and 31.7 g of KBr was vigorously agitated while maintaining the temperature at 35° C. 1583 mL of an aqueous solution containing 316.7 g of $AgNO_3$ and 1583 mL of an aqueous solution containing 221.5 g of KBr and 52.7 g of a low-molecular-weight gelatin whose molecular weight was 15,000 were added by the double jet method over a period of 1 min. Immediately after the completion of the addition, 52.8 g of KBr was added, 2485 mL of an aqueous solution containing 398.2 g of $AgNO_3$ and 2581 mL of an aqueous solution containing 291.1 g of KBr were added by the double jet method over a period of 2 min. Immediately after the completion of the addition, 47.8 of KBr was added and heated to 43° C., and the mixture was ripened. After the completion of the ripening, 923 g of a gelatin of 100,000 molecular weight converted to phthalate at a ratio of 97% and 79.2 g of KBr were added, and an aqueous solution of KBr and 15,947 mL of an aqueous solution containing 5,103 g of $AgNO_3$ were added by the double jet method over a period of 12 min while increasing the flow rate so that the final flow rate was 1.4 times the initial flow rate. During this period, the silver potential was maintained at −60 mV against saturated calomel electrode. The mixture was washed with water, and gelatin was added, effecting adjustments to a pH of 5.7, a pAg of 8.8, a gelatin weight to 64.1 g and weight of the emulsion, in terms of silver, to 131.8 g per kg of emulsion. Thus, a seed emulsion was obtained.

1211 mL of an aqueous solution containing 46 g of a gelatin converted to phthalate at a ratio of 97% and 1.7 g of KBr was vigorously agitated while maintaining the temperature at 75° C. 9.9 g of the above seed emulsion and then 0.3 g of modified silicon oil (L7602, produced by Nippon Unicar Company, Limited) were added thereto. $H_2SO_4$ was added to thereby adjust the pH to 5.5, and 67.6 mL of an aqueous solution containing 7.0 g of $AgNO_3$ and an aqueous solution of KBr were added by the double jet method over a period of 6 min while increasing the flow rate so that the final flow rate was 5.1 times the initial flow rate. During this period, the silver potential was maintained at −20 mV against saturated calomel electrode. 2 mg of sodium benzenethiosulfonate was added, an aqueous solution containing 144.5 g of $AgNO_3$ and 410 mL of a mixed aqueous solution of KBr and KI containing 7 mol % of KI were added by the double jet method over a period of 56 min while increasing the flow rate so that the final flow rate was 3.7 times the initial flow rate. During this period the silver potential was maintained at −45 mV against saturated calomel electrode. Still further, an aqueous solution of KBr and 121.3 mL of an aqueous solution containing 45.6 g of $AgNO_3$ were added by the double jet method over a period of 22 min. During this period, the silver potential was maintained at +20 mV against saturated calomel electrode. The mixture was heated to 82° C., and KBr was added to thereby adjust the silver potential to −80 mV. Thereafter, an AgI fine grain emulsion of 0.037 $\mu$m grain size was added in an amount, in terms of the weight of KI, of 6.33 g. Immediately after the completion of the addition, 206.2 mL of an aqueous solution containing 66.4 g of $AgNO_3$ was added over a period of 16 min. For 5 min in the initial stage of addition, the silver potential was maintained at −80 mV by the use of an aqueous solution of KBr. The mixture was washed with water, and gelatin was added, adjusting the pH and pAg thereof at 40° C. to 5.8 and 8.7, respectively. The gelatin contains ingredients having a molecular weight of 280,000, which was measured according to PAGI method, in an amount of 30%. Compounds 11 and 12 were added, and the mixture was heated to 60° C. Sensitizing dyes 11 and 12 were added and potassium thiocyanate, chloroauric acid, sodium thiosulfate and N,N-dimethylselenourea were added to thereby effect optimum chemical sensitization. At the completion of chemical sensitization, Compounds 13 and 14 were added. The terminology "optimum chemical sensitization" used herein means that the addition amount of sensitizing dye or each compound has been selected so as to fall within the range of $10^{-1}$ to $10^{-8}$ mol per mol of silver halide.

Compound 11

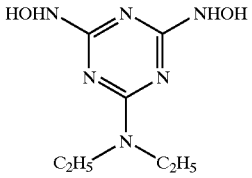

Compound 12

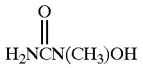

Sensitizing dye 11

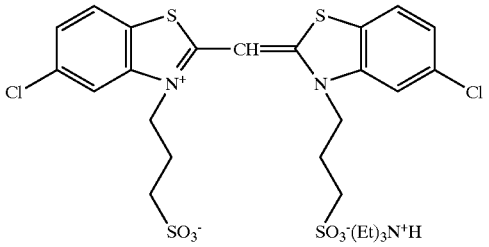

Sensitizing dye 12

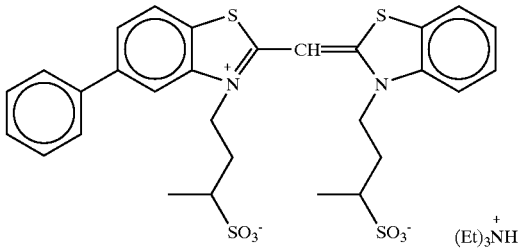

Compound 13

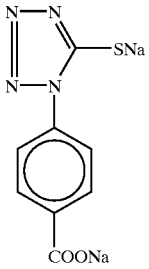

Compound 14

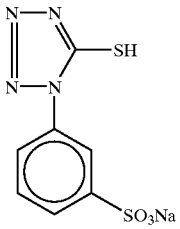

The thus obtained grains were observed with transmission electron microscope while cooling with liquid nitrogen. As a result, 10 or more dislocation lines per grain were observed at a periphery portion of the grains.

(Em-A2 to Em-A16)

Emulsions Em-A2 to -A16 were prepared in the same manner as Em-A1, except that a compound selected from type A or Types 1 to 4 of the invention were added at the time of chemical sensitization in an amount of $1\times10^{-4}$ mol per mol of silver halide, as set forth in Table 2.

(Em-B; Emulsion for Low-Speed Blue-Sensitive Layer)

1,192 mL of an aqueous solution containing 0.96 g of low-molecular weight gelatin and 0.9 g of KBr were vigorously stirred at 40° C. 37.5 mL of an aqueous solution containing 1.49 g of $AgNO_3$ and 37.5 mL of an aqueous solution containing 1.5 g of KBr were added over 30 sec by the double jet method. After 1.2 g of KBr were added, the temperature was raised to 75° C. to ripen the material. After the ripening, 30 g of trimellitated gelatin whose amino groups were chemically modified with trimellitic acid and whose molecular weight is 100,000 were added, and the pH was adjusted to 7.6 mg of thiourea dioxide were added. 116 mL of an aqueous solution containing 29 g of $AgNO_3$ and an aqueous KBr solution were added by the double jet method while the flow rate was accelerated such that the final flow rate was 3 times the initial flow rate. During the addition, the silver potential was maintained at −20 mV against saturated calomel electrode. 440.6 mL of an aqueous solution containing 110.2 g of $AgNO_3$ and an aqueous KBr solution were added over 30 min by the double jet method while the flow rate was accelerated such that the final flow rate was 5.1 times the initial flow rate. During the addition, the AgI fine grain emulsion used in the preparation of Em-A1 was simultaneously added at an accelerated flow rate so that the silver iodide content was 15.8 mol %. At the same time, the silver potential was maintained at 0 mV against saturated calomel electrode. 96.5 mL of an aqueous solution containing 24.1 g of $AgNO_3$ and an aqueous KBr solution were added over 3 min by the double jet method. During the addition, the silver potential was maintained at 0 mV. After 26 mg of sodium ethylthiosulfonate were added, the temperature was raised to 55° C., an aqueous KBr solution was added to adjust the silver potential to −90 mV. The aforementioned AgI fine grain emulsion was added in an amount of 8.5 g in terms of a KI weight. Immediately after the addition, 228 mL of an aqueous solution containing 57 g of $AgNO_3$ were added over 5 min. At this time, an aqueous KBr solution was used to adjust the silver potential at the completion of the addition to +20 mV. The resultant emulsion was washed with water and chemically sensitized in almost the same manner as for Em-A1.

(Em-C; Emulsion for Low-Speed Blue-Sensitive Layer)

1,192 mL of an aqueous solution containing 1.02 g of phthalated gelatin containing 35 μmol of methionine per g thereof and having a molecular weight of 100,000, and having a phthalation ratio of 97%, and 0.97 g of KBr were vigorously stirred at 35° C. 42 mL of an aqueous solution containing 4.47 g of $AgNO_3$ and 42 mL of an aqueous solution containing 3.16 g of KBr were added over 9 sec by the double jet method. After 2.6 g of KBr were added, the temperature was raised to 66° C. to ripen the material. After the ripening, 41.2 g of trimellitated gelatin used in the preparation of Em-B whose molecular weight is 100,000 and 18.5 g of NaCl were added. After the pH was adjusted to 7.2, 8 mg of dimethylamineborane was added. 203 mL of an aqueous solution containing 26 g of $AgNO_3$ and an aqueous KBr solution were added by the double jet method while the flow rate was accelerated such that the final flow rate was 3.8 times the initial flow rate. During the addition, the silver potential was maintained at −30 mV against saturated calomel electrode. 440.6 mL of an aqueous solution containing 110.2 g of $AgNO_3$ and an aqueous KBr solution were added over 24 min by the double jet method while the flow rate was accelerated such that the final flow rate was 5.1 times the initial flow rate. During the addition, the AgI fine grain emulsion used in the preparation of Em-A1 was simultaneously added at an accelerated flow rate so that the silver iodide content was 2.3 mol %. At the same time, the silver potential was maintained at −20 mV against saturated calomel electrode. After the addition of 10.7 mL IN potassium thiocyanate, 153.5 mL of an aqueous solution containing 24.1 g of $AgNO_3$ and an aqueous KBr solution were added over 2 min and 30 sec by the double jet method. During the addition, the silver potential was maintained at 10 mV. An aqueous KBr solution was added to adjust the silver potential to −70 mV. The aforementioned AgI fine grain emulsion was added in an amount of 6.4 g in terms of a KI weight. Immediately after the addition, 2404 mL of an aqueous solution containing 57 g of $AgNO_3$ were added over 45 min. At this time, an aqueous KBr solution was used to adjust the silver potential at the completion of the addition to −30 mV. The resultant emulsion was washed with water and chemically sensitized in almost the same manner as for Em-A1.

(Em-D; Emulsion for Low-Speed Blue-Sensitive Layre)

In the preparation of Em-C, the addition amount of $AgNO_3$ during the nucleation was changed to 2.0 times, and the potential at the completion of the addition of the final 404 mL aqueous solution containing 57 g of $AgNO_3$ was change to +90 mV by adjusting with a KBr aqueous solution.

(Em-E; Magenta-Coloring Layer Having a Spectral Sensitivity Peak in a Range of 480–550 nm; Layer for Donating Multilayer Effect to a Red-Sensitive Layer)

1,200 mL of an aqueous solution containing 0.71 g of low-molecular weight gelatin having a molecular weight of 15,000, 0.92 g of KBr and 0.2 g of modified silicon oil used in the preparation of Em-A1 were held at 39° C. and stirred with violence at pH 1.8. An aqueous solution containing 0.45 g of $AgNO_3$ and an aqueous KBr solution containing 1.5 mol % of KI were added over 17 sec by the double jet method. During the addition, the excess KBr concentration was held constant. The temperature was raised to 56° C. to ripen the material. After the ripening, 20 g of phthalated gelatin containing 35 $\mu$mol of methionine per g thereof and having a molecular weight of 100,000, and having a phthalation ratio of 97% was added. After the pH was adjusted to 5.9, 2.9 g of KBr were added. 288 mL of an aqueous solution containing 28.8 g of $AgNO_3$ and an aqueous KBr solution were added over 53 min by the double jet method. During the addition, an AgI fine grain emulsion used in the preparation of Em-A1 was simultaneously added such that the silver iodide content was 4.1 mol %. At the same time, the silver potential was maintained at −60 mV against a calomel electrode. After 2.5 g of KBr were added, an aqueous solution containing 87.7 g of $AgNO_3$ and an aqueous KBr solution were added over 63 min by the double jet method while the flow rate was accelerated so that the final flow rate was 1.2 times the initial flow rate. During the addition, abovementioned AgI fine grain emulsion was simultaneously added such that the silver iodide content was 10.5 mol %. At the same time, the silver potential was maintained at −70 mV. After adding 1 mg of thiourea dioxide, 132 mL of an aqueous solution containing 41.8 g of $AgNO_3$ and an aqueous KBr solution were added over 25 min by the double jet method. The addition of the aqueous KBr solution was so adjusted that the silver potential at the completion of the addition was +20 mV. After the addition of 2 mg of sodium benzenethiosulfonate, the pH was adjusted to 7.3. After KBr was added to adjust the silver potential at −70 mV, the aforementioned AgI fine grain emulsion was added in an amount of 5.73 in terms of a KI weight. Immediately after the addition, 609 mL of an aqueous solution containing 66.4 g of $AgNO_3$ were added over 10 min. For the first 6 min of the addition, the silver potential was maintained at −70 mV by an aqueous KBr solution. After washing with water, gelatin was added, and the pH and the pAg were adjusted to 6.5 and 8.2, respectively. Compounds 11 and 12 were added, and then the temperature was raised to 56° C. The abovementioned AgI fine grain emulsion was added in an amount of 0.0004 mol per mol of silver. Then, sensitizing dyes 13 and 14 were added. Potassium thiocyanate, chlorauric acid, sodium thiosulfate, N,N-dimethylselenourea were added to optimally perform chemical sensitization. Compounds 13 and 14 were added at the completion of the chemical sensitization.

Sensitizing dye 13

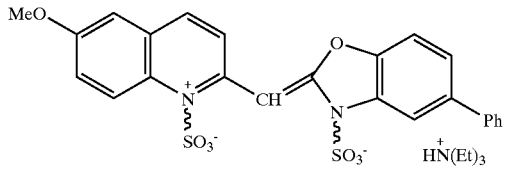

Sensitizing dye 14

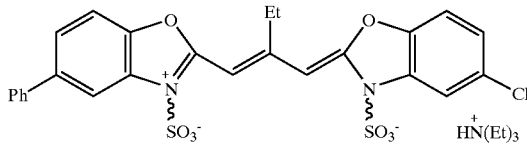

(Em-F; Emulsion for Medium-Speed Green-Sensitive Layer)

Emulsion Em-F was prepared in almost the same manner as in Em-E, except that the addition amount of $AgNO_3$ during the nucleation was changed to 3.1 times. In addition, sensitizing dyes in Em-E were changed to spectral sensitizing dyes 15, 16 and 17.

Sensitizing dye 15

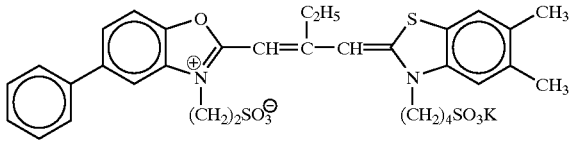

Sensitizing dye 16

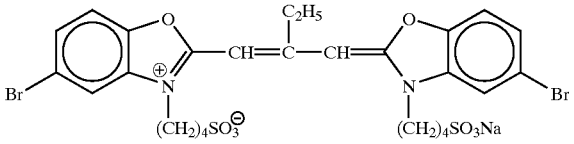

Sensitizing dye 17

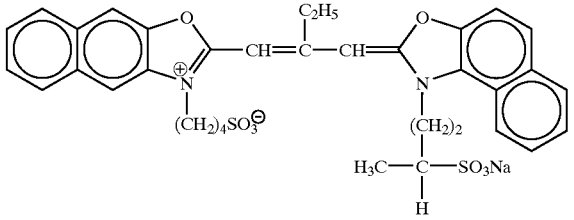

(Em-G; Emulsion for Low-Speed Green-Sensitive Layer)

1,200 mL of an aqueous solution containing 0.70 g of low-molecular weight gelatin having a molecular weight of 15,000, 0.9 g of KBr, 0.175 g of KI and 0.2 g of modified silicon oil used in the preparation of Em-A1 were held at 33° C. and stirred with violence at pH 1.8. An aqueous solution containing 1.8 g of $AgNO_3$ and an aqueous KBr solution containing 3.2 mol % of KI were added over 9 sec by the double jet method. During the addition, the excess KBr concentration was held constant. The temperature was raised to 69° C. to ripen the material. After the ripening, 27.8 g of trimellitated gelatin containing 35 μmol of methionine per g thereof and having a molecular weight of 100,000 was added. After the pH was adjusted to 6.3, 2.9 g of KBr were added. 270 mL of an aqueous solution containing 27.58 g of $AgNO_3$ and an aqueous KBr solution were added over 37 min by the double jet method. During the addition, an AgI fine grain emulsion was simultaneously added such that the silver iodide content was 4.1 mol %, and the silver potential was maintained at −60 mV against calomel electrode. The AgI fine grain emulsion was prepared immediately before the addition thereof in a separate chamber provided with a magnetic coupling induction type stirrer described in JP-A-10-43570 and has a grain size of 0.008 μm. After 2.6 g of KBr were added, an aqueous solution containing 87.7 g of $AgNO_3$ and an aqueous KBr solution were added over 49 min by the double jet method while the flow rate was accelerated so that the final flow rate was 3.1 times the initial flow rate. During the addition, above-mentioned AgI fine grain emulsion that was prepared by mixing immediately before the addition thereof was simultaneously added such that the silver iodide content was 7.9 mol %. At the same time, the silver potential was maintained at −70 mV. After adding 1 mg of thiourea dioxide, 132 mL of an aqueous solution containing 41.8 g of $AgNO_3$ and an aqueous KBr solution were added over 20 min by the double jet method. The addition of the aqueous KBr solution was so adjusted that the silver potential at the completion of the addition was +20 mV. After the temperature was raised to 78° C., the pH was adjusted to 9.1. After KBr was added to adjust the silver potential at −60 mV, the AgI fine grain emulsion used in the preparation of Em-A1 was added in an amount of 5.73 in terms of a KI weight. Immediately after the addition, 321 mL of an aqueous solution containing 66.4 g of $AgNO_3$ were added over 4 min. For the first 2 min of the addition, the silver potential was maintained at −60 mV by an aqueous KBr solution. The emulsion was washed with water and chemically sensitized in almost the same manner as in Em-F.

(Em-H; Emulsion for Low-Speed Green-Sensitive Layer)

An aqueous solution containing 17.8 g of ion-exchanged gelatin having a molecular weight of 100,000, 6.2 g of KBr and 0.46 g of KI was vigorously stirred while maintaining the temperature thereof at 45° C. An aqueous solution containing 11.85 g of $AgNO_3$ and an aqueous solution containing 3.8 g of KBr were added by the double jet method over 47 sec. After the temperature was raised to 63° C., 24.1 g of ion-exchanged gelatin having a molecular weight of 100,000 was added to ripen the material. After the ripening, an aqueous solution containing 133.4 g of $AgNO_3$ and an aqueous KBr solution were added by the double jet method over 20 min so that the final flow rate becomes 2.6 times the initial flow rate. During the addition, the silver potential was maintained at +40 mV against saturated calomel electrode. Also, 10 min after the initiation of the addition, 0.1 mg of $K_2IrCl_6$ was added. After 7 g of NaCl was added, an aqueous solution containing 45.6 g of $AgNO_3$ and an aqueous KBr solution were added over 12 min by the double jet method. At the same time, the silver potential was maintained at +90 mV against saturated calomel electrode. Also, 100 mL of an aqueous solution containing 29 g of yellow prussiate was added over 6 min from the initiation of the addition. After 14.4 g of KBr was added, the AgI fine grain emulsion that was used in the preparation of Em-A1 was added in an amount of 6.3 g in terms of a KI weight. Immediately after the addition, an aqueous solution containing 542.7 g of $AgNO_3$ and a KBr solution were added by the double jet method over 11 min. At this time, the the silver potential was maintained at +90 mV. The resultant emulsion was washed with water and chemically sensitized in almost the same manner as for Em-F.

(Em-I; Emulsion for Low-Speed Green-Sensitive Layer)

Emulsion Em-I was prepared in almost the same manner as Em-H, except that the temperature at nucleation was changed to 38° C.

(Em-J; Emulsion for High-Speed Red-Sensitive Layer)

1,200 mL of an aqueous solution containing 0.38 g of phthalated gelatin having a molecular weight of 100,000 and phthalation ratio of 97% and 0.99 g of KBr were vigorously stirred at 60° C., while adjusting the pH thereof at 2. An aqueous solution containing 1.96 g of $AgNO_3$, an aqueous solution containing 1.97 g of KBr, and 0.172 g of KI were added over 30 sec by the double jet method. After the ripening, 12.8 g of trimellitated gelatin whose amino groups were chemically modified with trimellitic acid, containing 35 μmol of methionine per g thereof and having a molecular weight of 100,000 was added. After the pH was adjusted to 5.9, 2.99 g of KBr and 6.2 g of NaCl were added. 60.7 mL of an aqueous solution containing 27.3 g of $AgNO_3$ and an aqueous KBr solution were added over 35 min by the double jet method. During the addition, the silver potential was maintained at −50 mV against calomel electrode. An aqueous solution containing 65.6 g of $AgNO_3$ and an aqueous KBr solution were added over 37 min by the double jet method while the flow rate was accelerated so that the final flow rate was 2.1 times the initial flow rate. During the addition, AgI fine grain emulsion that was used in the preparation of Em-A1 was simultaneously added such that the silver iodide content was 6.5 mol %. At the same time, the silver potential was maintained at −50 mV. After adding 1.5 mg of thiourea dioxide, 132 mL of an aqueous solution containing 41.8 g of $AgNO_3$ and an aqueous KBr solution were added over 13 min by the double jet method. The addition of the aqueous KBr solution was so adjusted that the silver potential at the completion of the addition was +40 mV. After 2 mg of sodium benzenethiosulfonate, KBr was added to adjust the silver potential at −100 mV. The above-mentioned AgI fine grain emulsion was added in an amount of 6.2 in terms of a KI weight. Immediately after the addition, 300 mL of an aqueous solution containing 88.5 g of $AgNO_3$ were added over 8 min. An KBr solution was added so that the potential at the completion of the addition was adjusted to +60 mV. After washing with water, gelatin was added, and pH and pAg were adjusted to 6.5 and 8.2, respectively at 40° C. After compounds 11 and 12 were added, the temperature was raised to 61° C. After sensitizing dyes 18, 19, 20 and 21 were added $K_2IrCl_6$, potassium thiocyanate, chlorauric acid, sodium thiosulfate, and N,N-dimethylselenourea were added to optimally perform chemical sensitization. Compounds 13 and 14 were added at the completion of the chemical sensitization.

Sensitizing dye 18

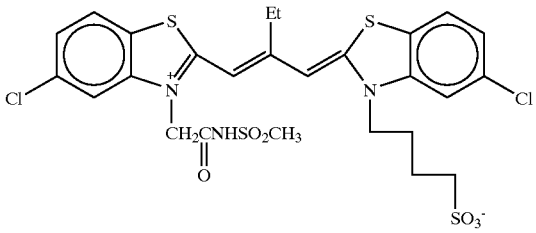

Sensitizing dye 19

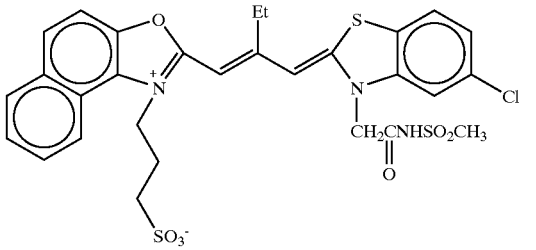

Sensitizing dye 20

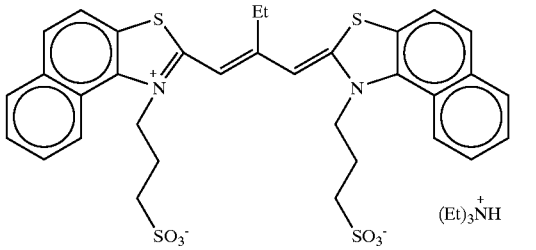

Sensitizing dye 21

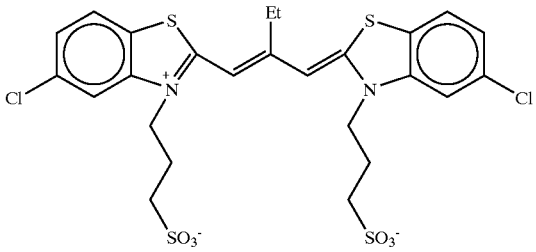

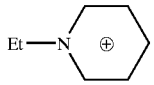

(Em-K; Emulsion for a Medium-Speed Red-Sensitive Layer)

1,200 mL of an aqueous solution containing 4.9 g of low-molecular weight gelatin having a molecular weight of 15,000, and 5.3 g of KBr was held at 60° C. and stirred with violence. 27 mL of an aqueous solution containing 8.75 g of $AgNO_3$ and 36 mL of an aqueous solution containing 6.45 g of KBr were added over 1 min by the double jet method. After the temperature was raised to 77° C., 21 mL of an aqueous solution containing 6.9 g of $AgNO_3$ was added over 2.5 min. 26 g of $NH_4NO_3$, 56 mL of 1N NaOH were added subsequently, and then ripened. After the termination of the ripening, pH was adjusted to 4.8. 438 mL of an aqueous solution containing 141 g of $AgNO_3$ and 458 mL of an aqueous solution containing 102.6 g of KBr were added by the double jet method while the flow rate was accelerated so that the final flow rate was 4 times the initial flow rate. After the temperature was raised to 55° C., 240 mL of an aqueous solution containing 7.1 g of $AgNO_3$ and an aqueous solution containing 6.46 g of KI were added by the double jet method over 5 min. After 7.1 g of KBr was added, 4 mg of sodium benzenethiosulfonate and 0.05 mg of $K_2KrCl_6$ were added. 177 mL of an aqueous solution containing 57.2 g of $AgNO_3$ and 223 mL of an aqueous solution containing 40.2 g of KBr were added over 8 min by the double jet method. Washing and chemical sensitization were performed in almost the same manner as in Em-J.

(Em-L; Emulsion for a Medium-Speed Red-Sensitive Layer)

Emulsion Em-L was prepared in almost the same manner as in Em-K, except that the temperature during the nucleation was changed to 42° C.

(Em-M, -N and -O; Emulsions for Low-Speed Red-Sensitive Layer)

Em-M, Em-N and Em-O were prepared in almost the same manner as in Em-H or Em-I, except that the chemical sensitization was performed in almost the same manner ass in Em-J.

(Em-P; Emulsion for High-Speed Green-Sensitive Layer)

Em-P was prepared in the same manner as in Em-J, except that the spectral sensitizing dyes were changed to sensitizing dyes 15, 16 and 17, performing an optimal chemical sensitization.

The characteristics of the thus obtained silver halide emulsions Em-1-A1 to Em-P are shown in Table 1.

TABLE 1

| Emulsion No. | Equivalent sphere diameter μm | Projected area diameter μm | Aspect ratio | Iodide content mol % | Index of main plane | Chloride content mol % |
|---|---|---|---|---|---|---|
| Em-A1 to -A16 | 1.9 | 3.65 | 10.5 | 6.1 | (111) | 0 |
| Em-B | 1.0 | 2.0 | 12.2 | 10.0 | (111) | 0 |
| Em-C | 0.7 | — | 1 | 4.0 | (111) | 1.0 |
| Em-D | 0.4 | 0.53 | 3.5 | 4.1 | (111) | 2.0 |
| Em-E | 1.1 | 2.63 | 20.6 | 6.7 | (111) | 0 |
| Em-F | 1.2 | 2.74 | 18 | 6.9 | (111) | 0 |
| Em-G | 0.9 | 1.98 | 15.9 | 6.1 | (111) | 0 |
| Em-H | 0.7 | 1.22 | 8 | 6.0 | (111) | 2.0 |
| Em-I | 0.4 | 0.63 | 6 | 6.0 | (111) | 2.0 |
| Em-J | 1.3 | 3.18 | 22 | 3.5 | (111) | 0 |
| Em-K | 1.0 | 2.37 | 20 | 4.0 | (111) | 0 |
| Em-L | 0.8 | 1.86 | 19 | 3.6 | (111) | 0 |
| Em-M | 0.6 | 1.09 | 8.9 | 2.9 | (111) | 2.0 |
| Em-N | 0.4 | 0.63 | 6 | 2.0 | (111) | 2.0 |
| Em-O | 0.3 | 0.38 | 3 | 1.0 | (111) | 2.0 |
| Em-P | 1.3 | 3.18 | 22 | 3.5 | (111) | 0 |

Further, the following is an outline of preparation prescription of the emulsion of the present invention.

A solution made by dissolving a coupler in ethyl acetate, a high-boiling organic solvent, and a surfactant are added to a 10% gelatin solution and mixed. The mixture is emulsified by using a homoginizer (Nippon Seiki) to obtain an emulsion.

1) Support

A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec, thereby obtaining a 90 μm thick PEN (polyethylenenaphthalate) film. Note that proper amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core 20 cm in diameter and given a thermal history of 110° C. and 48 hr, manufacturing a support with a high resistance to curling.

2) Coating of Undercoat Layer

The two surfaces of the above support were subjected to corona discharge, UV discharge, and glow discharge. After that, each surface of the support was coated with an undercoat solution (10 mL/m$^2$, by using a bar coater) consisting of 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamido-epichlorohydrin polycondensation product, thereby forming an undercoat layer on a side at a high temperature upon orientation. Drying was performed at 115° C. for 6 min (all rollers and conveyors in the drying zone were at 115° C.).

3) Coating of Back Layers

One surface of the undercoated support was coated with an antistatic layer, magnetic recording layer, and slip layer having the following compositions as back layers.

3-1) Coating of Antistatic Layer

The surface was coated with 0.2 g/m$^2$ of a dispersion (secondary aggregation grain size=about 0.08 μm) of a fine-grain powder, having a specific resistance of 5 Ω·cm, of a tin oxide-antimony oxide composite material with an average grain size of 0.005 μm, together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and resorcin.

3-2) Coating of Magnetic Recording Layer

A bar coater was used to coat the surface with 0.06 g/m$^2$ of cobalt-γ-iron oxide (specific area 43 m$^2$/g, major axis 0.14 μm, minor axis 0.03 μm, saturation magnetization 89 Am$^2$/kg, $Fe^{+2}/Fe^{+3}$=6/94, the surface was treated with 2 wt % of iron oxide by aluminum oxide silicon oxide) coated with 3-poly(polymerization degree 15)oxyethylene-propyloxytrimethoxysilane (15 wt %), together with 1.2 g/m$^2$ of diacetylcellulose (iron oxide was dispersed by an open kneader and sand mill), by using 0.3 g/m$^2$ of $C_2H_5C(CH_2OCONH{-}C_6H_3(CH_3)NCO)_3$ as a hardener and acetone, methylethylketone, and cyclohexane as solvents, thereby forming a 1.2-μm thick magnetic recording layer. 10 mg/m$^2$ of silica grains (0.3 μm) were added as a matting agent, and 10 mg/m$^2$ of aluminum oxide (0.15 μm) coated with 3-poly(polymerization degree 15)oxyethylene-propyloxytrimethoxysilane (15 wt %) were added as a polishing agent. Drying was performed at 115° C. for 6 min (all rollers and conveyors in the drying zone were at 115° C.). The color density increase of $D^B$ of the magnetic recording layer measured by an X-light (blue filter) was about 0.1. The saturation magnetization moment, coercive force, and squareness ratio of the magnetic recording layer were 4.2 Am$^2$/kg, 7.3×10$^4$ A/m, and 65%, respectively.

3-3) Preparation of Slip Layer

The surface was then coated with diacetylcellulose (25 mg/m$^2$) and a mixture of $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$). Note that this mixture was melted in xylene/propylenemonomethylether (1/1) at 105° C. and poured and dispersed in propylenemonomethylether (tenfold amount) at room temperature. After that, the resultant mixture was formed into a dispersion (average grain size 0.01 μm) in acetone before being added. 15 mg/m$^2$ of silica grains (0.3 μm) were added as a matting agent, and 15 mg/m$^2$ of aluminum oxide (0.15 μm) coated with 3-poly(polymerization degree 15)oxyethylene-propyloxytrimethoxysiliane (15 wt %) were added as a polishing agent. Drying was performed at 115° C. for 6 min (all rollers and conveyors in the drying zone were at 115° C.). The resultant slip layer was found to have excellent characteristics; the coefficient of kinetic friction was 0.06 (5 mmϕ stainless steel hard sphere, load 100 g, speed 6 cm/min), and the coefficient of static friction was 0.07 (clip method). The coefficient of kinetic friction between an emulsion surface (to be described later) and the slip layer also was excellent, 0.12.

4) Coating of Lightsensitive Layer

Next, on the opposite side of the support of the back layer obtained by the above, layers of the following compositions were coated in a superposed manner to prepare a color negative photosensitive material of Sample 101.

(Composition of Lightsensitive Layers)

Main materials used for the layers are classified into the following:

ExC: cyan coupler UV: ultraviolet absorbent
ExM: magenta coupler HBS: high-boiling organic solvent
ExY: yellow coupler H: gelatin hardener (Specific compounds are shown in the following description. Numerical values are described after the symbols, and their chemical formulae are shown thereafter.)

The figures corresponding to respective components indicate coating amounts in terms of g/m$^2$. With respect to silver halide, the figures indicate a coating amount in terms of silver.

| | | |
|---|---|---|
| 1st layer (First antihalation layer) | | |
| Black colloidal silver | silver | 0.150 |
| Surface-fogged AgBrI (2) of 0.07 μm | silver | 0.01 |
| Gelatin | | 0.90 |
| ExC-1 | | 0.002 |
| ExC-3 | | 0.002 |
| Cpd-2 | | 0.001 |
| HBS-1 | | 0.004 |
| HBS-2 | | 0.002 |
| 2nd layer (Second antihalation layer) | | |
| Black colloidal silver | silver | 0.069 |
| Gelatin | | 0.400 |
| ExM-1 | | 0.055 |
| ExF-1 | | 2.0 × 10$^{-3}$ |
| HBS-1 | | 0.079 |
| Solid disperse dye ExF-2 | | 0.018 |
| Solid disperse dye ExF-3 | | 0.024 |
| 3rd layer (Intermediate layer) | | |
| AgBrI (2) of 0.07 μm | | 0.020 |
| ExC-2 | | 0.022 |
| Cpd-1 | | 0.050 |
| UV-1 | | 0.06 |
| UV-2 | | 0.04 |
| UV-3 | | 0.06 |
| UV-4 | | 0.008 |
| Polyethylacrylate latex | | 0.085 |
| HBS-1 | | 0.500 |
| HBS-4 | | 0.500 |
| Gelatin | | 0.354 |

-continued

| | | |
|---|---|---|
| 4th layer (Low-speed red-sensitive emulsion layer) | | |
| Em-M | silver | 0.060 |
| Em-N | silver | 0.105 |
| Em-O | silver | 0.156 |
| ExC-1 | | 0.111 |
| ExC-3 | | 0.047 |
| ExC-4 | | 0.079 |
| ExC-5 | | 0.013 |
| ExC-6 | | 0.005 |
| ExC-8 | | 0.020 |
| Cpd-2 | | 0.025 |
| Cpd-4 | | 0.025 |
| HBS-1 | | 0.17 |
| Gelatin | | 0.84 |
| 5th layer (Medium-speed red-sensitive emulsion layer) | | |
| Em-K | silver | 0.24 |
| Em-L | silver | 0.65 |
| ExC-1 | | 0.18 |
| ExC-2 | | 0.024 |
| ExC-3 | | 0.020 |
| ExC-4 | | 0.14 |
| ExC-5 | | 0.016 |
| ExC-6 | | 0.009 |
| ExC-8 | | 0.035 |
| Cpd-2 | | 0.036 |
| Cpd-4 | | 0.028 |
| HBS-1 | | 0.19 |
| Gelatin | | 1.23 |
| 6th layer (High-speed red-sensitive emulsion layer) | | |
| Em-J | silver | 1.60 |
| ExC-1 | | 0.19 |
| ExC-3 | | 0.09 |
| ExC-6 | | 0.049 |
| ExC-8 | | 0.040 |
| Cpd-2 | | 0.043 |
| Cpd-4 | | 0.077 |
| HBS-1 | | 0.25 |
| HBS-2 | | 0.12 |
| Gelatin | | 2.00 |
| 7th layer (Intermediate layer) | | |
| Cpd-1 | | 0.089 |
| Solid disperse dye ExF-4 | | 0.030 |
| HBS-1 | | 0.050 |
| Polyethylacrylate latex | | 0.83 |
| Gelatin | | 0.84 |
| 8th layer (Multilayer effect-donating layer (layer for donating multiplayer effect to red-sensitive layer)) | | |
| Em-E | silver | 0.510 |
| Cpd-4 | | 0.030 |
| ExM-2 | | 0.090 |
| ExM-3 | | 0.033 |
| ExY-1 | | 0.033 |
| ExG-1 | | 0.007 |
| ExC-8 | | 0.005 |
| HBS-1 | | 0.089 |
| HBS-3 | | 0.004 |
| Gelatin | | 0.55 |
| 9th layer (Low-speed green-sensitive emulsion layer) | | |
| Em-G | silver | 0.36 |
| Em-H | silver | 0.24 |
| Em-I | silver | 0.32 |
| ExM-2 | | 0.37 |
| ExM-3 | | 0.043 |
| EmG-1 | | 0.005 |
| ExC-8 | | 0.005 |
| HBS-1 | | 0.28 |
| HBS-3 | | 0.01 |

-continued

| | | |
|---|---|---|
| HBS-4 | | 0.27 |
| Gelatin | | 1.30 |
| 10th layer (Medium-speed green-sensitive emulsion layer) | | |
| Em-F | silver | 0.24 |
| Em-G | silver | 0.20 |
| ExC-6 | | 0.011 |
| ExM-2 | | 0.031 |
| ExM-3 | | 0.026 |
| ExY-1 | | 0.005 |
| ExM-4 | | 0.028 |
| ExG-1 | | 0.005 |
| ExC-0 | | 0.010 |
| HBS-1 | | 0.064 |
| HBS-3 | | $2.1 \times 10^{-3}$ |
| Gelatin | | 0.43 |
| 11th layer (High-speed green-sensitive emulsion layer) | | |
| Em-P | silver | 1.100 |
| ExC-6 | | 0.004 |
| ExM-1 | | 0.016 |
| ExM-3 | | 0.036 |
| ExM-4 | | 0.020 |
| ExM-5 | | 0.004 |
| ExY-5 | | 0.008 |
| ExM-2 | | 0.013 |
| ExC-8 | | 0.010 |
| Cpd-4 | | 0.007 |
| HBS-1 | | 0.18 |
| Polyethylacrylate latex | | 0.099 |
| Gelatin | | 1.11 |
| 12th layer (Yellow filter layer) | | |
| Yellow colloidal silver | silver | 0.047 |
| Cpd-1 | | 0.16 |
| Dye ExF-5 | | 0.010 |
| Solid disperse dye ExF-6 | | 0.010 |
| HBS-1 | | 0.082 |
| Gelatin | | 1.057 |
| 13th layer (Low-speed blue-sensitive emulsion layer) | | |
| Em-B | silver | 0.19 |
| Em-C | silver | 0.23 |
| Em-D | silver | 0.05 |
| ExC-1 | | 0.045 |
| ExC-8 | | 0.010 |
| ExY-1 | | 0.032 |
| ExY-2 | | 0.71 |
| ExY-3 | | 0.10 |
| ExY-4 | | 0.005 |
| Cpd-2 | | 0.10 |
| Cpd-3 | | $4.0 \times 10^{-3}$ |
| HBS-1 | | 0.26 |
| Gelatin | | 1.47 |
| 14th layer (High-speed blue-sensitive emulsion layer) | | |
| Em-A1 | silver | 0.85 |
| ExC-1 | | 0.016 |
| ExC-8 | | 0.010 |
| ExY-2 | | 0.30 |
| ExY-3 | | 0.05 |
| ExY-6 | | 0.065 |
| Cpd-2 | | 0.075 |
| Cpd-3 | | $1.0 \times 10^{-3}$ |
| HBS-1 | | 0.12 |
| Gelatin | | 0.98 |
| 15th layer (First protective layer) | | |
| AgBrI (2) of 0.07 $\mu$m | silver | 0.30 |
| UV-1 | | 0.21 |
| UV-2 | | 0.13 |
| UV-3 | | 0.20 |
| UV-4 | | 0.025 |
| F-18 | | 0.009 |
| F-19 | | 0.005 |
| HBS-1 | | 0.12 |
| HBS-4 | | $5.0 \times 10^{-2}$ |
| Gelatin | | 3.0 |

-continued

| 16th layer (Second protective layer) | |
|---|---|
| H-1 | 0.40 |
| B-1 (diameter 1.7 μm) | $5.0 \times 10^{-2}$ |
| B-2 (diameter 1.7 μm) | 0.15 |
| B-3 | 0.05 |
| S-1 | 0.20 |
| Gelatin | 0.75 |

In addition to the above components, to improve the storage stability, processability, resistance to pressure, antiseptic and mildewproofing properties, antistatic properties, and coating properties, the individual layers contained B-4 to B-6, F-1 to F-18, iron salt, lead salt, gold salt, platinum salt, palladium salt, iridium salt, ruthenium salt and rhodium salt. Also in the coating liquids for the 8th and the 11th layers, $8.5\times10^{-3}$ g and $7.9\times10^{-3}$ g, respectively, per mole of silver halide of calcium was added in the form of calcium nitrate, thereby preparing samples. In addition, at least one of W-1, -6, -7 and -8 was added in order to improve anti-electron static property, and at least one of W-2 and -5 was added in order to improve coating property.

Preparation of Dispersions of Organic Solid Disperse Dyes

ExF-3 was dispersed by the following method. That is, 21.7 mL of water, 3 mL of a 5% aqueous solution of sodium p-octylphenoxyethoxyethanesulfonate, and 0.5 g of a 5% aqueous solution of p-octylphenoxypolyoxyethyleneether (polymerization degree 10) were placed in a 700-mL pot mill, and 5.0 g of the dye ExF-3 and 500 mL of zirconium oxide beads (diameter 1 mm) were added to the mill. The contents were dispersed for 2 hr. This dispersion was done by using a BO type oscillating ball mill manufactured by Chuo Koki K.K. The dispersion was extracted from the mill and added to 8 g of a 12.5% aqueous solution of gelatin. The beads were filtered away to obtain a gelatin dispersion of the dye. The average grain size of the fine dye grains was 0.44 μm.

Following the same procedure as above, solid dispersions ExF-4 was obtained. The average grain sizes of these fine dye grains was 0.45. ExF-2 was dispersed by a microprecipitation dispersion method described in Example 1 of EP549,489A. The average grain size was found to be 0.06 μm.

A solid dispersion ExF-6 was dispersed by the following method.

4000 g of water and 376 g of a 3% solution of W-2 were added to 2,800 g of a wet cake of ExF-6 containing 18% of water, and the resultant material was stirred to form a slurry of ExF-6 having a concentration of 32%. Next, ULTRA VISCO MILL (UVM-2) manufactured by Imex K.K. was filled with 1,700 mL of zirconia beads having an average grain size of 0.5 mm. The slurry was milled by passing through the mill for 8 hr at a peripheral speed of about 10 m/sec and a discharge amount of 0.5 L/min.

Compounds used in the formation of each layer were as follows.

ExC-1

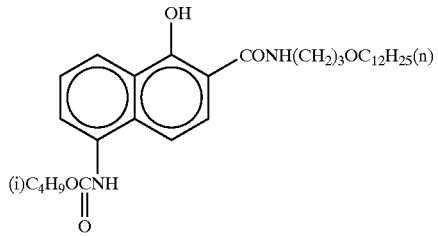

ExC-2

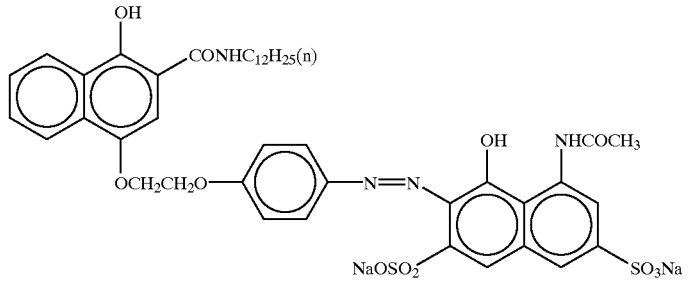

ExC-3

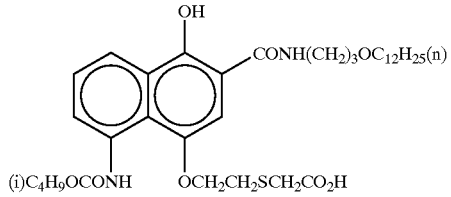

-continued
ExC-4
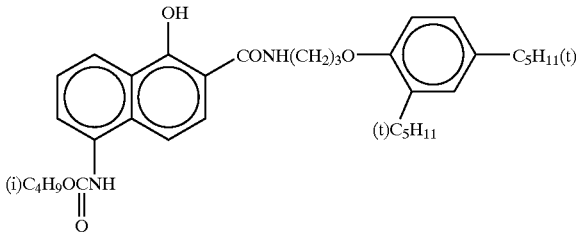
ExC-5
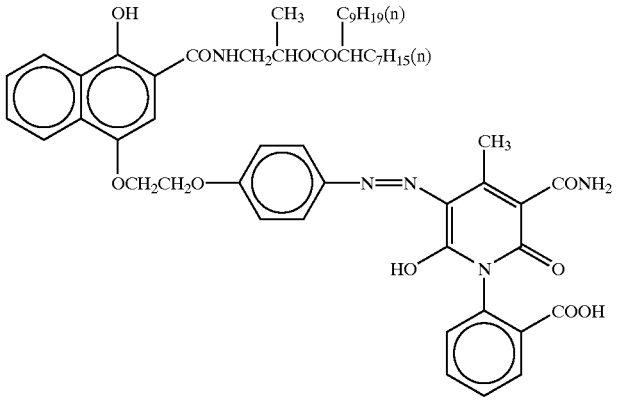
ExC-6
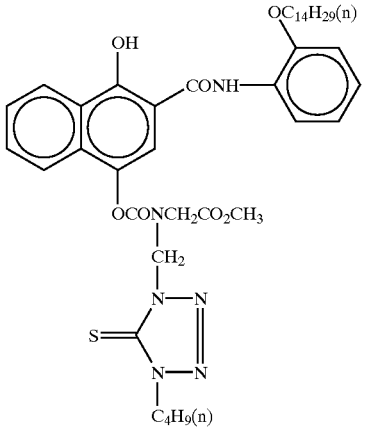
ExC-8
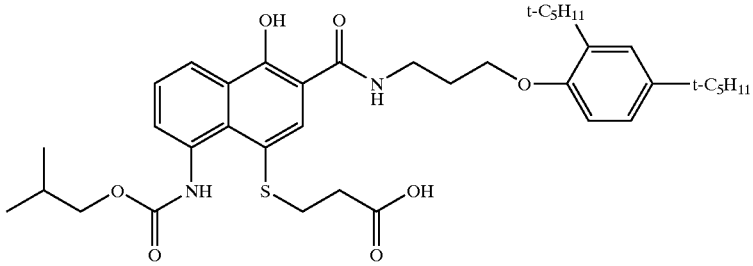

-continued
ExM-1
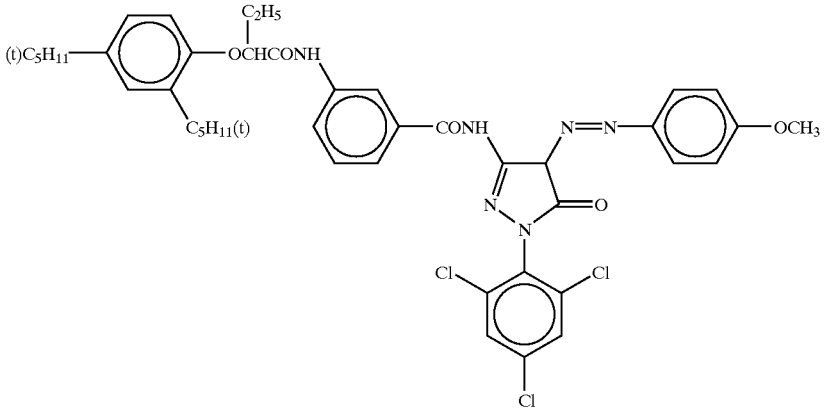
ExM-2
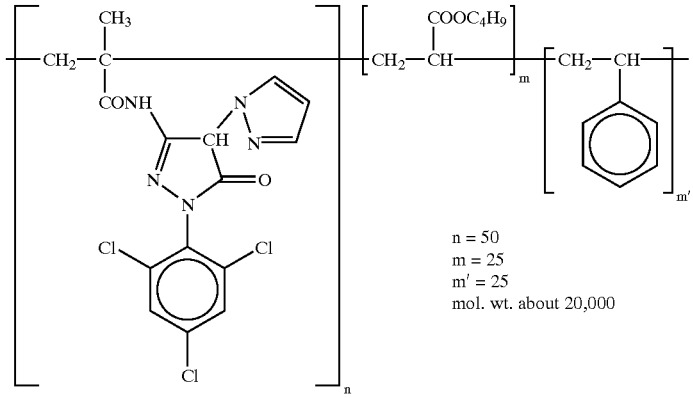
ExM-3
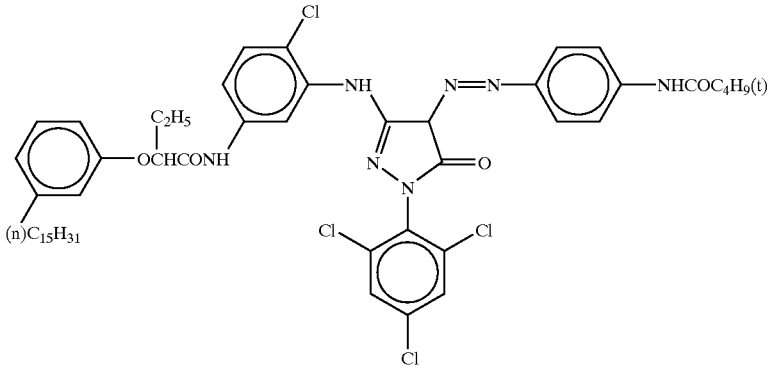
ExM-4
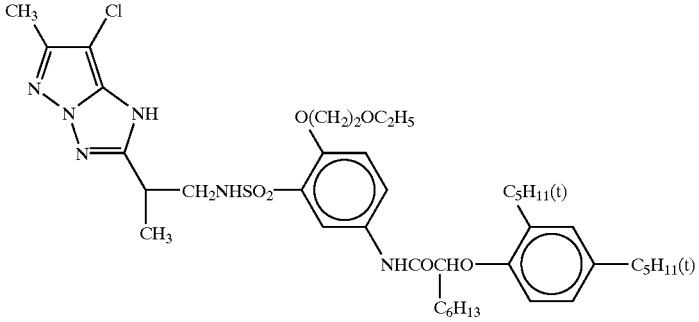

-continued
ExM-5
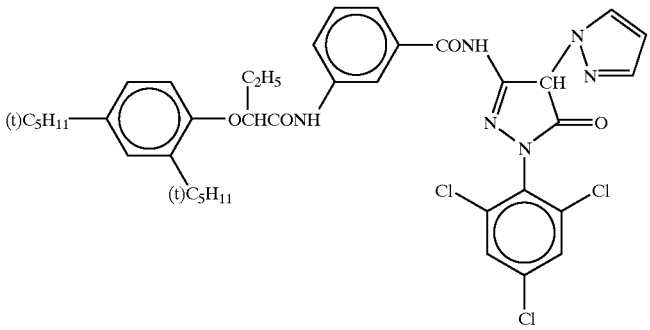
ExY-1
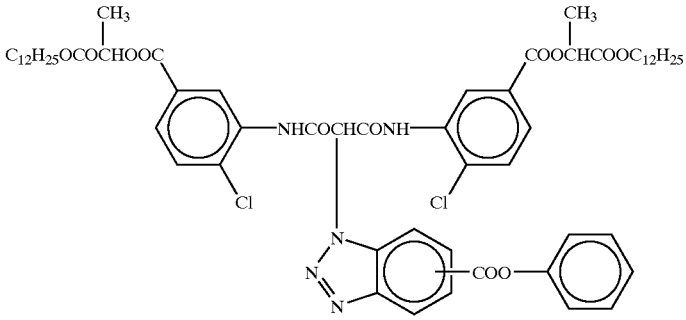
ExY-2
ExY-3
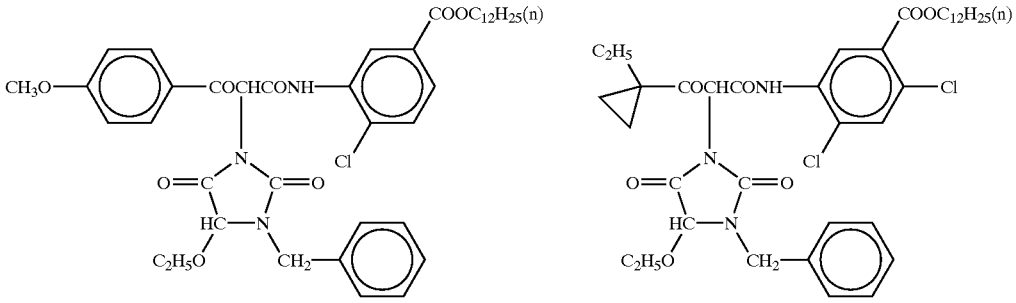
ExY-4
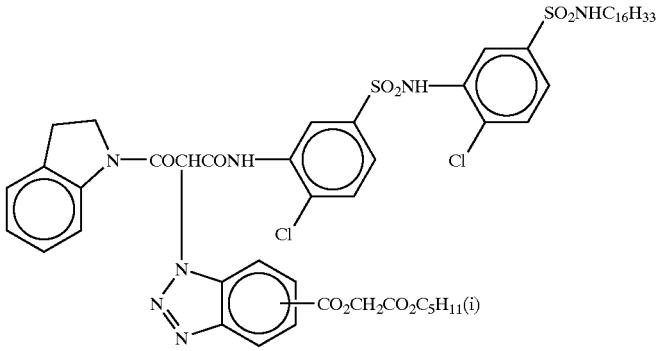

-continued
ExY-5
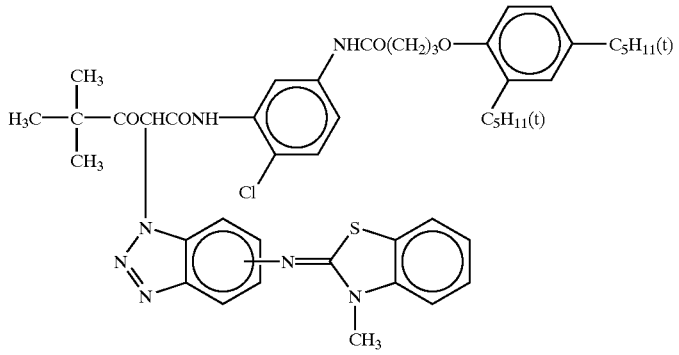
ExG-1
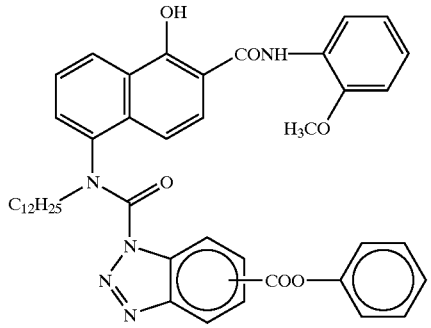
ExY-6
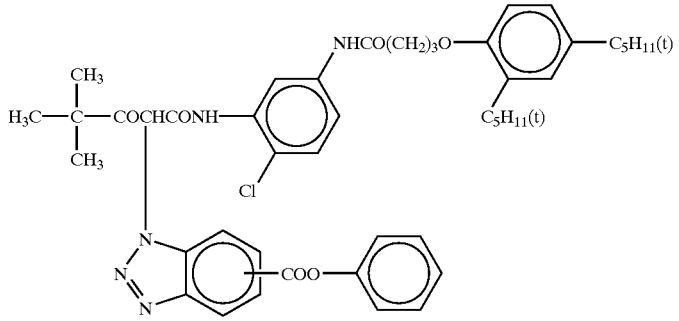
ExF-1
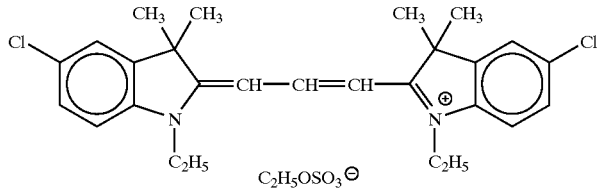
ExF-2
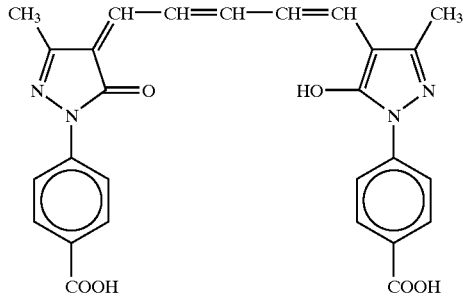

-continued
ExF-3
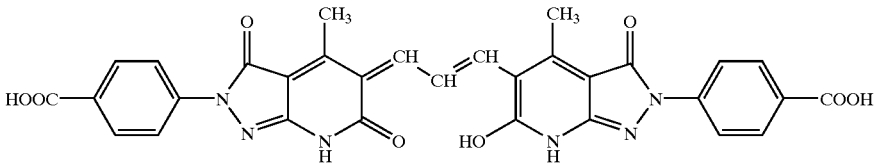
ExF-4
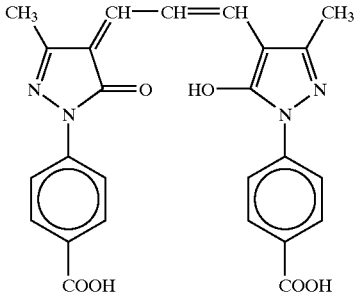
ExF-5
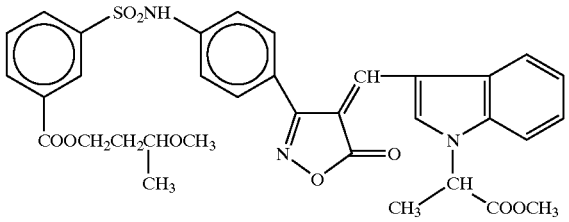
ExF-6
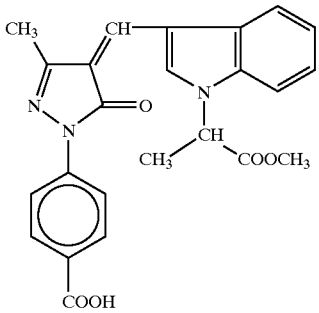
Cpd-1
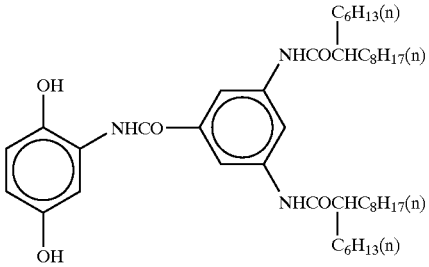
Cpd-2
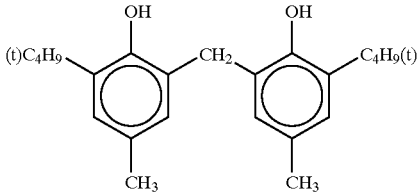
Cpd-3
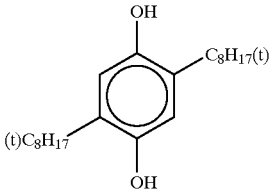
Cpd-4
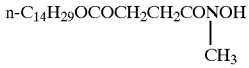
UV-1
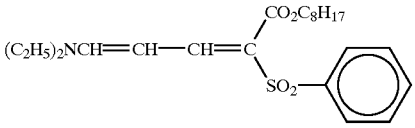
UV-2
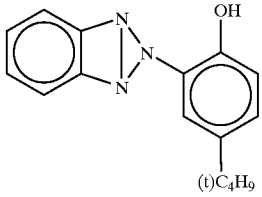
UV-3
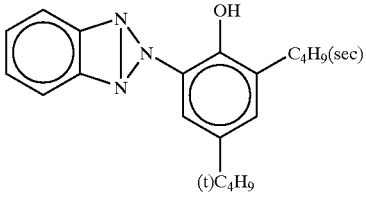

-continued
UV-4
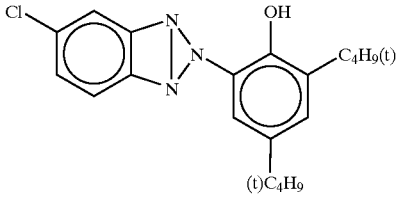
HBS-1
Tricresyl phosphate
HBS-2
Di-n-butyl phthalate
HBS-3
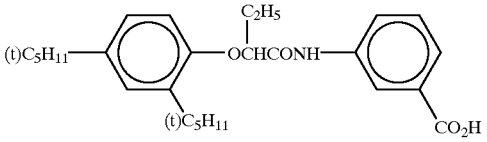
HBS-4
Tri(2-ethylhexyl) phosphate
H-1
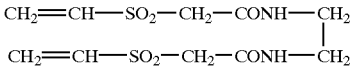
S-1
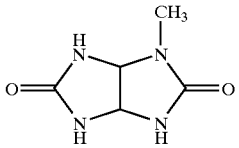
B-1
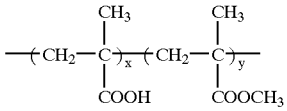
x/y = 10/90 (Wt. ratio)
Av. mol. wt.:
about 35,000
B-2
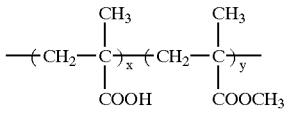
x/y = 40/60 (Wt. ratio)
Av. mol. wt.:
about 20,000
B-3
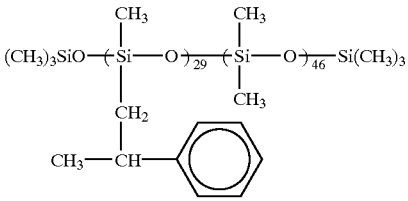
(Molar ratio)
Av. mol. wt.:
about 8,000
B-4
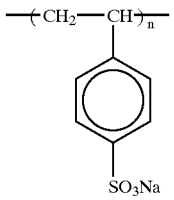
Av. mol. wt.:
about 750,000
B-5
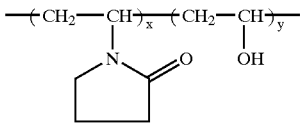
x/y = 70/30 (Wt. ratio)
Av. mol. wt.:
about 17,000
B-6
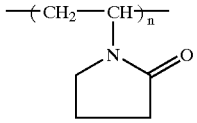
Av. mol. wt.:
about 10,000
W-1
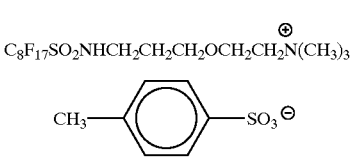
W-2
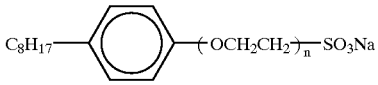
n = 2–4
W-4
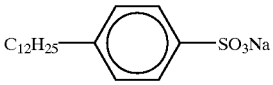

-continued
W-5
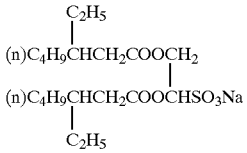
W-6
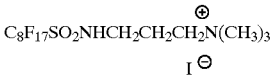
W-7
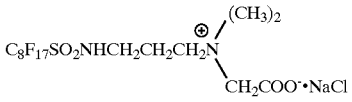
W-8
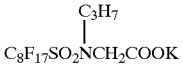
F-1
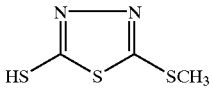
F-2
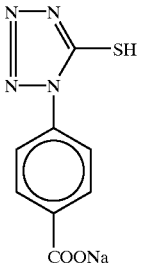
F-3
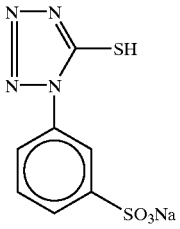
F-4
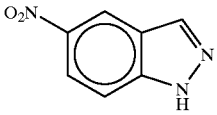
F-5
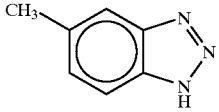
F-6
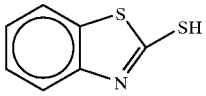
F-7
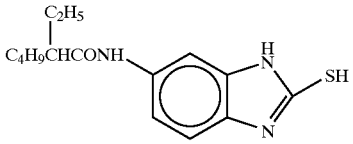
F-8
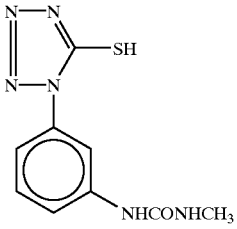
F-9
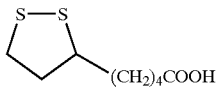
F-10
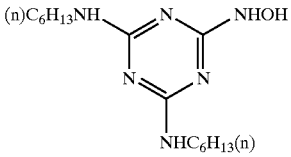
F-11
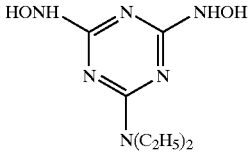
F-12
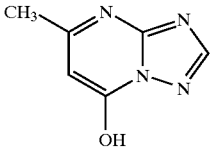
F-13
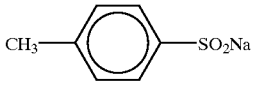
F-14
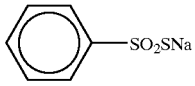

-continued

F-15

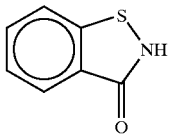

F-16

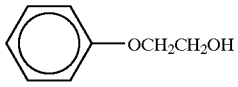

F-17

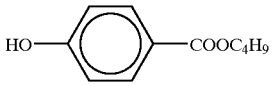

F-18

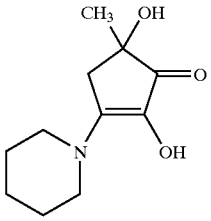

F-19

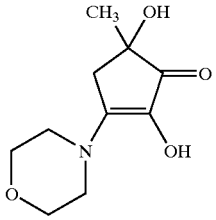

Samples 102 to 116 were prepared in the same manner as Sample 101, except that the emulsion of the 14th layer was changed as shown in Table 2. Samples 117 to 147 were prepared, with the compound (B) of the present invention added to the 14th layer by the amount of $1\times10^{-2}$ mol per mol of silver halide by emulsifying dispersion, as shown in Table 2.

The evaluation method of the samples are as follows. These samples were exposed for 1/100 sec through a gelatin filter SC-39 (a long-wavelength light transmitting filter having a cutoff wavelength of 390 nm) manufactured by Fuji Photo Film Co., Ltd. and a continuous wedge. Development was performed as follows by using an automatic developer FP-360B manufactured by Fuji Photo Film Co., Ltd. Note that FP-360B was modified such that the overflow solution of the bleaching bath was entirely discharged to a waste solution tank without being supplied to the subsequent bath. This FP-360B includes an evaporation correcting means described in JIII Journal of Technical Disclosure No. 94-4992.

The processing steps and the processing solution compositions are presented below.

(Processing steps)

| Step | Time | Temperature | Replenishing rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |

-continued (Processing steps)

| Step | Time | Temperature | Replenishing rate* | Tank volume |
|---|---|---|---|---|
| Stabilization (2) | 20 sec | 38.0° C. | 15 mL | 3 L |
| Drying | 1 min 30 sec | 60.0° C. | | |

*The replenishment rate was per 1.1 m of a 35-mm wide sensitized material (equivalent to one 24 Ex. 1)

The stabilizer and fixer were counterflowed from (2) to (1), and the overflow of washing water was entirely introduced to the fixing bath (2). Note that the amounts of the developer, bleaching solution, and fixer carried over to the bleaching step, fixing step, and washing step were 2.5 mL, 2.0 mL, and 2.0 mL, respectively, per 1.1 m of a 35-mm wide sensitized material. Note also that each crossover time was 6 sec, and this time was included in the processing time of each preceding step.

The aperture areas of the processor were 100 $cm^2$ for the color developer, 120 $cm^2$ for the bleaching solution, and about 100 $cm^2$ for the other processing solutions.

The compositions of the processing solutions are presented-below.

| | Tank solution (g) | Replenisher (g) |
|---|---|---|
| (Color developer) | | |
| Diethylenetriamine pentaacetic acid | 3.0 | 3.0 |
| Disodium cathecol-3,5-disulfonate | 0.3 | 0.3 |
| Sodium sulfite | 3.9 | 5.3 |
| Potassium carbonate | 39.0 | 39.0 |
| Disodium-N,N-bis(2-sulfonatoethyl) | 1.5 | 2.0 |

-continued

| | Tank solution (g) | Replenisher (g) |
|---|---|---|
| hydroxylamine | | |
| Potassium bromide | 1.3 | 0.3 |
| Potassium iodide | 1.3 mg | — |
| 4-hydroxy-6-methyl-1,3,3a,7-tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0 L |
| pH (controlled by potassium hydroxide and sulfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (controlled by ammonia water) | 4.6 | 4.0 |

(Fixing (1) Tank Solution)

A 5:95 (volume ratio) mixture of the above bleaching tank solution and the following fixing tank solution (pH 6.8).

| (Fixer (2)) | Tank solution (g) | Replenisher (g) |
|---|---|---|
| Aqueous ammonium thiosulfate solution (750 g/L) | 240 mL | 720 mL |
| Imidazole | 7 | 21 |
| Ammonium methane thiosulfonate | 5 | 15 |
| Ammonium methane sulfinate | 10 | 30 |
| Ethylenediamine tetraacetic acid | 13 | 39 |
| Water to make | 1.0 L | 1.0 L |
| pH (controlled by ammonia water and acetic acid) | 7.4 | 7.45 |

(Washing water) Common to Tank Solution and Replenisher

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) common to tank solution and replenisher | (g) |
|---|---|
| Sodium p-toluenesulfinate | 0.03 |
| Polyoxyethylene-p-monononylphenylether (average polymerization degree 10) | 0.2 |
| 1,2-benzoisothiazoline-3-one · sodium | 0.10 |
| Disodium ethylenediaminetetraacetate | 0.05 |
| 1,2,4-triazole | 1.3 |
| 1,4-bis(1,2,4-triazole-1-isomethyl) piperazine | 0.75 |
| Water to make | 1.0 L |
| pH | 8.5 |

The samples 101 to 147 were subjected to the above treatment. The photographic properties of the samples were evaluated by measuring the yellow density of the treated samples. The sensitivities thereof were compared in the logarithmic value of a reciprocal of exposure which provides a density of the minimum yellow density +0.1, and determined by the difference between their respective results and the result of the sample 101. The greater this value is, the higher speed the sample has and is preferable.

The latent-image storability were evaluated as follows.

The samples were exposed to light by the above method, stored for 2 weeks under a forced deterioration condition of 40° C. and 60% RH, and developed by the above method. A logarithmic value of a reciprocal of an exposure which provides a density of the minimum yellow density +0.5 of each sample was determined.

The difference between the result of each sample and the result in the case where the sample was not stored under the forced deterioration condition was determined and evaluated. The closer to zero this value is, the smaller the property change due to storage after exposure is and thus preferable.

Table 2 shows the obtained results.

Table 2 shows that the photosensitive materials of the present invention have a high speed and excellent latent-image storability, and thus preferable.

TABLE 2

| Sample | Emulsion in 14th layer | Compound selected form type A or types 1 to 4 | Compound B | Speed | Latent image preservability | Remarks |
|---|---|---|---|---|---|---|
| 101 | Em-A1 | — | | 0 | +0.04 | Comp. |
| 102 | Em-A2 | 53 | | +0.06 | +0.06 | Comp. |
| 103 | Em-A3 | 63 | | +0.04 | +0.06 | Comp. |
| 104 | Em-A4 | 1 | | +0.07 | +0.05 | Comp. |
| 105 | Em-A5 | 6 | | +0.06 | +0.06 | Comp. |
| 106 | Em-A6 | 19 | | +0.08 | +0.06 | Comp. |
| 107 | Em-A7 | 20 | | +0.07 | +0.05 | Comp. |
| 108 | Em-A8 | 21 | | +0.06 | +0.06 | Comp. |
| 109 | Em-A9 | 36 | | +0.05 | +0.06 | Comp. |
| 110 | Em-A10 | 35 | | +0.05 | +0.06 | Comp. |
| 111 | Em-A11 | 30 | | +0.05 | +0.05 | Comp. |
| 112 | Em-A12 | 31 | | +0.06 | +0.06 | Comp. |
| 113 | Em-A13 | 32 | | +0.06 | +0.06 | Comp. |
| 114 | Em-A14 | 45 | | +0.06 | +0.05 | Comp. |

TABLE 2-continued

| Sample | Emulsion in 14th layer | Compound selected form type A or types 1 to 4 | Compound B | Speed | Latent image preservability | Remarks |
|---|---|---|---|---|---|---|
| 115 | Em-A15 | 46 | | +0.06 | +0.06 | Comp. |
| 116 | Em-A16 | 50 | | +0.06 | +0.05 | Comp. |
| 117 | Em-A1 | — | HET-3 | +0.04 | +0.03 | Comp. |
| 118 | Em-A2 | 53 | HET-3 | +0.13 | +0.04 | Inv. |
| 119 | Em-A3 | 63 | HET-3 | +0.11 | +0.03 | Inv. |
| 120 | Em-A4 | 1 | HET-3 | +0.14 | +0.04 | Inv. |
| 121 | Em-A5 | 6 | HET-3 | +0.13 | +0.04 | Inv. |
| 122 | Em-A6 | 19 | HET-3 | +0.15 | +0.04 | Inv. |
| 123 | Em-A7 | 20 | HET-3 | +0.13 | +0.03 | Inv. |
| 124 | Em-A8 | 21 | HET-3 | +0.13 | +0.04 | Inv. |
| 125 | Em-A9 | 36 | HET-3 | +0.13 | +0.04 | Inv. |
| 126 | Em-A10 | 35 | HET-3 | +0.13 | +0.04 | Inv. |
| 127 | Em-A11 | 30 | HET-3 | +0.12 | +0.04 | Inv. |
| 128 | Em-A12 | 31 | HET-3 | +0.13 | +0.04 | Inv. |
| 129 | Em-A13 | 32 | HET-3 | +0.13 | +0.03 | Inv. |
| 130 | Em-A14 | 45 | HET-3 | +0.12 | +0.04 | Inv. |
| 131 | Em-A15 | 46 | HET-3 | +0.13 | +0.04 | Inv. |
| 132 | Em-A16 | 50 | HET-3 | +0.13 | +0.04 | Inv. |
| 133 | Em-A2 | 53 | (2) | +0.17 | +0.02 | Inv. |
| 134 | Em-A3 | 63 | (2) | +0.15 | +0.02 | Inv. |
| 135 | Em-A6 | 19 | (2) | +0.18 | +0.02 | Inv. |
| 136 | Em-A7 | 20 | (2) | +0.16 | +0.02 | Inv. |
| 137 | Em-A8 | 21 | (2) | +0.16 | +0.02 | Inv. |
| 138 | Em-A2 | 53 | (59) | +0.19 | +0.02 | Inv. |
| 139 | Em-A3 | 63 | (59) | +0.17 | +0.02 | Inv. |
| 140 | Em-A6 | 19 | (59) | +0.20 | +0.02 | Inv. |
| 141 | Em-A7 | 20 | (59) | +0.18 | +0.02 | Inv. |
| 142 | Em-A8 | 21 | (59) | +0.18 | +0.01 | Inv. |
| 143 | Em-A2 | 53 | (60) | +0.19 | +0.02 | Inv. |
| 144 | Em-A3 | 63 | (60) | +0.17 | +0.02 | Inv. |
| 145 | Em-A6 | 19 | (60) | +0.21 | +0.02 | Inv. |
| 146 | Em-A7 | 20 | (60) | +0.19 | +0.01 | Inv. |
| 147 | Em-A8 | 21 | (60) | +0.18 | +0.02 | Inv. |

Example 2

(Preparation of Self-Emulsifying Vinyl Polymer (P-15))

A mixed solution (A) comprising 4.6 parts of sodium 2-acrylamide-2-methylpropanesulfonate, 75.4 parts of ethyl methacrylate, 70 parts of isopropylalcohol, and 30 parts of water was prepared.

Next, 30 parts of isopropylalcohol and 0.4 parts of dimethyl 2,2'-azobisisobutylate were put into a flask, and its temperature was raised to 80° C. while being stirred under nitrogen seal. Thereafter, the mixture solution (A) was dropped in the resulting solution for 2 hours. After the completion of the dropping a solution of 0.2 parts of dimethyl 2,2'-azobisisobutylate and 30 parts of isopropylalcohol was added, and the resulting solution was reacted for 5 hours at the same temperature. The obtained polymer solution was vacuum-concentrated to obtain a 125 parts of an objected self-emulsifying vinyl polymer having 35 wt % solid content.

(Preparation of the Ultraviolet-Absorbent-Containing Fine-Grain Dispersion UVPV-1)

A mixed solution formed of 51.4 parts of the self-emulsifying vinyl polymer solution obtained above, 20 parts of isopropylalcohol, 3.35 parts of UV-1, 3.19 parts of UV-3, 2.07 parts of UV-2 and 0.40 parts of UV-4 was prepared. The temperature of the mixed solution was raised to 80° C., and then 300 parts of water was added to the solution while it was stirred. The solution was concentrated at 40° C. under reduced pressure to prepare an ultraviolet-absorbent-containing fine-grain dispersion having a solid content of 14.5%. The dispersion has a bluish milky-white color, grain size of 150 nm, and pH of 6.70.

The UV-1 to UV-4 in the 15th layer of sample 118 of Example 1 were added as dispersion that was co-emulsified with the high-boiling organic solvents HBS-1 and HBS-2. Sample 201 was prepared by adding the dispersion, by using the above UVPV-1, such that the addition amount of the ultraviolet absorbents is the same as that of the sample 118. The gelatin coating amount was controlled such that its dried film thickness is the same as that of the sample 118.

In the same manner, samples 202, 203 and 204 were prepared by using UVPV-1 for the 15th layer of the samples 122, 143 and 145, respectively.

Further, samples 205 to 212 were prepared in the same manner as samples 118, 122, 145, 145 and 201–204, respectively, except that the support was changed from (a) described in Example 1 to (b).

(a) Polyethylenenaphthalate film having a magnetic recording layer in a back layer described in Example 1

(b) cellulose triacetate film

Pressure heat time-lapse fog of these samples were evaluated by the following method. Each sample was cut into pieces of 35 mm×35 mm, and humidified for 24 hours under the condition of 25° C. and 65% RH. 21 pieces thereof were superposed, and stored for 72 hours under the forced deterioration condition of 60° C. and 60% RH, with a weight of 500 g put thereon. Three pieces in the center among the superposed 21 pieces of each sample were developed by the method described in Example 1.

The yellow density of the central parts of the three pieces was measured, and the mean value of the results of the three pieces was determined. The difference between the result of each sample and that in the case where the sample was not stored in the forced deterioration condition was obtained to evaluate the pressure heat time-lapse fog of each sample. Table 3 shows the results. The evaluation of each sample was indicated by a relative value to the result of the sample 118.

Table 3 shows that the samples 201 to 204, and 209 to 212, using the ultraviolet-absorbent-containing fine-grain dispersion prepared by emulsification by putting water into the organic solvent phase containing vinyl polymer and ultraviolet absorbent, have a small pressure heat time-lapse fog and thus are preferable. Further, it also shows that this effect is more remarkable in the case of using, as a support, (a) in comparison with the case of using (b).

TABLE 3

| Sample | Emulsion in 14th layer | Compound selected form type A or types 1 to 4 in 14th layer | Compound B in 14th layer | Ultraviolet absorbent-containing fine grain dispersion in 15th layer | Pressure heat time-lapse fog | Remarks |
|---|---|---|---|---|---|---|
| 118 | Em-A2 | 53 | HET-3 | — | (a) | Inv. |
| 122 | Em-A6 | 19 | HET-3 | — | (a) | Inv. |
| 143 | Em-A2 | 53 | (60) | — | (a) | Inv. |
| 145 | Em-A6 | 19 | (60) | — | (a) | Inv. |
| 201 | Em-A2 | 53 | HET-3 | UVPV-1 | (a) | Inv. |
| 202 | Em-A6 | 19 | HET-3 | UVPV-1 | (a) | Inv. |
| 203 | Em-A2 | 53 | (60) | UVPV-1 | (a) | Inv. |
| 204 | Em-A6 | 19 | (60) | UVPV-1 | (a) | Inv. |
| 205 | Em-A2 | 53 | HET-3 | — | (b) | Inv. |
| 206 | Em-A6 | 19 | HET-3 | — | (b) | Inv. |
| 207 | Em-A2 | 53 | (60) | — | (b) | Inv. |
| 208 | Em-A6 | 19 | (60) | — | (b) | Inv. |
| 209 | Em-A2 | 53 | HET-3 | UVPV-1 | (b) | Inv. |
| 210 | Em-A6 | 19 | HET-3 | UVPV-1 | (b) | Inv. |
| 211 | Em-A2 | 53 | (60) | UVPV-1 | (b) | Inv. |
| 212 | Em-A6 | 19 | (60) | UVPV-1 | (b) | Inv. |

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color photosensitive material having at least one blue-sensitive silver halide emulsion layer containing a yellow coupler, at least one green-sensitive silver halide emulsion layer containing a magenta coupler, at least one red-sensitive silver halide emulsion layer containing a cyan coupler, and at least one non-lightsensitive layer, on a support, wherein at least one of the layers contains a compound selected from the group consisting of compounds of type A and compounds of types 1 to 4, and at least one of the layers contains the following Compound (B):

(Type A)

a compound represented by X—Y, wherein X represents a reducing group, Y represents a split-off group, and wherein a one-electron oxide product thereof generated by one-electron-oxidation of the reducing group represented by X is capable of leaving Y to generate an X radical accompanying a subsequent cleavage reaction of X—Y bonding, and is capable of releasing another electron;

(Type 1)

a compound capable of undergoing a one-electron oxidation to thereby form a one-electron oxidation product thereof, wherein the one-electron oxidation product is capable of releasing further two or more electrons accompanying a subsequent bond cleavage reaction;

(Type 2)

a compound capable of undergoing a one-electron oxidation to thereby form a one-electron oxidation product thereof, wherein the one-electron oxidation product is capable of releasing further one electron accompanying a subsequent carbon-carbon bond cleavage reaction, and the compound having, in its molecule, two or more groups adsorptive to silver halide;

(Type 3)

a compound capable of undergoing a one-electron oxidation to thereby form a one-electron oxidation product thereof, wherein the one-electron oxidation product is capable of releasing further one or more electrons after going through a subsequent bond forming process; and (Type 4)

a compound capable of undergoing a one-electron oxidation to thereby form a one-electron oxidation product thereof, wherein the one-electron oxidation product is capable of releasing further one or more electrons after going through a subsequent intramolecular ring cleavage reaction; and Compound (B)

a compound having at least three hetero atoms, the compound capable of increasing a photographic speed of the photosensitive material in comparison with the case where the material does not contain the compound.

2. The silver halide color photosensitive material according to claim 1, wherein the compound selected from the group consisting of compounds of Type A and of types 1 to 4 is a compound selected from the group consisting of compounds represented by general formula (A) and compounds represented by general formulae (1—1) to (4-2):

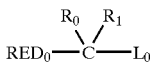

(A)

wherein $RED_0$ represents a reducing group, $L_0$ represents a split-off group, and $R_0$ and $R_1$ independently represent a hydrogen atom or substituent, the groups $RED_0$ and $R_0$, wherein the groups $R_0$ and $R_1$ may be bonded with each other to thereby form a cyclic structure;

(1-1)

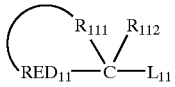

(1-2)

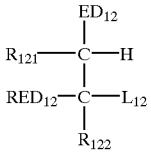

(2)

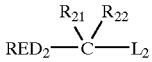

(3)

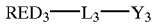

(4-1)

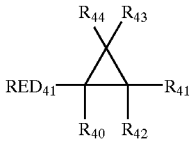

(4-2)

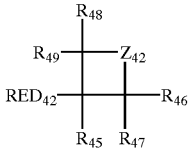

in the general formula (1—1), $RED_{11}$ represents a reducing group, $L_{11}$ represents a split-off group, $R_{112}$ represents a hydrogen atom or substituent, and $R_{111}$ represents a group of nonmetallic atoms capable of forming a cyclic structure corresponding to a tetrahydro form, hexahydro form or octahydro form of a 5-membered or 6-membered aromatic ring (including an aromatic heterocycle) together with the carbon atom (C) and $RED_{11}$;

in the general formula (1-2), $RED_{12}$ and $L_{12}$ have the same meanings as those of $RED_{11}$ and $L_{11}$ of the general formula (1—1), respectively, each of $R_{121}$ and $R_{122}$ represents a hydrogen atom or substituent capable of substituting on the carbon atom, which may have the same meaning as $R_{112}$ of the general formula (1—1), and $ED_{12}$ represents an electron-donating group, wherein the groups $R_{121}$, and $RED_{12}$, the groups $R_{121}$ and $R_{122}$, or the groups $ED_{12}$ and $RED_{12}$ may be bonded with each other to thereby form a cyclic structure;

in the general formula (2), $RED_2$ has the same meaning as that of $RED_{12}$ of the general formula (1-2), $L_2$ represents a split-off group, and each of $R_{21}$ and $R_{22}$ represents a hydrogen atom or substituent, wherein $RED_2$ and $R_{21}$ may be bonded with each other to thereby form a cyclic structure, provided that the compound represented by the general formula (2) has, in its molecule, two or more groups adsorptive to silver halide;

in the general formula (3), $RED_3$ has the same meaning as $RED_{12}$ of the general formula (1-2), $Y_3$ represents a reactive group having a carbon-carbon double bond moiety or a carbon-carbon triple bond moiety, which moiety capable of forming a new bond by reacting with a one-electron oxidation product formed as a result of a one-electron oxidation of $RED_3$, and L3 represents a linking group that links between $RED_3$ and $Y_3$; and in the general formulae (4-1) and (4-2), each of $RED_{41}$ and $RED_{42}$ has the same meaning as $RED_{12}$ of the general formula (1-2), and each of $R_{40}$ to $R_{44}$ and $R_{45}$ to $R_{49}$ represents a hydrogen atom or substituent, and in the general formula (4-2), $Z_{42}$ represents $—CR_{420}R_{421}—$, $—NR_{423}—$ or —O—, wherein each of $R_{420}$ and $R_{421}$ represents a hydrogen atom or substituent, and $R_{423}$ represents a hydrogen atom, alkyl group, aryl group or heterocyclic group.

3. The silver halide color photosensitive material according to claim 1, wherein the compound selected from the group consisting of compounds of type A and compounds of types 1 to 4 has, in a molecule thereof, an adsorptive group or a partial structure of a sensitizing dye.

4. The silver halide color photosensitive material according to claim 1, wherein the compound (B) is a 1,3,4,6-tetraazaindene or a derivative thereof.

5. The silver halide color photosensitive material according to claim 1, wherein the compound (B) is represented by general formula (M) or general formula (C):

(M)

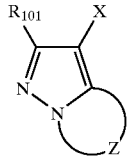

wherein $R_{101}$ represents a hydrogen atom or substituent, Z represents a group of nonmetallic atoms required to form a 5-membered azole ring containing 2 to 4 nitrogen atoms, and the azole ring may have a substituent (including a condensed ring), and X represents a hydrogen atom or substituent;

(C)

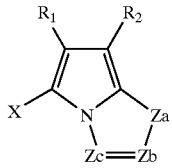

wherein Za represents —NH— or $—CH(R_3)—$, and each of Zb and Zc represents a $—C(R_4)=$ or —N=, each of $R_1$, $R_2$ and $R_3$ represents an electron-withdrawing group having Hammett substituent constant σp value of 0.2 to 1.0, $R_4$ represents a hydrogen atom or substituent, wherein when two or more $R_4$'s exist in the general formula (C), they may be the same or different, and X represents a hydrogen atom or substituent.

6. The silver halide color photosensitive material according to claim 1, wherein the photosensitive material further contains, in at least one of the layers, a fine-grain dispersion containing an ultraviolet absorbent, the fine grains being prepared by means of emulsification by putting water into an organic solvent phase containing vinyl polymer and the ultraviolet absorbent, or putting the organic solvent phase into water.

7. The silver halide color photosensitive material according to claim 1, wherein the support is formed of polyethylene naphthalate, and the photosensitive material further comprising a magnetic recording layer in a back layer thereof.

* * * * *